US006068969A

United States Patent [19]

Mikoshiba et al.

[11] Patent Number: 6,068,969

[45] Date of Patent: May 30, 2000

[54] SILVER HALIDE COLOR PHOTOGRAPHIC LIGHT-SENSITIVE MATERIAL AND METHOD FOR FORMING AN IMAGE USING THE SAME

[75] Inventors: Hisashi Mikoshiba; Shin Soejima; Yasuhiro Shimada; Osamu Takahashi; Yasuaki Deguchi, all of Minami-ashigara, Japan

[73] Assignee: Fuji Photo Film Co., Ltd., Minami-ashigara, Japan

[21] Appl. No.: 09/235,548

[22] Filed: Jan. 22, 1999

[30] Foreign Application Priority Data

| | | | |
|---|---|---|---|
| Jan. 23, 1998 | [JP] | Japan | 10-025208 |
| Mar. 10, 1998 | [JP] | Japan | 10-076596 |
| Mar. 12, 1998 | [JP] | Japan | 10-078512 |
| Mar. 12, 1998 | [JP] | Japan | 10-080368 |
| Sep. 28, 1998 | [JP] | Japan | 10-288708 |

[51] Int. Cl.[7] ..... G03E 1/295

[52] U.S. Cl. ..... 430/607; 430/384; 430/385; 430/558

[58] Field of Search ..... 430/607, 558

[56] References Cited

U.S. PATENT DOCUMENTS

| | | | |
|---|---|---|---|
| 4,105,793 | 8/1978 | Gross | 424/314 |
| 4,904,561 | 2/1990 | Yamamoto | 430/138 |
| 5,162,197 | 11/1992 | Aoki et al. | 430/546 |

FOREIGN PATENT DOCUMENTS

| | | |
|---|---|---|
| 382444 A2 | 8/1990 | European Pat. Off. . |
| 545305 A1 | 6/1993 | European Pat. Off. . |
| 675404 A1 | 10/1995 | European Pat. Off. . |
| 710881 A1 | 5/1996 | European Pat. Off. . |
| 756200 A1 | 1/1997 | European Pat. Off. . |
| 57-198455 | 12/1982 | Japan . |
| 60-067938 | 4/1985 | Japan . |
| 8-044015A | 2/1996 | Japan . |
| 8-044021A | 2/1996 | Japan . |
| 9-288337A | 4/1997 | Japan . |
| 9-288339A | 4/1997 | Japan . |
| 9189988 | 7/1997 | Japan . |

*Primary Examiner*—Hoa Van Le

*Attorney, Agent, or Firm*—Birch, Stewart, Kolasch & Birch, LLP

[57] ABSTRACT

There is disclosed a silver halide color photographic light-sensitive material, which comprises a compound of formula (I):

(I)

wherein, in formula (I), $R^{11}$ is a hydrogen atom, an alkyl group having 1 to 30 carbon atoms, an alkenyl group having 2 to 30 carbon atoms, or an aryl group; $R^{12}$, $R^{13}$, $R^{14}$, $R^{15}$, $R^{16}$, and $R^{17}$, each independently represent a hydrogen atom or an alkyl group having 1 to 30 carbon atoms, and n is 0 or 1. This color photographic light-sensitive material is excellent in fastness of dye image.

34 Claims, No Drawings

SILVER HALIDE COLOR PHOTOGRAPHIC LIGHT-SENSITIVE MATERIAL AND METHOD FOR FORMING AN IMAGE USING THE SAME

FIELD OF THE INVENTION

The present invention relates to a silver halide color photographic light-sensitive material that is enhanced in fastness of cyan dye image.

The present invention relates to a silver halide color photographic light-sensitive material that is enhanced in color reproduction and fastness (stability) of dye image formed, through the use of a pyrrolotriazole cyan coupler and a specific vinyl compound in combination. The present invention also relates to a silver halide color photographic light-sensitive material increased in processing stability.

Further, the present invention relates to a silver halide color photographic light-sensitive material, and more particularly to a silver halide color photographic light-sensitive material that has a nondiffusion cyan dye-forming coupler built in a silver halide emulsion layer, and that, when processed with a color developer containing a color-developing agent, forms a color image excellent in color reproduction and dye image fastness. The present invention also relates to a method for forming an image using the photographic material.

Further, the present invention relates to a silver halide color photographic light-sensitive material, and more particularly to a silver halide color photographic light-sensitive material excellent in color forming property, color reproduction, and rapid processability, which color photographic light-sensitive material is increased in fastness of a formed dye image.

BACKGROUND OF THE INVENTION

In silver halide color photographic light-sensitive materials, it is well known that, with an exposed silver halide serving as an oxidizer, an oxidized aromatic primary amine-series color-developing agent and a coupler are reacted to produce a dye, such as indophenol, indoaniline, indamine, azomethine, phenoxazine, and phenazine, to form an image. In this photographic system, the subtractive color process is used, wherein a color image is formed by yellow, magenta, and cyan dyes.

In order to form a cyan dye image out of these, conventionally, use is made of phenol- or naphthol-series couplers. Since the dyes formed from these couplers have, however, undesirable absorption in the region from yellow to magenta, they have a problem of making the color reproduction deteriorated, which is earnestly desired to be solved.

Particularly in recent years, the demand for so-called digital photographs has been increasing, wherein image information has been subjected to image processing by digitizing it, and it has then been exposed onto a silver halide color photographic light-sensitive material based on the information. In such a case, a silver halide color photographic light-sensitive material is desired wherein, particularly, dyes that will be formed are free from the above undesirable absorption and have a wide color reproduction range.

As a means for solving this problem, heterocyclic compounds described, for example, in U.S. Pat. No. 4,728,598, U.S. Pat. No. 4,873,183, and European patent application laid-open No. 0249453 A2 are proposed. These couplers, however, have such fatal defects as that the coupling activity is low and the fastness of the dye is poor.

As couplers that overcome these problems, pyrrolotriazole couplers described in U.S. Pat. No. 5,256,526 and European patent No. 0545300 are proposed. Although these couplers are excellent in hue of a formed dye and coupling activity, it is found that further improvement is required, because the color photographic light-sensitive material in which these couplers are used is not satisfactory in fastness of the formed dye image, and in particular fastness to light of the formed dye image is inferior to an image formed with a conventional phenol-series coupler.

Further, when the color-forming property and fastness to light of dye image are to be improved, sometimes there arises a problem of so-called cyan stain; that is, cyan color formation occurs in non-image areas.

As a means for improving fastness to light of the above pyrrolotriazole couplers, a method in which they are used in combination with phenol-series couplers is proposed in JP-A-9-288337 ("JP-A" means unexamined published Japanese patent application). However, not only do phenol-series couplers damage color reproduction as mentioned above, they also have the problem (referred to as so-called blix discoloration (blix fading)) that the color forming property is lowered by their change to leuco dyes (reduction and decoloring of part of the dyes) when bleach-fixing is carried out. Although JP-A-9-171240 describes that blix discoloration of cyan dyes is improved by means of a certain polymer, the conventional technique still cannot secure excellent color reproduction and satisfactory dye image fastness without deteriorating the processability; for example, without causing the blix discoloration.

SUMMARY OF THE INVENTION

Therefore, an object of the present invention is to provide a silver halide color photographic light-sensitive material enhanced in fastness of cyan dye image, through the use of a specific vinyl compound. Another object of the present invention is to provide a silver halide color photographic light-sensitive material that is excellent in color reproduction and fastness of formed dye image, by using a pyrrolotriazole cyan coupler and the said specific vinyl compound in combination. Still another object of the present invention is to provide a silver halide color photographic light-sensitive material improved in processing stability.

A further object of the present invention is to provide a silver halide color photographic light-sensitive material that forms a cyan dye image excellent in dye image fastness for a wide wavelength range from ultraviolet light to visible light. A still further object of the present invention is to provide a method for forming an image by using the photographic light-sensitive material.

A further object of the present invention is to provide a silver halide color photographic light-sensitive material excellent in color reproduction and fastness to light of dye image by using a pyrrolotriazole cyan coupler in combination with a specific compound. A still further object of the present invention is to provide a silver halide color photographic light-sensitive material that causes no cyan stain in non-image areas when processed.

Other and further objects, features, and advantages of the invention will appear more fully from the following description.

DETAILED DESCRIPTION OF THE INVENTION

The inventors of the present invention, having intensively investigated in various ways, have found that the above objects are attained by providing:

(1) A silver halide color photographic light-sensitive material, which comprises a compound represented by the following formula (I):

(I)

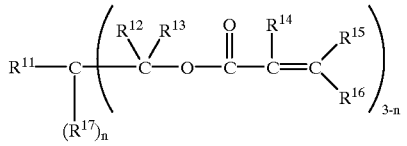

wherein, in formula (I), $R^{11}$ represents a hydrogen atom, an alkyl group having 1 to 30 carbon atoms, an alkenyl group having 2 to 30 carbon atoms, or an aryl group; $R^{12}$, $R^{13}$, $R^{14}$, $R^{15}$, $R^{16}$, and $R^{17}$, which are the same or different, each independently represent a hydrogen atom or an alkyl group having 1 to 30 carbon atoms, and n is 0 or 1;

(2) A silver halide color photographic light-sensitive material, which comprises a cyan coupler represented by the following formula (II) and a compound represented by the following formula (I):

(II)

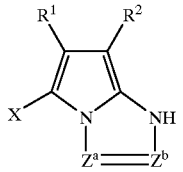

(I)

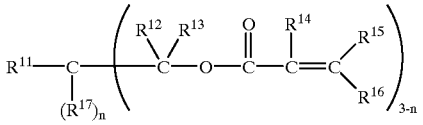

wherein, in formula (II), $Z^a$ and $Z^b$ each represent —C($R^3$)═ or —N═, provided that one of $Z^a$ and $Z^b$ is —N═ and the other is —C($R^3$)═; $R^1$ and $R^2$ each represent an electron-attracting group whose Hammet substituent constant $\sigma_p$ value is 0.20 or more, with the sum of the $\sigma_p$ values of $R^1$ and $R^2$ being 0.65 or more; $R^3$ represents a hydrogen atom or a substituent; X represents a hydrogen atom, or a group capable of being split-off in the coupling reaction with the oxidized product of an aromatic primary amine color-developing agent; the group $R^1$, $R^2$, $R^3$, or X may be a divalent group, to form a dimer or higher polymer, or to bond to a polymer chain to form a homopolymer or a copolymer; and in formula (I), $R^{11}$ represents a hydrogen atom, an alkyl group having 1 to 30 carbon atoms, an alkenyl group having 2 to 30 carbon atoms, or an aryl group; $R^{12}$, $R^{13}$, $R^{14}$, $R^{15}$, $R^{16}$, and $R^{17}$, which are the same or different, each independently represent a hydrogen atom or an alkyl group having 1 to 30 carbon atoms, and n is 0 or 1;

(3) The silver halide color photographic light-sensitive material as stated in the above (2), wherein the cyan-coupler-containing layer further contains a cyan coupler represented by the following formula (C) and a polymer latex represented by the following formula (L):

formula (C)

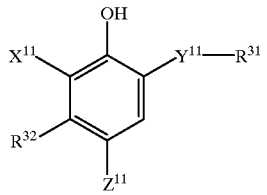

wherein, in formula (C), $Y^{11}$ represents —NHCO— or —CONH—; $R^{31}$ represents an aliphatic group, an aryl group, a heterocyclic group, or a substituted or unsubstituted amino group; $X^{11}$ represents a hydrogen atom, a halogen atom, an alkoxy group, or an acylamino group; $R^{32}$ represents an alkyl group or an acylamino group; or $X^{11}$ and $R^{32}$ together represent a group of nonmetallic atoms to form a 5- to 7-membered ring, and $Z^{11}$ represents a hydrogen atom or a group capable of being split-off in the coupling reaction with the oxidized product of a developing agent;

formula (L)

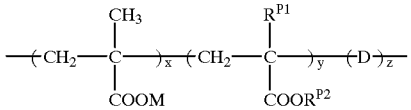

wherein, in formula (L), $R^{P1}$ represents a hydrogen atom or a methyl group, $R^{P2}$ represents an alkyl group having 1 to 8 carbon atoms or a cycloalkyl group, D represents a repeating unit derived from an ethylenically unsaturated monomer; x, y, and z each represent the weight percent of the particular component with x=25 to 60, y=75 to 40, and z=0 to 30, and x+Y+z=100; and the degree of neutralization of —COOM in which M represents a hydrogen atom or a cation is 0 to 50%.

In this specification, the alkyl group, the alkenyl group, and the aryl group represented by any of the above $R^{11}$ to $R^{17}$ include both substituted and unsubstituted ones.

(4) A silver halide color photographic light-sensitive material having at least one silver halide emulsion layer on a base, wherein the emulsion layer contains at least one cyan dye-forming coupler represented by the following formula (1), at least one compound represented by formula (I), and at least one compound represented by formula (B):

formula (1)

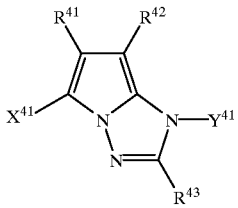

wherein, in formula (1), $R^{41}$ and $R^{42}$ each represent an electron-attracting group whose Hammet substituent constant $\sigma_p$ value is 0.20 or more, with the sum of the $\sigma_p$ values of $R^{41}$ and $R^{42}$ being 0.65 or more; $R^{43}$ represents a substituent; $X^{41}$ represents a hydrogen atom, or a group capable of being split-off in the coupling reaction with the oxidized product of an aromatic primary amine color-developing agent; and $Y^{41}$ represents a hydrogen atom or a substituent;

formula (I)

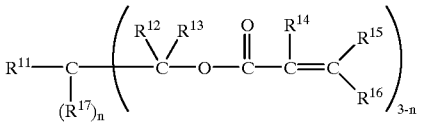

wherein, in formula (I), $R^{11}$ represents a hydrogen atom, an alkyl group having 1 to 30 carbon atoms, an alkenyl group having 2 to 30 carbon atoms, or an aryl group; $R^{12}$, $R^{13}$, $R^{14}$, $R^{15}$, $R^{16}$, and $R^{17}$, which are the same or different, each independently represent a hydrogen atom or an alkyl group having 1 to 30 carbon atoms, and n is 0 or 1; and formula (B)

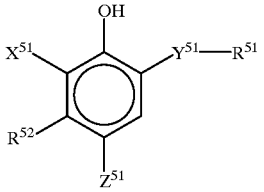

wherein, in formula (B), $R^{51}$ represents an aliphatic group, an aromatic group, a heterocyclic group, or an amino group; $R^{52}$ represents an alkyl group or an acylamino group; $X^{51}$ represents a hydrogen atom, a halogen atom, an aliphatic group, an alkoxy group, or an acylamino group; $Y^{51}$ represents —NHCO— or —CONH—; $Z^{51}$ represents a hydrogen atom, or a group capable of being split-off upon coupling reaction with the oxidized product of a developing agent, and $X^{51}$ and $R^{52}$ may bond together to form a 5- to 7-membered ring;

(5) A method for forming an image, comprising carrying out scanning exposure of a silver halide color photographic light-sensitive material having at least one silver halide emulsion layer on a base by a light beam modulated based on an image information, and subjecting the silver halide color photographic light-sensitive material to development, to form a color image, wherein the silver halide color photographic light-sensitive material is the silver halide color photographic light-sensitive material as stated in the above (4);

(6) A silver halide color photographic light-sensitive material having on a base at least one yellow color-forming light-sensitive silver halide emulsion layer, at least one magenta color-forming light-sensitive silver halide emulsion layer, at least one cyan color-forming light-sensitive silver halide emulsion layer, and at least one non-light-sensitive non-color forming hydrophilic colloid layer, wherein at least one of the cyan color-forming light-sensitive silver halide emulsion layers contains i) at least one cyan dye-forming coupler selected from compounds represented by the following formula (II), ii) at least one compound represented by the following formula (I), and iii) at least one compound represented by the following formula (3):

formula (II)

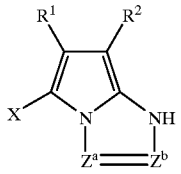

wherein, in formula (II), $Z^a$ and $Z^b$ each represent —C($R^3$)= or —N=, provided that one of $Z^a$ and $Z^b$ is —N= and the other is —C($R^3$)=; $R^1$ and $R^2$ each represent an electron-attracting group whose Hammet substituent constant $\sigma_p$ value is 0.20 or more, with the sum of the $\sigma_p$ values of $R^1$ and $R^2$ being 0.65 or more; $R^3$ represents a hydrogen atom or a substituent; X represents a hydrogen atom, or a group capable of being split-off in the coupling reaction with the oxidized product of an aromatic primary amine color-developing agent; the group $R^1$, $R^2$, $R^3$, or X may be a divalent group, to form a dimer or higher polymer, or to bond to a polymer chain to form a homopolymer or a copolymer;

formula (I)

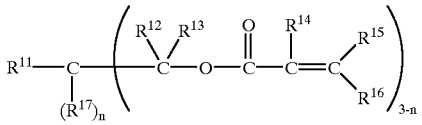

wherein, in formula (I), $R^{11}$ represents a hydrogen atom, an alkyl group having 1 to 30 carbon atoms, an alkenyl group having 2 to 30 carbon atoms, or an aryl group; $R^{12}$, $R^{13}$, $R^{14}$, $R^{15}$, $R^{16}$, and $R^{17}$, which are the same or different, each independently represent a hydrogen atom or an alkyl group having 1 to 30 carbon atoms, and n is 0 or 1; and formula (3)

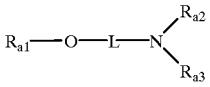

wherein, in formula (3), L represents a single bond or an arylene group; $R_{a1}$, $R_{a2}$, and $R_{a3}$, which are the same or different, each represent an alkyl group, an alkenyl group, an aryl group, or a heterocyclic group; when L represents a single bond, $R_{a1}$ may further represent a radical (•); $R_{a3}$ may further represent a hydrogen atom; $R_{a1}$ and L, $R_{a2}$ and L, $R_{a3}$ and L, $R_{a1}$ and $R_{a2}$, $R_{a1}$ and $R_{a3}$, and $R_{a2}$ and $R_{a3}$ each may bond together to form a 5- to 7-membered ring; and (7) The silver halide color photographic light-sensitive material as stated in the above (6), which further contains, in one or both of at least one layer of the cyan color-forming light-sensitive silver halide emulsion layer and the non-color-forming hydrophilic colloid layer, at least one compound represented by the following formula (4):

formula (4)

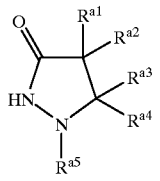

wherein, in formula (4), $R^{a1}$ and $R^{a2}$ each independently represent a hydrogen atom, an alkyl group, or an aryl group; $R^{a3}$ and $R^{a4}$ each represent a hydrogen atom, an alkyl group, or an aryl group, and $R^{a5}$ represents an aryl group, with the proviso that the total number of the carbon atoms of $R^{a1}$, $R^{a2}$, $R^{a3}$, $R^{a4}$, and $R^{a5}$ is more than 13.

Herein, in the present specification and claims, a group on a compound includes both a group having a substituent thereon and a group having no substituent (i.e. an unsubstituted group), unless otherwise specified.

The silver halide color photographic light-sensitive material in the above (1) of the present invention is excellent in fastness of dye image, through the inclusion of a vinyl compound represented by formula (I). This silver halide color photographic light-sensitive material can take each of the following embodiments.

The color photographic light-sensitive material of (1) can improve color reproduction, in addition to fastness of dye image, by including, as a cyan coupler, a pyrrolotriazole cyan coupler represented by formula (II).

The color photographic light-sensitive material of (1) can further improve processing stability, in addition to the improvement of fastness of dye image, by including, as a cyan coupler, a phenol-series cyan coupler represented by formula (C), and a polymer latex represented by formula (L).

The color photographic light-sensitive material of (1) can improve fastness of dye image, to a light for a wide wavelength range from ultraviolet light to visible light, by including, as a cyan coupler, a pyrrolotriazole cyan coupler represented by formula (1) and a phenol-series cyan coupler represented by formula (B).

The color photographic light-sensitive material of (1) has fastness to light of dye image, color reproduction, and high color-forming property, by including, as a cyan coupler, a pyrrolotriazole cyan coupler represented by formula (II), and a compound represented by formula (3).

The color photographic light-sensitive material of (1) can further suppress cyan stain, by including a phenidone compound represented by formula (4).

Now, the present invention is described in detail.

First, the Hammett substituent constant σp value used in the present specification is described below. The Hammett rule is an empirical rule suggested by L. P. Hammett in 1935 in order to deal quantitatively with the influence of substituents on reactions or equilibria of benzene derivatives, and nowadays its validity is widely accepted. The substituent constants determined by the Hammett rule include σp values and σm values, many of which can be found in general books and are described in detail, for example, edited by J. A. Dean in "Lange's Handbook of Chemistry," 12th edition, 1979 (McGraw-Hill), in "Kagaku no Ryoiki" Zokan, No. 122, pages 96 to 103, 1979 (Nanko-do), and in Chemical Reviews, Vol. 91, pages 165 to 195, 1991. In the present invention, substituents are in some cases stipulated or explained by the Hammett substituent constant σp values (hereinbelow, also referred to as, simply, σp values), but the present invention should, of course, not be construed as being limited to the substituents whose values are known and described in literature in the above books; rather the present invention includes substituents whose Hammett substituent constant values are not known in the literature but will fall within the above range when measured in accordance with the Hammett rule. The compound represented by formula (II) for use in the present invention is not a benzene derivative, but, as a scale for indicating the electron effect of the substituent, the σp value is used irrespective of the substitution position. In the present invention, hereinafter, the σp value is used in this sense. Further, "lipophilic" referred to in the present invention means that the solubility in water at room temperature is 10% or less.

"Aliphatic" in this specification may be one that is straight-chain, or branched-chain, and may be saturated or unsaturated, and further it may include cyclic ones, and, for example, represents alkyl, alkenyl, alkynyl, cycloalkyl, or cycloalkenyl, which may be further substituted. Further, "aromatic"represents aryl, which may be further substituted; and "heterocyclic" means a ring having a hetero atom(s) in the ring, including an aromatic heterocyclic group, which may be further substituted. In this specification, the above substituents, and the substituents that may be possessed by these aliphatic, aromatic, and heterocyclic, may be groups that can substitute unless otherwise specified, and examples of these substituents include an aliphatic group, an aromatic group, a heterocyclic group, an acyl group, an acyloxy group, an acylamino group, an aliphatic oxy group, an aromatic oxy group, a heterocyclic oxy group, an aliphatic oxycarbonyl group, an aromatic oxycarbonyl group, a heterocyclic oxycarbonyl group, an aliphatic carbamoyl group, an aromatic carbamoyl group, an aliphatic sulfonyl group, an aromatic sulfonyl group, an aliphatic sulfamoyl group, an aromatic sulfamoyl group, an aliphatic sulfonamido group, an aromatic sulfonamido group, an aliphatic amino group, an aromatic amino group, an aliphatic sulfinyl group, an aromatic sulfinyl group, an aliphatic thio group, an aromatic thio group, a mercapto group, a hydroxyl group, a cyano group, a nitro group, a hydroxyamino group, a halogen atom, and the like.

The compound represented by formula (I) is described now.

In formula (I), $R^{11}$ represents a hydrogen atom, a substituted or unsubstituted alkyl group having 1 to 30 carbon atoms (e.g., methyl, ethyl, n-propyl, n-butyl, n-octyl, isopropyl, n-eicosyl, 2-hydroxylethyl, 2-methoxyethyl, and 3-(n-octyloxy)-propyl), a substituted or unsubstituted alkenyl group having 2 to 30 carbon atoms (e.g., vinyl, allyl, prenyl, geranyl, geranylgeranyl, and 2-methoxycarbonylvinyl), or a substituted or unsubstituted aryl group (preferably having 6 to 30 carbon atoms and more preferably having 6 to 10 carbon atoms, e.g., phenyl, tolyl, naphthyl, and p-octyloxyphenyl).

When $R^{11}$ represents an alkyl group, preferably it is an unsubstituted alkyl group having 1 to 10 carbon atoms, and most preferably an unsubstituted alkyl group having 1 to 3 carbon atoms.

When $R^{11}$ represents an alkenyl group, preferably it is an unsubstituted alkenyl group having 2 to 10 carbon atoms, and more preferably an unsubstituted alkenyl group having 2 to 4 carbon atoms.

When $R^{11}$ represents an aryl group, preferably it is an unsubstituted aryl group having 6 to 10 carbon atoms, with a phenyl group being most preferred.

Among the hydrogen atom, the alkyl group, the alkenyl group, and the aryl group, the alkyl group is preferable.

$R^{12}$, $R^{13}$, $R^{14}$, $R^{15}$, $R^{16}$, and $R^{17}$, which are the same or different, each independently represent a hydrogen atom, or a substituted or unsubstituted alkyl group having 1 to 30 carbon atoms. Specific examples of the alkyl group include those described for $R^{11}$.

Preferably $R^{12}$, $R^{13}$, $R^{14}$, $R^{15}$ and $R^{16}$ each represent a hydrogen atom, or an unsubstituted alkyl group having 1 to 3 carbon atoms, and more preferably a hydrogen atom. Preferably both of $R^{12}$ and $R^{13}$ represent a hydrogen atom.

Preferably $R^{14}$ represents a hydrogen atom or a methyl group.

Preferably $R^{17}$ represents a hydrogen atom or an unsubstituted alkyl group having 1 to 3 carbon atoms.

n is 0 or 1. Preferably n is 0. The compound of formula (I) may form a polymer by bonding two or more molecules of the compound at $R^{11}$.

In formula (I), when the groups represented by $R^{11}$, $R^{12}$, $R^{13}$, $R^{14}$, $R^{15}$, and $R^{16}$ have a substituent, the substituent is not particularly limited and includes generally known atoms and groups. Specific examples of the substituent include a halogen atom, an alkyl group, an alkoxy group, an aryl group, an aryloxy group, a sulfonamido group, a sulfamoyl group, a carbonamido group, a carbamoyl group, an acyl group, and an acyloxy group.

Specific examples of the compound represented by formula (I) are shown below.

A-1

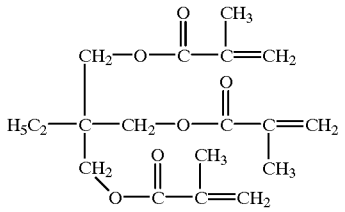

A-2

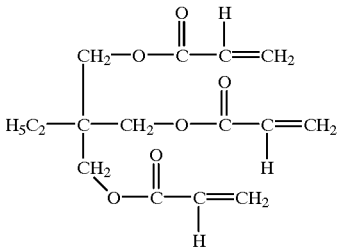

A-3

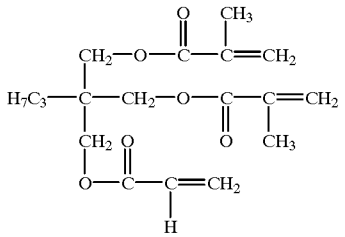

A-4

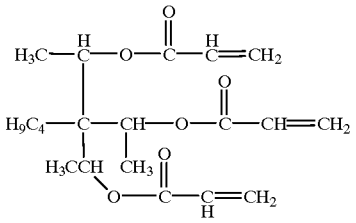

A-5

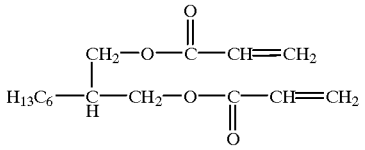

A-6

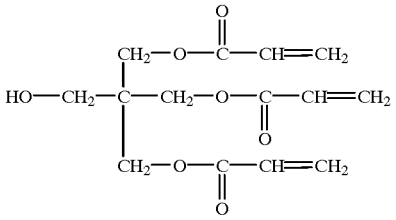

A-7

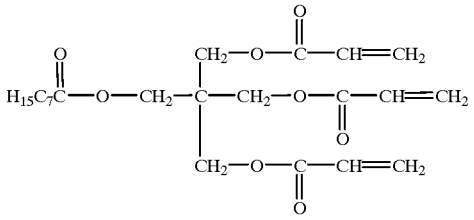

A-8

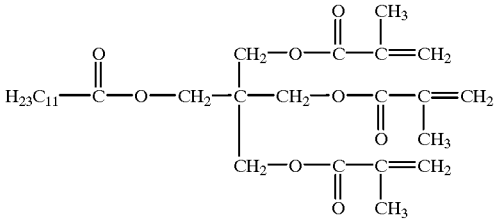

A-9

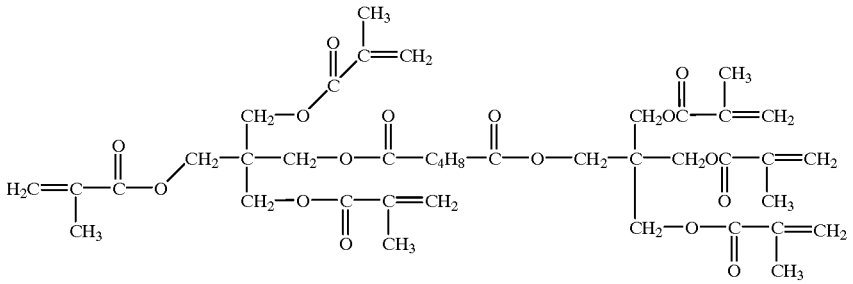

-continued

A-10

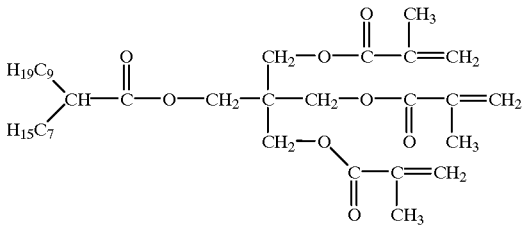

A-11

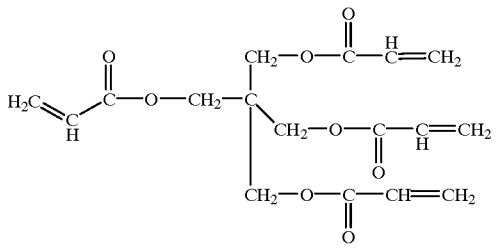

A-12

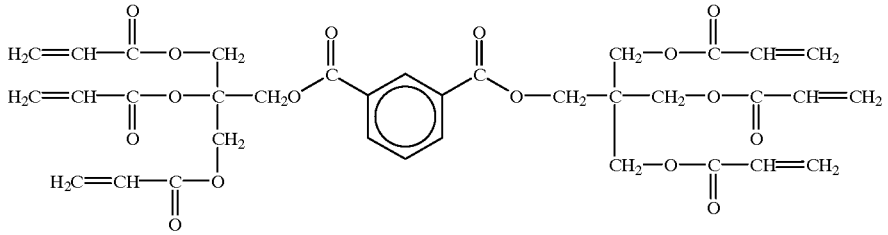

A-13

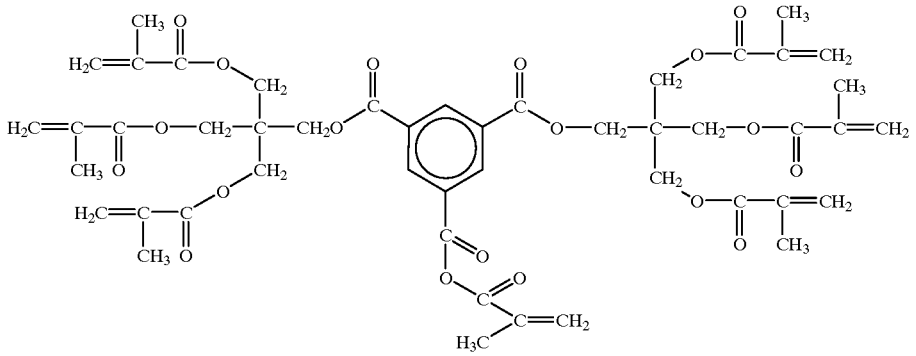

A-14

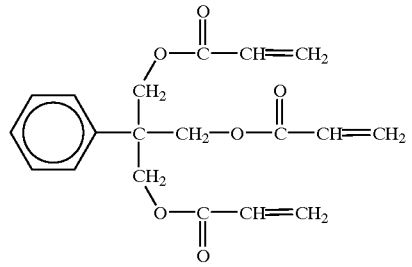

A-15

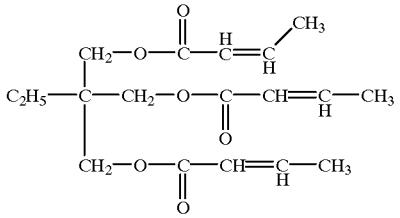

These compounds can be easily synthesized, for example, by the following methods, and they are also on the market, and therefore they can be easily obtained.

(Synthetic Method)

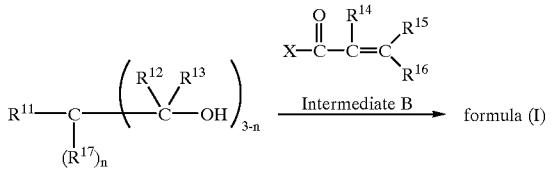

Intermediate A $R^{11}$, $R^{12}$, $R^{13}$, $R^{17}$, and n in the intermediate A have the same meanings as those defined in formula (I). This is a simple trihydric or dihydric alcohol, and it is readily available.

$R^{14}$, $R^{15}$, and $R^{16}$ in the intermediate B have the same meanings as those defined in formula (I). X represents a hydroxyl group, a halogen atom (preferably a chlorine atom), or an activated oxygen atom (a so-called split-off group).

When X in the intermediate B is a halogen atom, like a chlorine atom, it is reacted with the intermediate A in the presence of a deoxidizer (an inorganic or organic base). Alternatively, it is reacted without using any deoxidizer, while the produced hydrogen chloride is removed to the outside of the system.

When X is a hydroxyl group, an acid catalyst is added to the reaction system, and the intermediate A and the intermediate B are reacted with each other, while the produced water is removed to outside of the system.

As the acid catalyst, an inorganic acid, such as hydrochloric acid and sulfuric acid, or an organic acid, such as p-toluenesulfonic acid, can be used.

The case wherein X is an activated oxygen atom is now described.

A condensing agent is added to the intermediate A, wherein X is a hydroxyl group and the oxygen atom is activated in the reaction system, to allow the intermediate A to react with the intermediate B. As the condensing agent, an acid halide, dicyclohexylcarbodiimide, or the like can be used.

On the other hand, A-1 and A-2 can be purchased as reagents commercially numbered T 0912 and T 0949, respectively, that are produced by Tokyo Kasei Kogyo Co., Ltd.

Hereinbelow the cyan coupler (cyan dye-forming coupler) represented by formula (II) used in the present invention is described in detail. $Z^a$ and $Z^b$ each represent —C($R^3$)═ or —N═, provided that one of $Z^a$ and $Z^b$ is —N═ and the other is —C($R^3$)═.

$R^3$ represents a hydrogen atom or a substituent, and as the substituent, can be mentioned a halogen atom, an alkyl group, an aryl group, a heterocyclic group, a cyano group, a hydroxyl group, a nitro group, a carboxyl group, a sulfo group, an amino group, an alkoxy group, an aryloxy group, an acylamino group, an alkylamino group, an anilino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclic oxy group, an azo group, an acyloxy group, a carbamoyloxy group, a silyloxy group, an aryloxycarbonylamino group, an imido group, a heterocyclic thio group, a sulfinyl group, a phosphonyl group, an aryloxycarbonyl group, an acyl group, and the like, each of which may further be substituted by the substituent(s) shown by way of example in $R^3$.

More specifically, $R^3$ represents a hydrogen atom, a halogen atom (e.g., a chlorine atom and a bromine atom), an alkyl group (e.g., a straight-chain or branched-chain alkyl group, an aralkyl group, an alkenyl group, an alkynyl group, a cycloalkyl group, and a cycloalkenyl group, each having 1 to 32 carbon atoms, and specifically, for example, methyl, ethyl, propyl, isopropyl, t-butyl, tridecyl, 2-methanesulfonylethyl, 3-(3-pentadecylphenoxy)propyl, 3-{4-{2-[4-(4-hydroxyphenylsulfonyl)phenoxy]dodecaneamido}phenyl}propyl, 2-ethoxytridecyl, trifluoromethyl, cyclopentyl, and 3-(2,4-di-t-amylphenoxy)propyl), an aryl group (e.g., phenyl, 4-t-butylphenyl, 2,4-di-t-amylphenyl, and 4-tetradecaneamidophenyl), a heterocyclic group (e.g., imidazolyl, pyrazolyl, triazolyl, 2-furyl, 2-thienyl, 2-pyrimidinyl, and 2-benzothiazolyl), a cyano group, a hydroxyl group, a nitro group, a carboxyl group, an amino group, an alkoxy group (e.g., methoxy, ethoxy, 2-methoxyethoxy, 2-dodecylethoxy, and 2-methanesulfonylethoxy), an aryloxy group (e.g., phenoxy, 2-methylphenoxy, 4-t-butylphenoxy, 3-nitrophenoxy, 3-t-butyloxycarbamoylphenoxy, and 3-methoxycarbamoyl), an acylamino group (e.g., acetamido, benzamido, tetradecanamido, 2-(2,4-di-t-amylphenoxy)butanamido, 4-(3-t-butyl-4-hydroxyphenoxy)butanamido, and 2-{4-(4-hydroxyphenylsulfonyl)phenoxy}decanamido), an alkylamino group (e.g., methylamino, butylamino, dodecylamino, diethylamino, and methylbutylamino), an anilino group (e.g., phenylamino, 2-chloroanilino, 2-chloro-5-tetradecanaminoanilino, 2-chloro-5-dodecyloxycarbonylanilino, N-acetylanilino, and 2-chloro-5-{2-(3-t-butyl-4-hydroxyphenoxy)dodecanamido}anilino), a ureido group (e.g., phenylureido, methylureido, and N,N-dibutylureido), a sulfamoylamino group (e.g., N,N-dipropylsulfamoylamino and N-methyl-N-decylsulfamoylamino), an alkylthio group (e.g., methylthio, octylthio, tetradecylthio, 2-phenoxyethylthio, 3-phenoxypropylthio, and 3-(4-t-butylphenoxy)propylthio), an arylthio group (e.g., phenylthio, 2-butoxy-5-t-octylphenylthio, 3-pentadecylphenylthio, 2-carboxyphenylthio, and 4-tetradecanamidophenylthio), an alkoxycarbonylamino group (e.g., methoxycarbonylamino and tetradecyloxycarbonylamino), a sulfonamido group (e.g., methanesulfonamido, hexadecanesulfonamido, benzenesulfonamido, p-toluenesulfonamido, octadecanesulfonamido, and 2-methoxy-5-t-butylbenzenesulfonamido), a carbamoyl group (e.g., N-ethylcarbamoyl, N,N-dibutylcarbamoyl, N-(2-dodecyloxyethyl)carbamoyl, N-methyl-N-dodecylcarbamoyl, and N-{3-(2,4-di-t-amylphenoxy)propyl}carbamoyl), a sulfamoyl group (e.g., N-ethylsulfamoyl, N,N-dipropylsufamoyl, N-(2-dodecyloxyethyl)sulfamoyl, N-ethyl-N-dodecylsulfamoyl, and N,N-diethylsulfamoyl), a sulfonyl group (e.g., methanesulfonyl, octanesulfonyl, benzenesulfonyl, and toluenesulfonyl), an alkoxycarbonyl group (e.g., methoxycarbonyl, butyloxycarbonyl, dodecyloxycarbonyl, and octadecyloxycarbonyl), a heterocyclic oxy group (e.g., 1-phenyltetrazole-5-oxy and 2-tetrahydropyranyloxy), an azo group (e.g., phenylazo, 4-methoxyphenylazo, 4-pivaroylaminophenylazo, and 2-hydroxy-4-propanoylphenylazo), an acyloxy group (e.g., acetoxy), a carbamoyloxy group (e.g., N-methylcarbamoyloxy and N-phenylcarbamoyloxy), a silyloxy group (e.g., trimethylsilyloxy and dibutylmethylsilyloxy), an aryloxycarbonylamino group (e.g., phenoxycarbonylamino), an imido group (e.g., N-succinimido, N-phthalimido, and 3-octadecenylsuccinimido), a heterocyclic thio group (e.g., 2-benzothiazolylthio, 2,4-di-phenoxy-1,3,5-tirazole-6-thio, and 2-pyridylthio), a sulfinyl group (e.g., dodecanesulfinyl, 3-pentadecylphenylsulfinyl, and 3-phenoxypropylsulfinyl), a phosphonyl group (e.g., phenoxyphosphonyl, octyloxyphosphonyl, and phenylphosphonyl), an aryloxycarbonyl group (e.g., phenoxycarbonyl), or an acyl group (e.g., acetyl, 3-phenylpropanoyl, benzoyl, and 4-dodecyloxybenzoyl).

As $R^3$, preferably can be mentioned an alkyl group, an aryl group, a heterocyclic group, a cyano group, a nitro group, an acylamino group, an anilino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclic oxy group, an acyloxy group, a carbamoyloxy group, an aryloxycarbonylamino group, an imido group, a heterocyclic thio group, a sulfinyl group, a phosphonyl group, an aryloxycarbonyl group, and an acyl group.

More preferably, an alkyl group or an aryl group, further preferably, in view of cohesiveness, an alkyl group or aryl group having at least one substituent, and furthermore preferably an alkyl group or aryl group having, as a substituent, at least one alkyl group, alkoxy group, sulfonyl group, sulfamoyl group, carbamoyl group, acylamido group or sulfonamido group, is mentioned. Particularly preferably, an alkyl group or aryl group having, as a substituent, at least one alkyl group, acylamido group, or sulfonamido group, is mentioned. In the case of an aryl group, if the aryl group has these substituents, more preferably the aryl group has the substituent at least in the ortho position or the para position.

In the cyan coupler for use in the present invention, each of $R^1$ and $R^2$ is an electron-attracting group whose Hammet substituent constant σp value is 0.20 or more, and the sum of the σp values of $R^1$ and $R^2$ is 0.65 or more, thereby forming color as a cyan image. The sum of the σp values of $R^1$ and $R^2$ is preferably 0.70 or more, and the upper limit is in the order of 2.0.

$R^1$ and $R^2$ each are an electron-attracting group whose Hammett substituent constant σp value is 0.20 or more and preferably 0.30 or more, with the upper limit being 1.0 or less.

As a specific example of $R^1$ and $R^2$ that are electron-attracting groups whose σp value is 0.20 or more, can be mentioned an acyl group, an acyloxy group, a carbamoyl group, an alkoxycarbonyl group, an aryloxycarbonyl group, a cyano group, a nitro group, a dialkylphosphono group, a diaryiphosphono group, a diarylphosphinyl group, an alkylsulfinyl, an arylsulfinyl group, an alkylsulfonyl group, an arylsulfonyl group, a sulfonyloxy group, an acylthio group, a sulfamoyl group, a thiocyanate group, a thiocarbonyl group, a halogenated alkyl group, a halogenated alkoxy group, a halogenated aryloxy group, a halogenated alkylamino group, a halogenated alkylthio group, an aryl group substituted by another electron-attracting group whose σp value is 0.20 or more, a heterocyclic group, a halogen atom, an azo group, or a selenocyanate group. Out of these substituents, the groups that can be further substituted may further have the substituent(s) as mentioned for $R^3$.

In passing, in the present invention, the term "alkyl" of the group having an alkyl moiety in $R^1$ and $R^2$, means straight-chain or branched-chain alkyl, aralkyl, alkenyl, alkynyl, cycloalkyl, and cycloalkenyl, as defined for the alkyl group of $R^3$.

Accordingly, the alkoxycarbonyl group includes a straight- or branched-chain alkoxycarbonyl group, an aralkyloxycarbonyl group, an alkenyloxycarbonyl group, an alkynyloxycarbonyl group, a cycloalkyloxycarbonyl group, and a cycloalkenoxycarbonyl group.

With respect to $R^1$ and $R^2$, more specifically, the electron-attracting group whose σp value is 0.20 or more represents an acyl group (e.g., acetyl, 3-phenylpropanoyl, benzoyl, and 4-dodecyloxybenzoyl), an acyloxy group (e.g., acetoxy), a carbamoyl group (e.g., carbamoyl, N-ethylcarbamoyl, N-phenylcarbamoyl, N,N-dibutylcarbamoyl, N-(2-dodecyloxyethyl)carbamoyl, N-(4-n-pentadecanamido) phenylcarbamoyl, N-methyl-N-dodecylcarbamoyl, and N-{3-(2,4-di-t-amylphenoxy)propyl}carbamoyl), an alkoxycarbonyl group (e.g., methoxycarbonyl, ethoxycarbonyl, iso-propyloxycarbonyl, tert-butyloxycarbonyl, iso-butyloxycarbonyl, butyloxycarbonyl, dodecyloxycarbonyl, octadecyloxycarbonyl, cyclohexyloxycarbonyl, cyclohexenoxycarbonyl), an aryloxycarbonyl group (e.g., phenoxycarbonyl), a cyano group, a nitro group, a dialkylphosphono group (e.g., dimethylphosphono), a diarylphosphono group (e.g., diphenylphosphono), a diarylphosphinyl group (e.g., diphenylphosphinyl), an alkylsulfinyl group (e.g., 3-phenoxypropylsulfinyl), an arylsulfinyl group (e.g., 3-pentadecylphenylsulfinyl), an alkylsulfonyl group (e.g., methanesulfonyl and octanesulfonyl), an arylsulfonyl group (e.g., benzenesulfonyl and toluenesulfonyl), a sulfonyloxy group (e.g., methanesulfonyloxy and toluenesulfonyloxy), an acylthio group (e.g., acetylthio and benzoylthio), a sulfamoyl group (e.g., N-ethylsulfamoyl, N,N-dipropylsulfamoyl, N-(2-dodecyloxyethyl)sulfamoyl, N-ethyl-N-dodecylsulfamoyl, and N,N-diethylsulfamoyl), a thiocyanate group, a thiocarbonyl group (e.g., methylthiocarbonyl and phenylthiocarbonyl), a halogenated alkyl group (e.g., trifluoromethane and heptafluoropropane), a halogenated alkoxy group (e.g., trifluoromethyloxy), a halogenated aryloxy group (e.g., pentafluorophenyloxy), a halogenated alkylamino group (e.g., N,N-di-(trifluoromethyl) amino), a halogenated alkylthio group (e.g., difluoromethylthio and 1,1,2,2-tetrafluoroethylthio), an aryl group substituted by another electron-attracting group whose σp value is 0.20 or more (e.g., 2,4-dinitrophenyl, 2,4,6-trichlorophenyl, and pentachlorophenyl), a heterocyclic group (e.g., 2-benzooxazolyl, 2-benzothiazolyl, 1-phenyl-2-benzimidazolyl, 5-chloro-1-tetrazolyl, and 1-pyrrolyl), a halogen atom (e.g., a chlorine atom and a bromine atom), an azo group (e.g., phenylazo), or a selenocyanate group. Out of these substituents, the groups that can be further substituted may further have the substituent(s) as mentioned for $R^3$.

As preferable $R^1$ and $R^2$, can be mentioned an acyl group, an acyloxy group, a carbamoyl group, an alkoxycarbonyl group, an aryloxycarbonyl group, a cyano group, a nitro group, an alkylsulfinyl group, an arylsulfinyl group, an alkylsulfonyl group, an arylsulfonyl group, a sulfamoyl group, a halogenated alkyl group, a halogenated alkyloxy group, a halogenated alkylthio group, a halogenated aryloxy group, an aryl group substituted by two or more another electron-attracting groups whose σp value is 0.20 or more, and a heterocyclic group; and more preferably an alkoxycarbonyl group, a nitro group, a cyano group, an arylsulfonyl group, a carbamoyl group, and a halogenated alkyl group. Most preferably $R^1$ is a cyano group. Particularly preferably $R^2$ is an alkoxycarbonyl group, and most preferably a branched-chain alkoxycarbonyl group (particularly a cycloalkoxycarbonyl group).

X represents a hydrogen atom or a group capable of being split-off upon coupling reaction with the oxidized product of an aromatic primary amine color-developing agent, and specifically examples of the group capable of being split-off include a halogen atom, an alkoxy group, an aryloxy group, an acyloxy group, an alkyl- or aryl-sulfonyloxy group, an acylamino group, an alkyl- or aryl-sulfonamido group, an alkoxycarbonyloxy group, an aryloxycarbonyloxy group, an alkylthio, arylthio, or heterocyclic thio group, a carbamoylamino group, a carbamoyloxy group, a heterocyclic carbonyloxy group, a 5- or 6-membered nitrogen-containing heterocyclic group, an imido group, an arylazo group, and the like, each of which may further be substituted by the group that is an allowable substituent of $R^3$.

More specifically, examples of X include a halogen atom (e.g. fluorine atom, chlorine atom, and bromine atom), an alkoxy group (e.g. ethoxy, dodecyloxy, methoxyethylcarbamoylmethoxy, carboxypropyloxy, methanesulfonylethoxy, and ethoxycarbonylmethoxy), an aryloxy group (e.g. 4-methylphenoxy, 4-chlorophenoxy, 4-methoxyphenoxy, 4-carboxyphenoxy, 3-ethoxycarbonylphenoxy, 3-acetylaminophenoxy, and 2-carboxyphenoxy), an acyloxy group (e.g. acetoxy, tetradecanoyloxy, and benzoyloxy), an alkyl- or arylsulfonyloxy group (e.g. methansulfonyloxy, and toluenesulfonyloxy), an acylamino group (e.g. dichloroacetylamino and heptafluorobutyrylamino), an alkyl- or arylsulfonamido group (e.g. methanesulfonylamino, trifuloromethanesulfonylamino, and p-toluenesufonylamino), an alkoxycarbonyloxy group (e.g. ethoxycarbonyloxy and benzyloxycarbonyloxy), an aryloxycarbonyloxy group (e.g. phenoxycarbonyloxy), an alkylthio, arylthio, or heterocyclic thio group (e.g. dodecylthio, 1-carboxydodecylthio, phenylthio, 2-butoxy-5-t-octylphenylthio, tetrazolylthio), a carbamoylamino group (e.g. N-methylcarbamoylamino and N-phenylcarbamoylamino), a carbamoyloxy group (e.g. N,N-diethylcarbamoyloxy, N-ethylcarbamoyloxy, N-ethyl-N-phenylcarbamoyloxy), a heterocyclic carbonyloxy group (e.g. morpholinocarbonyloxy and piperidinocarbonyloxy), a 5- or 6-membered nitrogen-containing heterocyclic group (e.g. imidazolyl, pyrazolyl, triazolyl, tetrazolyl, 1,2-dihydro-2-oxo-1-pyridyl), an imido group (e.g. succinimido and hydantoinyl), and an aryl azo group (e.g. phenylazo and 4-methoxyphenylazo). In addition to these, in some cases, X takes the form of a bis-type coupler that is obtained by condensing a four-equivalent coupler with aldehydes or ketones, as a split-off group bonded through a carbon atom. Further, X may contain a photographically useful group, such as a development inhibitor and a development accelerator.

Preferable X is a halogen atom, an alkoxy group, an aryloxy group, an alkyl- or aryl-thio group, an alkyloxycarbonyloxy group, an aryloxycarbonyloxy group, a carbamoyloxy group, a heterocyclic carbonyloxy group, or a 5- or 6-membered nitrogen-containing heterocyclic group bonded through the nitrogen atom to the coupling active site. More preferable X is a halogen atom, an alkyl- or aryl-thio group, an alkyloxycarbonyloxy group, an aryloxycarbonyloxy group, a carbamoyloxy group, or a heterocyclic carbonyloxy group, and particularly preferably a carbamoyloxy group or a heterocyclic carbonyloxy group.

With respect to the cyan coupler represented by formula (II), the group represented by $R^1$, $R^2$, $R^3$ or X may be a divalent group, to form a dimer or a higher polymer, or to bond to a polymer chain to form a homopolymer or a copolymer. The homopolymer or the copolymer formed by bonding to a polymer chain is typically a honopolymer or a copolymer of an addition polymer ethylenically unsaturated compound having a residue of a cyan coupler represented by formula (II). In this case, the polymer may contain one or more types of the cyan color-forming repeating units having the residue of the cyan coupler represented by formula (II), and the copolymer may be a copolymer containing one or more types of non-color-forming ethylenically monomers as a copolymer component. The cyan color-forming repeating unit having a residue of a cyan coupler represented by formula (II) is preferably represented by the following formula (P):

(P)

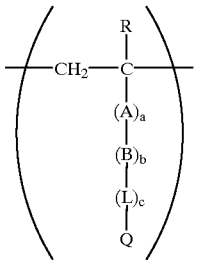

wherein R represents a hydrogen atom, an alkyl group having 1 to 4 carbon atoms, or a chlorine atom, A represents —CONH—, —COO—, or a substituted or unsubstituted phenylene group, B represents a substituted or unsubstituted alkylene group, phenylene group, or aralkylene group, L represents —CONH—, —NHCONH—, —NHCOO—, —NHCO—, —OCONH—, —NH—, —COO—, —OCO—, —CO—, —O—, —S—, —$SO_2$—, —$NHSO_2$— or —$SO_2NH$—; a, b, and c each represent 0 or 1; and Q represents a cyan coupler residue formed by releasing a hydrogen atom from $R^1$, $R^2$, $R^3$, or X of the compound represented by formula (II). As the polymer, a copolymer of a cyan-color-forming monomer represented by the coupler unit of formula (II) with a non-color-forming ethylenically monomer that does not couple with the oxidized product of an aromatic primary amine developing agent is preferable.

As the non-color-forming ethylenically monomer that does not couple with the oxidized product of an aromatic primary amine developing agent, there, for example, are acrylic acid, α-chloroacrylic acid, and an α-alkyl acrylic acids (e.g., methacrylic acid and the like) and amides or esters derived from these acrylic acids (e.g., acrylamide, methacrylamide, n-butylacrylamide, t-butylacrylamide, diacetone acrylamide, methyl acrylate, ethyl acrylate, n-propyl acrylate, n-butyl acrylate, t-butyl acrylate, iso-butyl acrylate, 2-ethylhexyl acrylate, n-octyl acrylate, lauryl acrylate, methyl methacrylate, ethyl methacrylate, n-butyl methacrylate, and β-hydroxymethacrylate), vinyl esters (e.g., vinyl acetate, vinyl propionate, and vinyl laurate), acrylonitrile, methacrylonitrile, aromatic vinyl compounds (e.g., styrene and its derivative, such as vinyltoluene, divinylbenzene, vinylacetophenone, and sulfostyrene), itaconic acid, citraconic acid, crotonic acid, vinylidene chloride, vinyl alkyl ethers (e.g., vinyl ethyl ether), maleates, N-vinyl-2-pyrrolidone, N-vinylpyridine, and 2- and 4-vinylpyridine.

Particularly, acrylates, methacrylates, and maleates are preferable. The non-color-forming ethylenically monomers used herein can be used in the form of a combination of two or more; for example, methyl acrylate and butyl acrylate, butyl acrylate and styrene, butyl methacrylate and methacrylic acid, methyl acrylate and diacetone acrylamide, and the like may be used.

As is well known in the field of polymer couplers, the ethylenically unsaturated monomer to be copolymerized with the vinyl-series monomer corresponding to the above formula (II) can be chosen so that the physical properties and/or the chemical properties of the copolymer to be formed—for example, the solubility, the compatibility with the binder of photographic colloid compositions, such as gelatin; the flexibility, the heat stability, and the like—may be favorably influenced.

To incorporate the cyan coupler for use in the present invention into the silver halide light-sensitive material preferably into a red-sensitive silver halide emulsion layer, preferably the cyan coupler is made into a so-called incorporated coupler, and to do so, preferably at least one group of $R^1$, $R^2$, $R^3$, and X is a so-called ballasting group (preferably having 10 or more carbon atoms in total), and more preferably the number of carbon atoms in total is 10 to 50. In particular, preferably $R^3$ has a ballasting group.

The cyan coupler represented by formula (II) is more preferably a compound having a structure represented by the following formula (III):

(III)

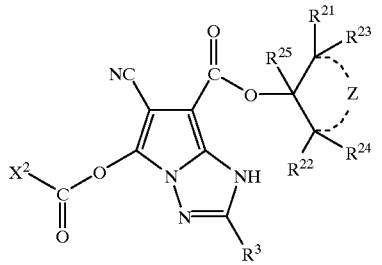

wherein $R^{21}$, $R^{22}$, $R^{23}$, $R^{24}$, and $R^{25}$, which are the same or different, each represent a hydrogen atom or a substituent. As the substituent, a substituted or unsubstituted aliphatic group or a substituted or unsubstituted aryl group is preferable, and more preferable ones are described below.

$R^{21}$ and $R^{22}$ preferably represent an aliphatic group, for example, a straight-chain, branched-chain or cyclic alkyl group, aralkyl group, alkenyl group, alkynyl group, or cycloalkenyl group, each having 1 to 36 carbon atoms, and specifically, for example, methyl, ethyl, propyl, isopropyl, t-butyl, t-amyl, t-octyl, tridecyl, cyclopentyl, or cyclohexyl. The aliphatic group has more preferably 1 to 12 carbon atoms. $R^{23}$, $R^{24}$, and $R^{25}$ represent a hydrogen atom or an aliphatic group. As the aliphatic group, those mentioned above for $R^{21}$ and $R^{22}$ can be mentioned. Particularly preferably $R^{23}$, $R^{24}$, and $R^{25}$ are a hydrogen atom.

Z represents a group of non-metal atoms required to form a 5- to 8-membered ring, which ring may be substituted and may be a saturated ring or have a unsaturated bond. As preferable non-metal atoms, a nitrogen atom, an oxygen atom, a sulfur atom, and a carbon atom can be mentioned, and a carbon atom is more preferable.

As the ring formed by Z, for example, a cyclopentane ring, a cyclohexane ring, a cycloheptane ring, a cyclooctane ring, a cyclohexene ring, a piperazine ring, an oxane ring, and a thiane ring can be mentioned. These rings may be substituted by such substituents as represented by $R^3$ described above.

The ring formed by Z is preferably an optionally substituted cyclohexane ring, and particularly preferably a cyclohexane ring whose 4-position is substituted by an alkyl group having 1 to 24 carbon atoms (that may be substituted by such a substituent as represented by $R^3$ described above).

$R^3$ in formula (III) has the same meaning as $R^3$ in formula (II), and it is particularly preferably an alkyl group or an aryl group, and more preferably a substituted aryl group. Concerning the number of carbon atoms, in the case of the alkyl group, preferably the alkyl group has 1 to 36 carbon atoms, and in the case of the aryl group, preferably the aryl group has 6 to 36 carbon atoms.

Out of the aryl groups, one wherein the ortho position to the position where it is attached to the coupler mother nucleus is substituted by an alkoxy group is not preferable, because the fastness to light of the dye originated from the coupler is low.

In this connection, the substituent of the aryl group is preferably a substituted or unsubstituted alkyl group, and inter alia an unsubstituted alkyl group is most preferable. Particularly, an unsubstituted alkyl group having 1 to 30 carbon atoms is preferable.

$X^2$ represents a hydrogen atom or a substituent. The substituent is preferably a group that accelerates the release of the $X^2$—C(=O)O— group at the time of the oxidation coupling reaction. Preferably $X^2$ is, out of them, a heterocyclic ring, a substituted or unsubstituted amino group, or an aryl group. As the heterocyclic ring, a 5- to 8-membered ring having a nitrogen atom(s), an oxygen atom(s), or a sulfur atom(s) and 1 to 36 carbon atoms is preferable. A 5- or 6-membered ring bonded through a nitrogen atom is more preferable, with particular preference given to a 6-membered ring. These rings may form a condensed ring with a benzene ring or a heterocycle. As specific examples, imidazole, pyrazole, triazole, lactam compounds, piperidine, pyrrolidine, pyrrole, morpholine, pyrazolidine, thiazolidine, pyrazoline, and the like can be mentioned, with preference given to morpholine and piperidine and particular preference to morpholine.

As the substituent of the substituted amino group, an aliphatic group, an aryl group, or a heterocyclic group can be mentioned. As the aliphatic group, the substituents of $R^3$ mentioned above can be mentioned, which may further be substituted by a cyano group, an alkoxy group (e.g., methoxy), an alkoxycarbonyl group (e.g., ethoxycarbonyl), a chlorine atom, a hydroxyl group, a carboxyl group, or the like. As the substituted amino group, a di-substituted amino group is preferred over a mono-substituted amino group. The substituent is preferably an alkyl group.

As the aryl group, one having 6 to 36 carbon atoms is preferable, and a single ring is more preferable. As specific examples, phenyl, 4-t-butylphenyl, 2-methylphenyl, 2,4,6-trimethylphenyl, 2-methoxyphenyl, 4-methoxyphenyl, 2,6-dichlorophenyl, 2-chlorophenyl, 2,4-dichlorophenyl, and the like can be mentioned.

Preferably the cyan coupler represented by formula (III) used in the present invention has, in the molecule, a group that makes it soluble in an oil (hereinbelow referred to as a solubilizing-in-oil group), so that the cyan coupler may be easily soluble in a high-boiling organic solvent, and that this cyan coupler itself and the dye formed by the oxidation coupling of this cyan coupler with a color-forming reducing agent (developing agent) are nondiffusible in hydrophilic colloid layers.

For the coupler represented by formula (III), $R^3$ may contain a residue of a coupler represented by formula (III) to form a dimer or a higher polymer, or $R^3$ may contain a polymer chain to form a homopolymer or a copolymer. The homopolymer or the copolymer containing a polymer chain is typically a homopolymer or a copolymer of an addition copolymer ethylenically unsaturated compound having a residue of a coupler represented by formula (III). In this case, with respect to the cyan color-forming repeating unit having a residue of a coupler represented by formula (III), one or more kinds of such cyan color-forming repeating units may be contained in the polymer. The copolymer may contain, as a copolymer component(s), one, or two or more non-color-forming ethylenically monomers that do not couple with the oxidation product of an aromatic primary amine developing agent, such as acrylates, methacrylates, and maleates.

Hereinbelow, specific examples of the cyan coupler defined in the present invention are shown, but the present invention is not restricted to them.

(1)
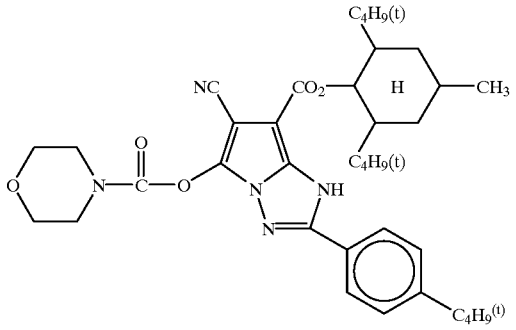
pKa 7.14
(2)
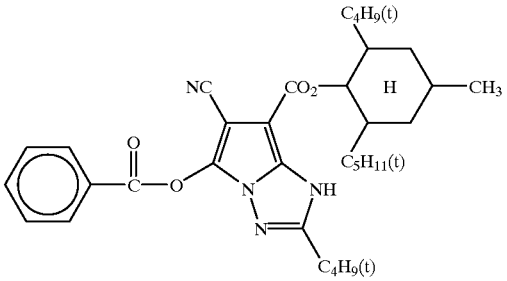
pKa 7.90
(3)
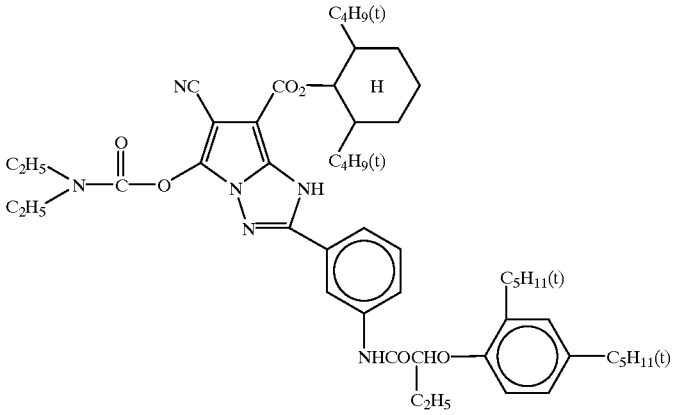
(4)
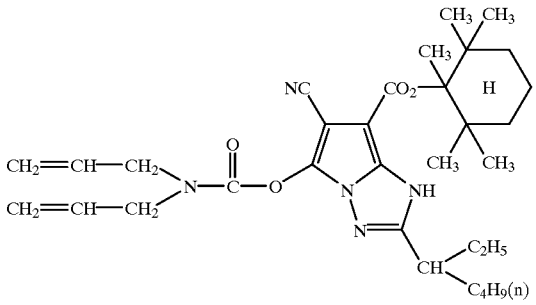
(5)
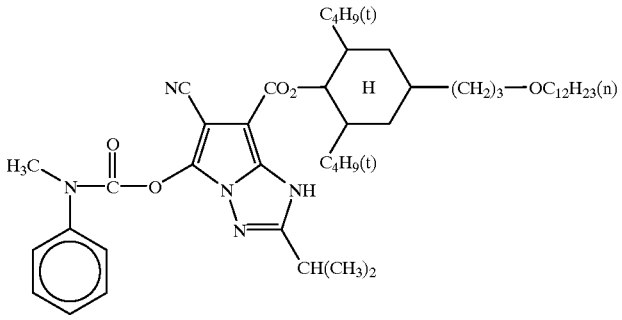

-continued
(6)
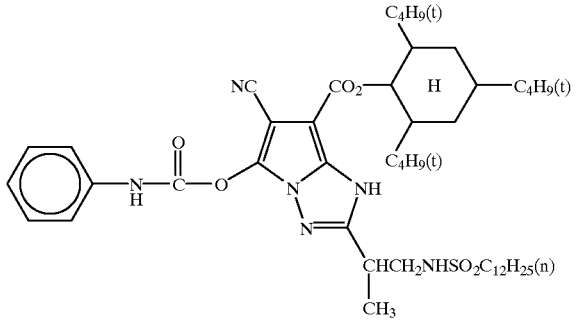
(7)
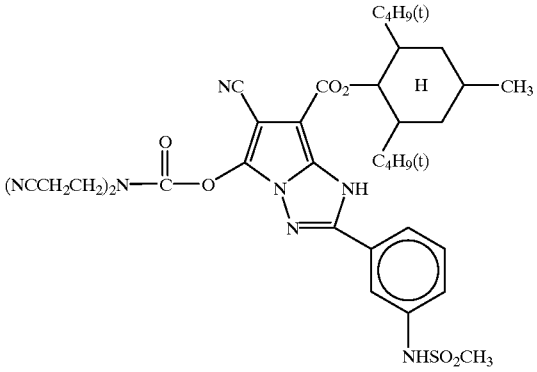
(8)
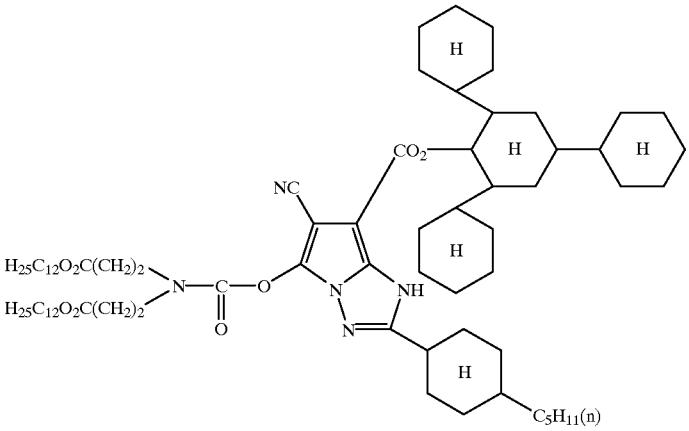
(9)
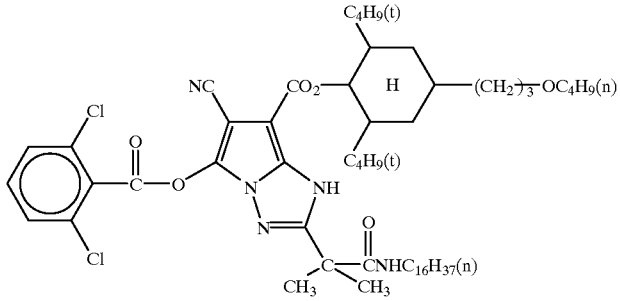

-continued
(10)
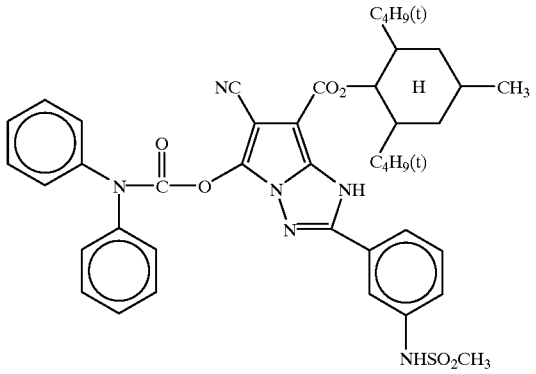
(11)
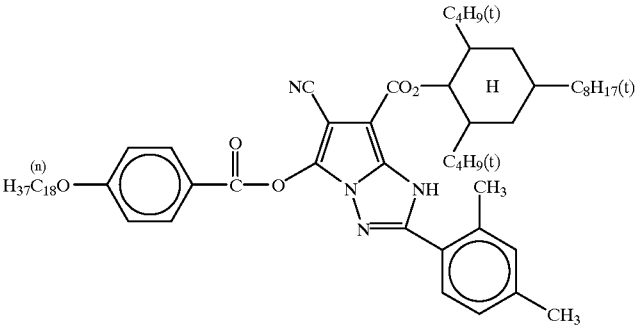
(12)
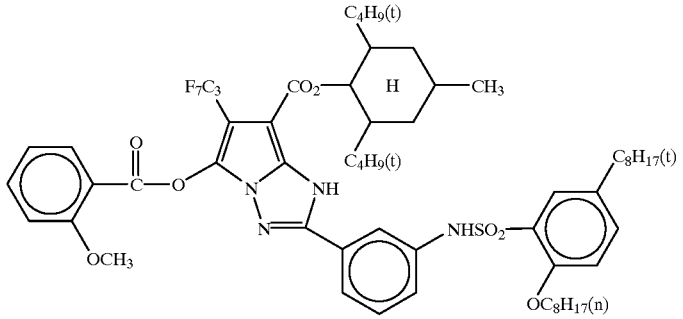
(13)
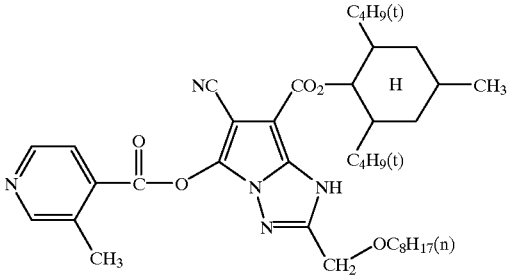

-continued
(14)
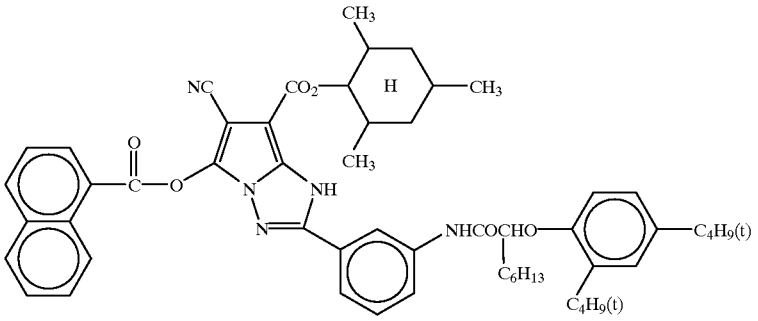
(15)
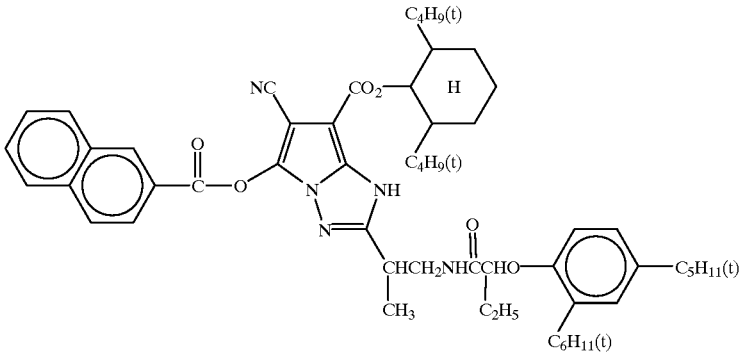
(16)
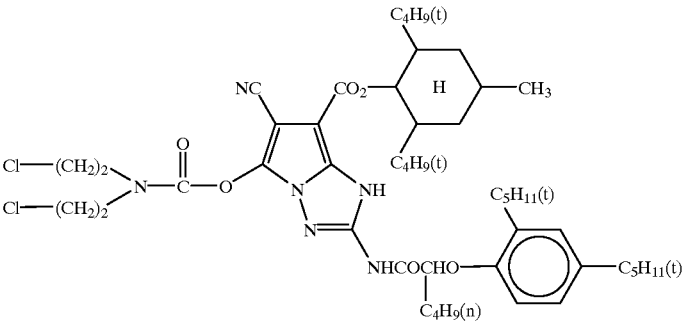
(17)
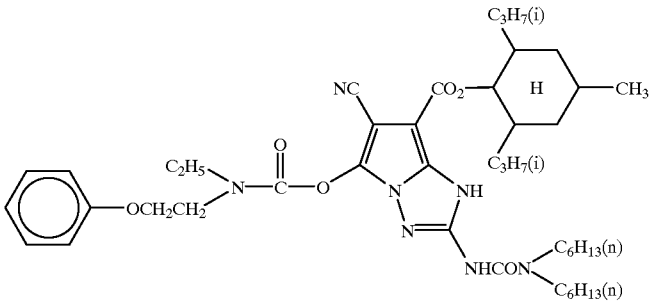

-continued
(18)
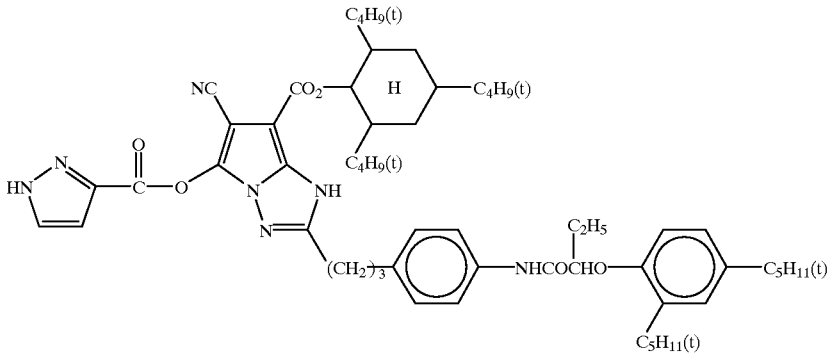
(19)
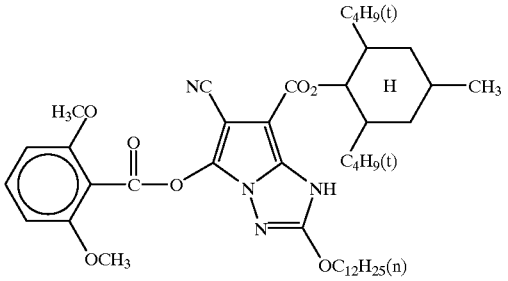
(20)
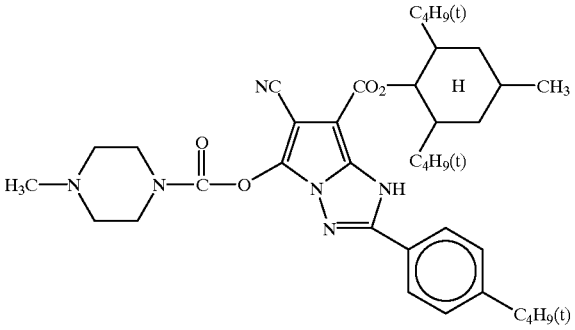
(21)
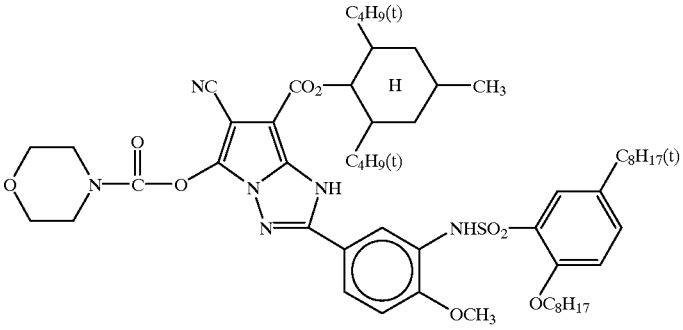
pKa 7.70
(22)
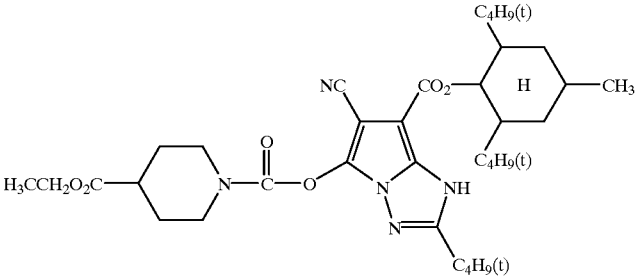
pKa 8.30

-continued
(23)
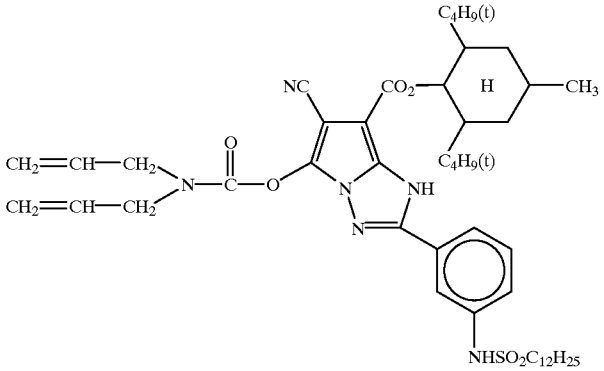
(24)
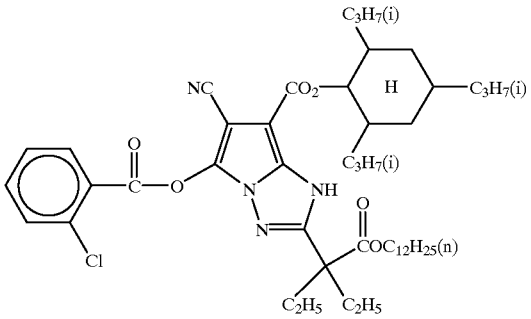
(25)
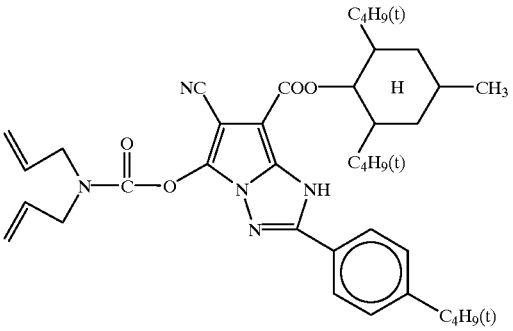
pKa 7.47
(26)
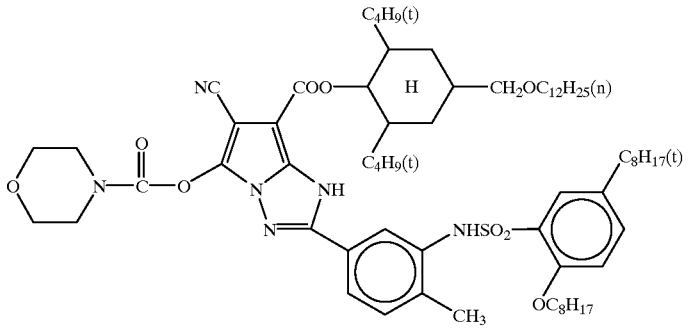
pKa 7.38
(27)
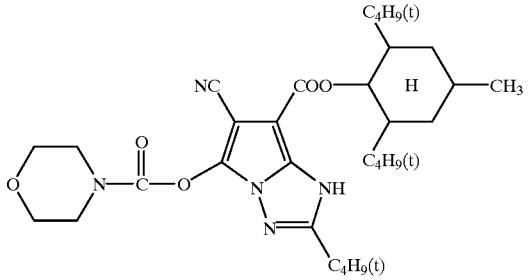
pKa 8.28

-continued
(28)
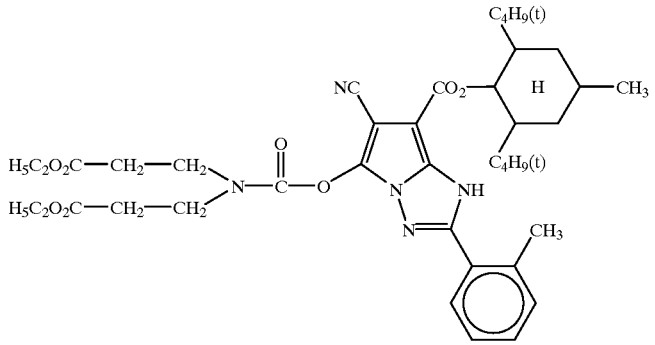
(29)
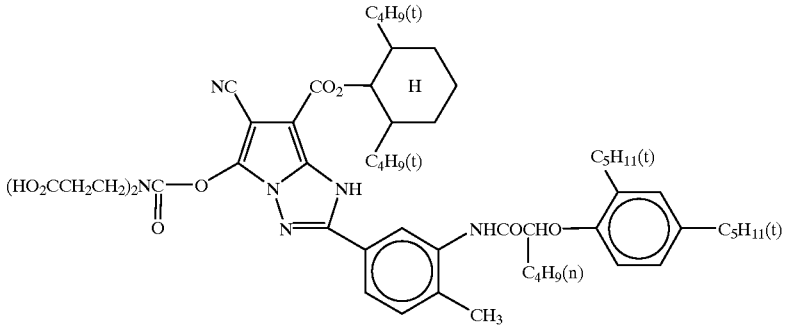
(30)
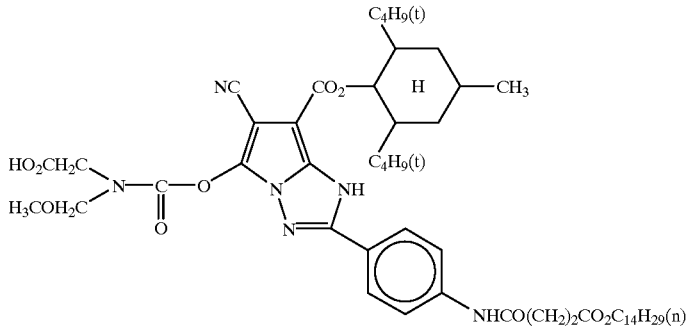
(31)
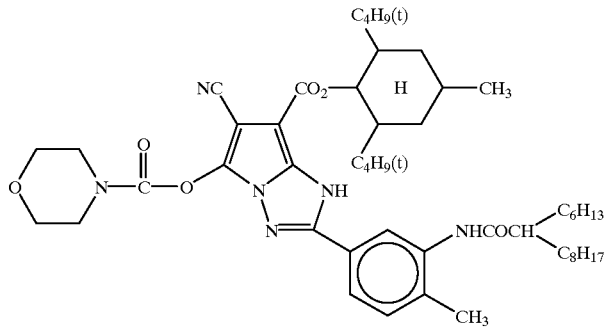

-continued
(32)
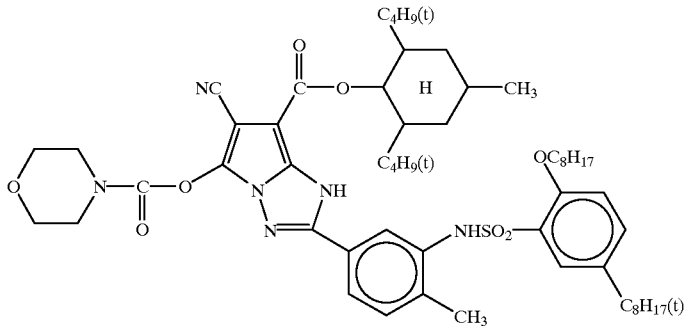
pKa 7.38
(33)
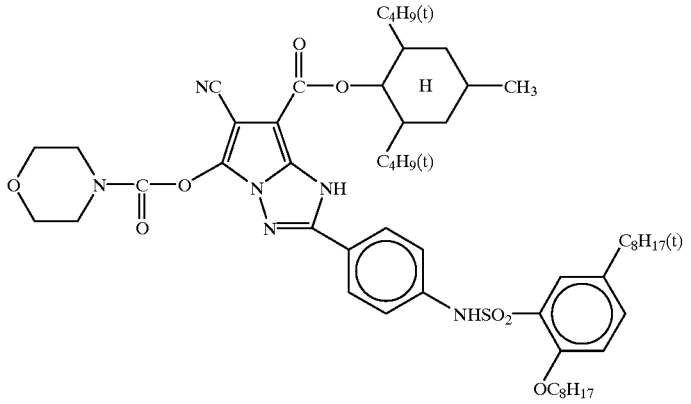
(34)
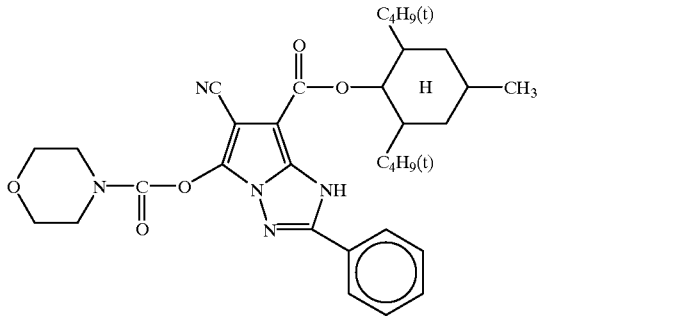
(35)
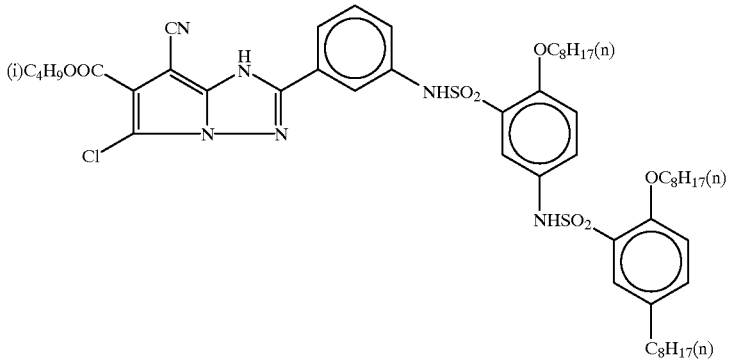

-continued
(36)
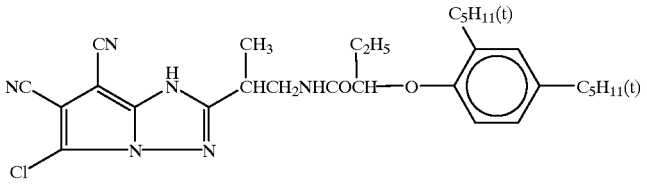
(37)
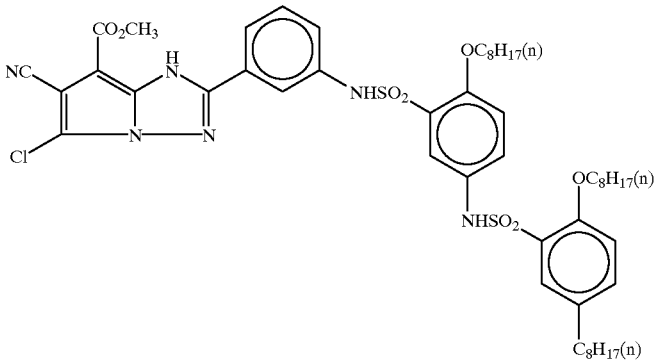
(38)
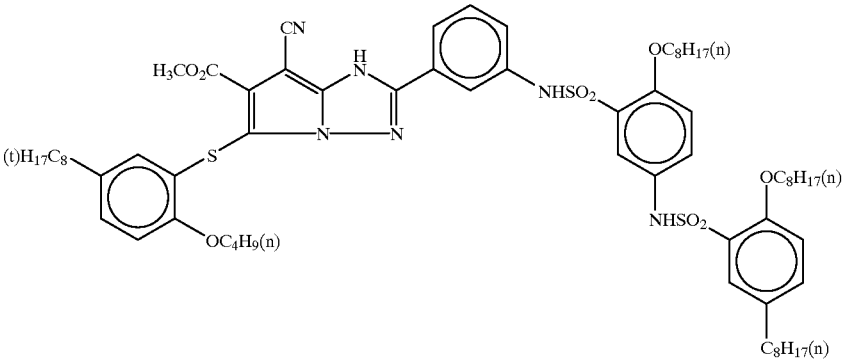
(39)
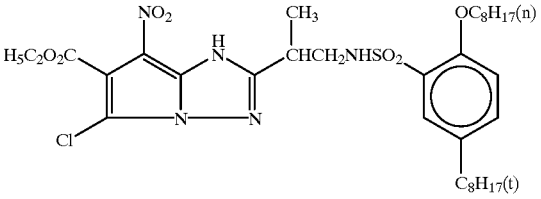
(40)
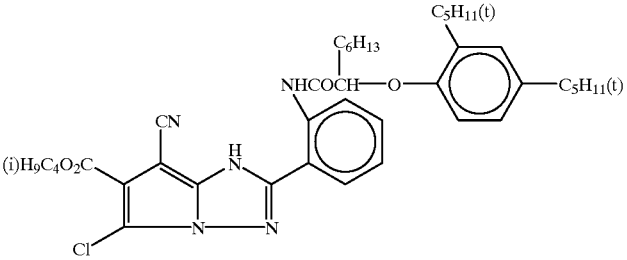

-continued
(41)
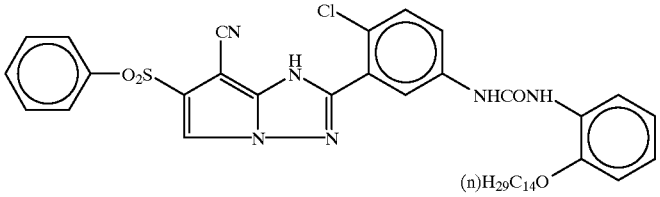
(42)
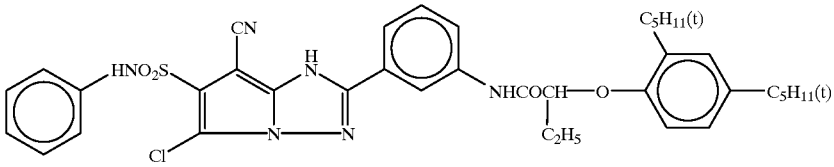
(43)
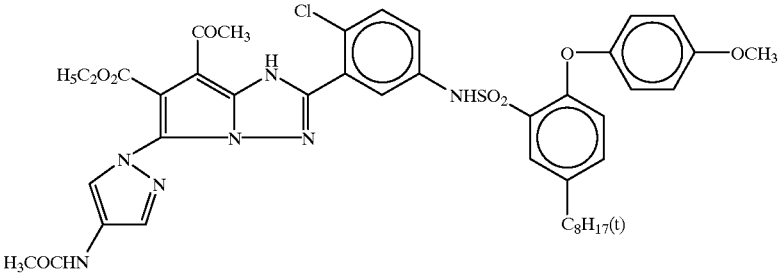
(44)
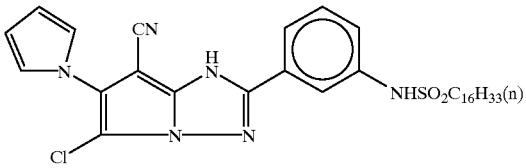
(45)
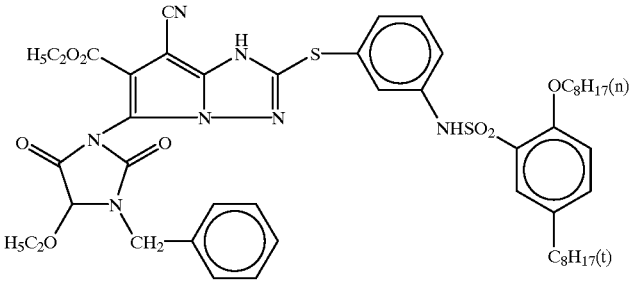
(46)
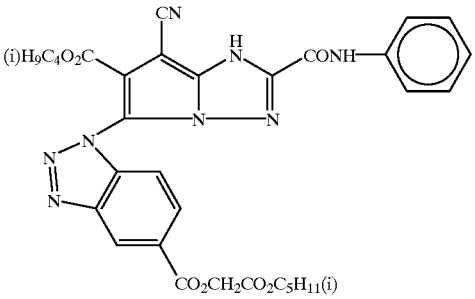
(47)
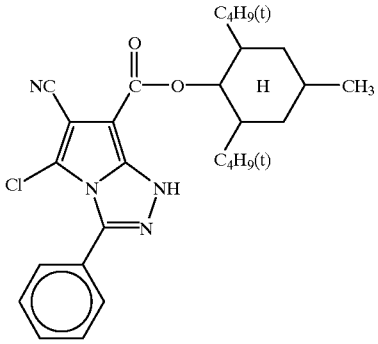

The compound represented by formula (II) can be synthesized by the known method, for example, by methods described in JP-A-5-150423, JP-A-5-255333, JP-A-5-202004, JP-A-7-48376, and JP-A-9-189988.

Specific synthetic examples of the compound represented by formula (II) are shown below.

[Synthetic Example 1: Synthesis of Exemplified Compound (1)]

Exemplified Compound (1) was synthesized according to the following route.

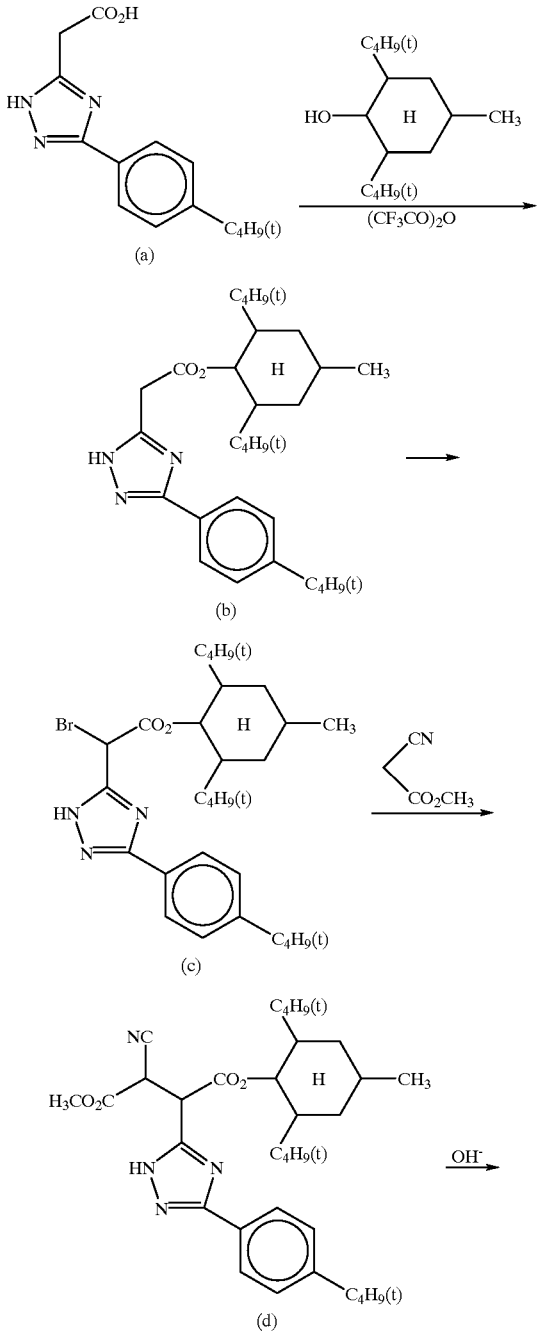

-continued

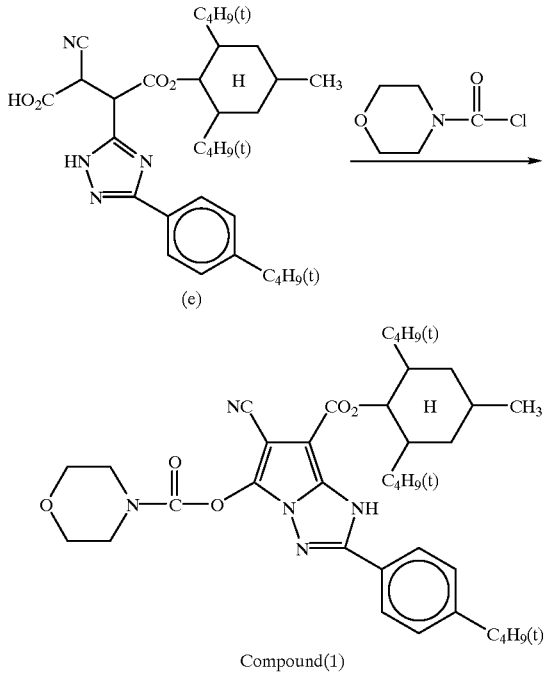

Synthesis of Compound (b)

To a solution of 17 g (75 mmol) of 2,6-di-t-butyl-4-methylcyclohexanol in 200 ml of acetonitrile, was added 10.6 ml (75 mmol) of trifluoroacetic anhydride at 0° C., dropwise, and then 15.6 g (60.4 mmol) of Compound (a) was added, slowly. After the reaction liquid was stirred at room temperature for 2 hours, 300 ml of water and 300 ml of ethyl acetate were added, to effect extraction. The organic layer was washed with an aqueous sodium bicarbonate solution, water, and then brine. After the organic layer was dried over magnesium sulfate, the solvent was distilled off under reduced pressure, and recrystallization from acetonitrile was carried out, to obtain 19.6 g of Compound (b).

Synthesis of Compound (c)

To a solution of 19.6 g of Compound (b) in 200 ml of ethyl acetate, was added 5 ml of pyridine, and then bromine was added thereto, dropwise, under cooling with water. After stirring for 1 hour, 300 ml of water and 300 ml of ethyl acetate were added, to carry out extraction. After the extraction, the ethyl acetate layer was dried over magnesium sulfate; then the solvent was distilled off, and recrystallization was carried out by adding acetonitrile to the residue, to obtain 18.0 g of Compound (c).

Synthesis of Compound (e)

To a solution of 2.2 g of methyl cyanoacetate in 20 ml of dimethylacetamide, was added, slowly, 0.8 g of sodium hydride at 0° C., followed by stirring at room temperature for 30 min (Solution S).

A solution of 10.0 g of Compound (c) dissolved in 50 ml of dimethylacetamide was added to (Solution S), slowly, dropwise, under cooling with ice. After stirring for 1 hour, a solution of 4 g of sodium hydroxide dissolved in 20 ml of water and 20 ml of methanol were added to the reaction liquid, and the reaction temperature was kept at 50° C., with stirring, for 1 hour. After the reaction, 200 ml of ethyl acetate was added, and hydrochloric acid was added, for neutralization. After washing with water, the ethyl acetate layer was dried over magnesium sulfate, and then the solvent was distilled off under reduced pressure, to obtain crude Compound (e).

Synthesis of Exemplified Compound (1)

8.0 g of crude Compound (e) obtained above was dissolved in 40 ml of dimethylacetamide and 6 ml of pyridine, and then 4.3 g of morpholinocarbamoyl chloride was added, at 0° C. After stirring for 2 hours at room temperature, the resultant mixture was poured into 200 ml of diluted aqueous hydrochloric acid, and extraction with 200 ml of ethyl acetate was carried out. The organic phase was washed with water and then dried over magnesium sulfate; the solvent was distilled off under reduced pressure, and hexane was added to the residue, to carry out crystallization, to obtain 6.0 g of Exemplified Compound (1). The melting point of the thus-obtained Exemplified Compound (1) was 256 to 257° C.

[Synthetic Example 2: Synthesis of Exemplified Compound (25)]

In the synthesis of Compound (1), instead of morpholinocarbamoyl chloride, diallylcarbamoyl chloride, in an amount of 4.5 g, was added, and the resulting mixture was stirred at room temperature for 2 hours. After the reaction, the reaction mixture was poured into 200 ml of diluted aqueous hydrochloric acid, and extraction with 200 ml of ethyl acetate was carried out. After the organic phase was dried over magnesium sulfate, the solvent was distilled off under reduced pressure; then hexane was added to the residue, to carry out crystallization, to obtain the intended Exemplified Compound (25), in an amount of 5.5 g. The melting point of the thus-obtained Exemplified Compound (25) was 219 to 220° C.

In the present invention, other compounds can be synthesized in the similar manner as the above.

The amount to be added of the compound represented by formula (I) is preferably 1 to 300 mol %, more preferably 10 to 200 mol %, and most preferably 30 to 150 mol %, to the cyan coupler.

Preferably, the compound represented by formula (I) is contained in the layer containing the cyan coupler represented by formula (II).

In the present invention, the cyan dye-forming coupler represented by formula (1) (hereinafter referred to as the coupler represented by formula (1)) has excellent performance as a cyan coupler through the introduction of a strong electron-attracting group.

In formula (I), $R^{41}$ and $R^{42}$ each are an electron-attracting group whose Hammett substituent constant σp value is 0.20 or more, preferably 0.35 or more, and more preferably 0.6 or more, with the upper limit of the σp value being in the order of 1.0 or less. The sum of the σP values of $R^{41}$ and $R^{42}$ is 0.65 or more, and the upper limit is in the order of 1.8.

As a specific example of $R^{41}$ and $R^{42}$ that each are an electron-attracting group whose Up value is 0.20 to about 1.0, can be mentioned an acyl group, an acyloxy group, a carbamoyl group, an aliphatic oxycarbonyl group, an aryloxycarbonyl group, a cyano group, a nitro group, a dialkylphosphono group, a diarylphosphono group, a diarylphosphinyl group, an alkylsulfinyl, an arylsulfinyl group, an alkylsulfonyl group, an arylsulfonyl group, a sulfonyloxy group, an acylthio group, a sulfamoyl group, a thiocyanate group, a thiocarbonyl group, an alkyl group substituted by at least 2 halogen atoms, an alkoxy group substituted by at least 2 halogen atoms, an aryloxy group substituted by at least 2 halogen atoms, an alkylamino group substituted by at least 2 halogen atoms, an alkylthio group substituted by at least 2 halogen atoms, an aryl group substituted by another electron-attracting group whose σp value is 0.20 or more, a heterocyclic group, a chlorine atom, a bromine atom, an azo group, or a selenocyanate group. Out of these substituents, the groups that can be further substituted may further have the substituent(s) as mentioned below for $R^{43}$. The σp values of representative electron-attracting groups having a σp value of 0.2 to 1.0 represented by the above $R^{41}$ and $R^{42}$ are as follows: a bromine atom (0.23), a chlorine atom (0.23), a cyano group (0.66), a nitro group (0.78), a trifluoromethyl group (0.54), a tribromomethyl group (0.29), a trichloromethyl group (0.33), a carboxyl group (0.45), an acetyl group (0.50), a benzoyl group (0.43), an acetyloxy group (0.31), a trifluoromethanesulfonyl group (0.92), a methanesulfonyl group (0.72), a benzenesulfonyl group (0.70), a methanesulfinyl group (0.49), a carbamoyl group (0.36), a methoxycarbonyl group (0.45), an ethoxycarbonyl group (0.45), a phenoxycarbonyl group (0.44), a pyrazolyl group (0.37), a methanesulfonyloxy group (0.36), a dimethoxyphosphoryl group (0.60), a sulfamoyl group (0.57), and so on.

$R^{41}$ and $R^{42}$ in formula (1) preferably are an acyl group, an acyloxy group, a carbamoyl group, an alkoxycarbonyl group, an aryloxycarbonyl group, a cyano group, a nitro group, an alkylsulfinyl group, an arylsulfinyl group, an alkylsulfonyl group, an arylsulfonyl group, a sulfamoyl group, a halogenated alkyl group, a halogenated alkyloxy group, a halogenated alkylthio group, a halogenated aryloxy group, a halogenated aryl group, an aryl group substituted by two or more nitro groups, and a heterocyclic group. $R^{41}$ and $R^{42}$ in formula (1) are more preferably an acyl group, an alkoxycarbonyl group, an aryloxycarbonyl group, a nitro group, a cyano group, an arylsulfonyl group, a carbamoyl group, and a halogenated alkyl group, further preferably a cyano group, an alkoxycarbonyl group, an aryloxycarbonyl group, and a halogenated alkyl group, and particularly preferably a cyano group, an alkoxycarbonyl group, and an aryloxycarbonyl group.

As a combination of $R^{41}$ and $R^{42}$ in formula (1), preferably $R^{41}$ is a cyano group, while $R^{42}$ is a straight-chain, branched, or cyclic alkoxycarbonyl group, preferably a cyclic alkoxycarbonyl group.

Particularly preferably $R^{42}$ in formula (1) is an aliphatic oxycarbonyl group represented by formula (2):

formula (2)

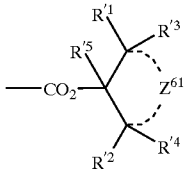

wherein, in formula (2), $R'^1$ and $R'^2$ each represent an aliphatic group (e.g., a straight-chain or branched-chain alkyl group, aralkyl group, alkenyl group, alkynyl group, cycloalkyl group, or cycloalkenyl group, having 1 to 36 carbon atoms), and specifically represent, for example, methyl, ethyl, propyl, isopropyl, t-butyl, t-amyl, t-octyl, tridecyl, cyclopentyl, and cyclohexyl. $R'^1$ and $R'^2$ each preferably represent an alkyl group (e.g., t-butyl) or a cyclohexyl group. $R'^3$, $R'^4$, and $R'^5$ each represent a hydrogen atom or an aliphatic group. The aliphatic group includes those listed for $R'^1$ and $R'^2$. $R'^3$, $R'^4$, and $R'^5$ each preferably represent a hydrogen atom.

In formula (2), $Z^{61}$ represents a group of non-metal atoms required to form a 5- to 8-membered ring, which ring may be a saturated ring or have a unsaturated bond. As preferable non-metal atoms, a nitrogen atom, an oxygen atom, a sulfur atom, and a carbon atom can be mentioned, and a carbon atom is more preferable. The ring formed by $Z^{61}$ may be substituted by a substituent, and as the substituent, those mentioned later as a substituent represented by $R^{43}$ in formula (1) can be applied.

In formula (2), as the ring formed by $Z^{61}$, for example, a cyclopentane ring, a cyclohexane ring, a cycloheptane ring, a cyclooctane ring, a cyclohexene ring, a piperazine ring, an oxane ring, and a thiane ring can be mentioned. $Z^{61}$ may be substituted by such a substituent(s) as represented by $R^{43}$ in formula (1) described below.

In formula (2), the ring formed by $Z^{61}$ is preferably an optionally substituted cyclohexane ring, and particularly preferably a cyclohexane ring whose 4-position is substituted by an alkyl group having 1 to 36 carbon atoms (that may be substituted by such a substituent as represented by $R^{43}$).

In formula (1), $R^{43}$ represents a substituent, and as the substituent, can be mentioned a halogen atom (e.g., a fluorine atom, a chlorine atom, and a bromine atom); an aliphatic group (e.g., a straight-chain or branched-chain alkyl group, aralkyl group, alkenyl group, alkynyl group, cycloalkyl group, and cycloalkenyl group, each having 1 to 36 carbon atoms, and specifically, for example, methyl, ethyl, propyl, isopropyl, t-butyl, tridecyl, t-amyl, t-octyl, 2-methanesulfonylethyl, 3-(3-pentadecylphenoxy)propyl, 3-{4-{2-[4-(4-hydroxyphenylsulfonyl)phenoxy] dodecanamido}phenyl}propyl, 2-ethoxytridecyl, trifluoromethyl, cyclopentyl, and 3-(2,4-di-t-amylphenoxypropyl); an aryl group (e.g., an aryl group having 6 to 36 carbon atoms, for example, phenyl, 4-t-butylphenyl, 2,4-di-t-amylphenyl, 4-tetradecanamidophenyl, and 2-methoxyphenyl); a heterocyclic group (e.g., a heterocyclic group having 1 to 36 carbon atoms, for example, 2-furyl, 2-thienyl, 2-pyrimidinyl, and 2-benzothiazolyl); a cyano group, a hydroxyl group, a nitro group, a carboxyl group, an amino group, an alkoxy group (e.g., a straight-chain, branched-chain or cyclic alkoxy group having 1 to 36 carbon atoms, for example, methoxy, ethoxy, buthoxy, 2-methoxyethoxy, 2-dodecyloxyethoxy, and 2-methanesulfonylethoxy); an aryloxy group (e.g., an aryloxy group having 6 to 36 carbon atoms, for example, phenoxy, 2-methylphenoxy, 4-t-butylphenoxy, 3-nitrophenoxy, 3-t-butyloxycarbamoylphenoxy, and 3-methoxycarbamoylphenoxy); an arylcarbonyloxy group (e.g., an arylcarbonyloxy group having 7 to 37 carbon atoms, for example, phenylcarbonyloxy); an acylamino group (e.g., an acylamino group having 2 to 36 carbon atoms, for example, acetamido, benzamido, tetradecanamido, 2-(2,4-di-t-amylphenoxy)butanamido, 4-(3-t-butyl-4-hydroxyphenoxy)butanamido, and 2-{4-(4-hydroxyphenylsulfonyl)phenoxy}decanamido); an alkylamino group (e.g., an alkylamino group having 1 to 36 carbon atoms, for example, methylamino, butylamino, dodecylamino, diethylamino, and methylbutylamino); an anilino group (e.g., an anilino group having 6 to 36 carbon atoms, for example, phenylamino, 2-chloroanilino, 2-chloro-5-tetradecanaminoanilino, 2-chloro-5-dodecyloxycarbonylanilino, N-acetylanilino, and 2-chloro-5-{2-(3-t-butyl-4-hydroxyphenoxy)dodecanamido}anilino); a ureido group (e.g., a ureido group having 2 to 36 carbon atoms, for example, phenylureido, methylureido, and N,N-dibutylureido); a sulfamoylamino group (e.g., a sulfamoylamino group having 1 to 36 carbon atoms, for example, N,N-dipropylsulfamoylamino and N-methyl-N-decylsulfamoylamino); an alkylthio group (e.g., an alkylthio group having 1 to 36 carbon atoms, for example, methylthio, octylthio, tetradecylthio, 2-phenoxyethylthio, 3-phenoxypropylthio, and 3-(4-t-butylphenoxy)propylthio); an arylthio group (e.g., an arylthio group having 6 to 36 carbon atoms, for example, phenylthio, 2-butoxy-5-t-octylphenylthio, 3-pentadecylphenylthio, 2-carboxyphenylthio, and 4-tetradecanamidophenylthio); an alkoxycarbonylamino group (e.g., an alkoxycarbonylamino group having 2 to 36 carbon atoms, for example, methoxycarbonylamino and tetradecyloxycarbonylamino); a sulfonamido group (e.g., an alkyl- or aryl-sulfonamido group having 1 to 36 carbon atoms, for example, methanesulfonamido, butanesulfonamido, octanesulfonamido, hexadecanesulfonamido, benzenesulfonamido, p-toluenesulfonamido, octadecanesulfonamido, and 2-methoxy-5-t-butylbenzenesulfonamido); a carbamoyl group (e.g., a carbamoyl group having 1 to 36 carbon atoms, for example, N-ethylcarbamoyl, N,N-dibutylcarbamoyl, N-(2-dodecyloxyethyl)carbamoyl, N-methyl-N-dodecylcarbamoyl, and N-{3-(2,4-di-t-amylphenoxy) propyl}carbamoyl); a sulfamoyl group (e.g., a sulfamoyl group having 1 to 36 carbon atoms, for example, N-ethylsulfamoyl, N,N-dipropylsufamoyl, N-(2-dodecyloxyethyl)sulfamoyl, N-ethyl-N-dodecylsulfamoyl, and N,N-diethylsulfamoyl); a sulfonyl group (e.g., an alkyl- or aryl-sulfonyl group having 1 to 36 carbon atoms, for example, methanesulfonyl, octanesulfonyl, benzenesulfonyl, and toluenesulfonyl); an alkoxycarbonyl group (e.g., an alkoxycarbonyl group having 2 to 36 carbon atoms, for example, methoxycarbonyl, butyloxycarbonyl, dodecyloxycarbonyl, and octadecyloxycarbonyl); a heterocyclic oxy group (e.g., a heterocyclic oxy group having 1 to 36 carbon atoms, for example, 1-phenyltetrazole-5-oxy and 2-tetrahydropyranyloxy), an azo group (e.g., phenylazo, 4-methoxyphenylazo, 4-pivaroylaminophenylazo, and 2-hydroxy-4-propanoylphenylazo); an acyloxy group (e.g., an acyloxy group having 2 to 36 carbon atoms, for example, acetoxy and heterocyclic acyloxy); a carbamoyloxy group (e.g., a carbamoyloxy group having 1 to 36 carbon atoms, for example, N-methylcarbamoyloxy and N-phenylcarbamoyloxy); a silyloxy group (e.g., a silyloxy group having 3 to 36 carbon atoms, for example, trimethylsilyloxy and dibutylmethylsilyloxy); an aryloxycarbonylamino group (e.g., an aryloxycarbonylamino group having 7 to 36 carbon atoms, for example, phenoxycarbonylamino); an imido group (e.g., an imido group having 4 to 36 carbon atoms, for example, N-succinimido, N-phthalimido, and 3-octadecenylsuccinimido); a heterocyclic thio group (e.g., a heterocyclic thio group having 1 to 36 carbon atoms, for example, 2-benzothiazolylthio, 2,4-di-phenoxy-1,3,5-tirazole-6-thio, and 2-pyridylthio); a sulfinyl group (e.g., a sulfinyl group having 1 to 36 carbon atoms, for example, dodecanesulfinyl, 3-pentadecylphenylsulfinyl, and 3-phenoxypropylsulfinyl); an alkyloxycarbonyl, aryloxycarbonyl, or heterocyclic oxycarbonyl group (e.g., methoxycarbonyl, butoxycarbonyl, dodecyloxycarbonyl, octadecyloxycarbonyl, phenyloxycarbonyl, and 2-pentadecyloxycarbonyl); an alkyloxycarbonylamino, aryloxycarbonylamino, or heterocyclic oxycarbonylamino group (e.g., methoxycarbonylamino, tetradecyloxycarbonylamino, phenoxycarbonylamino, and 2,4-di-tert-butylphenoxycarbonylamino); a sulfonamido group (e.g., methanesulfonamido, hexadecanesulfonamido, benzenesulfonamido, p-toluenesulfonamido, octadecanesulfonamido, and 2-methoxy-5-tert-butylbenzenesulfonamido); a carbamoyl group (e.g., N-ethylcarbamoyl, N,N-dibutylcarbamoyl, N-(2-dodecyloxyethyl)carbamoyl, N-methyl-N-dodecylcarbamoyl, and N-[3-(2,4-di-tert-amylphenoxy) propyl]carbamoyl); a sulfamoyl group (e.g., N-ethylsufamoyl, N,N-dipropylsulfamoyl, N-(2-dodecyloxyethyl)sulfamoyl, N-ethyl-N-dodecylsulfamoyl, and N,N-diethylsulfamoyl); a phosphonyl group (a phosphonyl group having 1 to 36 carbon atoms, e.g., phenoxyphosphonyl, octyloxyphosphonyl, and phenylphosphonyl); a sulfamido group (e.g., dipropylsulfamoylamino); an imido group (e.g., N-succinimido, hydantoinyl, N-phthalimido, and 3-octadecenylsuccinimido); an azolyl group (e.g., imidazolyl, pyrazolyl, 3-chloro-pyrazol-1-yl, and triazolyl), a hydroxyl group, a cyano group, a carboxyl group, a nitro group, a sulfo group, an unsubstituted amino group, etc.

In formula (1), as $R^{43}$, preferably can be mentioned an alkyl group, an aryl group, a heterocyclic group, a cyano group, a nitro group, an acylamino group, an arylamino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, an aryoxycarbonyl group, a heterocyclic oxy group, an acyloxy group, a carbamoyloxy group, an aryloxycarbonylamino group, an imido group, a heterocyclic thio group, a sulfinyl group, a phosphonyl group, and azolyl group.

In formula (1), $R^{43}$ is more preferably an alkyl group and an aryl group, and further preferably a substituted-aryl group.

In formula (1), $X^{43}$ represents a hydrogen atom, or a group capable of being split-off upon the reaction of the coupler represented by formula (1) with the oxidized product of an aromatic primary amine color-developing agent (hereinafter referred to as "the split-off group"). Examples of the split-off group include a halogen atom, an aryloxy group, an alkylacyloxy, arylacyloxy, substituted-amino acyloxy, or heterocyclic acyloxy group, an alkylsulfonyloxy, arylsulfonyloxy, or heterocyclic sulfonyloxy group, a dialkylphosphonooxy or diarylphosphonooxy group, an alkoxycarbonyloxy group, an aryloxycarbonyloxy group, a heterocyclic oxycarbonyloxy group, a carbamoyloxy group, an alkylsulfonyl, arylsulfonyl, or heterocyclic sulfonyl group, an alkylsulfinyl, arylsulfinyl, or heterocyclic sulfinyl group, an alkylthio, arylthio, or heterocyclic thio group, an imido group, an azo group, and a 5- or 6-membered nitrogen-containing heterocyclic group that bonds to the coupling site at the nitrogen atom. The alkyl moiety, aryl moiety, or heterocyclic moiety contained in these split-off groups may be substituted by a substituent(s) mentioned as $R^3$. When there are two or more such substituents, they are the same or different.

More specifically, examples of the split-off group include a fluorine atom, a chlorine atom, a bromine atom, an aryloxy group having 6 to 30 carbon atoms (e.g. 4-methylphenoxy, 4-chlorophenoxy, 4-methoxyphenoxy, 2-methoxyphenoxy, 4-ethoxycarbonylphenoxy, and 3-acetylaminophenoxy), an alkyl- or heterocyclic-acyloxy group having 2 to 30 carbon atoms (e.g. acetoxy, tetradecanoyloxy, and morpholinocarbonyloxy), an alkyl-, aryl-, or heterocyclic-sulfonyloxy group having 1 to 30 carbon atoms (e.g. methansulfonyloxy, and toluenesulfonyloxy), a dialkyl- or diarylphosphonoxy group having 1 to 30 carbon atoms (e.g. diethylphosphonoxy, and diphenylphosphonoxy), an alkoxycarbonyloxy group having 2 to 30 carbon atoms (e.g. ethoxycarbonyloxy and (i)-butoxycarbonyloxy), an arylcarbonyloxy group having 6 to 40 carbon atoms (e.g. benzoyloxy, 2,6-dichlorobezoyloxy, and 4-octadecyloxybenzoyloxy), an aryloxycarbonyloxy group having 6 to 40 carbon atoms (e.g. phenoxycarbonyloxy), a carbamoyloxy group having 1 to 30 carbon atoms (e.g. diehylcarbamoyloxy, diallylcarbamoyloxy), an alkyl-, aryl-, or heterocyclic-sulfonyl group having 1 to 30 carbon atoms (e.g. methanesulfonyloxy and toluenesulfonyloxy), an alkyl-, aryl- or heterocyclic sulfinyl group having 1 to 30 carbon atoms (e.g. phenylsulfinyl), an alkylthio, arylthio, or heterocyclic thio group having 1 to 30 carbon atoms (e.g. ethylthio, 2-butoxy-5-t-octylphenylthio, and tetrazolylthio), a heterocyclic oxy group (e.g. pyrimidinoxy, and triazinoxy), imidazolyl, pyrazolyl, triazolyl, 2-dihydro-2-oxo-l-pyridyl, phenylazo, and 4-methoxyphenylazo. The split-off group may contain a photographically useful group, such as a development inhibitor and a development accelerator.

In formula (1), preferably $X^{41}$ is a hydrogen atom, a halogen atom, an aryloxy group, a heterocyclic acyloxy group, dialkylphosphonoxy group, an arylcarbonyloxy group, an arylsulfonyloxy group, an alkoxycarbonyloxy group, or a carbamoyloxy group. More preferably $X^{41}$ is a hydrogen atom, a halogen atom, a heterocyclic-acyloxy group, an arylcarbonyloxy group, or a carbamoyloxy group, and particularly preferably a heterocyclic-acyloxy group, an arylcarbonyloxy group, or a carbamoyloxy group.

In formula (1), $Y^{41}$ represents a hydrogen atom or a substituent. The substituent is preferably a group capable of being split-off upon the coupling reaction of the coupler represented by formula (1) with the oxidized product of a developing agent, such as a group capable of being split-off under alkali conditions described, for example, in JP-A-61-228444, and a substituent capable of coupling split-off upon the reaction with a developing agent, as described in JP-A-56-133734. Preferably $Y^{41}$ represents a hydrogen atom.

With respect to the coupler represented by formula (1), the group represented by $R^{41}$, $R^{42}$, $R^{43}$ or $X^{41}$ may include a residue of the coupler represented by formula (1), to form a dimer or a higher polymer, or the group represented by $R^{41}$, $R^{42}$, $R^{43}$ or $X^{41}$ may include a polymer chain, to form a homopolymer or a copolymer. The homopolymer or copolymer including a polymer chain is typically a homopolymer or a copolymer (an addition polymer) of an ethylenically unsaturated compound having a residue of a coupler represented by formula (1). In this case, the polymer may contain one or more types of the cyan color-forming repeating unit having the residue of the coupler represented by formula (1), and the copolymer may be a copolymer containing one or more types of non-color-forming ethylenically monomer that does not couple with the oxidized product of an aromatic primary amine developing agent, such as acrylates, methacrylates, and maleates, as a copolymer component.

Specific examples of the coupler represented by formula (1) include the above Exemplified Compounds (1), (2), (4) to (6), (8), (9), (11) to (22), and (24) to (32), and the following Exemplified Compounds C-1 to C-26, but the present invention is not limited to them.

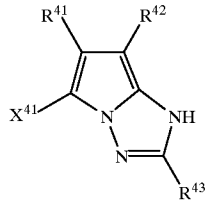
| No. | $R^{41}$ | $R^{42}$ | $R^{43}$ | $X^{41}$ |
|---|---|---|---|---|
| C-1 | CN | 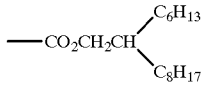 | 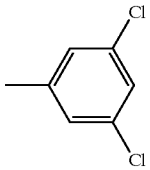 | H |
| C-2 | CN | 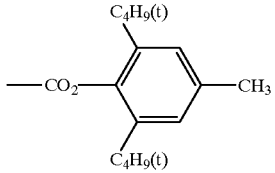 | 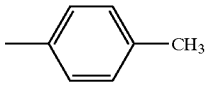 | Cl |
| C-3 | CN | 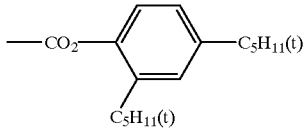 | 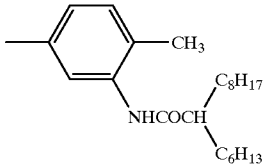 | 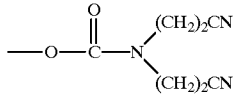 |
| C-4 | CN | 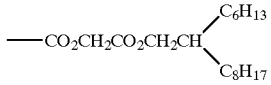 | 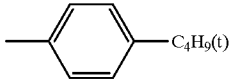 | H |

-continued
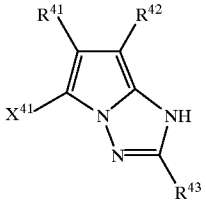
| No. | $R^{41}$ | $R^{42}$ | $R^{43}$ | $X^{41}$ |
|---|---|---|---|---|
| C-5 | CN | 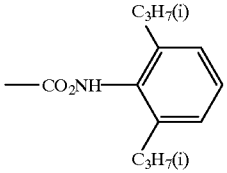 | 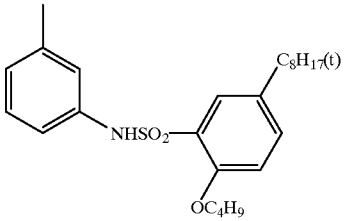 | 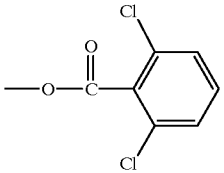 |
| C-6 | CN | 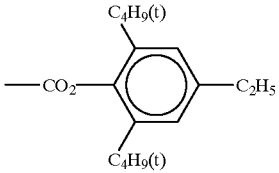 | 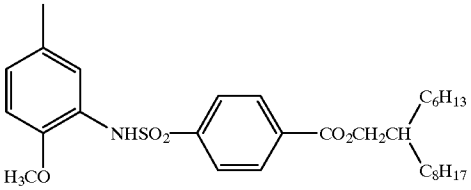 | 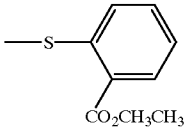 |
| C-7 | CN | 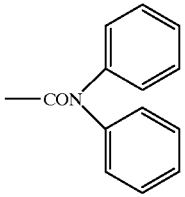 | 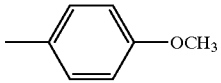 | 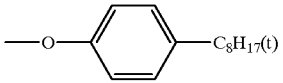 |

-continued
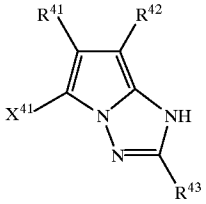
| No. | $R^{41}$ | $R^{42}$ | $R^{43}$ | $X^{41}$ |
|---|---|---|---|---|
| C-8 | CN | 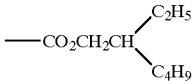 | 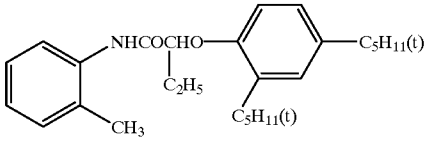 | 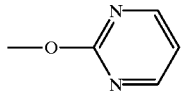 |
| C-9 | $CF_3$ | 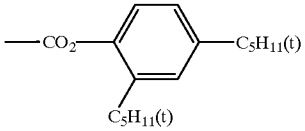 | 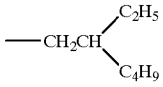 | 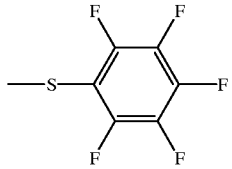 |
| C-10 | CN | 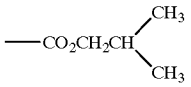 | 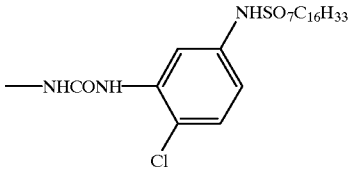 | 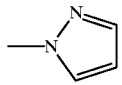 |
| C-11 | CN | 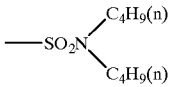 | 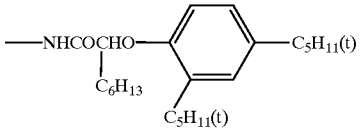 | 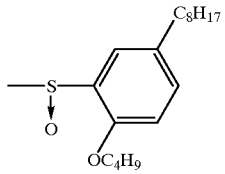 |

-continued
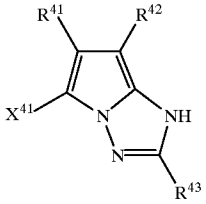
| No. | $R^{41}$ | $R^{42}$ | $R^{43}$ | $X^{41}$ |
|---|---|---|---|---|
| C-12 | CN | $-CO_2CH_2CH(C_8H_{17})(C_6H_{13})$ | 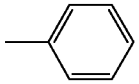 | H |
| C-13 | 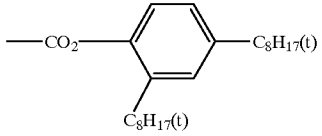 | CN | 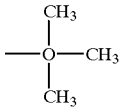 | 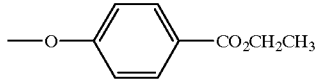 |
| C-14 | $-CO_2CH_2C_6F_{13}$ | CN | 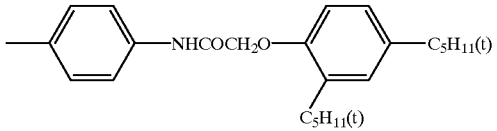 | Cl |
| C-15 | 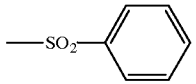 | 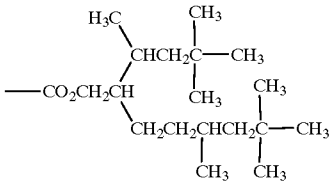 | $-CH_3$ | $-OCOCH_3$ |

-continued
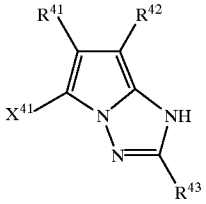
| No. | $R^{41}$ | $R^{42}$ | $R^{43}$ | $X^{41}$ |
|---|---|---|---|---|
| C-16 | CN | 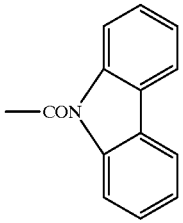 | 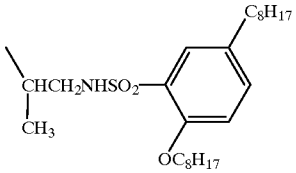 | 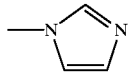 |
| C-17 | CN | 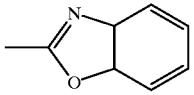 | 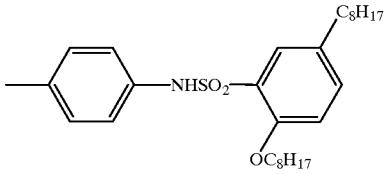 | 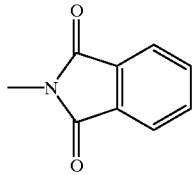 |
| C-18 | CN | $CF_3$ | 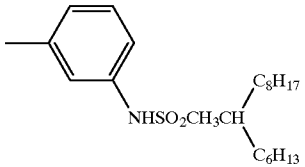 | Cl |
| C-19 | 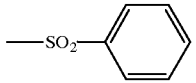 | $CF_3$ | 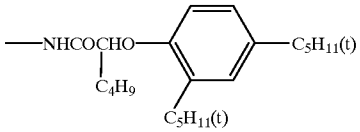 | F |

-continued
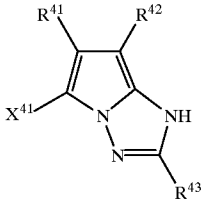
| No. | $R^{41}$ | $R^{42}$ | $R^{43}$ | $X^{41}$ |
|---|---|---|---|---|
| C-20 | CN | 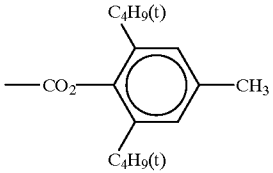 | 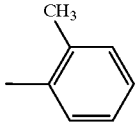 | 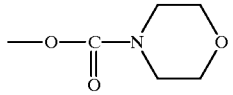 |
| C-21 | CN | 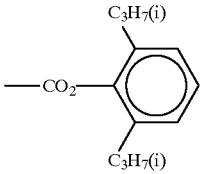 | 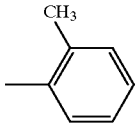 | 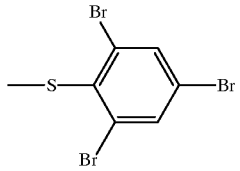 |
| C-22 | CN | 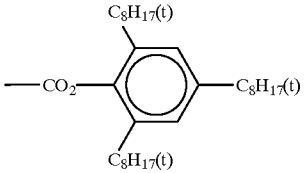 | 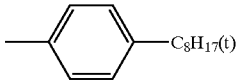 | 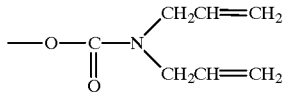 |

(C-23)
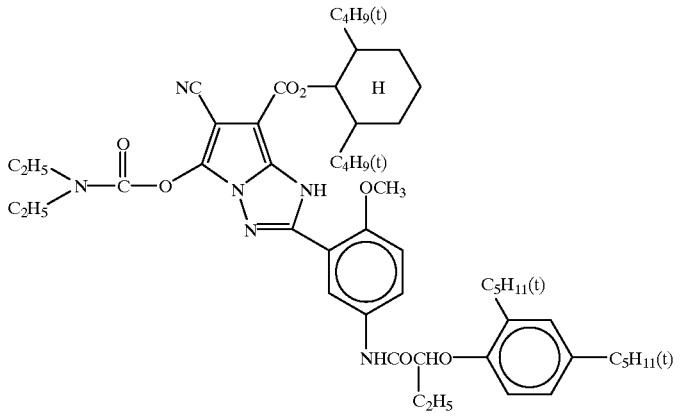
(C-24)
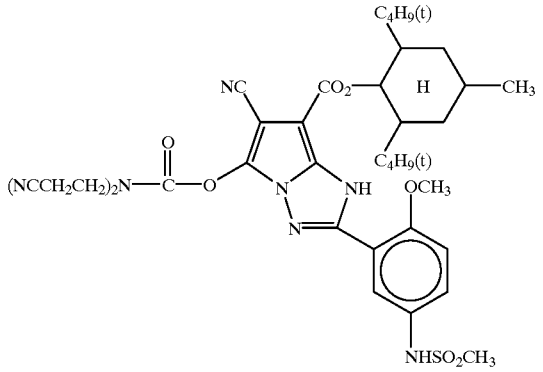
(C-25)
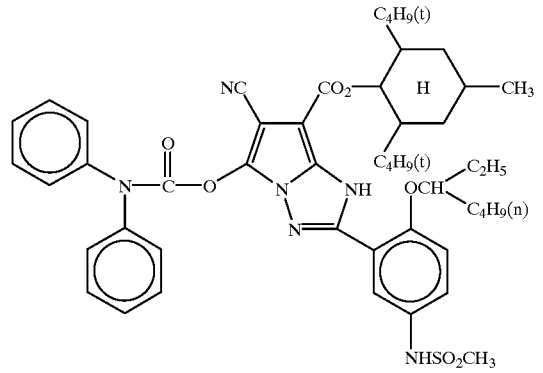
(C-26)
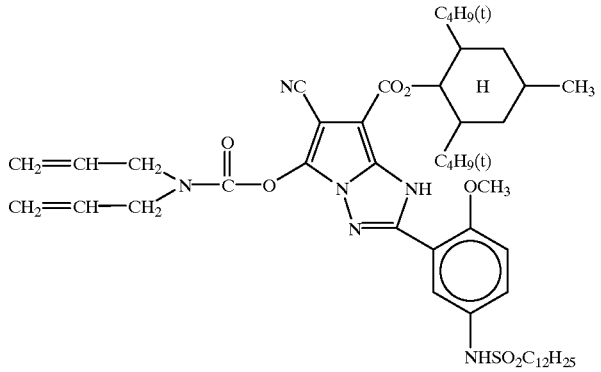
Hereinbelow, the compound represented by formula (B) is described in detail.

In the present invention, the compound represented by formula (B) is a phenol-series cyan coupler, and a carbostyryl-series cyan coupler that includes a 5- to 7-membered ring formed by bonding $R^{52}$ and $X^{51}$ is also preferable, and as the above condensed ring-type cyan coupler, an oxyindole-series cyan coupler and an imidazole-2-one-series cyan coupler are particularly preferable.

In formula (B), $R^{51}$ represents a chain or cyclic aliphatic group preferably having 1 to 32 carbon atoms (e.g., methyl, butyl, pentadecyl, and cyclohexyl), an aromatic group (e.g., phenyl and naphthyl), a heterocyclic group (e.g., 2-pyridyl, 3-pyridyl, 2-furanyl, and 2-oxazolyl), or an amino group.

The group represented by $R^{51}$ is preferably substituted by a substituent(s). Examples of the substituent include an alkyl group, an aryl group, an alkyloxy or aryloxy group (e.g., methoxy, dodecyloxy, methoxyethoxy, phenyloxy, 2,4-di-tert-amylphenoxy, 3-tert-butyl-4-hydroxyphenyloxy, and naphthyloxy), a carboxyl group, an alkylcarbonyl or arylcarbonyl group (e.g., acetyl, tetradecanoyl, and benzoyl), an alkyloxycarbonyl or aryloxycarbonyl group (e.g., methoxycarbonyl, benzyloxycarbonyl, and phenoxycarbonyl), an acyloxy group (e.g., acetyl, benzoyloxy, and phenylcaronyloxy), a sulfamoyl group (e.g., N-ethylsulfamoyl and N-octadecylsulfamoyl), a carbamoyl group (e.g., N-ethylcarbamoyl and N-methyl-dodecylcarbamoyl), a sulfonamido group (e.g., methanesulfonamido and benzenesulfonamido), an acylamino group (e.g., acetylamino, benzamido, ethoxycarbonylamino, and phenylaminocarbonylamino), an imido group (e.g., succinimido and hydantoinyl), a sulfonyl group (e.g., methanesulfonyl), a hydroxyl group, a cyano group, a nitro group, and a halogen atom.

In formula (B), $R^{52}$ represents an alkyl group having 1 to20 carbon atoms (e.g., methyl, ethyl, butyl, and pentadecyl) or an acylamino group (e.g., tetradecanoylamino, benzoylamino, and 2-(2,4-di-tert-amylphenoxy)butanamido).

In formula (B), $X^{51}$ represents a hydrogen atom, a halogen atom, an aliphatic group (e.g., methyl, propyl, and allyl), an alkoxy group (e.g., methoxy and butoxy), or an acylamino group (e.g., acetamido).

In formula (B), $Y^{51}$ represents —NHCO— or —CONH—.

In formula (B), $Z^{51}$ represents a hydrogen atom or a group capable of being split-off upon coupling reaction with the oxidized product of a developing agent (hereinafter referred to as "a split-off group"). Examples of the split-off group include a halogen atom (e.g., a fluorine atom, a chlorine atom, and a bromine atom), an alkoxy group (e.g., ethoxy, dodecyloxy, methoxycarbamoylmethoxy, carboxypropyloxy, and methylsulfonylethoxy), an aryloxy group (e.g., 4-chlorophenoxy, 4-methoxyphenoxy, and 4-carboxyphenoxy), an acyloxy group (e.g., acetoxy, tetradecanoyloxy, and benzoyloxy), a sulfonyloxy group (e.g., methanesulfonyloxy and toluenesulfonyloxy), an amido group (e.g., dichloroacetylamino, heptabutyrylamino, methanesulfonylamino, and toluenesulfonylamino), an alkoxycarbonyloxy group (e.g., ethoxycarbonyloxy and benzyloxycarbonyloxy), an aryloxycarbonyloxy group (e.g., phenoxycarbonyloxy), an aliphatic or aromatic thio group (e.g., ethylthio, phenylthio, and tetrazolylthio), an imido group (e.g., succinimido and hydantoinyl), an N-heterocyclic group (e.g., 1-pyrazolyl and 1-benztriazolyl), and an aromatic azo group (e.g., phenylazo). These split-off groups may contain a photographically useful component, such as a development inhibitor and a development accelerator.

In formula (B), $R^{52}$ and $X^{51}$ may bond together, to form a 5- to 7-membered ring.

In formula (B), in view of hue and fading prevention, $R^{52}$ is preferably an alkyl group having 1 to 15 carbon atoms, and more preferably an alkyl group having 1 to 4 carbon atoms. $X^{51}$ is preferably a halogen atom. $Z^{51}$ is preferably a hydrogen atom or a halogen atom, with particular preference given to a halogen atom.

Specific examples (B-1 to B-54) of the compound represented by formula (B) are shown below, but the present invention is not limited to these specific examples.

(B-1)

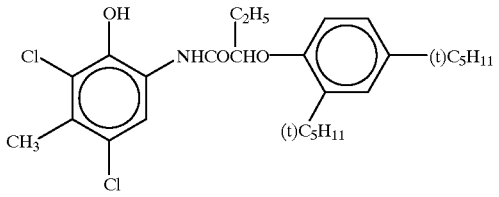

(B-2)

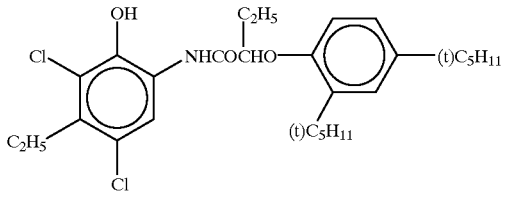

(B-3)

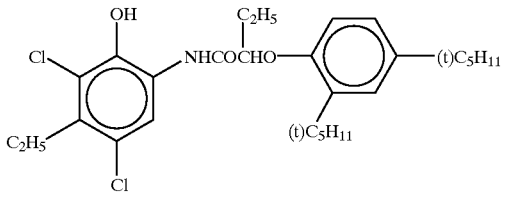

(B-4)

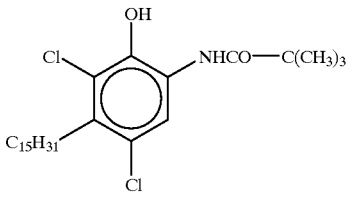

(B-5)

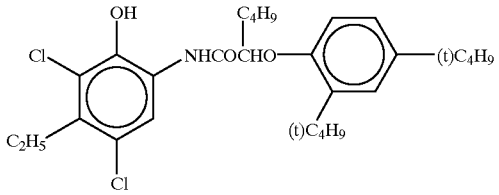

(B-6)

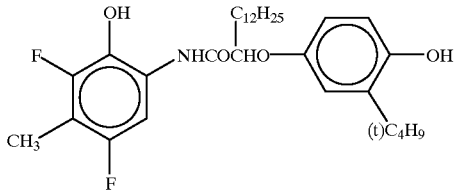

-continued
(B-7)
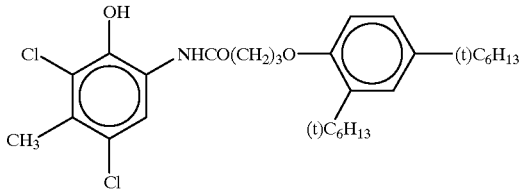
(B-8)
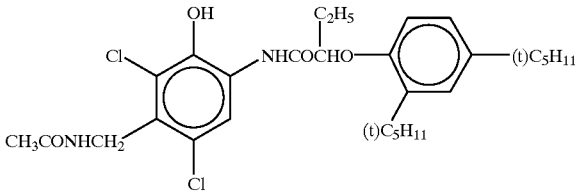
(B-9)
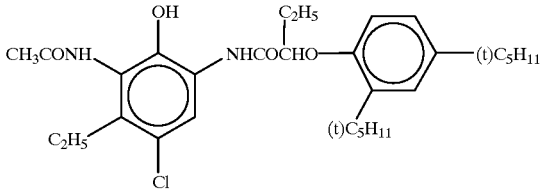
(B-10)
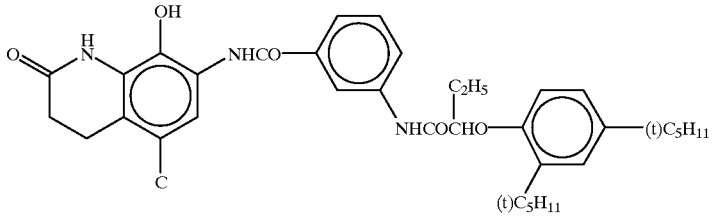
(B-11)
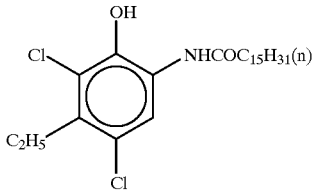
(B-12)
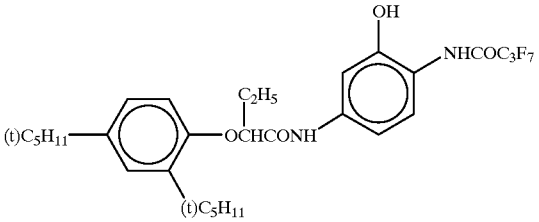
(B-13)
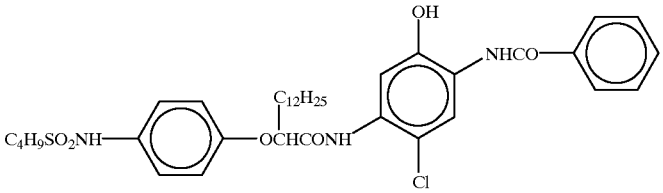
(B-14)
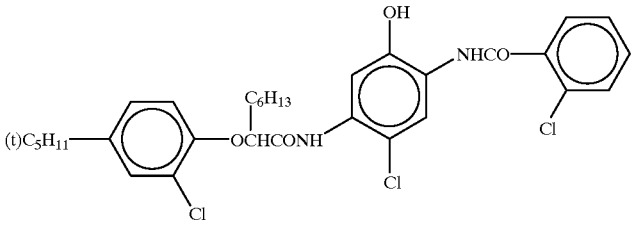

-continued
(B-15)
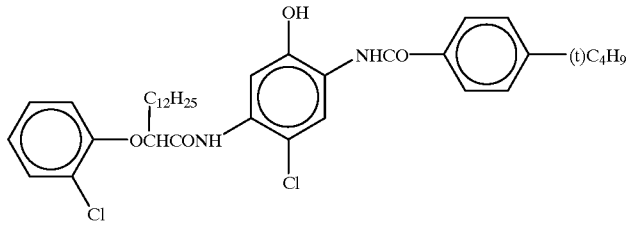
(B-16)
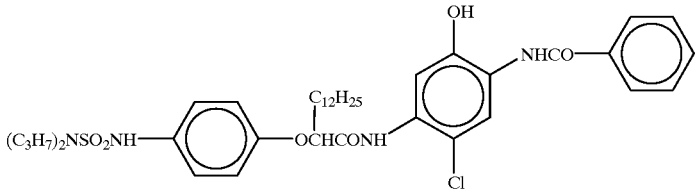
(B-17)
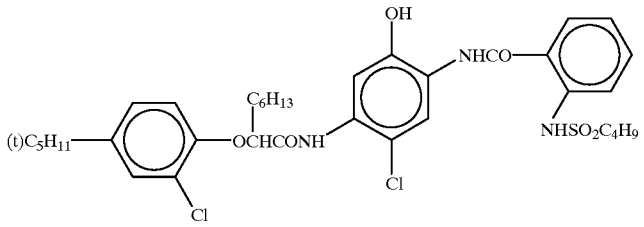
(B-18)
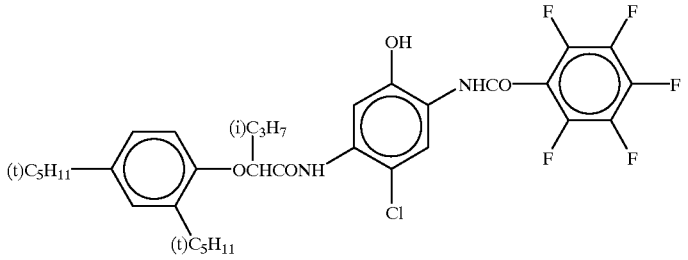
(B-19)
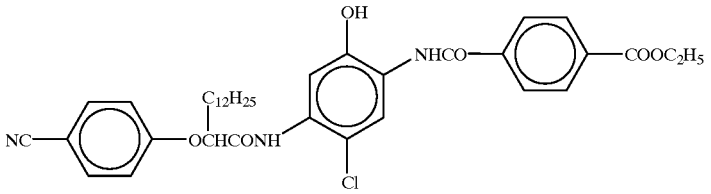
(B-20)
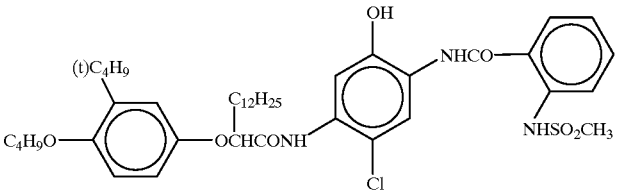

-continued
(B-21)
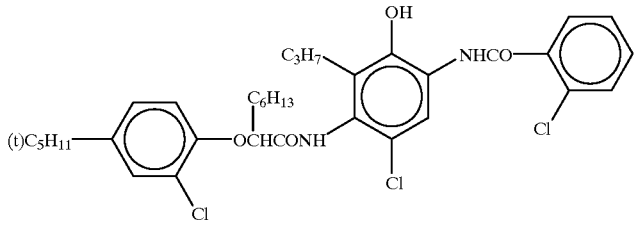
(B-22)
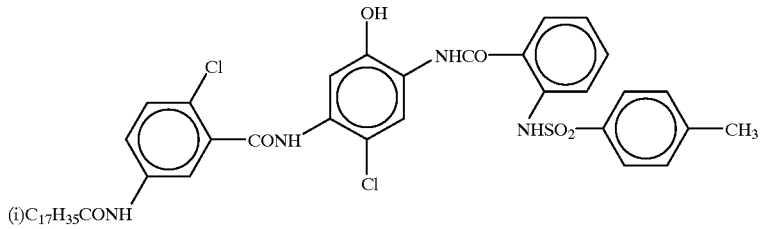
(B-23)
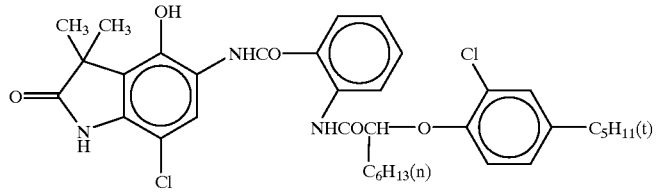
(B-24)
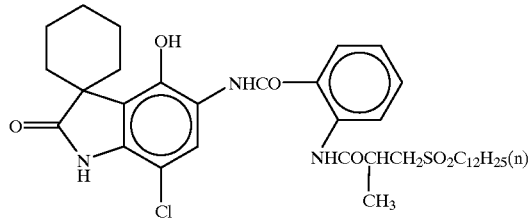
(B-25)
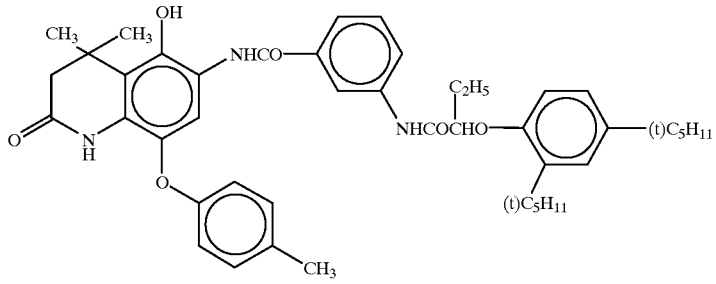
(B-26)
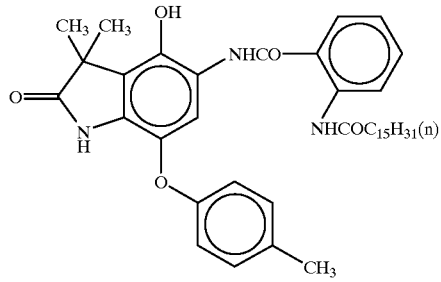
(B-27)
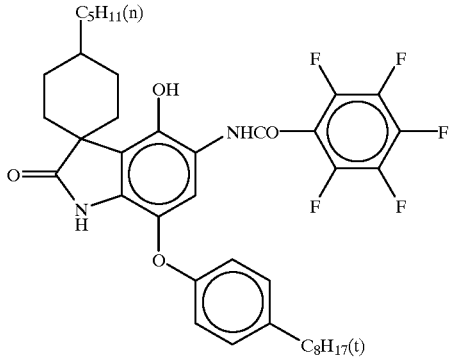

-continued
(B-28)
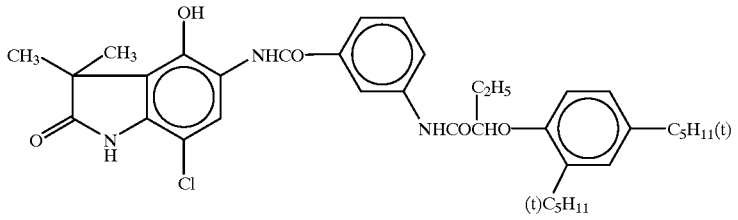
(B-29)
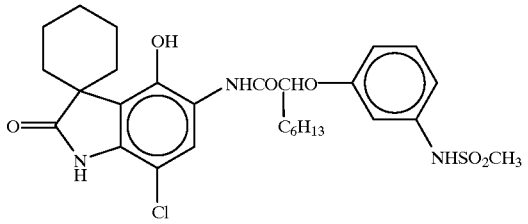
(B-30)
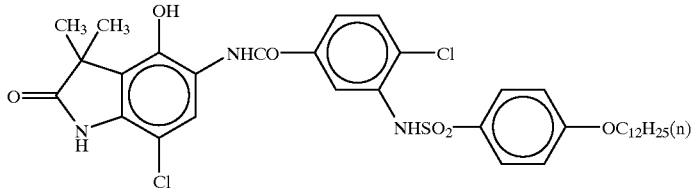
(B-31)
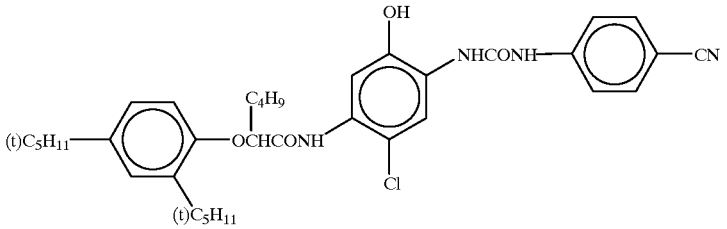
(B-32)
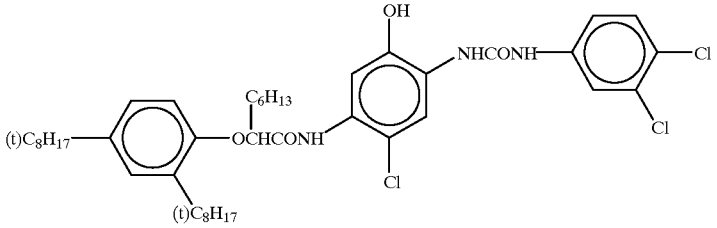
(B-33)
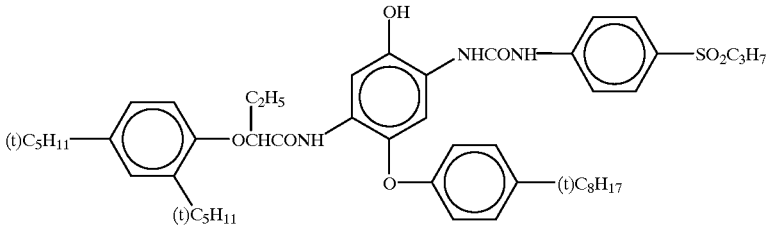

-continued
(B-34)
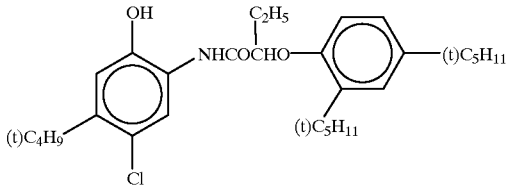
(B-35)
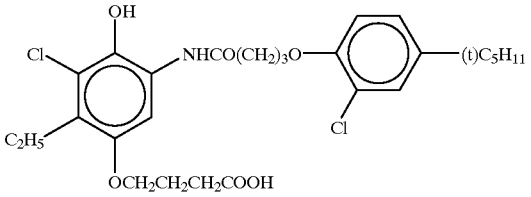
(B-36)
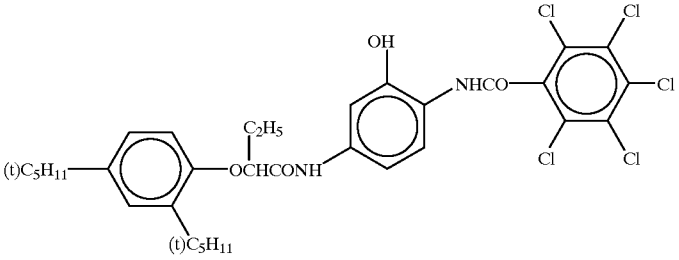
(B-37)
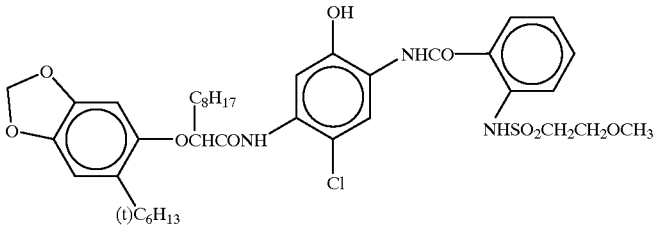
(B-38)
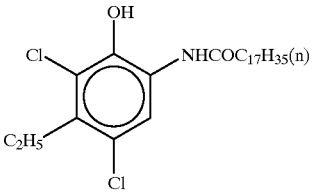
(B-39)
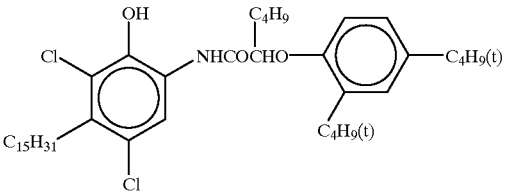
(B-40)
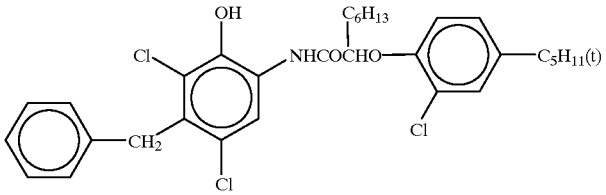
(B-41)
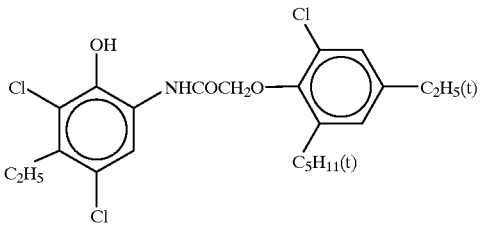
(B-42)
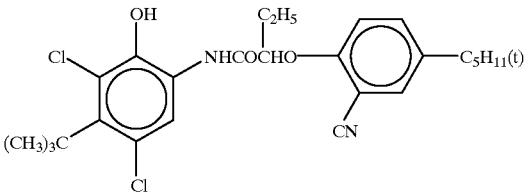
(B-43)
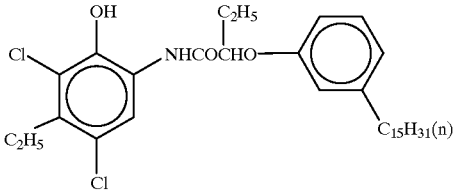

-continued
(B-44)
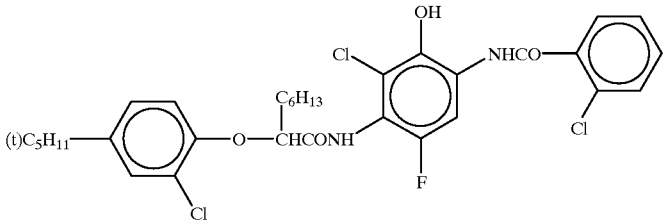
(B-45)
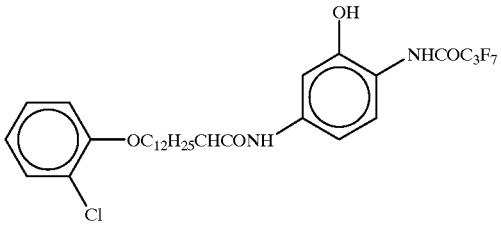
(B-46)
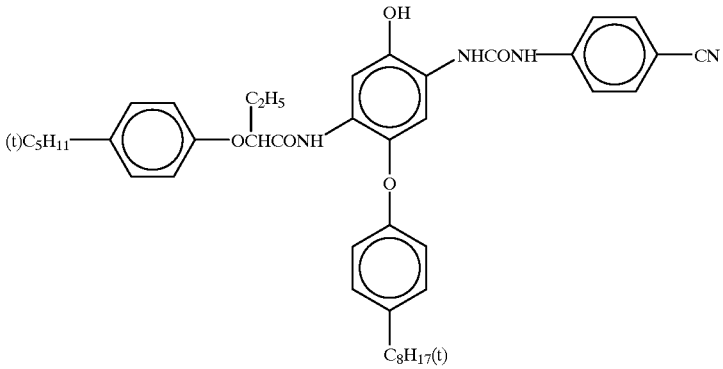
(B-47)
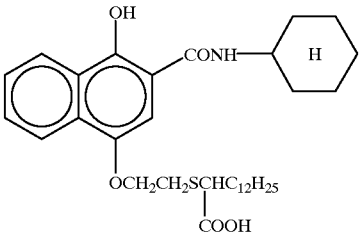
(B-48)
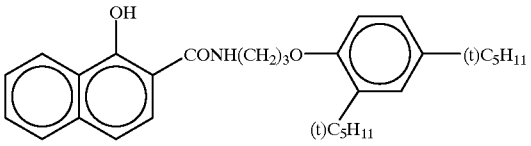
(B-49)
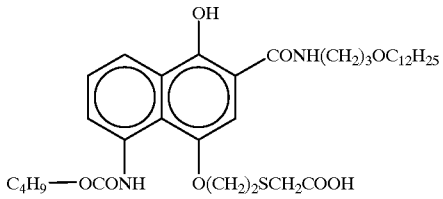
(B-50)
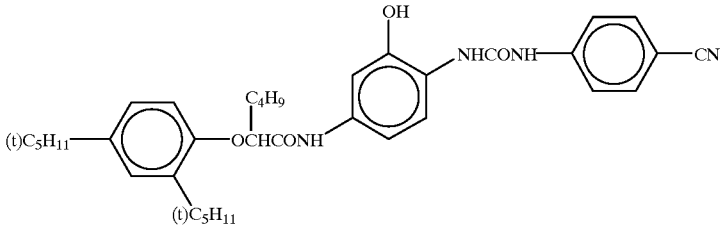

-continued (B-51)

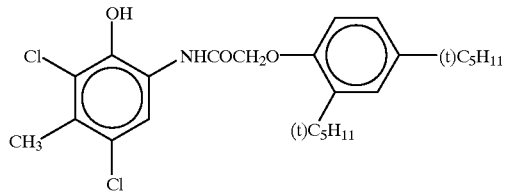

(B-52)

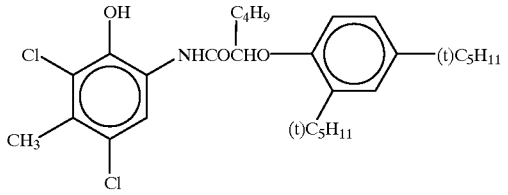

(B-53)

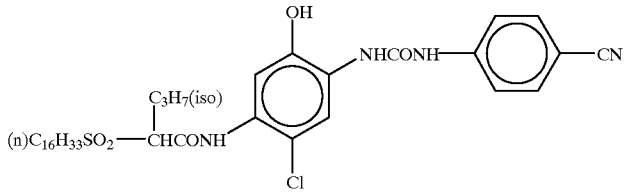

(B-54)

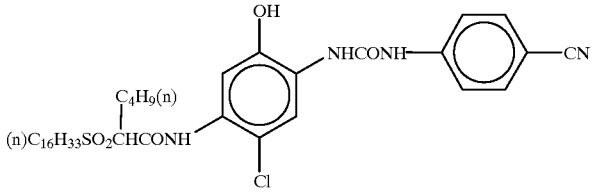

In the present invention, the compounds represented by formula (B) can be easily synthesized by the similar method for synthesizing, for example, 2-acylamino-5-alkylphenol-series couplers, as described in U.S. Pat. Nos. 2,369,929, 2,801,171, 2,772,162, 2,895,826, and 3,772,002; 2,5-diacylaminophenol-series couplers, as described in U.S. Pat. Nos. 2,772,162, 3,758,308, 4,126,396, 4,334,011, and 4,327,173, West Germany Patent Publication No. 3,329,729, and JP-A-59-166956; and 2-phenylureido-5-acylaminophenol-series couplers, as described in U.S. Pat. Nos. 3,446,622, 4,333,999, 4,451,559, and 4,427,767.

In the present invention, the amount of the coupler represented by formula (1) to be used is preferably 0.35 to 0.80 mmol/$m^2$, and more preferably 0.4 to 0.6 mmol/$m^2$, in the case of a four-equivalent coupler, wherein the split-off group is a hydrogen atom, and it is preferably 0.18 to 0.4 mmol/$m^2$, and more preferably 0.20 to 0.35 mmol/$m^2$, in the case of a two-equivalent coupler.

In the present invention, the amount of the compound represented by formula (I) to be used is preferably 5 to 400%, more preferably 30 to 300%, and particularly preferably 50 to 200%, to the weight of the coupler represented by formula (1). If the amount to be used is too large, the hue becomes easily deteriorated, and since the oil-soluble component increases, the film thickness of the light-sensitive material becomes thick, easily leading to such a problem as the deterioration of processability, unpreferably.

In the present invention, the amount of the compound represented by formula (B) to be used is preferably 1 to 160%, more preferably 2 to 80%, and particularly preferably 5 to 60%, to the weight of the coupler represented by formula (1). If the amount to be used is too large, the hue is inclined to be deteriorated.

In the present invention, the weight ratio of the used amount of the compound represented by formula (B) to the compound represented by formula (I) is preferably from 1/10 to 2/1, and more preferably from 3/10 to 1/1.

The light-sensitive material of the present invention is preferably improved in fastness to light by incorporating the cyan coupler represented by formula (C) therein.

Now, formula (C) is described in detail. $Y^{11}$ represents —NHCO— or —CONH—. $R^{31}$ represents an aliphatic group, an aryl group, a heterocyclic group, or a substituted or unsubstituted amino group. The aliphatic group is preferably a substituted or unsubstituted alkyl group, alkenyl group, cycloalkyl group, or cycloalkenyl group. The substituent that substitutes the aliphatic group includes those listed as examples of the substituent described for $R^3$ of formula (II).

Preferably the aryl group is a substituted or unsubstituted aryl group having 6 to 20 carbon atoms. Specific examples of the substituent include those listed as examples of the substituent described for $R^3$. Preferably the heterocyclic group is a substituted or unsubstituted heterocyclic group having 3 to 20 carbon atoms. Specific examples of the heterocyclic group includes those listed as examples of the substituent described for $R^3$.

Preferably, the amino group is a substituted or unsubstituted amino group having 3 to 20 carbon atoms. Specific examples are a dioctylamino group and a group having the following structure:

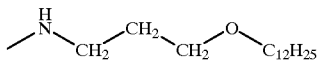

-continued

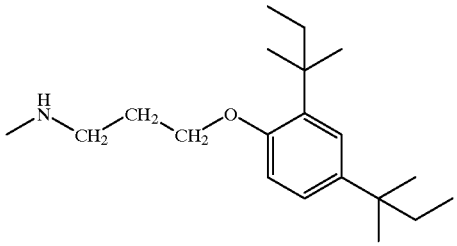

$X^{11}$ represents a hydrogen atom, a halogen atom, an alkoxy group, or an acylamino group. The halogen atom is preferably a chlorine atom or a bromine atom. The alkoxy group is preferably a substituted or unsubstituted alkoxy group having 1 to 30 carbon atoms. The acylamino group is preferably a substituted or unsubstituted acylamino group having 2 to 30 carbon atoms. Preferably $X^{11}$ is a chlorine atom or a hydrogen atom.

$R^{32}$ represents an alkyl group or an acylamino group, or $X^{11}$ and $R^{32}$ together represent a group of nonmetallic atoms to form a 5- to 7-membered ring. The alkyl group is preferably an unsubstituted alkyl group having 1 to 5 carbon atoms, with more preference given to a methyl group and an ethyl group. The acylamino group is preferably a substituted or unsubstituted acylamino group having 2 to 30 carbon atoms.

$Z^{11}$ represents a hydrogen atom or a group capable of split-off upon coupling with the oxidized product of a developing agent. $Z^{11}$ is preferably a chlorine atom.

Preferable specific compound examples of the cyan coupler represented by formula (C) include Compound Examples (C-1) to (C-54) described in JP-A-9-288337, pages 17 to 26. Among them, preferable examples include the above Exemplified Compounds (B-1), (B-2), (B-3), (B-11) and (B-52), and the following compounds.

1.

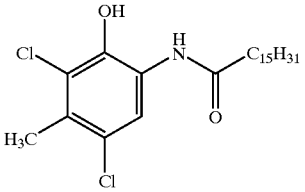

2.

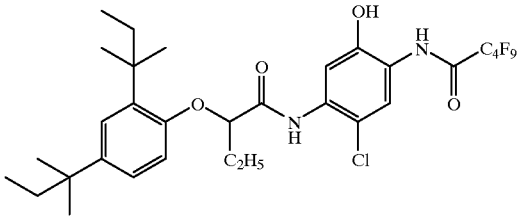

3.

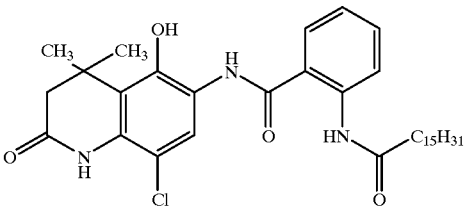

The compound represented by formula (C) is, generally, added to the layer containing the cyan coupler represented by formula (II), and its amount to be used is in the range of generally 1 to 50 mol %, preferably 5 to 40 mol %, and more preferably 10 to 30 mol %, to the cyan coupler of formula (II).

If the amount to be used of the cyan coupler of formula (C) is too large, the magenta color reproduction, color forming property, and processing stability are deteriorated, and in particular a phenomenon (blix discoloration) occurs wherein the color forming property is lowered by the change of the dye to a leuco dye when bleach-fixing is carried out. This phenomenon is improved by the addition of the above polymer compound represented by formula (L).

Next, the compound represented by the following formula (3) for use in the present invention is described in detail.

formula (3)

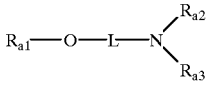

wherein, in formula (3), L represents a single bond or an arylene group (preferably having 6 to 36 carbon atoms, for example, phenylene and naphtylene). $R_{a1}$, $R_{a2}$, and $R_{a3}$, which are the same or different, each represent an alkyl group (preferably a straight-chain, branched-cahin, or cyclic alkyl group having 1 to 36 carbon atoms, for example, methyl, ethyl, isopropyl, t-butyl, cyclohexyl, octyl, sec-octyl, t-octyl, decyl, dodecyl, i-tridecyl, tetradecyl, hexadecyl, and octadecyl), an alkenyl group (preferably a straight-chain, branched-chain, or cyclic alkenyl group having 2 to 36 carbon atoms, for example, vinyl, allyl, cyclohexenyl, oleyl), an aryl group (preferably having 6 to 36 carbon atoms, for example, phenyl and naphtyl), or a heterocyclic group (preferably, a 5- to 7-membered heterocyclic group having 0 to 36 carbon atoms, and containing at least one of N, O, S, and P as a ring constituting atom, e.g., thienyl, furyl, pyranyl, pyrrolyl, imidazolyl, indolyl, chromanyl, and piperidinyl). When L is a single bond, $R_{a1}$ may also represent a radical (•) $R_{a3}$ may also represent a hydrogen atom. $R_{a1}$ and L, $R_{a2}$ and L, $R_{a3}$ and L, $R_{a1}$ and $R_{a2}$, $R_{a1}$ and $R_{a3}$, and $R_{a2}$ and $R_{a3}$, each pair may bond together, to form a 5- to 7-membered ring.

Each of the groups in formula (3) may be substituted by a substituent(s), and, as the substituent, can be mentioned, for example, an alkyl group, an alkenyl group, an aryl group, a heterocyclic group, a halogen atom, a cyano group, a nitro group, a hydroxyl group, an alkoxy group, an alkenoxy group, an aryloxy group, a heterocyclic oxy group, an alkylthio group, an alkenylthio group, an arylthio group, a heterocyclic thio group, an amino group, an alkylamino group, an alkenylamino group, an arylamino group, a heterocyclic amino group, an acylamino group, a sulfonamido group, an acyl group, an acyloxy group, an alkoxycarbonyl group, an alkenoxycarbonyl group, an aryloxycarbonyl group, a heterocyclic-oxycarbonyl group, a sulfonyl group, a sulfinyl group, an alkoxycarbonylamino group, an alkenoxycarbonylamino group, an aryloxycarbonylamino group, a heterocyclic oxycarbonylamino group, a carbamoyl group, a sulfamoyl group, a ureido group, a sulfonyloxy group, a carbamoyloxy group, a sulfamoyloxy group, a silyloxy group, a phosphoryloxy group, and the like.

The compound represented by formula (3) may be take the form of a bis-type or tetra-type, and further it may take the form of a polymer (for example, a polymer bonded to a polymer chain).

In formula (3), preferably L is a single bond or a phenylene group, and more preferably a single bond. Preferably each of $R_{a1}$, $R_{a2}$, and $R_{a3}$ is an alkyl group or an alkenyl group. Preferably the sum of the numbers of carbon atoms of $R_{a1}$, $R_{a2}$, $R_{a3}$ and L is 10 or more, and more preferably 15 or more.

In formula (3), a more preferable one can be represented by the following formula (3a):

[formula (3a)]

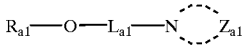

wherein, in formula (3a), $R_{a1}$ has the same meaning as in formula (3). $Z_{a1}$ represents a divalent group wherein both the two atoms bonded to the N are carbon atoms, and wherein $Z_{a1}$ represents a group of non-metal atoms required to form a 5- to 7-membered ring, together with the N. $L_{a1}$ represents a single bond or a phenylene group.

Out of the compounds represented by formula (3a), most preferable one can be represented by the following formula (3b) or (3c):

[formula (3b)]

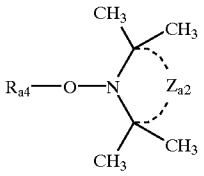

-continued

[formula (3c)]

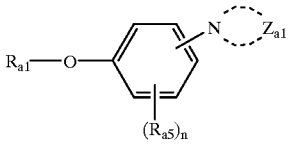

wherein, in formula (3b) or (3c), $R_{a1}$ has the same meaning as in formula (3). $R_{a4}$ represents an alkyl group, an alkenyl group, or a radical (•), and $R_{a5}$ represents a substituent. n represents an integer of 0,1 to 4. $Z_{a2}$ represents a group of non-metal atoms required to form a 6-membered ring. $Z_{a1}$ has the same meaning as in formula (3a).

In formula (3b), $Z_{a2}$ is preferably a group required to form a piperidine ring. In formula (3c), preferably $R_{a1}$ is an alkyl group or an alkenyl group, and more preferably $R_{a1}$ is in the para position to the ring consisting of $NZ_{a1}$.

Among the compounds represented by formulas (3b) or (3c), particularly compound represented by formula (3b) is most preferable. In addition to this, compounds whose $R_{a4}$ is a radical (•) is preferable, in view that it exhibits high effects with a small amount.

Specific examples of the compound represented by formula (3) used in the present invention are shown below, which do not restrict the scope of the compound.

A-(1)

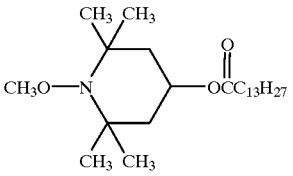

A-(2)

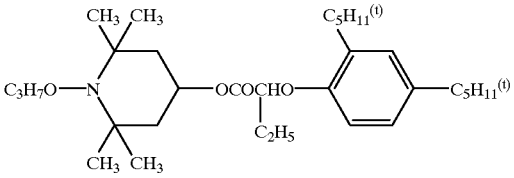

A-(3)

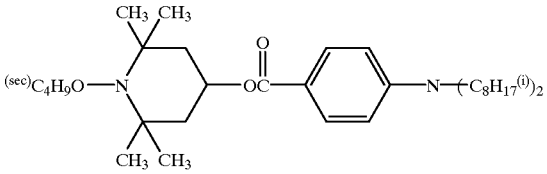

A-(4)

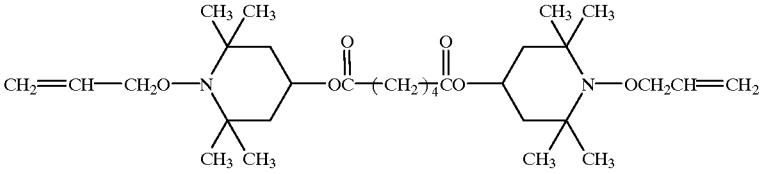

-continued
A-(5)
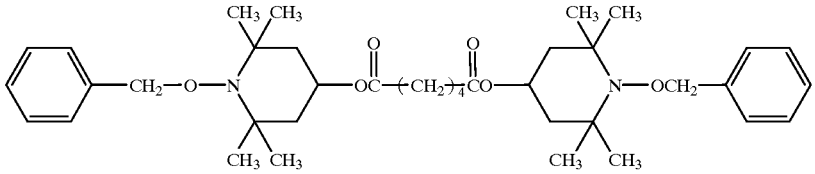
A-(6)
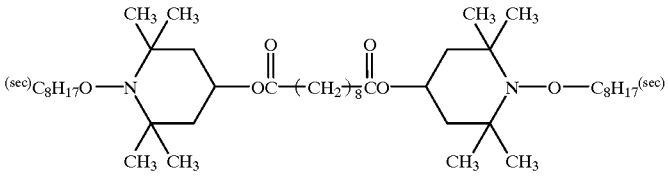
A-(7)
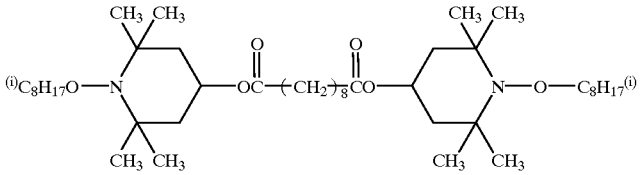
A-(8)
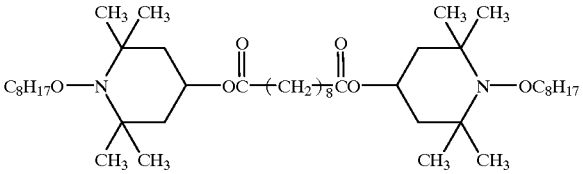
A-(9)
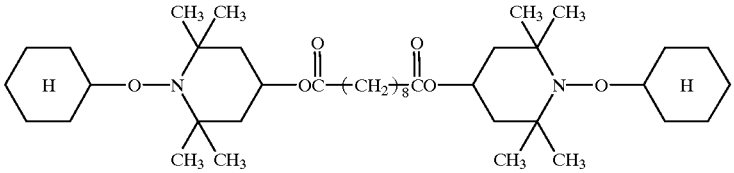
A-(10)
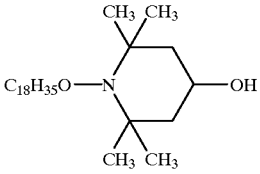
A-(11)
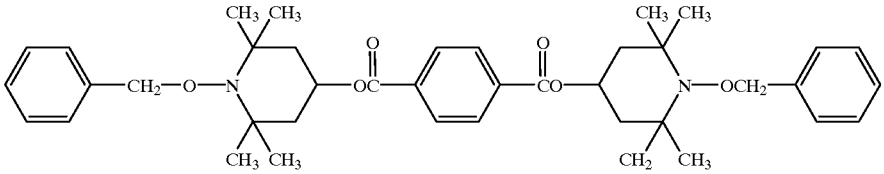
A-(12)
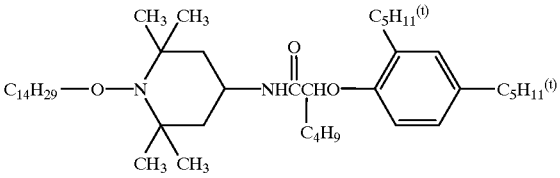

-continued
A-(13)
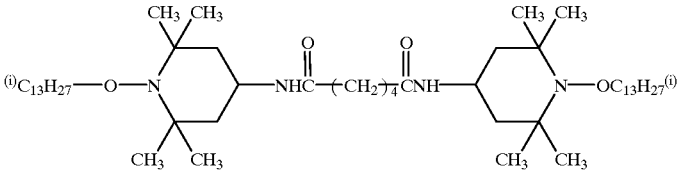
A-(14)
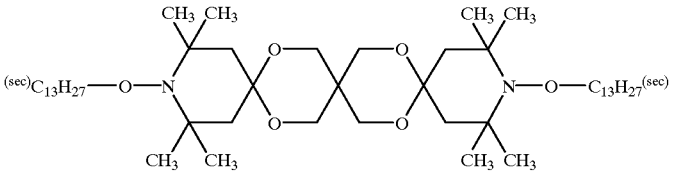
A-(15)
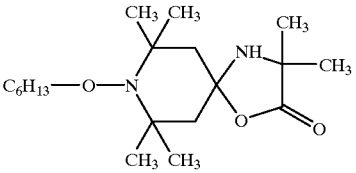
A-(16)
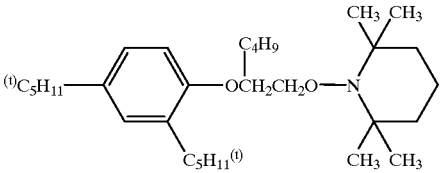
A-(17)
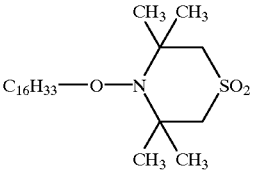
A-(18)
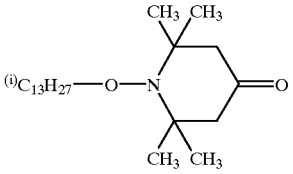
A-(19)
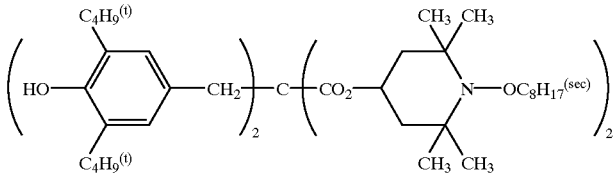
A-(20)
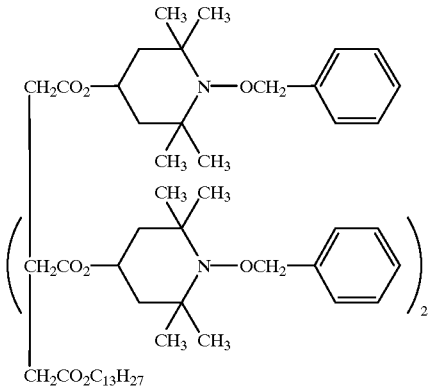
A-(21)
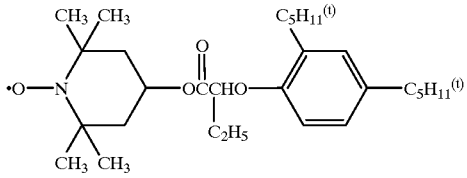
A-(22)
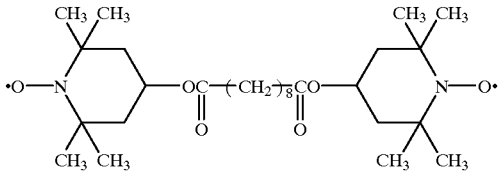
A-(23)
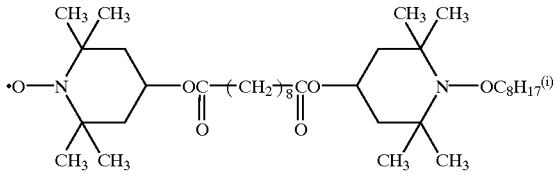

-continued
A-(24)
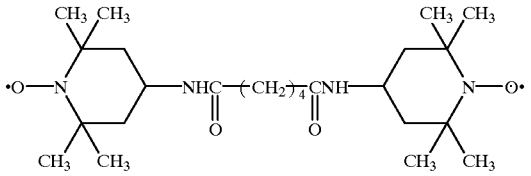
A-(25)
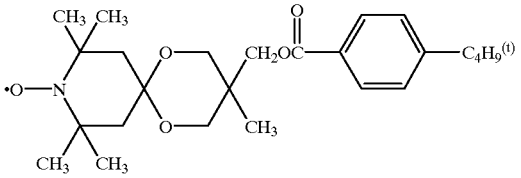
A-(26)
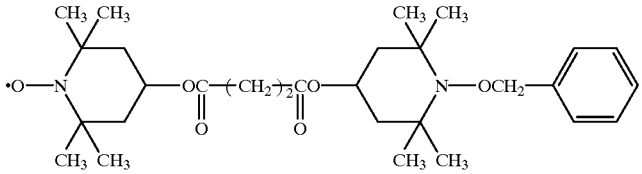
A-(27)
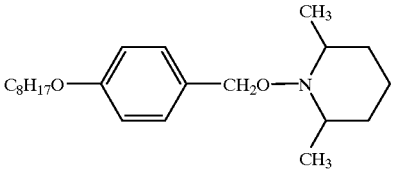
A-(28)
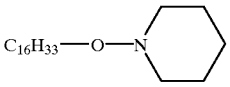
A-(29)
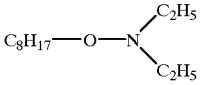
A-(30)
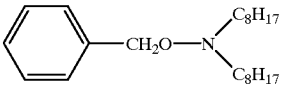
A-(31)
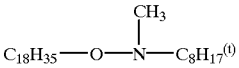
A-(32)
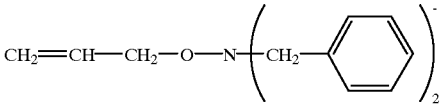
A-(33)
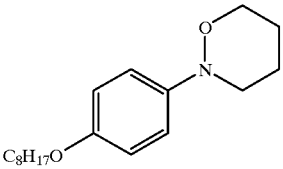
A-(34)
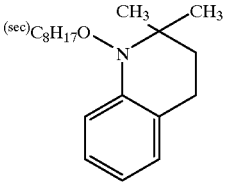
A-(35)
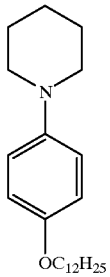
A-(36)
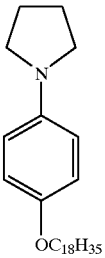

-continued
A-(37)
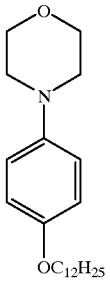
A-(38)
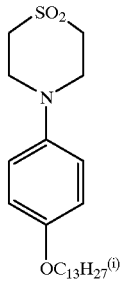
A-(39)
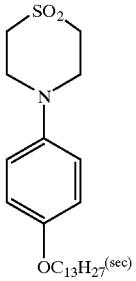
A-(40)
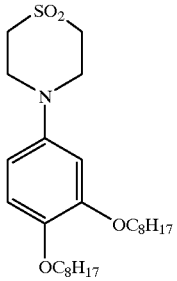
A-(41)
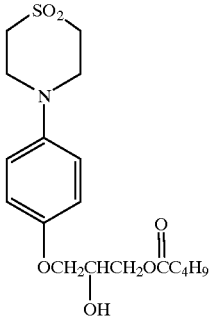
A-(42)
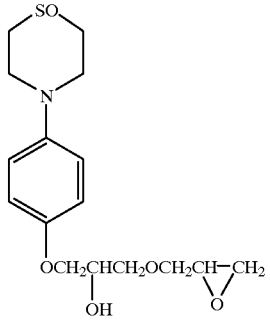
A-(43)
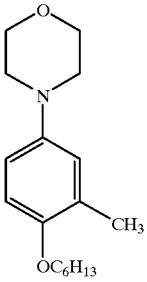
A-(44)
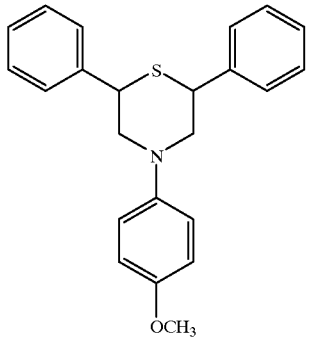

-continued
A-(45)
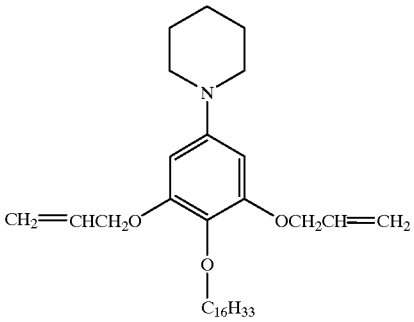
A-(46)
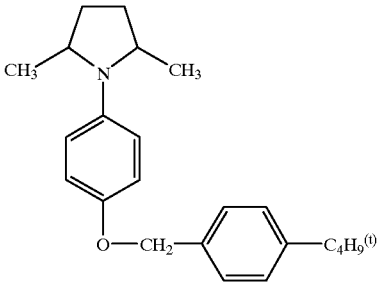
A-(47)
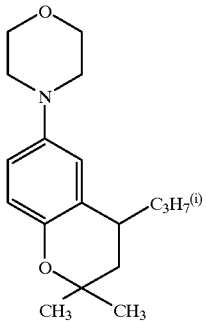
A-(48)
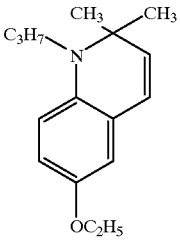
A-(49)
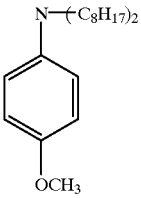
A-(50)
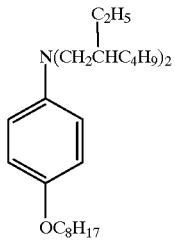
A-(51)
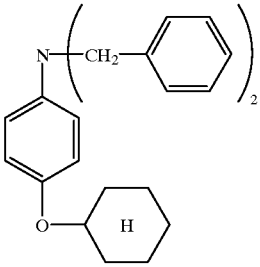
A-(52)
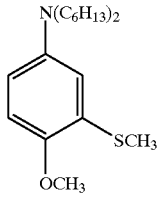

-continued

A-(53)

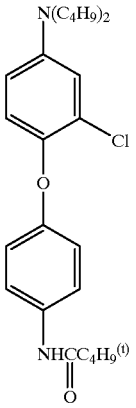

A-(54)

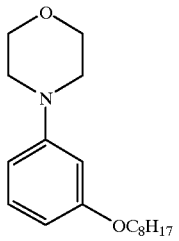

A-(55)

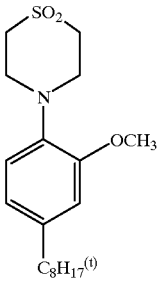

A-(56)

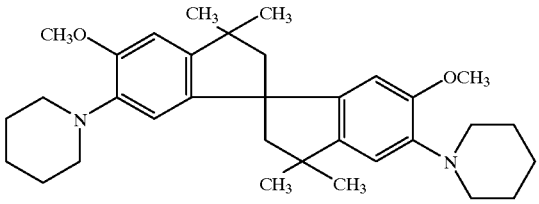

A-(57)

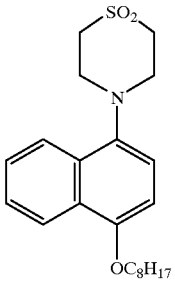

A-(58)

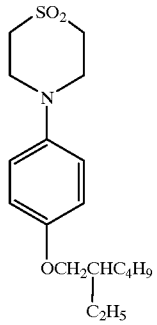

The compound represented by formula (3) used in the present invention can easily be synthesized in accordance with methods described, for example, in JP-B-6-75175 ("JP-B" means examined Japanese patent publication), JP-A-1-132562, JP-A-1-113368, U.S. Pat. Nos. 4,921,962, and 4,639,415.

In the present invention, the amounts to be added of the compound represented by formula (I) and the compound represented by formula (3) are each preferably 50 to 500 mol %, more preferably 50 to 300 mol %, and further preferably 50 to 200 mol %, to the added compound represented by formula (II). If the amounts to be added of the compound represented by formula (I) and the compound represented by formula (3) each are too small to the added compound represented by formula (II), it is not preferable, since sufficient improvement effects on fastness to light can not be attained. On the other hand, if the amounts of these compounds each are too large, it is also not preferable, since oil components become too much, thereby the image to be formed may diffuse.

According to the present invention, by adding both the compound represented by formula (I) and the compound represented by formula (3), together with the cyan coupler represented by formula (II), a silver halide color photographic light-sensitive material excellent in color reproduction and fastness to light of dye image can be provided. Although, if the compound represented by formula (I) or the compound represented by formula (3) is added alone, the effect for improving the fastness to light is saturated, even when the amount of the addition is increased, it seems that the use of both compounds in combination brings about a synergistic effect to improve drastically the effect for improving the fastness to light. Further, the addition of the compound represented by formula (I) lowers, a little, the color-forming property, but the addition of the compound represented by formula (3) can improve the color-forming property.

Further, the addition of the compound represented by formula (II), the compound represented by formula (I), and the compound represented by formula (3) can improve color-forming property and fastness to light, and the cyan stain sometimes occurring due to this addition can be suppressed effectively by the addition of the phenidone represented by formula (4).

The compound represented by formula (4) for use in the present invention is described in detail below.

When $R^{a1}$ or $R^{a2}$ in formula (4) is an alkyl group, the total number of carbon atoms including those in the substituent is preferably in the range of 1 to30, and more preferably 1 to 20. When $R^{a1}$ or $R^{a2}$ is an aryl group, the total number of carbon atoms including those in the substituent is preferably 6 to 30. When $R^{a3}$ or $R^{a4}$ is an alkyl group, the total number of carbon atoms including those in the substituent is preferably in the range of 1 to 24, and more preferably 1 to 18. When $R^{a3}$ or $R^{a4}$ is an aryl group, the total number of carbon atoms including those in the substituent is preferably in the range of 6 to 24.

The group that can substitute on the alkyl group represented by one of $R^{a1}$ to $R^{a4}$ is not particularly limited, and it is preferably a halogen atom, an alkoxy group, an aryl group, an aryloxy group, an acyl group, an acyloxy group, an alkoxycarbonyl group, a sulfonyl group, a phosphoryl group, an alkylthio group, an arylthio group, an acylamino group, a carbamoyl group, a sulfamoyl group, a sulfonamido group, a carbamoylamino group, and an alkoxycarbonylamino group, and particularly preferably a halogen atom, an alkoxy group, an acyloxy group, an alkoxycarbonyl group, an aryloxy group, and an acylamino group. Further the group that can substitute on the alkyl group may contain an unsaturated bond.

When $R^{a1}$ to $R^{a4}$ each represent an aryl group, the group that can substitute on the aryl group can be the substituent for the above alkyl group by way of example, and the group is preferably an alkyl group, a halogen atom, an alkoxy group, an acyloxy group, and an acylamino group.

The number of carbon atoms of $R^{a5}$ is preferably in the range of 6 to 40, more preferably 6 to 30, and further preferably 6 to 24. The group that can substitute on $R^{a5}$ can be the same as those substitutable on the aryl group of $R^{a1}$ to $R^{a4}$, and preferable substituents are also the same as those preferable substitutable on $R^{a1}$ to $Ra^4$.

The compound of formula (4) is used by fixing it in oil droplets and dispersing them in a hydrophilic colloid. To that end, the compound is required to be made lipophilic. Preferably, a lipophilic group (solubilizing-in-oil group) is introduced into at least one of $R^{a1}$ to $Ra^5$, and the total number of carbon atoms of $R^{a1}$ to $R^{a5}$ is needed to be at least 14, preferably in the range of 16 to 40, and more preferably 18 to 36.

Preferable groups to which a solubilizing-in-oil group is to be introduced are those represented by $R^{a1}$ or $R^{a5}$.

When a solubilizing-in-oil group is introduced into $R^{a1}$, preferably the solubilizing-in-oil group is an unsubstituted straight-chain or branched alkyl group, alkoxy group, aryloxy group, or acyl group having 12 to 24 carbon atoms, or an alkyl group having 12 to 36 carbon atoms, particularly preferably 14 to 20, and substituted by an alkoxycarbonyl group. In this case, $R^{a5}$ may or may not be substituted, but more preferably it is unsubstituted.

When a solubilizing-in-oil group is introduced into $R^{a5}$, preferably the solubilizing-in-oil group is an alkyl group, alkoxy group, acyloxy group, or acylamino group having 12 to 30 carbon atoms, and particularly preferably an alkoxy group having 12 to 24 carbon atoms.

$R^{a3}$ and $R^{a4}$ each are preferably a hydrogen atom.

In view of preservability, out of the compounds represented by formula (4), compounds represented by the following formula (IV) or (V) are preferable.

In the silver halide color photographic light-sensitive material of the present invention, together with the compound of formula (I) and the compound of formula (II), a compound represented by formula (IV) and/or a compound represented by formula(V) is preferably used.

(IV)

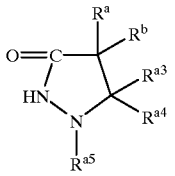

(V)

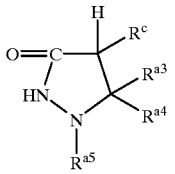

Hereinbelow the compound represented by formula (IV) is described in detail. $R^a$ and $R^b$ each independently represent a substituted or unsubstituted aryl group or a substituted or unsubstituted alkyl group having 1 to 30 carbon atoms in all, inclusive of the carbon atoms in the substituent.

When $R^a$ and $R^b$ each represent an aryl group, the substituent on the aryl group is the same as those described for $R^3$ in formula (II) (or $R^{a1}$ in formula (4), hereinbelow the same is applied) and specific examples thereof are also those described for $R^3$ ($R^{a1}$).

Among them, more preference is given to an alkyl group, an alkoxy group, an acylamino group, a halogen atom, an aminocarbonylamino group, and an alkoxycarbonylamino group.

An alkyl group (having 1 to 10 carbon atoms), a halogen atom (a chlorine atom and a bromine atom), and an alkoxy group (having 1 to 10 carbon atoms) are most preferable. When $R^a$ and $R^b$ each represent an aryl group, preference is given to an unsubstituted aryl group over a substituted aryl group.

When $R^a$ and $R^b$ each represent an alkyl group, the number of carbon atoms is 1 to 30 in all, inclusive of the carbon atoms in the substituent thereof. The unsubstituted alkyl group may be straight-chain or branched. As the straight-chain alkyl, one having 1 to 26 carbon atoms (e.g., methyl, ethyl, n-propyl, n-butyl, n-hexyl, n-octyl, n-decyl, n-octadecyl, and n-eicosyl) is preferable, and as the branched alkyl group, one having 3 to 26 carbon atoms (e.g., i-propyl, t-butyl, and 2-ethylhexyl) is preferable.

When $R^a$ and $R^b$ each represent a substituted alkyl group, the substituent may be those described for $R^3$ in formula (II), and the total number of carbon atoms including the carbon atoms in the substituent is preferably 1 to 20. Specific examples thereof include those described for $R^3$, and ethoxymethyl, acetoxymethyl, stearoyloxymethyl, p-phenoxymethyl, 1-nitrophenoxymethyl, and 1-chlorooctyl can be mentioned.

$R^{a3}$ and $R^{a4}$ each represent a hydrogen atom, a substituted or unsubstituted alkyl group, or a substituted or unsubstituted aryl group. When $R^{a3}$ and $R^{a4}$ each represent a substituted alkyl group or a substituted aryl group, the substituent may be the substituent described for $R^3$ in formula (II), and specific examples thereof include those described for $R^3$.

When $R^{a3}$ and $R^{a4}$ each represent an alkyl group, the number of carbon atoms is preferably 1 to 20. Preference is given to an unsubstituted alkyl group over a substituted alkyl group.

When $R^{a3}$ and $R^{a4}$ each represent an aryl group, the number of carbon atoms is preferably 6 to 20. Preferably at least one of $R^{a3}$ and $R^{a4}$ is a hydrogen atom, and most preferably each of $R^{a3}$ and $R^{a4}$ is a hydrogen atom.

$R^{a5}$ represents a substituted or unsubstituted aryl group, and the substituent on the aryl group is the same as the substituent described for $R^3$ in formula (II). Specific examples of the substituent include those described for in formula (II).

Preferably the substituent includes an alkyl group (having 1 to 20 carbon atoms, e.g., methyl, ethyl, i-propyl, t-butyl, and n-octyl), an alkoxy group (having 1 to 20 carbon atoms, e.g., methoxy, ethoxy, i-propoxy, t-butoxy, n-octyloxy, n-tetradecyloxy, n-hexadecyloxy, and n-octadecyloxy), an acylamino group (having 1 to 20 carbon atoms, e.g., acetylamino, propionylamino, and stearoylamino), an alkoxycarbonylamino group (having 2 to 20 carbon atoms, e.g., methoxycarbonylamino, ethoxycarbonylamino, and octyloxycarbonylamino), an aminocarbonylamino group (having 1 to 20 carbon atoms, e.g., dimethylaminocarbonylamino and dioctylaminocarbonylamino), an alkylsulfonylamino group (having 1 to 20 carbon atoms, e.g., methanesulfonylamino, ethanesulfonylamino, butanesulfonylamino, and octanesulofnylamino), and an arylsulfonylamino group (having 6 to 20 carbon atoms, e.g., benzenesulfonylamino, toluenesulfonylamino, and dodecylbenzenesulfonylamino).

In view of nondiffusibility, preferably, in the compound of formula (IV), at least one of $R^a$, $R^b$, $R^{a3}$, $R^{a4}$, and $R^{a5}$ has a so-called ballasting group. Preferably the molecular weight is 200 or more, more preferably 250 or more, further preferably 300 or more, and most preferably 350 or more.

Now, the compound of formula (V) is described in detail. $R^{a3}$, $R^{a4}$, and $R^{a5}$ of formula (V) have the same meanings as those of formula (IV). Specific examples and preferable examples thereof are the same as those of formula (IV). $R^c$ represents a substituted or unsubstituted alkyl group or a substituted or unsubstituted aryl group.

When $R^c$ represents an alkyl group or an aryl group, the substituent thereof includes those described for $R^3$ of formula (II). Specific examples thereof include those described for $R^3$.

$R^c$ is preferably an alkyl group (having 1 to 20 carbon atoms, e.g., methyl, ethyl, i-propyl, t-butyl, n-octyl, n-dodecyl, n-hexadecyl, n-octadecyl, i-octadecyl, 2-ethylhexyl, 2-methoxyethyl, and 2-chloroethyl) or an aryl group (having 6 to 20 carbon atoms, e.g., phenyl, naphthyl, p-chlorophenyl, m-methoxyphenyl, and o-methylphenyl).

In view of nondiffusibility, preferably, in the compound of formula (V), at least one of $R^c$, $R^{a3}$, $R^{a4}$, and $R^{a5}$ has a so-called ballasting group. Preferably the molecular weight is 200 or more, more preferably 250 or more, further preferably 300 or more, and most preferably 350 or more.

Out of the phenidone compounds represented by formula (IV) or (V) used in the present invention, a more preferable compound is one represented by formula (IV), if it is added to a non-light-sensitive layer. If it is added to a light-sensitive layer, the compound represented by formula (V) is more preferable.

Out of the compounds represented by formula (V), preferable ones are those wherein $R^c$ is an alkyl group, each of $R^{a3}$ and $R^{a4}$ is a hydrogen atom, and $R^{a5}$ is a substituted or unsubstituted aryl group.

Among them, one wherein the aryl group represented by $R^{a5}$ is unsubstituted—or the substituent thereof is an alkoxy group, an acylamino group, an alkylsulfonylamino group, or an arylsulfonylamino group—is preferable, and one wherein the aryl group represented by $R^{a5}$ is unsubstituted—or the substituent is an alkoxy group—is more preferable.

With respect to $R^c$, an unsubstituted alkyl group is preferred to a substituted alkyl group.

Most preferable of the compounds represented by formula (V) are those wherein $R^c$ is an unsubstituted alkyl group, each of $R^{a3}$ and $R^{a4}$ represents a hydrogen atom, and $R^{a5}$ is an unsubstituted aryl group.

Specific examples of the compound represented by formula (IV) or (V) used in the present invention are shown below, but the present invention is not limited to them.

ph-1.

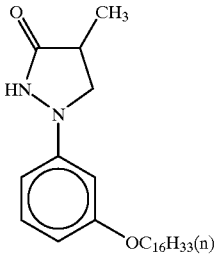

ph-2.

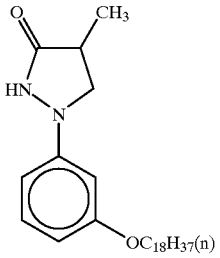

-continued
ph-3.
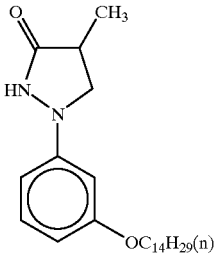
ph-4.
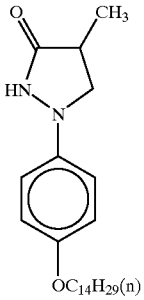
ph-5.
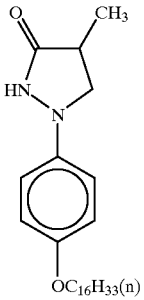
ph-6.
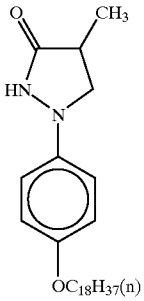
ph-7.
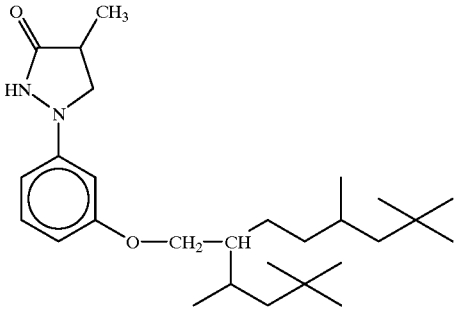
ph-8.
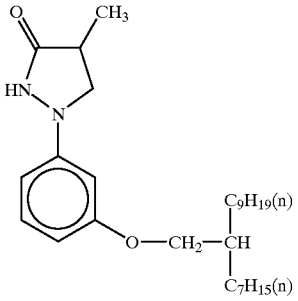
ph-9.
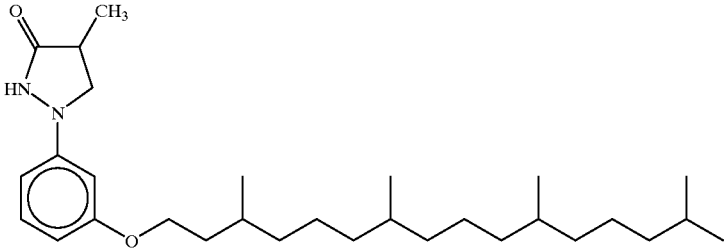
ph-10.
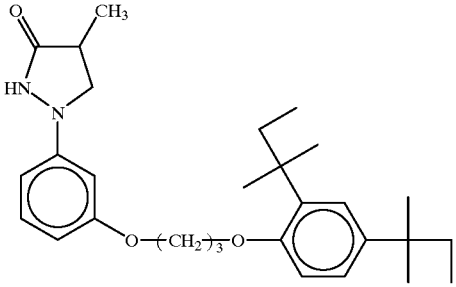
ph-11.
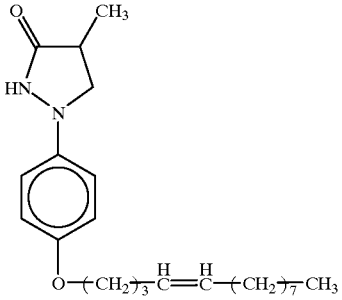

-continued
ph-12.
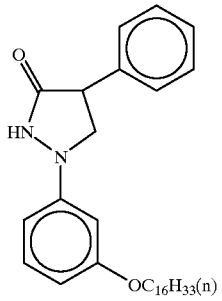
ph-13.
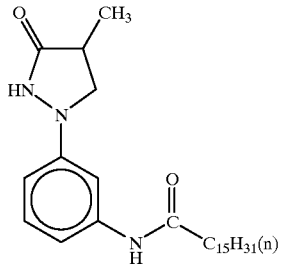
ph-14.
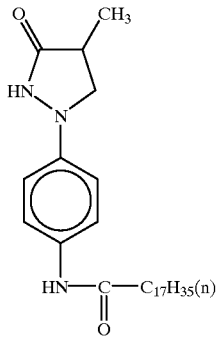
ph-15.
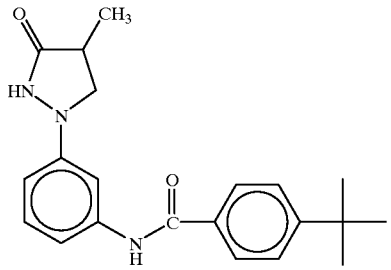
ph-16.
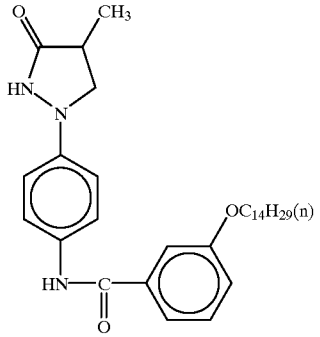
ph-17.
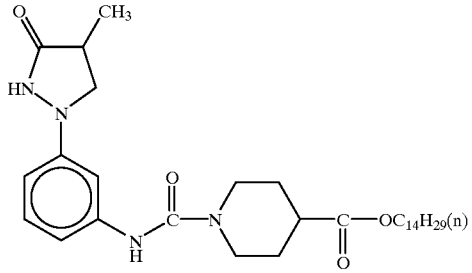
ph-18.
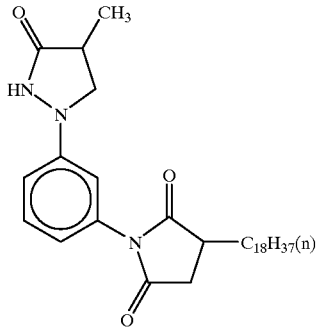
ph-19.
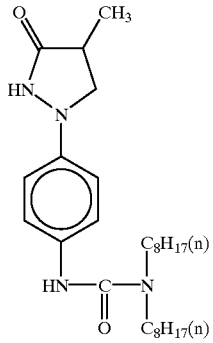

-continued
ph-20.
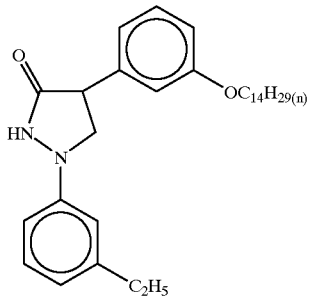
ph-21.
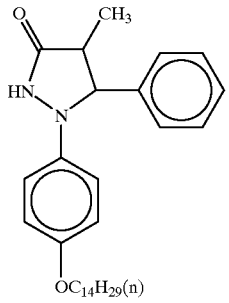
ph-22.
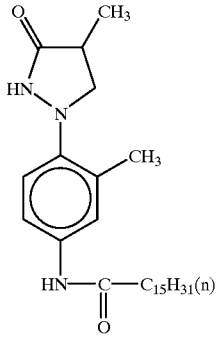
ph-23.
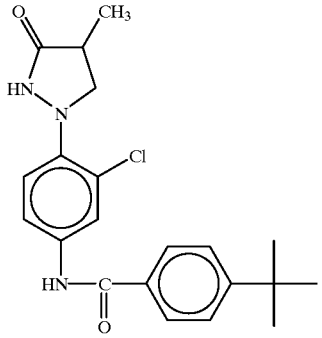
ph-24.
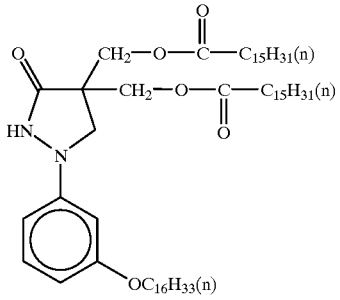
ph-25.
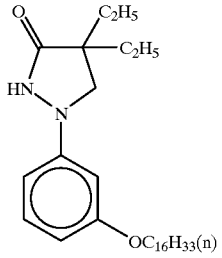
ph-26.
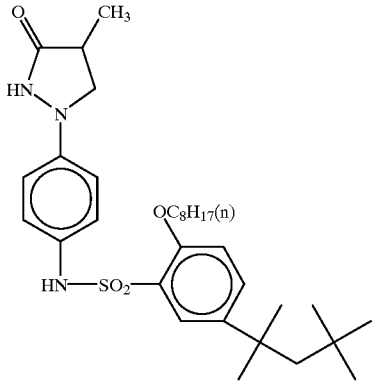
ph-27.
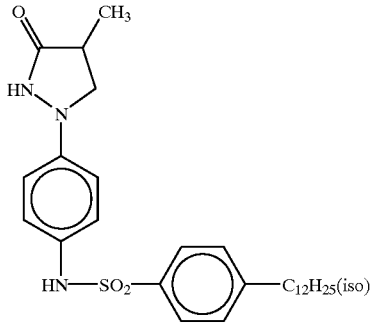

-continued
ph-28.
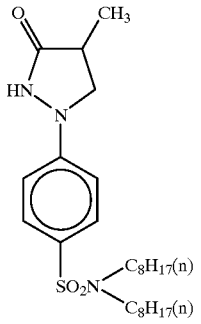
ph-29.
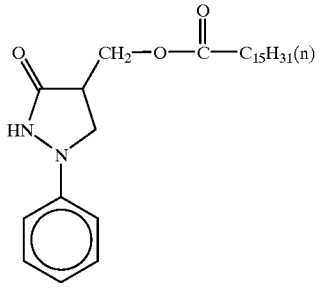
ph-30.
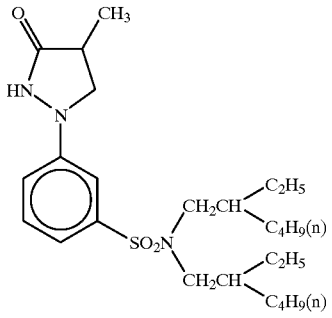
ph-31.
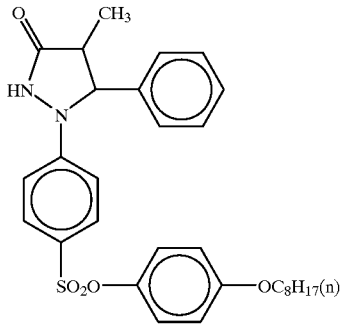
ph-32.
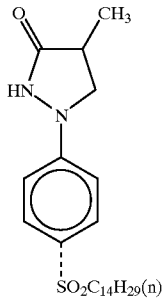
ph-33.
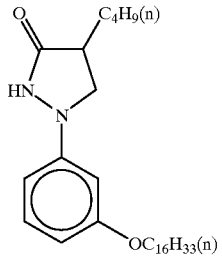
ph-34.
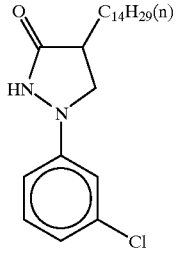
ph-35.
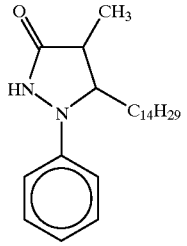

-continued
ph-36.
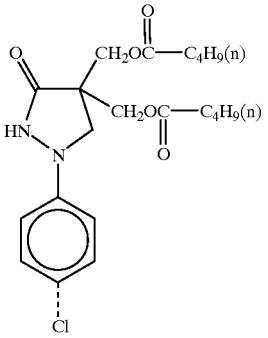
ph-37.
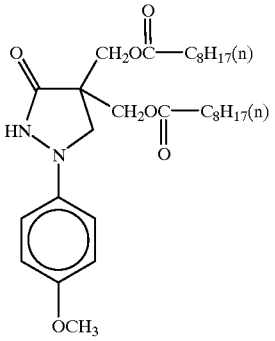
ph-38.
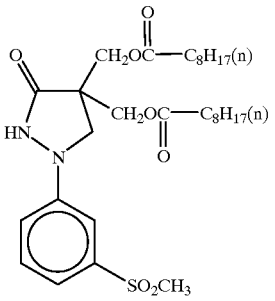
ph-39.
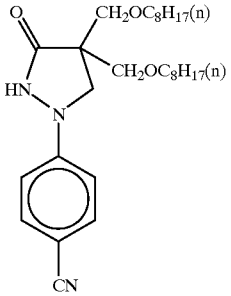
ph-40.
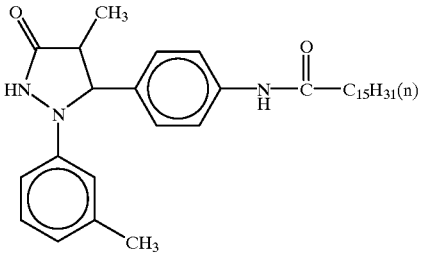
ph-41.
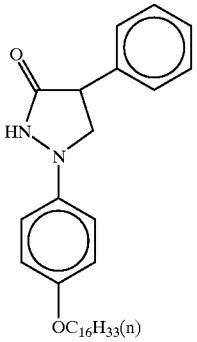
ph-42.
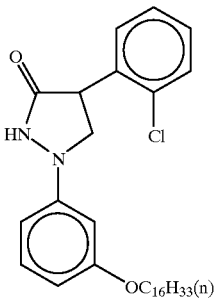
ph-43.
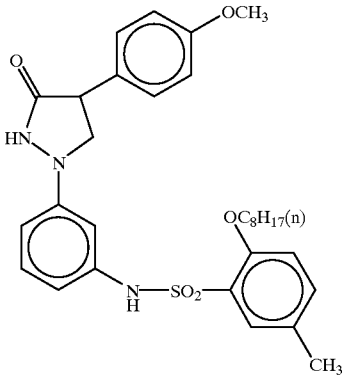

-continued
ph-44.
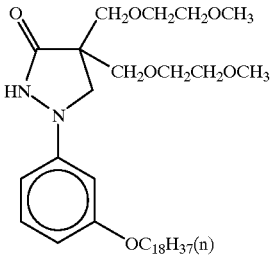
ph-45.
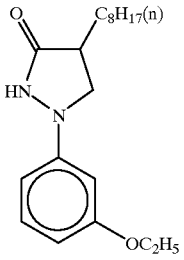
ph-46.
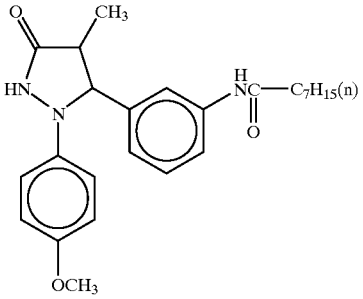
ph-47.
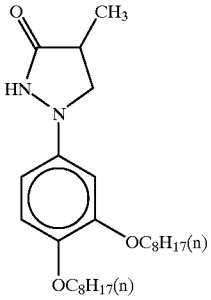
ph-48.
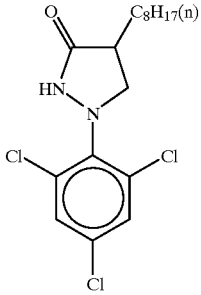
ph-49.
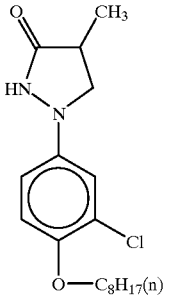
ph-50.
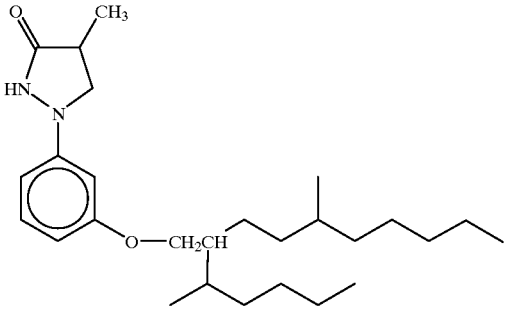
ph-51.
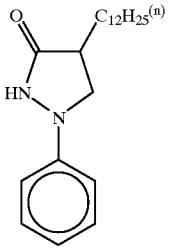
ph-52.
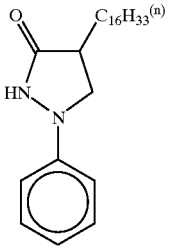
ph-53.
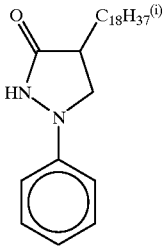

-continued
ph-54.
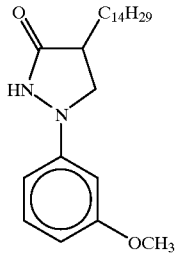
ph-55.
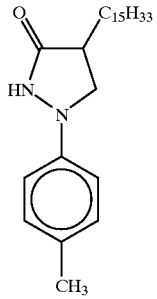
ph-56.
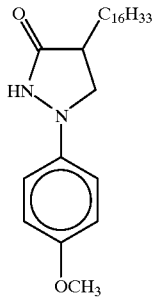
ph-57.
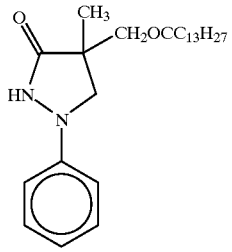
ph-58.
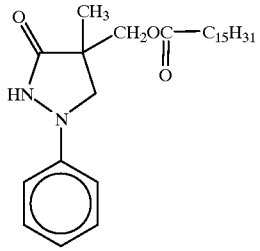
ph-59.
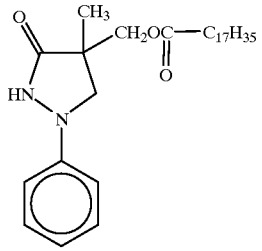
ph-60.
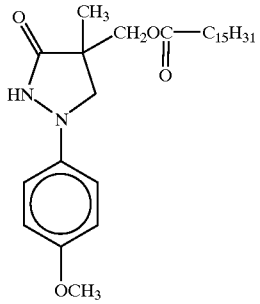
ph-61.
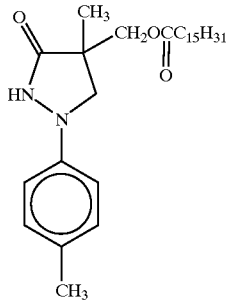
ph-62.
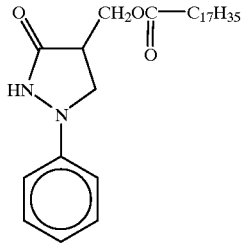
ph-63.
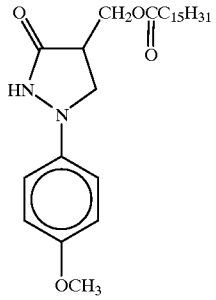

-continued
ph-64.
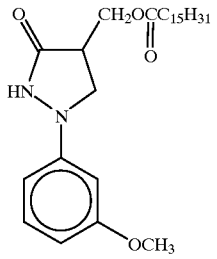
ph-65.
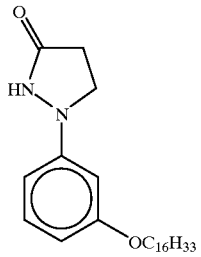
ph-66.
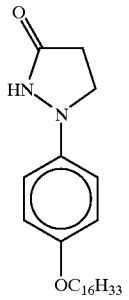
ph-67.
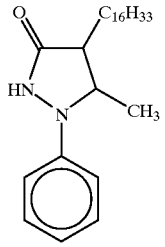
ph-68.
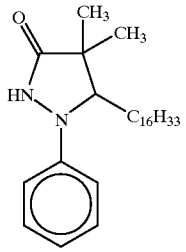
ph-69.
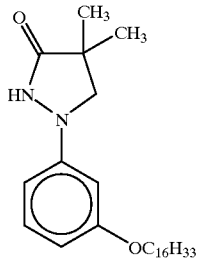
ph-70.
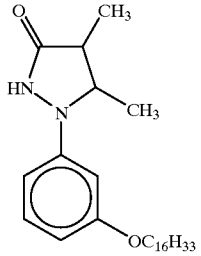
ph-71.
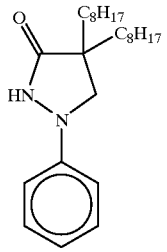
ph-72.
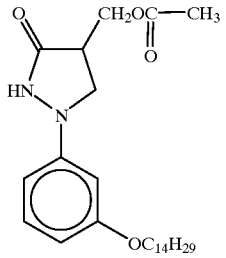
The methods of synthesizing the compounds represented by formula (IV) or (V) are described.

The compound represented by formula (IV) or (V) for use in the present invention can be synthesized according to the following synthetic method:

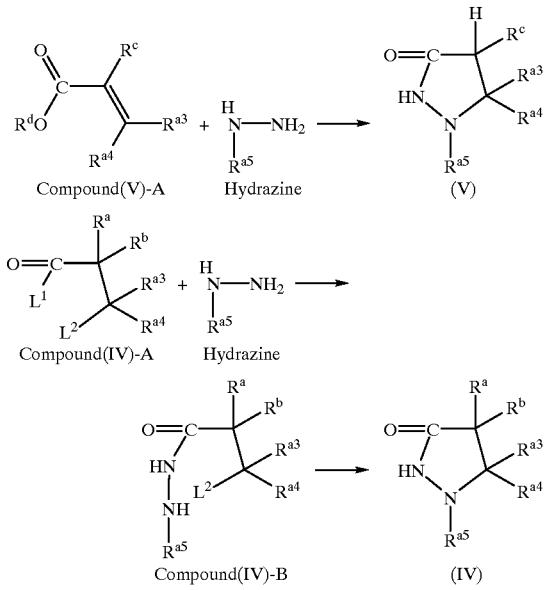

Compound (V)-A and Hydrazine are condensed to form a ring, thereby synthesizing a compound represented by formula (V). In Compound (V)-A, $R^d$ is an alkyl group or an aryl group, and $R^c$, $R^{a3}$, and $R^{a4}$ have the same meanings as those of $R^c$, $R^{a3}$, and $R^{a4}$ of formula (V). $R^{a5}$ of the hydrazine has the same meaning as that of $R^{a5}$ of formula (V).

Preferably, in this reaction, one equivalent or more of a base is permitted to act, in a suitable solvent. When a salt of the hydrazine is used, preferably two equivalents or more of a base are used, to cause the hydrazine to be free. As the base, an alkoxide is preferable, and potassium t-butoxide, sodium methoxide, and the like exemplify the base. As examples of the solvent, n-butanol, t-butanol, dimethyl sulfoxide, dimethylacetamide, and the like can be mentioned.

The reaction can be carried out under the reaction temperature at generally −20° C. to 180° C., preferably 0° C. to 120° C., and more preferably 30° C. to 90° C.

Generally the reaction time is suitably 5 min to 24 hours, preferably 30 min to 6 hours, and more preferably 1 hour to 3 hours.

Preferably the ratio of the hydrazine and Compound (V)-A to be used is 2:1 to 1:2, and more preferably 1.2:1 to 1:1.2, in terms of molar ratio.

Formula (IV)-A and the hydrazine are reacted, to synthesize a compound represented by formula (IV). $R^a$, $R^b$, $R^{a3}$, and $R^{a4}$ in formula (IV)-A have the same meanings as those of $R^a$, $R^b$, $R^{a3}$, and $R^{a4}$ in formula (IV). $L^1$ and $L^2$ are a group that splits off in a nucleophilic reaction. Preferably, $L^1$ is a halogen atom, or an oxygen atom activated with a condensation agent. Preferably $L^2$ is a hydroxyl group or a halogen atom.

The reaction can be carried out under the reaction temperature at generally −20° C. to 180° C., preferably 0° C. to 120° C., and more preferably 30° C. to 90° C.

Generally the reaction time is suitably 5 min to 24 hours, and preferably 1 hour to 6 hours.

The reaction from Compound (IV)-B to (IV) is preferably carried out under acidic conditions when $L^2$ is a hydroxyl group.

When $L^2$ is a halogen atom, the reaction may be carried out under either neutral, acidic or alkaline conditions.

Synthesis of Compound (52)

Exemplified Compound ph-52 was synthesized through the following route:

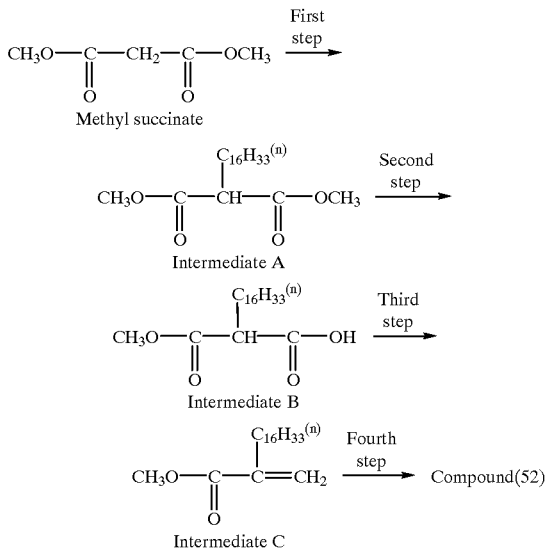

(1) First Step 256 g (1.94 mol) of methyl succinate and 800 ml of methanol were stirred at room temperature, and 375 g (1.94 mol) of sodium methylate (28 wt. %) was added thereto, dropwise. Then, 592 g (1.94 mol) of 1-bromohexadecane was added, dropwise. After refluxing under heat for 3 hours, the methanol was removed by distillation, and the reaction liquid was poured to 1N hydrochloric acid. Extraction with hexane was carried out, the organic layer was washed with brine, and after drying, the solvent was distilled off, to obtain 511 g (1.43 mol) of Intermediate A (yield: 73.7%).

(2) Second Step

While 511 g (1.43 mol) of Intermediate A and 800 ml of methanol were stirred at 35° C., a solution of 94.6 g (1.43 mol) of potassium hydroxide (85%) dissolved in 800 ml of methanol was added, dropwise, thereto. After reacting them at 40° C. for 2 hours, a solution of 130 ml of concentrated hydrochloric acid dissolved in 500 ml of water was added, dropwise, thereto. The deposited crystals were collected by filtering and were washed with water and n-hexane, to obtain Intermediate B. Intermediate B was used in the next step without drying it.

(3) Third Step

All of Intermediate B (1.43 mol) and 1.0 liter of methanol were mixed, and then 115 g (1.57 mol) of diethylamine was added thereto, dropwise, with stirring at 20° C. Thereafter, 135 g (1.57 mol) of a 35% aqueous formalin solution was added thereto, dropwise, and they were reacted for 24 hours at 20° C. The deposited crystals were filtered, washed with water and methanol, and dried, to obtain 396 g (1.28 mol) of Intermediate C (yield: 89.5%).

(4) Fourth Step 145 g (1.34 mol) of phenylhydrazine and 1.5 liters of toluene were stirred at 140° C., and the solvent was distilled off with a Dean-Stark trap, until the internal temperature reached 100° C. Then 272 g (1.41 mol) of sodium methylate (28 wt. %) was added, dropwise, and after the methanol was distilled off, a solution of 396 g (1.28 mol) of Intermediate C in 400 ml of toluene was added, dropwise.

After refluxing under heat for 30 min, it was cooled with ice, and 150 ml of concentrated hydrochloric acid was added, followed by addition of 200 ml of ethyl acetate. The undissolved matter was filtered and removed, and the solution was cooled. The deposited crystals were filtered, washed with water and n-hexane, and dried, to obtain 393 g (1.02 mol) of Compound (ph-52) (yield: 79.7%).

Other compounds can be synthesized similarly.

The effect obtained by means of the compound represented by formula (4), preferably the compound represented by formula (IV) and/or the compound represented by formula (V) used in the present invention improves such problems as cyan fogging, cyan stain, and processing color contamination, which are eminently noticed when a highly active cyan coupler having a pKa of 8.7 or less is used, without affecting other photographic properties, and it is an effect noticed commonly in a combination thereof with a cyan coupler having a pKa of 8.7 or less.

The cyan coupler, e.g. a cyan coupler represented by formula (II), for use in the present invention is characteristically low in pKa, due to its structure, and use of the compound of formula (4), preferably the compound of formula (IV) and/or the compound of formula (V) is particularly effective. The effect is particularly high when the cyan coupler used in the present invention has a pKa of 8.0 or less, and the effect is further increased particularly preferably when the pKa is 7.5 or less.

The pKa of a particular coupler can easily be measured by finding, from the pH titration curve in a THF/water=6/4 mixed solvent system, the pH at the point where half thereof has just been neutralized.

The compound represented by formula (4) for use in the present invention can be used in combination with a cyan coupler in a cyan color-forming layer. In this case, one having the structure represented by formula (V) is more preferred, since its effect is higher with less affection of lowering of color forming property and the like. The compound represented by formula (4) can be used in a non-light-sensitive colloid layer. In this case, the compound is desirably used in combination with a known color-mixing inhibitor, such as hydroquinones. When the compound of formula (4) is used in a non-light-sensitive layer, in view of its effect, the compound having the structure represented by formula (IV) is more preferred.

A preferable coating amount of the cyan coupler used in the present invention varies depending on the molar extinction coefficient of the particular cyan coupler, and it is in the range of generally 0.01 to 1 g/m$^2$, and preferably 0.05 to 0.5 g/m$^2$.

If the cyan coupler to be used is the coupler represented by formula (II), a preferable amount to be used is in the range of 0.01 to 0.6 g/m$^2$, more preferably 0.05 to 0.4 g/m$^2$, and further preferably 0.1 to 0.3 g/m$^2$.

The ratio of the amount to be used of the cyan coupler and the silver halide varies depending on the equivalence of the coupler, and in the case of two-equivalent couplers, the Ag/coupler ratio is generally in the range of from 1.5 to 8, and in the case of four-equivalent couplers, the Ag/coupler ratio is generally in the range of from 3 to 16. In the present invention, two-equivalent couplers low in pKa are preferable, and in this case, the Ag/coupler ratio is generally in the range of from 1.5 to 8, preferably from 2 to 6, and more preferably from 2.5 to 5.

In the present invention, the compound represented by formula (4), (IV), or (V) can be used in a non-light-sensitive hydrophilic colloid layer, together with such an organic compound as a high-boiling organic solvent, a color-mixing inhibitor, an ultraviolet absorber, or a polymer dispersant, by dispersing them with a dispersing auxiliary agent, such as a surfactant. The amount to be used is in the range of generally 0.1 to 200 mol %, preferably 1 to 100 mol %, and more'preferably 5 to 50 mol %, to the cyan coupler to be applied.

The compound represented by formula (4), (IV), or (V) used in the present invention is preferably used in a cyan color-forming layer also in addition to a non-light-sensitive hydrophilic colloid layer. In this case, the amount to be used in the cyan color-forming layer is generally in the range of 1 to 100 mol %, and preferably 5 to 50 mol %, to the cyan coupler. It is also preferable to add the compound of formula (4), (IV), or (V) also to a layer other than the above layers, and in that case, the total amount to be used is in the range of generally 1 to 200 mol %, preferably 5 to 100 mol %, and more preferably 10 to 50 mol %, to the cyan coupler.

With the cyan coupler used in the present invention, it is preferable to use any one of compounds represented by formula (VI), (VII), (VIII), or (IX), in addition to the above compounds, in view of hue adjustment and color formation acceleration. These compounds may be used by combining them in conformity with the purpose.

(VI)

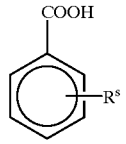

In formula (VI), the substituent R$^s$ represents an alkyl group, an alkoxy group, an acyl group, an alkoxycarbonyl group, an acyloxy group, an acylamino group, a sulfonamido group, a carbamoyl group, a sulfamoyl group, or a sulfonyl group, which may be further substituted by a halogen atom, a hydroxyl group, an alkyl group, an aryl group, an alkoxy group, an ester group, or the like. The substituent R$^s$ preferably represents an alkoxy group or an alkoxycarbonyl group, and an alkoxy group is most preferable. The position of the substituent R$^s$ may be the ortho-position, the meta-position, or the para-position to the COOH group, but the ortho-position is preferable, in view of the hue adjustment function. The benzene ring may further be substituted, and examples of the substituent include a halogen atom and an alkyl group.

(VII)

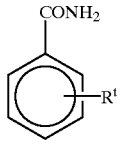

In formula (VII), the substituent R$^t$ represents an alkyl group, an alkoxy group, an acyl group, an alkoxycarbonyl group, an acyloxy group, an acylamino group, a sulfonamido group, a carbamoyl group, a sulfamoyl group, or a sulfonyl group, which may be further substituted by a halogen atom, a hydroxyl group, an alkyl group, an aryl group, an alkoxy group, an ester group, or the like. The substituent R$^t$ preferably represents an alkoxy group or an alkoxycarbonyl group, and an alkoxy group is most preferable. The position of the substituent R$^t$ may be the ortho-position, the meta-position, or the para-position to the CONH$_2$ group, but the ortho-position is preferable, in view of the hue adjustment function. The benzene ring may further be substituted, and examples of the substituent include a halogen atom and an alkyl group.

(VIII)

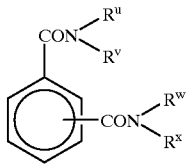

In formula (VIII), the substituents $R^u$, $R^v$, $R^w$, and $R^x$, which are the same or different, each represent a hydrogen atom, an alkyl group, an aryl group, an alkoxycarbonyl group, or an acyl group, which may further have a substituent, such as a halogen atom, a hydroxyl group, an alkyl group, an aryl group, an alkoxy group, an ester group, and the like. Preferably the substituents $R^u$, $R^v$, $R^w$, and $R^x$ each represent a hydrogen atom, an alkyl group (a straight-chain, branched, or cyclic alkyl group), or an aryl group, more preferably a branched alkyl group or a cycloalkyl group, and most preferably a cycloalkyl group. The substitution positions of the two carbamoyl groups may be any of the ortho-position, the meta-position, and the para-position, but the meta-position is particularly preferable, in view of the hue adjustment function. The benzene ring may further be substituted, and examples of the substituent include a halogen atom and an alkyl group.

(IX)

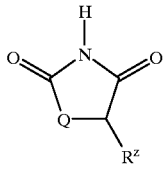

In formula (IX), the substituent Q represents a group >N-$R^y$ or a group >C($R^{y1}$)$R^{y2}$. The substituents $R^y$, $R^{y1}$ and $R^{y2}$ each represent a hydrogen atom, an alkyl group, an aryl group, an alkoxycarbonyl group, or an acyl group. The substituent $R^z$ represents a hydrogen atom, an alkyl group, an alkoxy group, an aryloxy group, or an acyloxy group. These substituents may further be substituted, and examples of the substituent include a halogen atom, a hydroxyl group, an alkyl group, an aryl group, an alkoxy group, and an ester group. Preferably the substituent $R^y$ represents an alkyl group or an aryl group, with more preference given to a straight-chain or branched alkyl group or an alkyl group substituted by an aryl group. Preferably the substituent $R^z$ represents an alkyl group or an alkoxy group, with more preference given to an alkoxy group.

Preferably $R^{y1}$ and $R^{y2}$ each represent a hydrogen atom or an alkyl group.

Hereinbelow, specific examples of the compounds represented by formula (VI), (VII), (VIII) or (IX) are given, but the compounds preferably used with the couplers for use in the present invention are not limited to the following compounds.

VI-1

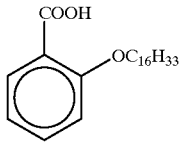

VI-2

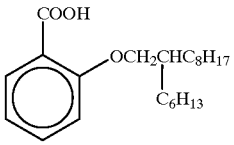

VI-3

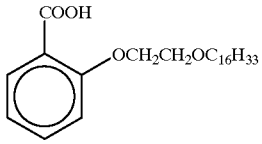

VI-4

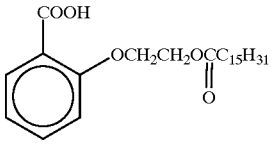

VI-5

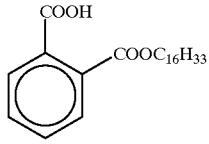

VI-6

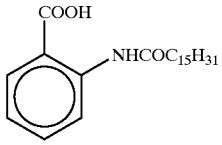

VI-7

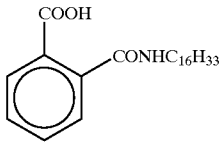

VI-8

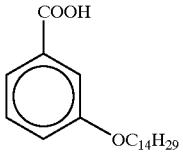

VI-9

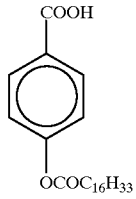

-continued
VI-10
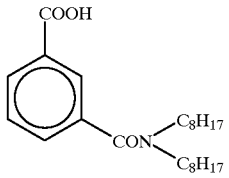
VI-11
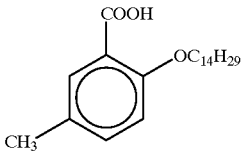
VI-12
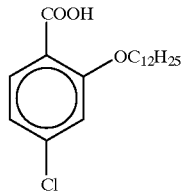
VII-1
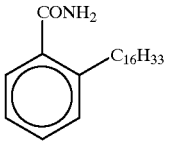
VII-2
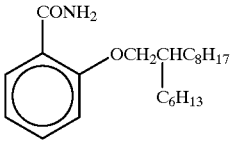
VII-3
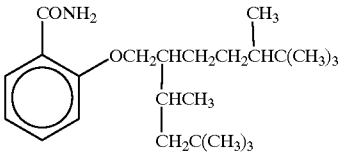
VII-4
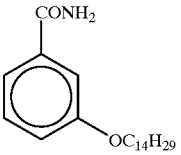
VII-5
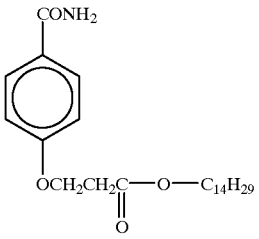
-continued
VII-6
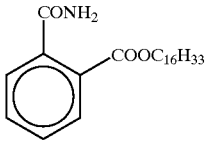
VII-7
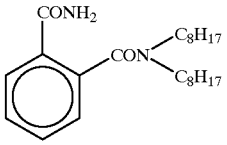
VII-8
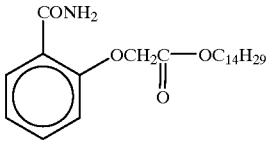
VIII-1
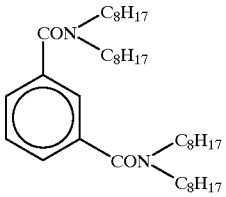
VIII-2
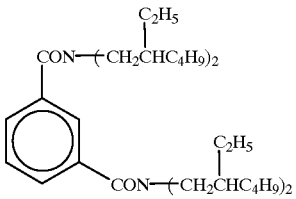
VIII-3
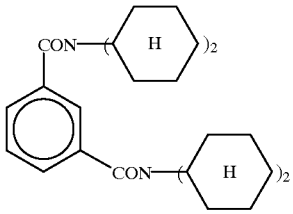
VIII-4
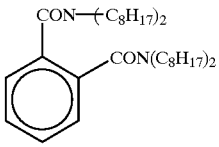

-continued

VIII-5

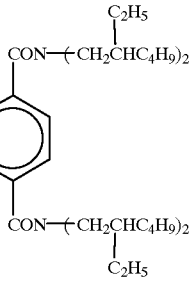

VIII-6

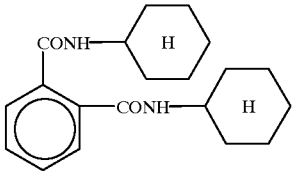

VIII-7

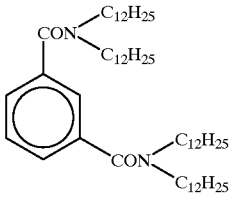

VIII-8

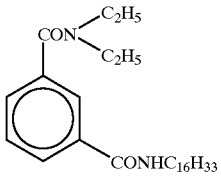

VIII-9

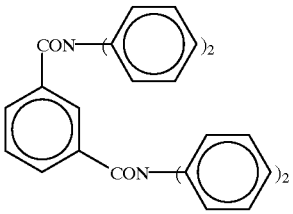

IX-1

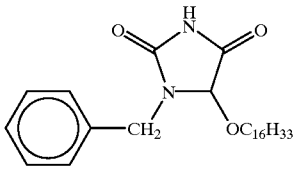

IX-2

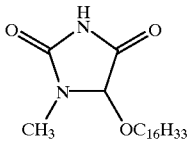

-continued

IX-3

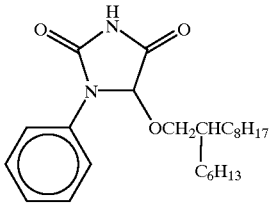

IX-4

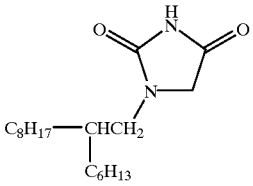

IX-5

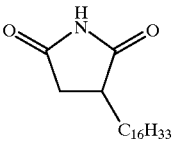

IX-6

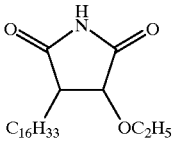

IX-7

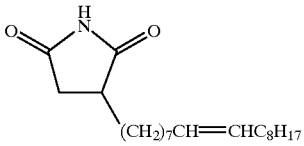

IX-8

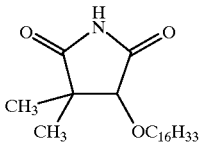

IX-9

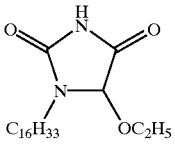

In order to introduce the above cyan coupler and the like into the silver halide light-sensitive material, a known dispersion method can be used, such as an oil-in-water dispersion method that uses a high-boiling organic solvent described later, the latex dispersion method, or the polymer dispersion method, wherein they are co-emulsified together with an oil-soluble polymer, as described, for example, in Research Disclosure, February 1995, Item 37038.

As the high-boiling organic solvent used in the present invention, any compound having a melting point of 100° C. or less, and a boiling point of 140° C. or more, that is immiscible with water, and that is a good solvent for the coupler, can be used. The melting point of the high-boiling organic solvent is preferably 80° C. or less, and the boiling point of the high-boiling organic solvent is preferably 160°

C. or more, and more preferably 170° C. or more. Details of these high-boiling organic solvents are described in JP-A-62-215272, page 137, right lower column, to page 144, right upper column.

Further, in the present invention, known dispersion methods using a polymer can be used. Specific examples of steps, effects, and latexes for impregnation of the latex dispersion method, which is one polymer dispersion method, are described, for example, in U.S. Pat. No. 4,199,363, West Germany Patent Application (OLS) Nos. 2,541,274 and 2,541,230, JP-B-53-41091, and EP-A-029104. As another method, a dispersion method using a water-insoluble and organic solvent-soluble polymer is described, for example, in PCT international publication No. WO 88/00723, EP-A-324476, U.S. Pat. Nos. 4,857,449, and 5,006,453, and such dispersion method using a water-insoluble and organic solvent-soluble polymer is particularly preferable.

In the oil-in-water dispersion method and the above polymer dispersion method, in addition to a cyan coupler and a compound represented by formula (I), if necessary, other photographically useful compounds, such as an anti-fading agent, a development accelerating agent, and an anti-staining agent, can be dissolved in a high-boiling organic solvent, and they can be emulsified and dispersed, together with a dispersant, such as a surfactant, into a hydrophilic colloid, preferably into an aqueous gelatin solution, in the form of fine particles, by means of a known apparatus, such as an ultrasonic, a colloid mill, a homogenizer, a Manton-Gaulin, and a high-speed dissolver.

Further, in dissolving the coupler, an auxiliary solvent may further be used. Herein, the term "an auxiliary solvent" means an organic solvent useful in emulsifying and dispersing, which can finally be removed substantially from the light-sensitive material after the drying step at the time of applying. Examples of the auxiliary solvent include acetates of a lower alcohol, such as ethyl acetate and butyl acetate; ethyl propionate, secondary butyl alcohol, methyl ethyl ketone, methyl isobutyl ketone, β-ethoxyethyl acetate, methyl cellosolve acetate, methyl carbitol acetate, methyl carbitol propionate, and cyclohexanone.

Further, if necessary, an organic solvent that is completely miscible with water, such as methyl alcohol, ethyl alcohol, acetone, tetrahydrofuran, and dimethylformamide, can be used in combination with the above solvent. These organic solvents can be used in combination with two or more.

For the purpose of, for example, improving stability with time at storage in the state of an emulsified dispersion, and improving stability with time/inhibiting the change of photographic property in the end-composition for coating (applying) that is mixed with a silver halide emulsion, if necessary, from the thus-prepared emulsified dispersion, the auxiliary solvent may be removed in its entirety or part of it, for example, by distillation under reduced pressure, noodle washing, or ultrafiltration.

Preferably, the average particle size of the lipophilic fine particle dispersion obtained in this way is 0.04 to 0.50 μm, more preferably 0.05 to 0.30 μm, and most preferably 0.08 to 0.20 μm. The average particle size can be measured, for example, by using a Coulter Submicron Particle Analyzer model N4 (trade name, manufactured by Coulter Electronics Co.).

The average particle size of the lipophilic fine particles containing the coupler used in the present invention is not particularly limited, but in view of the improvement in color forming property, it is preferably 0.05 to 0.8 μm, more preferably 0.05 to 0.4 μm, and most preferably 0.05 to 0.3 μm.

In order to make small, generally, the average particle size of the lipophilic fine particles, it is attained, for example, by choosing the type of surfactant, increasing the amount of the surfactant used, increasing the viscosity of the hydrophilic colloid solution, lowering the viscosity of the lipophilic organic layer by additional use of a low-boiling organic solvent; increasing the shearing force, for example, by increasing the rotational frequency of the stirring blades of an emulsifier; or prolonging the emulsifying time.

In the oil-in-water dispersion method using a high-boiling organic solvent, the weight ratio of the high-boiling organic solvent to the total weight of all the cyan couplers used may be chosen arbitrarily, and preferably it is 0.1 or more, but 10.0 or less; more preferably 0.1 or more, but 8.0 or less, further preferably 0.3 or more, but 7.0 or less; further more preferably 0.3 or more, but 6.0 or less; still further preferably 0.5 or more, but 5.0 or less; and most preferably 0.5 or more, but 4.0 or less. Further, it is also possible not to use a high-boiling organic solvent at all.

With the cyan coupler for use in the present invention, 2-acylamino-5-alkylphenol-type cyan couplers, 2,5-diacylaminophonol-type cyan couplers, and 2-carbamoyl-1-naphthol-type cyan couplers that have been conventionally used can be used in combination. Among these, combination use with 2-acylamino-5-alkylphenol-type cyan couplers is particularly preferable. In this case, the amount to be added of the additional cyan coupler used in combination is in the range of generally 1 to 50 mol %, preferably 5 to 40 mol %, and more preferably 10 to 30 mol %, to the coupler for use in the present invention.

Besides the cyan coupler represented by formula (C) that is preferably used in combination with the cyan coupler represented by formula (II) used in the present invention, phenol-series and naphthol-series cyan couplers that have been conventionally used can also be used in combination with the cyan coupler represented by formula (II) used in the present invention. In this case, the amount to be added of the additional cyan coupler used in combination is in the range of generally 1 to 50 mol %, preferably 5 to 40 mol %, and more preferably 10 to 30 mol %, to the cyan coupler represented by formula (II) for use in the present invention.

In order to improve the fastness of image from the cyan coupler used in the present invention, a method in which a polymer that is soluble in organic solvents but insoluble in water is co-dispersed in oil droplets, is also preferably used. In this case, preferably the polymer is a polymer of styrene, acrylamide, methacrylamide, acrylate or methacrylate-series, or a copolymer thereof, and it preferably has a number-average molecular weight in the range of 20,000 to 200,000.

Further, in order to improve the stability of the emulsion, an oligomer molecule having a molecular weight of the order of 500 to 5,000 is preferably used, and a styrene oligomer, an α-methylstyrene oligomer, and the like are preferable. Particularly, an oligomer of styrene and α-methylstyrene is preferable, because of its solubility.

Further, in order to accelerate the color formation, it is also preferable to add an amphiphatic polymer to the coating solution. In this case, a copolymer of acrylic acid or methacrylic acid with acrylates or methacrylates is more preferable. In particular, a copolymer of methacrylic acid with butyl acrylate is a particularly preferable compound, because the effect is great.

In the present invention, the use of the polymer represented by formula (L) is preferable, because the decrease in the cyan color density (blix discoloration) owing, for example, to an increase in the ferrous ion concentration or a decrease in the pH in the bleach-fix processing solution, can be prevented, to improve the processing stability at the time of running processing. The polymer represented by formula (L) may be used in any layer, and most preferably it is added particularly to the layer containing the cyan coupler represented by formula (C), in view of the prevention of blix discoloration.

The polymer represented by formula (L) may be a polymer in solution, more preferably the polymer represented by formula (L) is in the form of the below-shown polymer latex, because, in that case, the blix discoloration prevention effect is excellent.

In formula (L), the three repeating units are such that A: methacrylic acid; B: $CH_2{=}C(R^{P1})COOR^{P2}$; and D: an ethylenically unsaturated monomer, as constituting components. The polymer latex of formula (L) may be in the form of a salt of —COOM, to such an extent that it does not become soluble, wherein the cation represented by M includes a metal ion (e.g. a sodium ion and a potassium ion) and an ammonium ion.

In B, $R^{P1}$ represents a hydrogen atom or a methyl group, and $R^{P2}$ represents an alkyl group having 1 to 8 carbon atoms or a cycloalkyl group. Preferably $R^{P2}$ represents an unsubstituted alkyl group having 1 to 7 carbon atoms and preferably 2 to 6 carbon atoms, a halogen-substituted or phenyl-substituted alkyl group, an unsubstituted cycloalkyl group, or a halogen-substituted cycloalkyl group. Accordingly, preferable examples of $R^{P2}$ include methyl, ethyl, n-propyl, isopropyl, n-butyl, sec-butyl, t-butyl, isobutyl, n-amyl, n-hexyl, cyclopropyl, cyclopentyl, cyclohexyl, benzyl, 3-chloropropyl, and 3-bromopropyl. Out of them, an unsubstituted straight-chain or branched alkyl or cycloalkyl is particularly preferable.

Examples of the ethylenically unsaturated monomer represented by B include acrylates, specifically methyl acrylate, ethyl acrylate, n-propyl acrylate, isopropyl acrylate, n-butyl acrylate, isobutyl acrylate, sec-butyl acrylate, tert-butyl acrylate, amyl acrylate, hexyl acrylate, 2-ethylhexyl acrylate, octyl acrylate, tert-octyl acrylate, 2-chloroethyl acrylate, 2-bromoethyl acrylate, 4-chlorobutyl acrylate, cyanoethyl acrylate, 2-acetoxyethyl acrylate, dimethylaminoethyl acrylate, benzyl acrylate, methoxybenzyl acrylate, 2-chlorocyclohexyl acrylate, cyclohexyl acrylate, 5-hydroxypentyl acrylate, 2,2-dimethyl-3-hydroxypropyl acrylate, and the like; and methacrylates, specifically methyl methacrylate, ethyl methacrylate, n-propyl methacrylate, isopropyl methacrylate, n-butyl methacrylate, isobutyl methacrylate, sec-butyl methacrylate, tert-butyl methacrylate, amyl methacrylate, hexyl methacrylate, cyclohexyl methacrylate, benzyl methacrylate, chlorobenzyl methacrylate, octyl methacrylate, 2-hydroxyethyl methacrylate, 4-hydroxybutyl methacrylate, triethylene glycol monomethacrylate, dipropylene glycol monomethacrylate, and the like.

As the ethylenically unsaturated monomer represented by B, a monomer that will form a water-insoluble homopolymer is preferably used. The proportion of the monomer, which will form a water-soluble homopolymer, out of B, is preferably about 0 to 20%, to all the polymer.

D represents a repeating unit made of an ethylenically unsaturated monomer, and preferably a repeating unit made of an ethylenically unsaturated monomer selected from monomers, except the group of monomers shown in B by way of example. More preferably D represents a repeating unit made of an ethylenically unsaturated monomer selected from the group of monomers, except A and B shown above.

The ethylenically unsaturated monomer represented by D includes acrylates and methacrylates: specific examples thereof includes compounds shown as the specific examples of B above plus alkyl acrylates (e.g., n-decyl acrylate and n-dodecyl acrylate), aryl acrylates (e.g., phenyl acrylate), acrylic acid heterocyclic esters (e.g., furfuryl acrylate and tetrahydrofurfuryl acrylate), alkyl methacrylates (e.g. stearyl methacrylate), aryl methacrylates (e.g., phenyl methacrylate, cresyl methacrylate, and naphthyl methacrylate), methacrylic acid heterocyclic esters (e.g., furfuryl methacrylate and tetrahydrofurfuryl methacrylate); vinyl esters (e.g., vinyl acetate, vinylphenyl acetate, vinyl benzoate, and vinyl salicylate), acrylamides (e.g., acrylamide, butylacrylamide, and phenylacrylamide), methacrylamides (e.g., methacrylamide, tert-butylmethacrylamide, and phenylmethacrylamide), olefins (e.g., dicyclopentadiene, vinyl chloride, and butadiene), styrenes (e.g., styrene and α-methylstyrene), and vinyl ethers (e.g., methyl vinyl ether and methoxyethyl vinyl ether).

Other examples include butyl crotonate, hexyl crotonate, dimethyl itaconate, dibutyl itaconate, diethyl maleate, dimethyl maleate, dibutyl maleate, diethyl fumarate, dimethyl fumarate, dibutyl fumarate, methyl vinyl ketone, phenyl vinyl ketone, methoxyethyl vinyl ketone, glycidyl acrylate, glycidyl methacrylate, N-vinyloxazolidone, N-vinylpyrrolidone, acrylonitrile, methacrylonitrile, methylenemalonitrile, and vinylidene chloride.

As the monomer represented by D, preferable ones are acrylate monomers, methacrylate monomers, and vinyl ester monomers.

Z is 0 to 30 and preferably 0 to 20, and in particular, two or more of the monomers represented by A, B, or D wherein Z is 0, may be used in combination.

In the polymer latex used in the present invention, the —COOH group may be neutralized to an extent wherein the latex is not dissolved in water, and the lower the rate of the neutralization is, the more preferable it is, in view of the ability to prevent blix discoloration. Therefore, the rate of neutralization of the —COOH group is preferably 0 to 20%, and particularly preferably 0 to 10%. Herein the rate of neutralization of the carboxylic acid group is defined as COOM, wherein M represents a cation, in the polymer latex (specifically the $—CH_2—C(CH_3)COOM$ component in formula (L))/[COOH+COOM wherein M represents a cation].

The term "insoluble in water" mentioned above means that the solubility of the polymer latex is 1 g or less per 100 ml of water (25° C.).

Specific examples of the compound represented by formula (L) used in the present invention are shown below, with ratios in the order of a copolmerization ratio (weight ratio) and a ratio of the —COOH component in the —COOM, but the present invention is not limited to these.

P-1 Methacrylic acid/n-butyl acrylate copolymer (30/70), M=H/Na (90/10)

P-2 Methacrylic acid/n-butyl acrylate copolymer (40/60), M=H/Na (90/10)

P-3 Methacrylic acid/n-butyl acrylate copolymer (50/50), M=H/Na (90/10)

P-4 Methacrylic acid/n-butyl acrylate copolymer (55/45), M=H (100)

P-5 Methacrylic acid/methyl acrylate copolymer (25/75), M=H/K (90/10)

P-6 Methacrylic acid/ethyl acrylate copolymer (30/70), M=H (100)

P-7 Methacrylic acid/ethyl acrylate copolymer (35/65), M=H (100)

P-8 Methacrylic acid/n-hexyl acrylate copolymer (45/55), M=H (100)

P-9 Methacrylic acid/cyclohexyl acrylate copolymer (40/60), M=H (100)

P-10 Methacrylic acid/cyclohexyl methacrylate copolymer (40/60), M=H (100)

P-11 Methacrylic acid/methyl methacrylate copolymer (30/70), M=H/Na (80/20)

P-12 Methacrylic acid/ethyl methacrylate copolymer (40/60), M=H (100)

P-13 Methacrylic acid/n-propyl methacrylate copolymer (40/60), M=H (100)

P-14 Methacrylic acid/sec-butyl methacrylate copolymer (40/60), M=H (100)

P-15 Methacrylic acid/t-butyl methacrylate copolymer (50/50), M=H/K (90/10)

P-16 Methacrylic acid/n-butyl acrylate/methyl acrylate copolymer (40/40/20), M=H (100)

P-17 Methacrylic acid/methyl methacrylate/stylene copolymer (40/30/30), M=H (100)

P-18 Methacrylic acid/acrylic acid/benzyl methacrylate copolymer (20/20/60), M=H (100)

P-19 Methacrylic acid/n-butyl acrylate/vinyl acetate copolymer (40/20/20), M=H (100)

P-20 Methacrylic acid/sodium 3-acryloxypropanesulfonate/ethyl methacrylate copolymer (30/5/65), M=H/Na (90/10)

P-21 Methacrylic acid/itaconic acid/n-butyl acrylate copolymer (30/10/60), M=H/K (95/5)

The polymer latex used in the present invention can be prepared by the generally well-known emulsifying and polymerizing method. The emulsifying and polymerizing method is preferably carried out in such a manner that a monomer is emulsified in water, or a mixed solvent of a water-miscible organic solvent (e.g. methanol, ethanol, and acetone) with water, using at least one emulsifier, and polymerization is conducted using a radial polymerization initiator, generally at a temperature of 30 to about 100° C., and preferably 40 to about 90° C. The amount of the water-miscible organic solvent is generally 0 to 100%, and preferably 0 to 50%, by volume to the water.

The polymerization reaction is carried out using a radical polymerization initiator, generally in an amount of 0.05 to 5% by weight to the monomer to be polymerized, and if necessary an emulsifier in an amount of 0.1 to 10% by weight to that monomer. As the polymerization initiator, an azobis compound, a peroxide, a hydroperoxide, or a redox catalyst can be used, and specific examples include potassium persulfate, ammonium persulfate, tert-butyl peroctoate, benzoly peroxide, isopropyl percarbonate, 2,4-dichlorobenzyl peroxide, methyl ethyl ketone peroxide, cumene hydroperoxide, dicumyl peroxide, 2,2'-azobisisobutylate and 2,2'-azobis(2-amidinopropane)-hydrochloride, as well as a combination of potassium persulfate with sodium hydrogensulfite.

As the emulsifier, an anionic surfactant, a cationic surfactant, an amphoteric surfactant, and a nonionic surfactant, as well as a water-soluble polymer and the like, can be mentioned. Examples are sodium laurate, sodium dodecylsulfate, sodium 1-octoxycarbonylmethyl-1-octoxycarbonylmethanesulfonate, sodium laurylnaphthalenesulfonate, sodium laurylbenzenesulfonate, sodium laurylphosphonate, cetyltrimethylammonium chloride, dodecyltrimethyleneammonium chloride, N-2-ethylhexylpyridinium chloride, polyoxyethylene nonylphenyl ether, polyoxyethylene sorbitane lauryl ester, sodium dodecyl-diphenyl ether disulfonate, sodium 2-tetradecene-1-sulfonate, sodium 3-hydroxytetradecane-1-sulfonate, gelatin, and a polyvinyl alcohol, as well as a water-soluble polymer and an emulsifier described in JP-B-53-6190, and among them an anionic surfactant, a nonionic surfactant, and a water-soluble polymer are particularly preferable.

In the photographic coating solution used in the present invention, the content of the polymer represented by formula (L) is preferably 1 to 100% by weight, more preferably 5 to 50% by weight, and most preferably 10 to 30% by weight, to the dye-forming coupler. If the amount of the polymer is too small, the blix discoloration improvement effect is weak, while if the amount is too large, the polymer lowers the film strength, unpreferably.

The particle diameter of the polymer latex is not particularly limited, and in view of the stability and the like it is generally 1.0 $\mu$m or less, preferably 0.7 $\mu$m or less, and particularly preferably 0.5 $\mu$m or less, and the lower limit thereof is preferably 0.00001 $\mu$m or more.

The polymer latex exhibits an excellent effect without respect to its molecular weight, and taking the diffusion into other layers when applied or processed and the viscosity of the coating solution into account, a preferable molecular weight is $5\times10^3$ to $1\times10^7$, more preferably $1\times10^4$ to $5\times10^6$, and particularly preferably $2\times10^4$ to $3\times10^6$, in terms of weight-average molecular weight.

Since the obtained polymer itself of the polymer latex is a dispersion of fine particles, the polymer latex may be directly mixed with a hydrophilic colloid, and the mixture in the form of an aqueous medium dispersion may be applied.

As a hydrophilic colloid that is mixed with the polymer latex, gelatin is used preferably. As the gelatin, in addition to a lime-processed gelatin, an acid-processed gelatin, and an enzyme-processed gelatin can be used, further a hydrolyzate or enzymolyzate of gelatin can also be used.

Further, hydrophilic colloids other than gelatin can be used, for example, a protein, such as albumin and casein; a cellulose derivative, such as hydroxyethylcellulose, carboxymethylcellulose, and cellulose sulfate ester; sodium alginate, dextran, a saccharide derivative, such as a starch derivative; and many synthetic hydrophilic polymers, including homopolymers and copolymers, such as a polyvinyl alcohol, a polyvinyl alcohol partial acetal, a poly-N-vinylpyrrolidone, a polyacrylamide, a polyvinylimidazole, and a polyvinylpyrazole.

The light-sensitive silver halide emulsion (1), the lipophilic fine particle coupler dispersion (2), and the polymer latex used in the present invention (3) that constitute the photographic coating solution used in the present invention may be mixed in any order. Further, as an alternative preparation method, can be mentioned a method wherein a gelatin dispersion solution, prepared by previously adding the polymer latex to an aqueous gelatin solution or the coupler dispersion, is mixed with the light-sensitive silver halide emulsion. Further, to the coating solution used in the present invention, may be arbitrarily added a pH adjuster and any other photographically useful compound.

A preferable method for preparing the photographic coating solution used in the present invention includes one in which the polymer latex is added to a mixture of the coupler dispersion and the silver halide emulsion dissolved by heating to 30 to 50° C., and then photographically useful compounds and the like are added, to obtain the coating solution, and a more preferable method is one in which the polymer latex is added to a silver halide emulsion dissolved by heating to 30 to 50° C., and then the coupler dispersion, other photographically useful compounds, and the like are added, to obtain the coating solution. The heating to 30 to 50° C. in the above preparation is preferably to 35 to 45° C.

Further, another preferable preparation method uses a gelatin dispersion containing the polymer latex. That is, a method wherein a gelatin dispersion containing the polymer latex is mixed with the silver halide emulsion and the coupler dispersion, to obtain the coating solution, can be mentioned.

Preferably the photographic coating solution used in the present invention has a pH of 4.0 or more, but 6.0 or less, and more preferably 4.5 or more, but 5.8 or less. If the pH of the coating solution used in the present invention is too high, the effect of the polymer latex used in the present invention is lowered unpreferably, while if the pH of the coating solution is too low, the photographic properties are affected; for example, the components in the coating solution deposit and the fogging is increased, which is not preferred.

The polymer latex used in the present invention has a pH of generally 2.0 or more, but 6.5 or less, preferably 4.0 or more, but 6.0 or less, and most preferably 4.5 or more, but 5.5 or less.

The gelatin dispersion of the polymer latex used in the present invention has a pH of generally 3 or more, but 6.5 or less, and preferably 4.0 or more, but 6.0 or less.

The lipophilic fine particle coupler dispersion used in the photographic coating solution for use in of the present invention has preferably a pH of 4.0 or more, but 6.5 or less, and more preferably 4.5 or more, but 6.0 or less.

The silver halide photographic light-sensitive material of the present invention can be used as color negative films, color positive films, color reversal films, color reversal photographic printing papers, color photographic printing papers, and the like, and it is preferably used for color photographic printing papers inter alia.

As the photographic base (support) used in the present invention, any support can be used if it is a support on which a photographic emulsion layer can be coated (applied), such as glass, paper, and a plastic film, and a transparent-type base or a reflective-type base can be used, with preference given to a reflective-type base. As the transparent-type base, a transparent film, such as a cellulose triacetate film and a polyethylene terephthalate film; and one wherein a film, for example, of a polyester of 2,6-naphthalenedicarboxylic acid (NDCA) and ethylene glycol (EG) or a polyester of NDCA, terephthalic acid, and EG, is provided with an information recording layer, such as a magnetic layer, are preferably used. As a reflective-type base, particularly, a reflective-type base, wherein a laminate has a plurality of polyethylene layers or polyester layers and wherein at least one of such water-resistant resin layers (laminated layers) contains a white pigment, such as titanium oxide, is preferable.

Further, the above water-resistant resin layers preferably contain a fluorescent whitening agent. Further, a fluorescent whitening agent may be dispersed in the hydrophilic colloid layer of the light-sensitive material. As the fluorescent whitening agent, preferably a benzoxazole-series fluorescent whitening agent, a cumarin-series fluorescent whitening agent, or a pyrazoline-series fluorescent whitening agent can be used, and more preferably a benzoxazolylnaphthalene-series fluorescent whitening agent or a benzoxazolylstilbene-series fluorescent whitening agent is used. Specific examples of the fluorescent whitening agent that is contained in a water-resistant resin layer, include 4,4'-bis(benzoxazolyl)stylbene, 4,4'-bis(5-methylbenzoxazolyl)stylbene, and mixture of these. The amount to be used is not particularly limited, but preferably it is 1 to 100 mg/m$^2$. When it is mixed with a water-resistant resin, preferably the mixing proportion is 0.0005 to 3% by weight, and more preferably 0.001 to 0.5% by weight, to the resin.

The reflective-type base may be one wherein a hydrophilic colloid layer containing a white pigment is applied on a transparent-type base or a reflective-type base described in the above.

Further, the reflective-type base may be a base having a specular reflective- or a second-type diffusion reflective metal surface.

As a silver halide emulsion for use in the present invention, for example, a silver (iodo)chloride, a silver chloro(iodo)bromide, a silver (iodo)bromide emulsion can be used. In view of the rapid processability, the silver halide emulsion for use in the present invention is preferably a silver chloride or silver chlorobromide emulsion having a silver chloride content of 95 mol % or more, and more preferably it is a silver halide emulsion having a silver chloride content of 98 mol % or more. Among such silver halide emulsions, a silver halide emulsion having a silver bromide localized phase on the surface of silver chloride grains are particularly preferable, because high sensitivity can be obtained and the photographic properties can be stabilized.

For the above reflective-type base, silver halide emulsions, as well as different metal ion species to be doped into silver halide grains, antifoggants or storage stabilizers of silver halide emulsions, chemical sensitizing methods (sensitizers), and spectrally sensitizing methods (spectral sensitizers) for silver halide emulsions, cyan, magenta, and yellow couplers and methods for emulsifying and dispersing them, dye-image-preservability improving agents (antistaining agents and anti-fading agents), dyes (colored layers), gelatins, layer structures of light-sensitive materials, the pH of coatings of light-sensitive materials, and the like, those described in the patents shown in Tables 1 to 2 can be preferably applied in the present invention.

TABLE 1

| Element | JP-A-7-104448 | JP-A-7-77775 | JP-A-7-301895 |
|---|---|---|---|
| Reflective-type bases | Column 7, line 12 to Column 12, line 19 | Column 35, line 43 to Column 44, line 1 | Column 5, line 40 to Column 9, line 26 |
| Silver halide emulsions | Column 72, line 29 to Column 74, line 18 | Column 44, line 36 to Column 46, line 29 | Column 77, line 48 to Column 80, line 28 |
| Different metal ion species | Column 74, lines 19 to 44 | Column 46, line 30 to Column 47, line 5 | Column 80, line 29 to Column 81, line 6 |
| Storage stabilizers or antifoggants | Column 75, lines 9 to 18 | Column 47, lines 20 to 29 | Column 18, line 11 to Column 31, line 37 (Especially, mercaptheterocyclic compounds) |
| Chemical sensitizing methods (Chemical sensitizers) | Column 74, line 45 to Column 75, line 6 | Column 47, lines 7 to 17 | Column 81, lines 9 to 17 |

TABLE 1-continued

| Element | JP-A-7-104448 | JP-A-7-77775 | JP-A-7-301895 |
|---|---|---|---|
| Spectrally sensitizing methods (Spectral sensitizers) | Column 75, line 9 to Column 76, line 45 | Coiumn 47, line 30 to Column 49, line 6 | Column 81, line 21 to Column 82, line 48 |
| Cyan couplers | Column 12, line 20 to Column 39, line 49 | Column 62, line 50 to Column 63, line 16 | Column 88, line 49 to Column 89, line 16 |
| Yellow couplers | Column 87, line 40 to Column 88, line 3 | Column 63, lines 17 to 30 | Column 89, lines 17 to 30 |
| Magenta couplers | Column 88, lines 4 to 18 | Column 63, line 31 to Column 64, line 11 | Column 32, line 34 to Column 77, line 44 and column 89, lines 32 to 46 |
| Emulsifying and dispersing methods of couplers | Column 71, line 3 to Column 72, line 11 | Column 61, lines 36 to 49 | Column 87, lines 35 to 48 |

TABLE 2

| Element | JP-A-7-104448 | JP-A-7-77775 | JP-A-7-301895 |
|---|---|---|---|
| Dye-image-preservability improving agents (antistaining agents) | Column 39, line 50 to Column 70, line 9 | Column 61, line 50 to Column 62, line 49 | Column 87, line 49 to Column 88, line 48 |
| Anti-fading agents | Column 70, line 10 to Column 71, line 2 | | |
| Dyes (colored layers) | Column 77, line 42 to Column 78, line 41 | Column 7, line 14 to Column 19, line 42, and Column 50, line 3 to Column 51, line 14 | Column 9, line 27 to Column 18, line 10 |
| Geratins | Column 78, lines 42 to 48 | Column 51, lines 15 to 20 | Column 83, lines 13 to 19 |
| Layer construction of light-sensitive materials | Column 39, lines 11 to 26 | Column 44, lines 2 to 35 | Column 31, line 38 to Column 32, line 33 |
| pH of coatings of light-sensitive material | Column 72, lines 12 to 28 | | |
| Scanning exposure | Column 76, line 6 to Column 77, line 41 | Column 49, line 7 to Column 50, line 2 | Column 82, line 49 to Column 83, line 12 |
| Preservatives in developing solution | Column 88, line 19 to Column 89, line 22 | | |

As the cyan, magenta, and yellow couplers additionally used in the present invention, further, couplers described in JP-A-62-215272, page 91, right upper column, line 4 to page 121, left upper column, line 6; JP-A-2-33144, page 3, right upper column, line 14 to page 18, left upper column, the last line, and page 30, right upper column, line 6 to page 35, right lower column, line 11; and EP-A-0 355 660 (A2), page 4, line 15 to line 27, page 5, line 30 to page 28, the last line, page 45, line 29 to line 31, and page 47, line 23 to page 63, line 50, are also useful.

As fungiproofing/mildewproofing agents that can be used in the present invention, those described in JP-A-63-271247 are useful. As a hydrophilic colloid used in photographic layers that constitute the light-sensitive material, gelatin is preferable, and in particular, heavy metals contained as impurities, such as iron, copper, zinc, and manganese are 5 ppm or less and more preferably 3 ppm or less.

The light-sensitive material of the present invention is for use in not only printing systems that use usual negative printers, it is also suitable for scanning exposure systems using cathode rays (CRT).

In comparison with apparatuses using lasers, cathode ray tube exposure apparatuses are simple and compact and make the cost low. Further, the adjustment of optical axes and colors is easy.

For the cathode ray tubes used for image exposure, use is made of various emitters that emit light in spectral regions as required. For example, any one of, or a mixture of two or more of, a red emitter, a green emitter, and a blue emitter may be used. The spectral region is not limited to the above red, green, and blue, and an emitter that emits a color in the yellow, orange, purple, or infrared region may also be used. In particular, a cathode ray tube that emits white light by mixing these phosphors is often used.

When the light-sensitive material has multiple light-sensitive layers different in spectral sensitivity distributions, and the cathode ray tube has phosphors that show light emission in multiple spectral regions, multiple colors may be exposed at a time; namely, image signals of multiple colors are inputted into the cathode ray tube, to emit lights from the tube surface. A method in which exposure is made in such a manner that image signals for respective colors are inputted successively, to emit the respective colors successively, and they are passed through films for cutting out other colors (surface-successive exposure), may be employed, and generally the surface-successive exposure is preferred to make image quality high, since a high-resolution cathode ray tube can be used.

The light-sensitive material of the present invention is preferably used for digital scanning exposure system that uses monochromatic high-density light, such as a second harmonic generating light source (SHG) that comprises a combination of a nonlinear optical crystal with a semiconductor laser or a solid state laser using a semiconductor laser as an excitation light source, a gas laser, a light-emitting diode, or a semiconductor laser. To make the system compact and inexpensive, it is preferable to use a semiconductor laser or a second harmonic generating light source (SHG) that comprises a combination of a nonlinear optical crystal with a semiconductor laser or a solid state laser. Particularly, to design an apparatus that is compact, inexpensive, long in life, and high in stability, the use of a semiconductor laser is preferable, and it is preferable to use a semiconductor laser for at least one of the exposure light sources.

If such a scanning exposure light source is used, the spectral sensitivity maximum wavelength of the light-sensitive material of the present invention can arbitrarily be set by the wavelength of the light source for the scanning exposure to be used. In an SHG light source obtained by combining a nonlinear optical crystal with a semiconductor laser or a solid state laser that uses a semiconductor laser as an excitation light source, since the emitting wavelength of the laser can be halved, blue light and green light can be obtained. Therefore, the spectral sensitivity maximum of the light-sensitive material can be present in each of the usual three wavelength regions, the blue region, the green region and the red region.

If the exposure time in this scanning exposure is defined as the time for which a picture element size is exposed to light with the density of the picture element being 400 dpi, preferably the exposure time is $10^{-4}$ sec or less, more preferably $10^{-6}$ sec or less.

Preferable scanning exposure used in the present invention is described.

Preferable scanning exposure used in the present invention is that in which the overlapped width between rasters is preferably 5 to 95%, more preferably 15 to 85%, and most preferably 20 to 80%, of the effective beam diameter. Herein, the "effective beam diameter" is found in the same manner as described in JP-A-5-19423, page 4, left lower part. That is, the light-sensitive material to be used is exposed to light to one line segment using the beam of laser light of an output of 50% of the laser light strength enough to give the maximum color density in the image to be formed, and it is subjected to color-development, to obtain a linear color-formed image. The density profile of this color-formed image is measured vertically to the line segment by using a microdensitometer. The line width of the density $D_{1/5}$ corresponding to ⅕ of the maximum density $D_{max}$ of this profile is defined as the effective beam diameter.

The effective beam diameter in scanning exposure can be determined from the picture (pixel) density of the intended output image, and a preferable pixel density for a pictorial image is generally in the range of 50 to 2,000 dpi. This is about 10 to 500 μm in terms of the size of the pixel. In principle, it is impossible to write a pattern finer than the effective beam diameter, but it is also possible to use an effective beam diameter larger than the pixel. An effective beam diameter preferably used in the present invention is 5 to 200 μm, and more preferably 10 to 100 μm.

As is described above, a preferable scanning pitch in the present invention is defined by the above described distance between the rasters of the beam that scans the surface of the light-sensitive material to be exposed. In the present invention, the effective beam diameter is required to be greater than the image scanning pitch. Specifically, in the following expression, the overlap between the rasters satisfies a preferable range defined in the present invention:

$$L=d-p$$

wherein L represents an overlapped width, d represents an effective beam diameter, and p represents a scanning pitch.

Based on the above expression, a preferable scanning pitch in the present invention is 0.25 to 190 μm, and most preferably 2 to 80 μm.

A preferable beam scanning used in the present invention can be carried out by the so-called drum scanning, wherein the light-sensitive material is wound around a cylindrical drum, the drum is rotated at a high speed, to carry out the main scanning, and the light of a light source is moved gradually in the direction of the axis of the cylinder, to carry out the sub-scanning; but a method wherein the beam of light of a light source is allowed to fall on a polygonal mirror surface (polygon mirror) that is rotated at a high speed, to carry out the main scanning, and the light-sensitive material is moved in the direction vertical to that, to carry out the sub-scanning, is more preferable. The number of mirrors (planes) of the polygon mirror is not particularly limited, but it is preferably 2 to 36, and particularly preferably 6 to 14. The stable rotational frequency of the polygon mirror is preferably in the range of 4,000 to 36,000 rpm. The number of scanning lines per hour can be found by multiplying this rotational frequency by the number of mirrors.

A preferable wavelength of the light beam in the present invention can be set arbitrarily based on the spectral maximum of the light-sensitive material. Further, preferably, in the present invention, the exposure time per pixel is $10^{-4}$ sec or less, and more preferably $10^{-6}$ sec or less.

Preferable scanning exposure systems that can be applied to the present invention are described in detail in the patents listed in the above Tables.

Further, in order to process the light-sensitive material of the present invention, processing materials and processing methods described in JP-A-2-207250, page 26, right lower column, line 1, to page 34, right upper column, line 9, and in JP-A-4-97355, page 5, left upper column, line 17, to page 18, right lower column, line 20, can be preferably applied. Further, as the preservative used for this developing solution, compounds described in the patents listed in the above Tables are preferably used.

As the systems for conducting development of the light-sensitive material of the present invention after the exposure thereof, a wet system, such as the conventional method, in which development is carried out by using a developing solution containing an alkali agent and a developing agent, and a method in which a developing agent is built in the light-sensitive material and the development is carried out by using an activator solution, such as an alkali solution, free from any developing agent, as well as a heat development system that does not use a processing solution, can be used. Particularly, since the activator method does not contain a developing agent in the processing solution, the control and the handling of the processing solution are easy, and the load at the time of waste liquor treatment is less, which makes the activator method preferable in view of environmental conservation.

In the activator method, as the developing agent or its precursor to be built in the light-sensitive material, for example, hydrazine-type compounds described in JP-A-8-234388, JP-A-9-152686, JP-A-9-152693, JP-A-9-160193, and JP-A-8-287288 are preferable.

Further, a development method in which the coated amount of silver in the light-sensitive material is decreased, and an image intensification processing (intensification processing) is carried out using hydrogen peroxide, is also preferably used. Particularly, it is preferable to use this method for the activator method. Specifically, preferably use is made of image-forming methods described in JP-A-8-297354 and JP-A-9-152695, wherein an activator solution containing hydrogen peroxide is used.

In the activator method, after the processing with an activator solution, a desilvering process is generally carried out, but in the image intensifying process in which a light-sensitive material with the amount of silver lowered is used, the desilvering process can be omitted, and a simple process, such as a washing process or a stabilizing process, can be carried out. Further, in a system in which image information is read from a light-sensitive material by a scanner or the like, a processing mode without requiring a desilvering process can be employed, even when a light-sensitive material having a large amount of silver, such as a light-sensitive material for shooting (photographing), is used.

As the activator solution, the desilvering solution (bleach/fix solution), the processing material of washing and stabilizing solution, and the processing method that are used in the present invention, known ones can be used. Preferably, those described in Research Disclosure Item 36544 (September 1994), pages 536 to 541, and JP-A-8-234388, can be used.

The silver halide photographic light-sensitive material of the present invention is excellent in color reproduction and fastness of dye image, it is improved with respect to processing color contamination and cyan stain, and it is good in processing stability against color-mixing.

Further, the present invention can provide a silver halide color photographic light-sensitive material that can form a cyan dye image excellent in dye image fastness in the wide range of wavelength ranging from ultraviolet light to visible light.

Further, the present invention can provide a silver halide color photographic light-sensitive material excellent in color reproduction and fastness to light of dye image. Still further, the present invention can provide a silver halide color photographic light-sensitive material that does not bring about cyan stain in non-image areas at the time of processing.

The present invention will be described in more detail with reference to examples, but the present invention is not restricted to them.

EXAMPLES

Example 1

A paper base both surfaces of which had been coated with a polyethylene resin, was subjected to surface corona discharge treatment; then it was provided with a gelatin undercoat layer containing sodium dodecylbenzensulfonate, and it was successively coated with the first to seventh photographic constitutional layers, to prepare a sample (101) of a silver halide color photographic light-sensitive material having the layer configuration shown below. The coating solutions for each photographic constitutional layer were prepared as follows.

The term "an average grain size" in the following description means a diameter of a circle corresponding to the area of a grain that is measured by the so-called projected area method.

(Preparation of Fifth-Layer Coating Solution)

160 g of a cyan coupler (1), 250 g of a color-image-stabilizer (Cpd-1), 10 g of a color-image-stabilizer (Cpd-9), 10 g of a color-image-stabilizer (Cpd-10), 20 g of a color-image-stabilizer (Cpd-12), 14 g of an ultraviolet absorbing agent (UV-1), 50 g of an ultraviolet absorbing agent (UV-2), 40 g of an ultraviolet absorbing agent (UV-3), and 60 g of an ultraviolet absorbing agent (UV-4) were dissolved in 230 g of a solvent (Solv-6) and 350 ml of ethyl acetate, and the resulting solution was emulsified and dispersed in 6500 g of a 10% aqueous gelatin solution containing 200 ml of 10% sodium dodecylbenzensulfonate, to prepare an emulsified dispersion C.

On the other hand, a silver chiorobromide emulsion C (cubes, a mixture of a large-size emulsion C having an average grain size of 0.50 $\mu$m, and a small-size emulsion C having an average grain size of 0.41 $\mu$m (1:4 in terms of mol of silver), the deviation coefficients of the grain size distributions being 0.09 and 0.11 respectively, and each emulsion having 0.5 mol% of silver bromide locally contained in part of the grain surface whose substrate was made up of silver chloride) was prepared. To the large-size emulsion C of this emulsion, had been added $6.0\times10^{-5}$ mol, per mol of silver, of each of red-sensitive sensitizing dyes G and H shown below, and to the small-size emulsion C of this emulsion, had been added $9.0\times10^{-5}$ mol, per mol of silver, of each of red-sensitive sensitizing dyes G and H shown below. The chemical ripening of this emulsion was carried out optimally with a sulfur sensitizer and a gold sensitizer being added.

The above emulsified dispersion C and this silver chlorobromide emulsion C were mixed and dissolved, and a fifth-layer coating solution was prepared so that it would have the composition shown below. The coating amount of the emulsion is in terms of silver.

The coating solutions for the first layer to fourth layer and the sixth layer to seventh layer were prepared in the similar manner as that for the fifth layer coating solution. As the gelatin hardener for each layer, 1-oxy-3,5-dichloro-s-triazine sodium salt was used.

Further, to each layer, were added Ab-1, Ab-2, Ab-3, and Ab-4, so that the total amounts would be 15.0 mg/m$^2$, 60.0 mg/m$^2$, 5.0 mg/m$^2$, and 10.0 mg/m$^2$, respectively.

(Ab-1)

Antiseptics

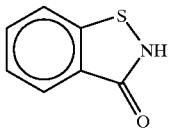

(Ab-2)

Antiseptics

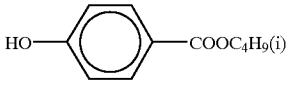

(Ab-3)

Antiseptics

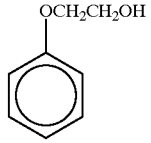

-continued (Ab-4)

Antiseptics

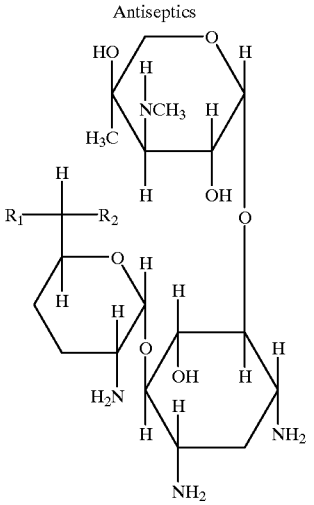

| | $R_1$ | $R_2$ |
|---|---|---|
| a | $CH_3$ | $NHCH_3$ |
| b | $CH_3$ | $NH_2$ |
| c | H | $NH_2$ |
| d | H | $NHCH_3$ |

A mixture in 1:1:1:1 (molar ratio) of a, b, c, d

For the silver chlorobromide emulsion of each photosensitive emulsion layer, the following spectral sensitizing dyes were used.

(Blue-Sensitive Emulsion Layer)

(Sensitizing dye A)

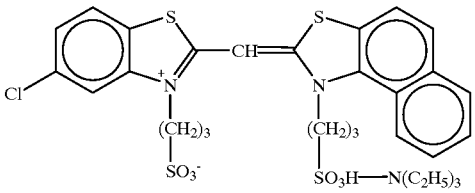

-continued (Sensitizing dye B)

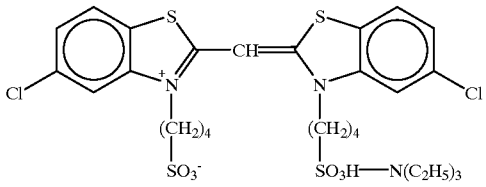

(Sensitizing dye C)

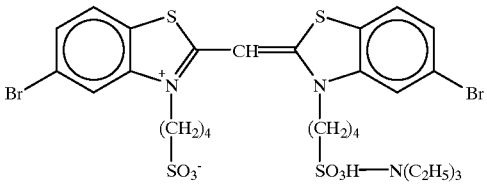

(The sensitizing dyes A, B, and C were added, respectively, to the large-size emulsion, in an amount of $1.4\times10^{-4}$ mol per mol of the silver halide, and to the small-size emulsion in an amount of $1.7\times10^{-4}$ mol per mol of the silver halide.)

(Green-Sensitive Emulsion Layer)

(Sensitizing dye D)

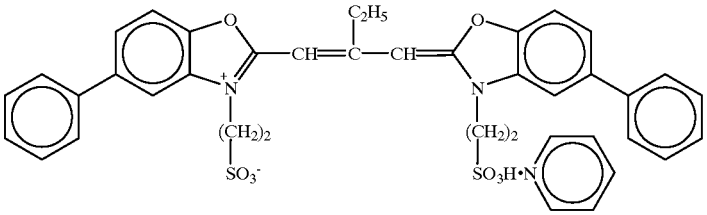

-continued (Sensitizing dye E)

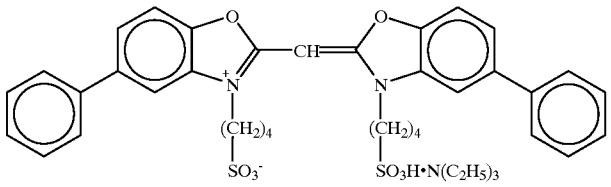

(Sensitizing dye F)

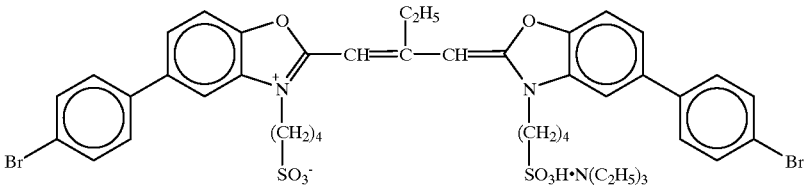

(The sensitizing dye D was added to the large-size emulsion in an amount of $3.0\times10^{-4}$ mol per mol of the silver halide, and to the small-size emulsion in an amount of $3.6\times10^{-4}$ mol per mol of the silver halide; the sensitizing dye E was added to the large-size emulsion in an amount of $4.0\times10^{-5}$ mol per mol of the silver halide, and to the small-size emulsion in an amount of $7.0\times10^{-5}$ mol per mol of the silver halide; and the sensitizing dye F was added to the large-size emulsion in an amount of $2.0\times10^{-4}$ mol per mol of the silver halide, and to the small-size emulsion in an amount of $2.8\times10^{-4}$ mol per mol of the silver halide.)

(Red-Sensitive Emulsion Layer)

(Sensitizing dye G)

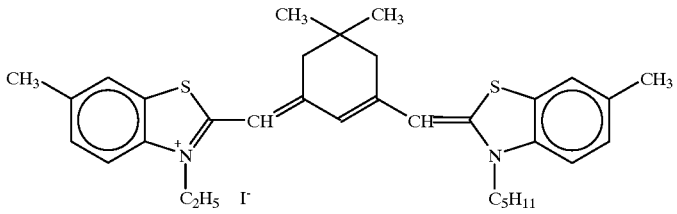

(Sensitizing dye H)

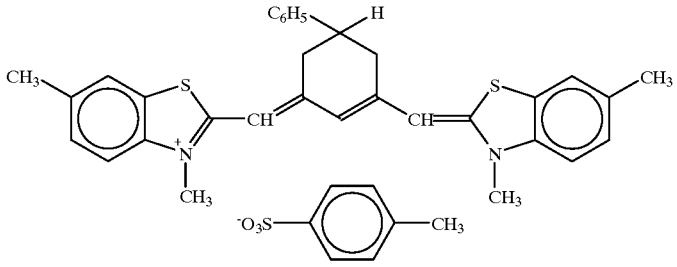

(The sensitizing dyes G and H were added, respectively, to the large-size emulsion, in an amount of $6.0\times10^{-5}$ mol per mol of the silver halide, and to the small-size emulsion in an amount of $9.0\times10^{-5}$ mol per mol of the silver halide.)

Further, the following Compound I was added to the red-sensitive emulsion layer, in an amount of $2.6\times10^{-3}$ mol, per mol of the silver halide.

(Compound I)

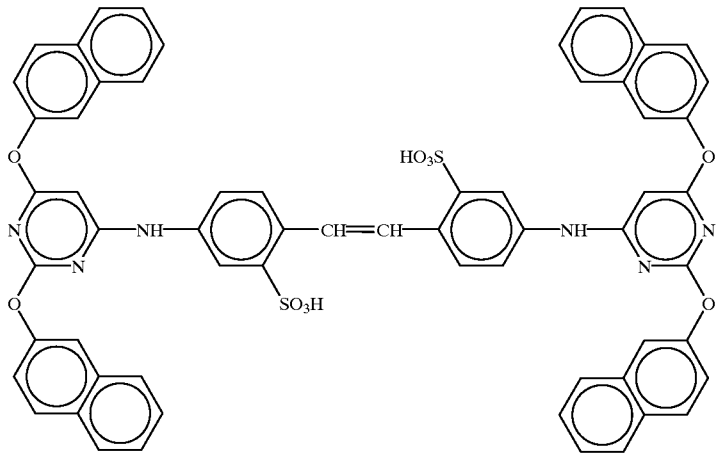

Further, to the blue-sensitive emulsion layer, the green-sensitive emulsion layer, and the red-sensitive emulsion layer, was added 1-(3-methylureidophenyl)-5-mercaptotetrazole in amounts of $3.3\times10^{-4}$ mol, $1.0\times10^{-3}$ mol, and $5.9\times10^{-4}$ mol, per mol of the silver halide, respectively.

Further, to the second layer, the fourth layer, the sixth layer, and the seventh layer, it was added in amounts of 0.2 mg/m$^2$, 0.2 mg/m$^2$, 0.6 mg/m$^2$, and 0.1 mg/m$^2$, respectively.

Further, to the blue-sensitive emulsion layer and the green-sensitive emulsion layer, was added 4-hydroxy-6-methyl-1,3,3a,7-tetrazaindene in amounts of $1\times10^{-4}$ mol and $2\times10^{-4}$ mol, respectively, per mol of the silver halide.

To the red-sensitive emulsion layer, was added a copolymer of methacrylic acid and butyl acrylate (1:1 in weight ratio; average molecular weight, 200,000 to 400,000) in an amount of 0.05g/m$^2$.

Further, to the second layer, the fourth layer, and the sixth layer, was added disodium catechol-3,5-disulfonate in amounts of 6 mg/m$^2$, 6 mg/m$^2$, and 18 mg/m$^2$, respectively.

Further, to neutralize irradiation, the following dyes were added to the emulsion layers (the coating amount is shown in parentheses).

(10 mg/m$^2$)

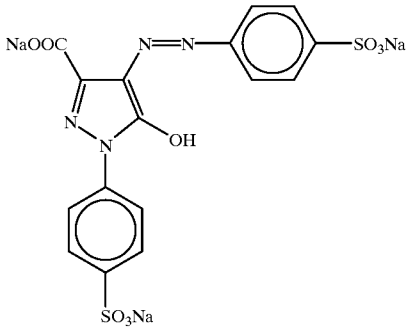

-continued (20 mg/m$^2$)

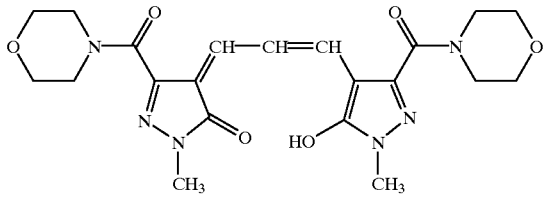

(5 mg/m$^2$)

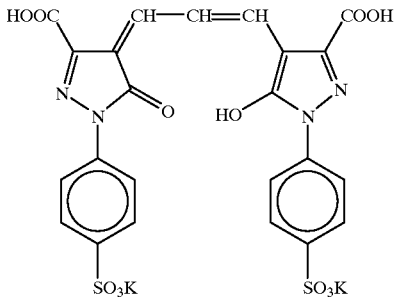

-continued (20 mg/m²)

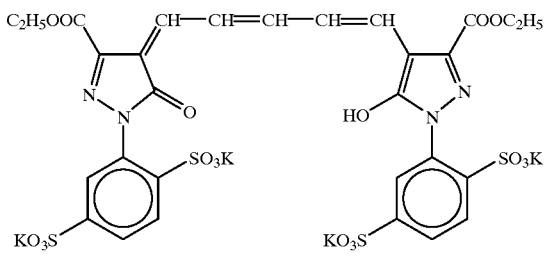

(20 mg/m²)

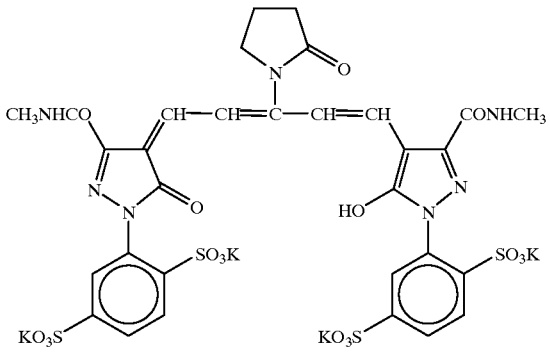

(Layer Constitution)

The composition of each layer is shown below. The numbers show coating amounts (g/m²). In the case of the silver halide emulsion, the coating amount is in terms of silver.

Base

Polyethylene Resin-Laminated Paper [The polyethylene resin on the first layer side contained a white pigment ($TiO_2$: content of 16 wt %, ZnO: content of 4 wt %), a fluorescent whitening agent (a mixture of 4,4'-bis(benzoxazoryl)stilbene and 4,4'-bis(5-methylbenzoxazoryl)stilbene (8:2): content of 0.05 wt %), and a blue dye (ultramarine)]

First Layer (Blue-Sensitive Emulsion Layer)

A silver chlorobromide emulsion (Cubes, a mixture of a large-size emulsion A having an average grain size of 0.72 μm, and a small-size emulsion A having an average grain size of 0.60 μm (3:7 in terms of mol of silver). The deviation coefficients of the grain size distributions were 0.08 and 0.10, respectively, and each emulsion had 0.3 mol % of AgBr locally contained in part of the grain surface whose substrate was made up of silver chloride.)0.26

| | |
|---|---|
| Gelatin | 1.35 |
| Yellow coupler (ExY) | 0.62 |
| Color-image stabilizer (Cpd-1) | 0.08 |
| Color-image stabilizer (Cpd-2) | 0.04 |
| Color-image stabilizer (Cpd-3) | 0.08 |
| Solvent (Solv-1) | 0.23 |
| Second Layer (Color-Mixing Inhibiting Layer) | |
| Gelatin | 0.99 |
| Color-mixing inhibitor (Cpd-4) | 0.09 |
| Color-image stabilizer (Cpd-5) | 0.018 |

-continued

| | |
|---|---|
| Color-image stabilizer (Cpd-6) | 0.13 |
| Color-image stabilizer (Cpd-7) | 0.01 |
| Solvent (Solv-1) | 0.06 |
| Solvent (Solv-2) | 0.22 |

Third Layer (Green-Sensitive Emulsion Layer)

A silver chlorobromide emulsion B (Cubes, a mixture of a large-size emulsion B having an average grain size of 0.45 μm, and a small-size emulsion B having an average grain size of 0.35 μm (1:3 in terms of mol of silver). The deviation coefficients of the grain size distributions were 0.10 and 0.08, respectively, and each emulsion had 0.4 mol % of AgBr locally contained in part of the grain surface whose substrate was made up of silver chloride.)0.14

| | |
|---|---|
| Gelatin | 1.36 |
| Magenta coupler (ExM) | 0.15 |
| Ultraviolet absorbing agent (UV-1) | 0.05 |
| Ultraviolet absorbing agent (UV-2) | 0.03 |
| Ultraviolet absorbing agent (UV-3) | 0.02 |
| Ultraviolet absorbing agent (UV-4) | 0.04 |
| Color-image stabilizer (Cpd-2) | 0.02 |
| Color-image stabilizer (Cpd-4) | 0.002 |
| Color-image stabilizer (Cpd-6) | 0.09 |
| Color-image stabilizer (Cpd-8) | 0.02 |
| Color-image stabilizer (Cpd-9) | 0.03 |
| Color-image stabilizer (Cpd-10) | 0.01 |
| Color-image stabilizer (Cpd-11) | 0.0001 |
| Solvent (Solv-3) | 0.11 |
| Solvent (Solv-4) | 0.22 |
| Solvent (Solv-5) | 0.20 |
| Fourth Layer (Color-Mixing Inhibiting Layer) | |
| Gelatin | 0.71 |
| Color-mixing inhibitor (Cpd-4) | 0.06 |
| Color-image stabilizer (Cpd-5) | 0.013 |
| Color-image stabilizer (Cpd-6) | 0.10 |
| Color-image stabilizer (Cpd-7) | 0.007 |
| Solvent (Solv-1) | 0.04 |
| Solvent (Solv-2) | 0.16 |

Fifth Layer (Red-Sensitive Emulsion Layer)

A silver chlorobromide emulsion C (Cubes, a mixture of a large-size emulsion C having an average grain size of 0.50 μm, and a small-size emulsion C having an average grain size of 0.41 μm (1:4 in terms of mol of silver). The deviation coefficients of the grain size distributions were 0.09 and 0.11, respectively, and each emulsion had 0.5 mol % of silver bromide locally contained in part of the grain surface whose substrate was made up of silver chloride.)0.20

| | |
|---|---|
| Gelatin | 1.11 |
| Cyan coupler (1) | 0.16 |
| Ultraviolet absorbing agent (UV-1) | 0.14 |
| Ultraviolet absorbing agent (UV-2) | 0.05 |
| Ultraviolet absorbing agent (UV-3) | 0.04 |
| Ultraviolet absorbing agent (UV-4) | 0.06 |
| Color-image stabilizer (Cpd-1) | 0.25 |
| Color-image stabilizer (Cpd-9) | 0.01 |
| Color-image stabilizer (Cpd-10) | 0.01 |
| Color-image stabilizer (Cpd-12) | 0.02 |
| Solvent (Solv-6) | 0.23 |

-continued

| Sixth Layer (Ultraviolet Absorbing Layer) | |
|---|---|
| Gelatin | 0.66 |
| Ultraviolet absorbing agent (UV-1) | 0.19 |
| Ultraviolet absorbing agent (UV-2) | 0.06 |
| Ultraviolet absorbing agent (UV-3) | 0.06 |
| Ultraviolet absorbing agent (UV-4) | 0.05 |
| Ultraviolet absorbing agent (UV-5) | 0.09 |

-continued

| | |
|---|---|
| Solvent (Solv-7) | 0.25 |
| Color-image stabilizer (Cpd-19) | 0.05 |
| Seventh Layer (Protective Layer) | |
| Gelatin | 1.00 |
| Acryl-modified copolymer of polyvinyl alcohol (modification degree: 17%) | 0.04 |
| Liquid paraffin | 0.02 |
| Surface-active agent (Cpd-13) | 0.01 |

The compounds used in this example and the following examples are shown below.

(ExY) Yellow coupler
A mixture in 60:40 (molar ratio) of

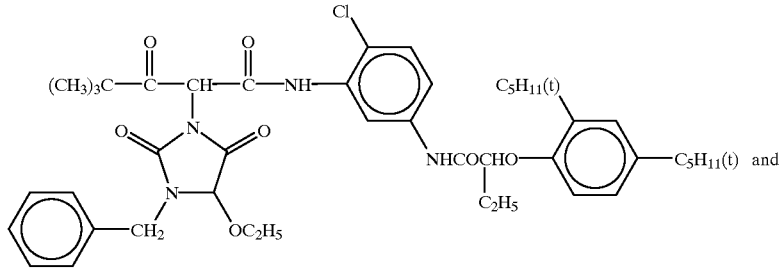

and

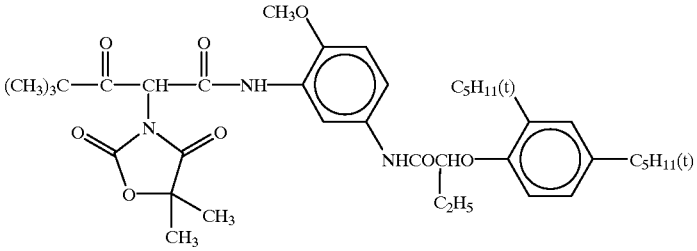

(ExM) Magenta coupler
A mixture in 60:40 (molar ratio) of

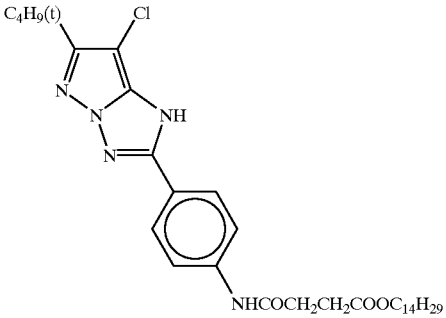

and

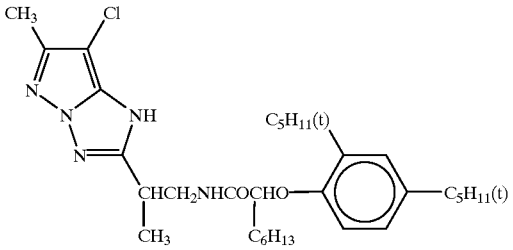

(Cpd-1) Color-image stabilizer

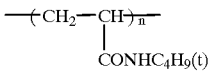

number average molecular weight 60,000

(Cpd-2) Color-image stabilizer

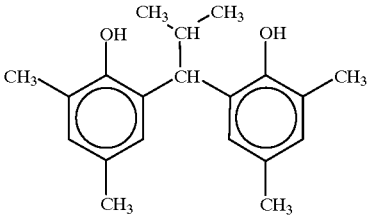

-continued
(Cpd-3) Color-image stabilizer
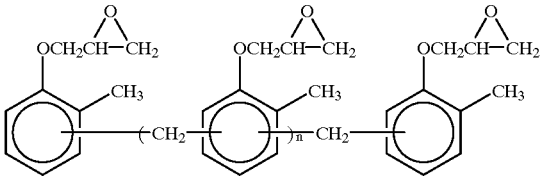
n = 7~8 (average)
(Cpd-4) Color-mixing inhibitor
A mixture in 1:1:1 (molar ratio) of
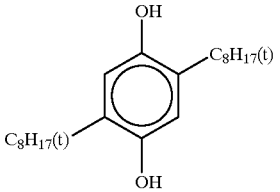
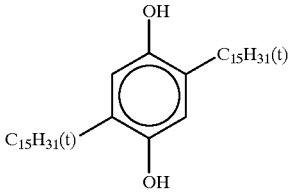
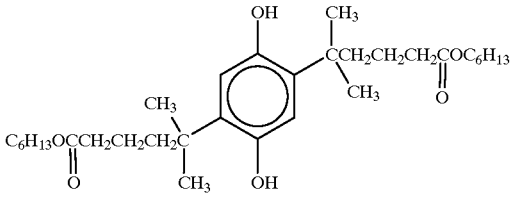
(Cpd-5) Color-mixing inhibiting auxiliary
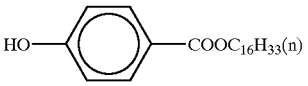
(Cpd-6) Stabilizer
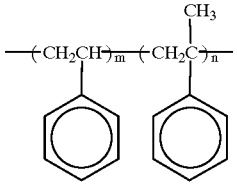
number average
molecular weight 600
$m/n$ = 10/90 (weight ratio)
(Cpd-7) Color-mixing inhibitor
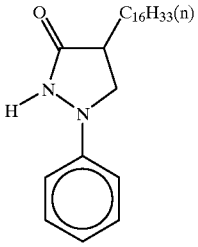
(Cpd-8) Color-image stabilizer
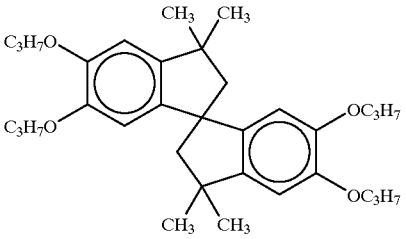
(Cpd-9) Color-image stabilizer
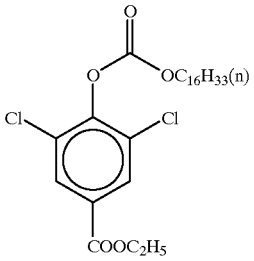
(Cpd-10) Color-image stabilizer
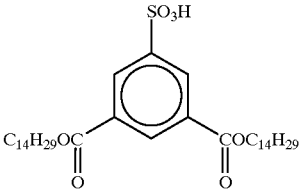

-continued
(Cpd-11)
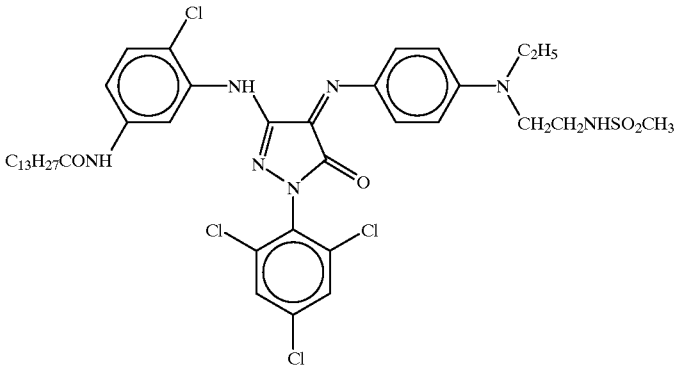
(Cpd-12) Color-image stabilizer
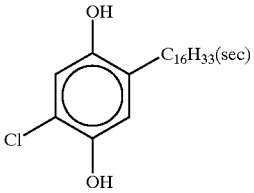
(Cpd-13) Surface-active agent
A mixture in 7:3 (molar ratio) of
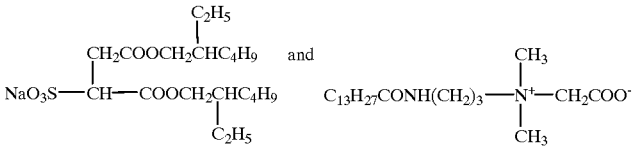
(Cpd-14)
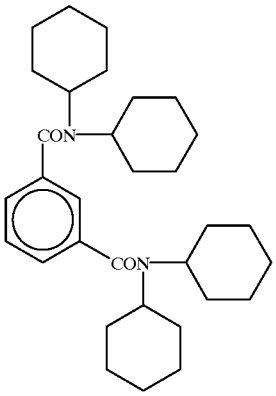
(Cpd-15)
A mixture in 1:1 (molar ratio) of
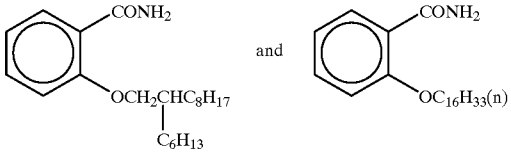
(Cpd-16)
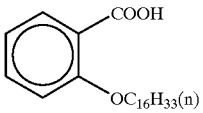
(Cpd-17)
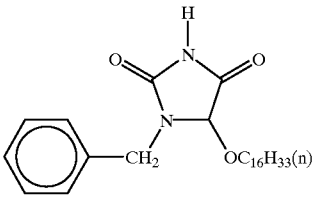

-continued
(Cpd-18)
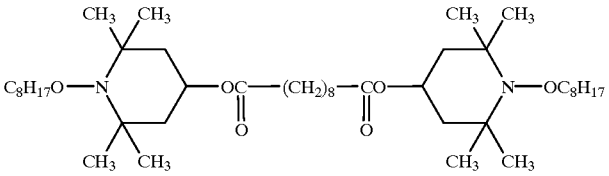
(Cpd-19)
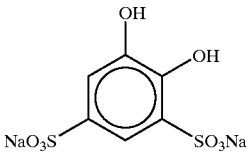
(C-1)
A mixture in 15:85 (molar ratio) of
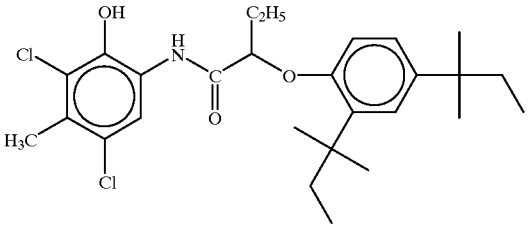
and
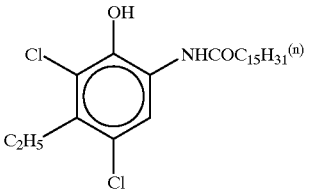
(UV-1) Ultra-violet absorbent
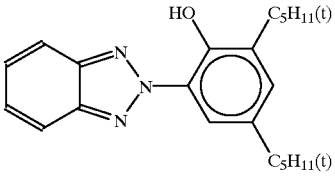
(UV-2) Ultra-violet absorbent
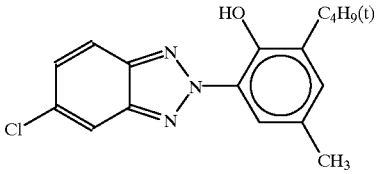
(UV-3) Ultra-violet absorbent
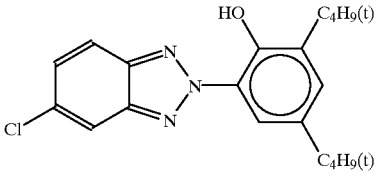
(UV-4) Ultra-violet absorbent
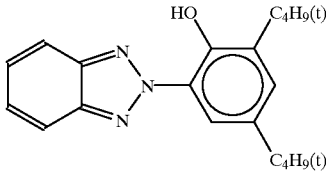
(UV-5) Ultra-violet absorbent
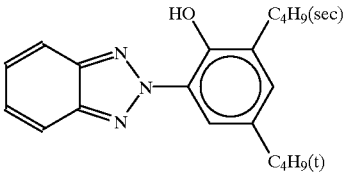
(Solv-1)
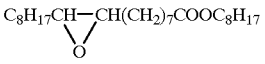
(Solv-2)
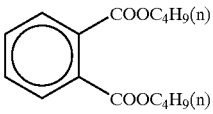
(Solv-3)
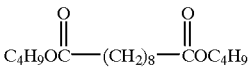

-continued (Solv-4)

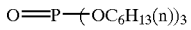

(Solv-5)

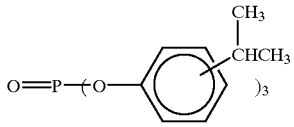

(Solv-6)

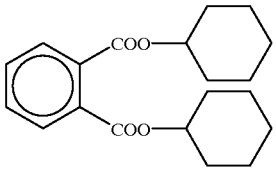

(Solv-7)

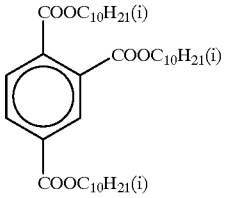

(Solv-8)

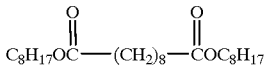

(Solv-9)

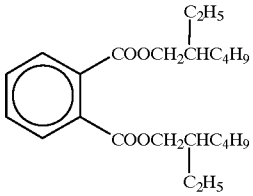

Light-Sensitive Materials 102 to 115 were prepared in the same manner as the Light-Sensitive Material 101, except that the composition in the fifth layer was changed as shown in Table 3 shown below. In these changes, the couplers of formula (II) were changed but used in equivalent moles. Further, the average grain sizes of the coupler-containing lipophilic fine grains prepared in the preparation of these samples were all in the range of 0.17 to 0.19 $\mu$m. The proportion of the compound of formula (I) and the compound of formula (II) is shown in molar ratio(%).

TABLE 3

| Sample No. | Coupler of formula(II) | Compound of formula(I) | Ratio of (I) to (II) | Fastness to light (remaining ratio %) | Remarks |
|---|---|---|---|---|---|
| 101 | 1 | — | — | 65 | Comparative example |
| 102 | 1 | a | 30 | 69 | Comparative example |
| 103 | 1 | b | 30 | 71 | Comparative example |
| 104 | 1 | A-1 | 30 | 89 | This invention |
| 105 | 1 | A-2 | 30 | 89 | This invention |
| 106 | 1 | A-3 | 30 | 87 | This invention |
| 107 | 1 | A-4 | 30 | 89 | This invention |
| 108 | 1 | A-8 | 30 | 90 | This invention |
| 109 | 1 | A-10 | 30 | 86 | This invention |
| 110 | 2 | A-1 | 15 | 84 | This invention |
| 111 | 3 | A-2 | 20 | 87 | This invention |

TABLE 3-continued

| Sample No. | Coupler of formula(II) | Compound of formula(I) | Ratio of (I) to (II) | Fastness to light (remaining ratio %) | Remarks |
|---|---|---|---|---|---|
| 112 | 4 | A-3 | 10 | 79 | This invention |
| 113 | 5 | A-4 | 20 | 85 | This invention |
| 114 | 6 | A-5 | 20 | 84 | This invention |
| 115 | 7 | A-6 | 15 | 81 | This invention |

Further, the comparative compounds a and b shown in the Table were as follows.

Comparative compound a

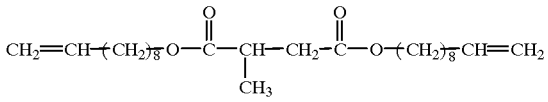

(Compound example S-112 described in JP-A-8-44015)

Comparative compound b

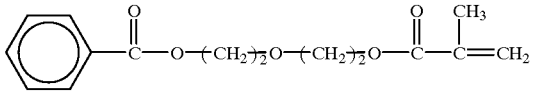

(Compound example S-103 described in JP-A-8-44015)

First, Light-Sensitive Material 104 was exposed to light image-wise, so that about 30% of the coated amount of silver would be subjected to development, and it was continuously processed using a paper processor, until the replenishment rate of the color-developing solution in the following processing steps became twice the volume of the tank.

| Processing step | Temperature | Time | Replenishment rate | Tank volume |
|---|---|---|---|---|
| Color development | 38.5° C. | 45 sec | 73 ml | 500 ml |
| Bleach-fix | 30–35° C. | 45 sec | 60 ml | 500 ml |
| Rinse (1) | 30–35° C. | 20 sec | — | 500 ml |
| Rinse (2) | 30–35° C. | 20 sec | — | 500 ml |
| Rinse (3) | 30–35° C. | 20 sec | 370 ml | 500 ml |
| Drying | 70–80° C. | 60 sec | | |

The replenishment rate was the amount per $m^2$ of the light-sensitive material.

(the rinse was conducted in a 3-tank counter-current system of Rinse (3) to Rinse (1))

The composition of each processing solution is shown below.

| Color Developing Solution | Tank solution | Replenisher |
|---|---|---|
| Water | 700 ml | 700 ml |
| Sodium triisopropylene(β) sulfonate | 0.1 g | 0.1 g |
| Ethylenediaminetetraacetic acid | 3.0 g | 3.0 g |
| Disodium 1,2-dihydroxybenzene-4,6-disulfonate | 0.5 g | 0.5 g |
| Triethanolamine | 12.0 g | 12.0 g |
| Potassium chloride | 6.5 g | — |
| Potassium bromide | 0.03 g | — |
| Potassium carbonate | 27.0 g | 27.0 g |
| Fluorescent whitening agent (WHITEX 4, trade name, made by Sumitomo Chemical Ind. Co.) | 1.0 g | 3.0 g |
| Sodium sulfite | 0.1 g | 0.1 g |
| Diethylhydroxylamine | 1.1 g | 1.1 g |
| Disodium-N,N-bis(sulfonatoethyl)-hydroxylamine | 10.0 g | 13.0 g |
| N-ethyl-N-(β-methane-sulfonamidoethyl)-3-methyl-4-aminoaniline sulfate | 5.0 g | 11.5 g |
| Water to make | 1000 ml | 1000 ml |
| pH (25° C.) | 10.0 | 11.0 |

Bleach-fixing Solution (Both Tank Solution and Replenisher)

| | |
|---|---|
| Water | 600 ml |
| Ammonium thiosulfate (700 g/liter) | 100 ml |
| Ammonium sulfite | 40 g |
| Etylenediaminetetraacetic acid iron(III) ammonium | 55 g |
| Ethylenediaminetetraacetic acid disodium | 5 g |
| Ammonium bromlde | 40 g |
| Nitric acid (67%) | 30 g |
| Water to make | 1000 ml |
| pH (25° C.) | 4.8 |

Rinse Solution (Both Tank Solution and Replenisher)

Ion-exchanged Water (Calcium and Magnesium each were 3 ppm or Below.)

Then, the respective samples were subjected to gradation exposure to light through a three-color separation optical wedge for sensitometry using a sensitometer (FWH type, manufactured by Fuji Photo Film Co., Ltd.; color temperature of the light source: 3,200° K). This exposure was carried out such that the exposure amount would be 250 CMS by the exposure time of 0.1 sec.

These samples were subjected to the following evaluations:

Evaluation 1 (color-forming property: Dmax)

The exposed samples were processed with the above running solutions by using a paper processor. The maximum color density (Dmax) of cyan in the cyan color-formed section (red-exposed section) of each of the processed samples was measured by an X-Rite 350 densitometer (manufactured by The X-Rite Company).

Evaluation 2 (cyan stain at the time of processing)

The difference between the cyan density of the Dmin section of each of the samples that were processed with a bleach-fix solution for cyan stain at the time of processing, which solution was prepared by changing the amount of ammonium sulfite contained in the above shown bleach-fix solution from 40 g to 4.0 g, and by changing the pH from 4.8 to 8.0, and the cyan density of the Dmin section of each of the samples that were processed with the above described bleach-fix solution, was determined, to designate this difference as cyan stain at the time of processing.

Evaluation 3 (fastness to light)

Each of the samples processed in the processing steps in Evaluation I was irradiated with light for 14 days using a xenon irradiator of 100,000 lux. During the irradiation, a heat-absorbing filter and an ultraviolet-absorbing filter, in the latter filter the light transmittance at 370 nm being 50%, were used. The cyan density residual rate (%) after the irradiation with light, at the points where the cyan density before the irradiation with light was 0.5, was found, to evaluate fastness to light. The evaluation results are also shown in Table 3.

In each of samples, a cyan image having a high density was obtained.

It can be understood that the samples containing the compound according to the present invention was excellent in fastness to light, than samples containing a conventionally known compound a or b, from the comparison between samples 102, 103 and 104 to 115.

Example 2

Samples 201 to 210 were prepared in the same manner as in Sample 101 in Example 1, except that the composition in the fifth layer was changed as shown in Table 4 shown below. Thereafter Samples 201 to 210 were exposed to light and subjected to development in the same manner as in Example 1, to evaluate various items. In passing, in the evaluation of fastness to light, the data of the initial density of 2.0 (Do: 2.0) are shown.

TABLE 4

| Sample No. | Compound of formula (II) | Compound of formula (I)[1)] | Compound of formula (IV)[2)] | Fastness to light (remaining ratio %) | Cyan stain at processing | Remarks |
|---|---|---|---|---|---|---|
| 201 | 1 | A-1 | — | 89 | 0.05 | This invention |
| 202 | 1 | A-1 | ph-52 | 94 | 0.01 | This invention |
| 203 | 1 | A-3 | ph-3 | 92 | 0.01 | This invention |

TABLE 4-continued

| Sample No. | Compound of formula (II) | Compound of formula (I)[1)] | Compound of formula (IV)[2)] | Fastness to light (remaining ratio %) | Cyan stain at processing | Remarks |
|---|---|---|---|---|---|---|
| 204 | 1 | A-4 | ph-4 | 92 | 0.01 | This invention |
| 205 | 1 | A-5 | ph-6 | 93 | 0.01 | This invention |
| 206 | 2 | A-6 | ph-6 | 91 | 0.01 | This invention |
| 207 | 3 | A-7 | ph-9 | 92 | 0.01 | This invention |
| 208 | 4 | A-8 | ph-20 | 91 | 0.01 | This invention |
| 209 | 5 | A-9 | ph-19 | 92 | 0.01 | This invention |
| 210 | 13 | A-10 | ph-29 | 91 | 0.01 | This invention |

Note [1)]The added amount was 30 mol % to the compound of formula(II).
[2)]The added amount was 25 mol % to the compound of formula(II).

As is apparent from Table 4, it can be understood that, when the cyan coupler of formula (II) and the vinyl compound of formula (I) defined in the present invention were used in combination, and the compound represented by formula (VI) was also used, the effect of the present invention could be further more effectively exhibited.

Example 3

Sample 301 was prepared in the same manner as Sample 101 in Example 1, except that the coating solution for the fifth layer was changed as shown below.

Samples 302 to 308 were prepared in the same manner as the thus-prepared Light-sensitive material 301, further adding the compound of formula (I) shown in Table 5 below. The obtained results are shown in Table 5.

TABLE 5

| Sample No. | Compound of formula (II) | Compound of formula (I)* | Fastness to light (remaining ratio %) | Stain at processing | Remarks |
|---|---|---|---|---|---|
| 301 | 1 | — | 91 | 0.01 | Comparative example |
| 302 | 1 | A-1 | 95 | 0.01 | This invention |
| 303 | 1 | A-3 | 96 | 0.01 | This invention |
| 304 | 1 | A-4 | 94 | 0.01 | This invention |
| 305 | 2 | A-6 | 95 | 0.01 | This invention |
| 306 | 3 | A-10 | 96 | 0.01 | This invention |
| 307 | 4 | A-11 | 95 | 0.01 | This invention |
| 308 | 13 | A-13 | 95 | 0.01 | This invention |

Note *The added amount of the compound of formula(I) was 30 mol % to the compound of formula(II).

From the results shown in Table 5, it can be understood that, in comparison with Sample 301, having a fifth layer that contained Color-image stabilizer (Cpd-7) and Light-fading preventing agent (C-1), in the cases of Samples 302 to 308, which contained additionally the compound of formula (I), the fastness to light was more remarkably (ultraadditively) improved, while the stain at the time of the processing was not impaired by the addition of the compound of formula (I).

| Fifth Layer (Red-Sensitive Emulsion Layer) | |
|---|---|
| A silver chlorobromide emulsion C (Cubes, a mixture of a large-size emulsion C having an average grain size of 0.50 μm, and a small-size emulsion C having an average grain size of 0.41 μm (1:4 in terms of mol of silver). The deviation coefficients of the grain size distributions were 0.09 and 0.11, respectively, and each emulsion had 0.5 mol % of silver bromide locally contained in part of the grain surface whose substrate was made up of silver chloride.) | 0.12 |
| Gelatin | 1.11 |
| Cyan coupler (1) | 0.16 |
| Color-image stabilizer (Cpd-1) | 0.05 |
| Color-image stabilizer (Cpd-6) | 0.05 |
| Color-image stabilizer (Cpd-7) | 0.02 |
| Color-image stabilizer (Cpd-9) | 0.04 |
| Color-image stabilizer (Cpd-10) | 0.01 |
| Color-image stabilizer (Cpd-14) | 0.01 |
| Color-image stabilizer (Cpd-15) | 0.06 |
| Color-image stabilizer (Cpd-16) | 0.09 |
| Color-image stabilizer (Cpd-17) | 0.09 |
| Color-image stabilizer (Cpd-18) | 0.01 |
| Solvent (Solv-5) | 0.15 |
| Solvent (Solv-8) | 0.05 |
| Solvent (Solv-9) | 0.10 |
| Light fading preventing agent (C-1) | 0.03 |

Example 4

Light-Sensitive Materials (401) to (408) were prepared in the same manner as in Light-Sensitive Material 104 prepared in Example 1, except that the constitution of the fifth layer was changed in such a manner that the used amounts of the cyan couplers represented by formula (II) or (C) were changed as shown in Table 6 below, and that the polymer latex represented by formula (L) was used. With respect to these light-sensitive materials, the following color reproduction evaluation and processing stability evaluation were carried out, and the fastness to light was evaluated in the same manner as in Example 1. As a result, the results shown in Table 7 below were obtained.

(Evaluation of Color Reproduction)

The value of the yellow density at a cyan color-formed density of 1.8 was designated D-y. It is indicated that the smaller the value of D-y is, the smaller the yellow component in the cyan color-formed section is, and the better the color reproduction is.

(Processing Stability)

Before and after the running processing of Example 1, development processing was carried out, to measure the cyan maximum color density (Dmax), and the value obtained by subtracting the value of Dmax obtained by using the processing solution after the running processing from the value of Dmax obtained by using the processing solution before the running processing, was designated ΔDmax. It is indicated that the smaller the value of ΔDmax is, the better the processing stability is.

TABLE 6

| Sample | Coupler of formula(II) | | Coupler of formula(C)* | | Molar ratio of couplers | Polymer of formula(L) | | |
|---|---|---|---|---|---|---|---|---|
| No. | No. | g/m² | No. | g/m² | (C)/(II) (%) | No. | g/m² | Remarks |
| 104 | 1 | 0.23 | — | — | 0 | — | — | This invention |
| 401 | 1 | 0.16 | — | — | 0 | — | — | This invention |
| 402 | 1 | 0.15 | C-11 | 0.02 | 19 | P-3 | 0.06 | This invention |
| 403 | 1 | 0.13 | C-1<br>C-11 | 0.02<br>0.02 | 37<br>(Sum of C-1 and C-11) | P-3 | 0.06 | This invention |
| 404 | 1 | 0.13 | C-1 | 0.05 | 50 | P-3 | 0.06 | This invention |
| 405 | 1 | 0.13 | C-11 | 0.05 | 56 | P-3 | 0.10 | This invention |
| 406 | 1 | 0.12 | C-1 | 0.07 | 76 | P-3 | 0.06 | This invention |
| 407 | 1 | 0.13 | C-1 | 0.05 | 50 | — | — | This invention |
| 408 | — | — | C-1 | 0.35 | ∞ | P-3 | 0.10 | Comparative example |

*Compounds with a number described in JP-A-9-288337, pages 17 to 18
C-I: 2,4-dicloro-6-[α-(2,4-di-t-amylphenoxy)butyrylamino]-3-methylphenol
C-II: 3-ethyl-2,4-dichloro-6-palmitoylaminophenyl

TABLE 7

| Sample No. | Color reproduction D-y | Processing stability Δ D max | Fastness to light (remaining ratio %) | Remarks |
|---|---|---|---|---|
| 401 | 0.23 | 0.01 | 88 | This invention |
| 402 | 0.23 | 0.02 | 91 | This invention |
| 403 | 0 23 | 0.02 | 92 | This invention |
| 404 | 0.24 | 0.03 | 92 | This invention |
| 405 | 0.24 | 0.02 | 92 | This invention |
| 406 | 0.27 | 0.05 | 92 | This invention |
| 407 | 0.24 | 0.09 | 92 | This invention |
| 408 | 0.45 | 0.11 | 92 | Comparative example |

As is apparent from the results shown in Table 7, it can be understood that the constitution of the present invention, containing the compound of formula (I) and the cyan couplers of formula (II) and (C), attains excellent color reproduction and fastness to light. The constitution of the present invention that further contains the polymer of formula (L) additionally brings about an excellent result of processing stability.

Example 5

A paper base both surfaces of which had been laminated with polyethylene, was subjected to surface corona discharge treatment; then it was provided with a gelatin undercoat layer containing sodium dodecylbenzensulfonate, and it was successively coated with the various photographic constitutional layers, to prepare a multi-layer color photographic paper (501) having the layer configuration shown below.

The coating solutions for each photographic constitutional layer were prepared as follows.

(Preparation of Fifth-Layer Coating Solution)

10 g of the above Exemplified compound (1) of the coupler represented by formula (1) was dissolved along with 10 g of a solvent (Solv-8), 3.3 g of a solvent (Solv-9), 2.7 g of a color-image-stabilizer (Cpd-7), 7.3 g of a color-image-stabilizer (Cpd-15), 0.67 g of a color-image-stabilizer (Cpd-13), 7.3 g of a color-image-stabilizer (Cpd-16), 10 g of a color-image-stabilizer (Cpd-17), 0.67 g of a color-image-stabilizer (Cpd-6), 5.3 g of a color-image-stabilizer (Cpd-8), and 6.7 g of a color-image-stabilizer (Cpd-18), in 50 ml of ethyl acetate, and the resulting solution was emulsified and dispersed in 400 g of a 12% aqueous gelatin solution containing 2.2 g of a surface active agent (Cpd-12), to prepare an emulsified dispersion C having an average grain size of 0.15 μm.

(Cpd-6) Color-image stabilizer

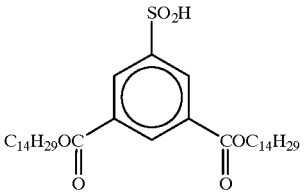

-continued (Cpd-7) Color-image stabilizer

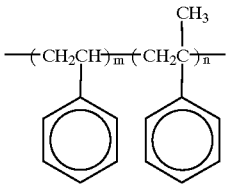

number average
molecular weight 600
$m/n$ = 10/90

(Cpd-8) Color-image stabilizer

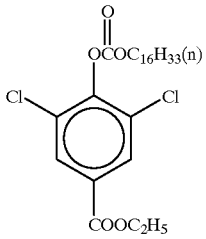

(Cpd-12) Surface-active agent
A mixture in 1:1 of (1) and (2)

(1)

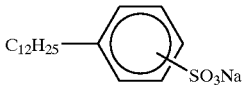

(2)

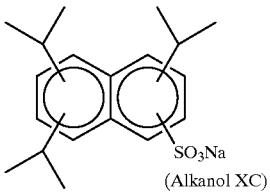

(Alkanol XC)

cpd13

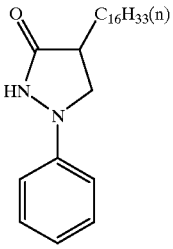

cpd15

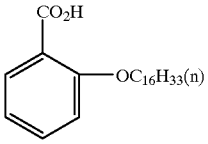

-continued cpd16

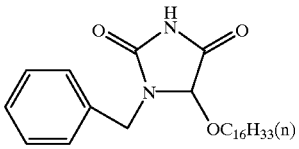

cpd17

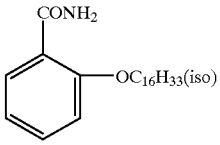

cpd18

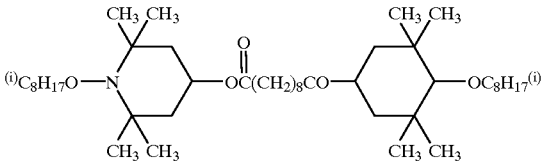

(Solv-8) Solvent

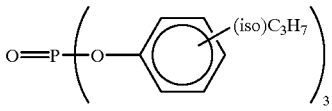

(Solv-9) Solvent

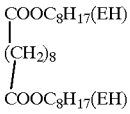

On the other hand, a silver chlorobromide emulsion C (cubes, a mixture of a large-size emulsion C having an average grain size of 0.50 $\mu$m, and a small-size emulsion C having an average grain size of 0.41 $\mu$m (1:4 in terms of mol of silver), the deviation coefficients of the grain size distributions being 0.09 and 0.11 respectively, and each emulsion having 0.8 mol % of silver bromide locally contained in part of the grain surface whose substrate was made up of silver chloride) was prepared. To the large-size emulsion C of this emulsion, had been added $5.0\times10^{-5}$ mol, per mol of silver, of each of red-sensitive sensitizing dyes G and H shown below, and to the small-size emulsion C of this emulsion, had been added $8.0\times10^{-5}$ mol, per mol of silver, of each of red-sensitive sensitizing dyes G and H shown below. Further, Additive X was added in an amount of 2.6×10–3, per mol of the silver halide. Further, 1-(5-methylureidophenyl)-5-mercaptotetrazole was added in an amount of $5.9\times10^{-4}$ mol, per mol of the silver halide. The chemical ripening of this emulsion was carried out optimally with a sulfur sensitizer and a gold sensitizer being added.

Sensitizing dye G

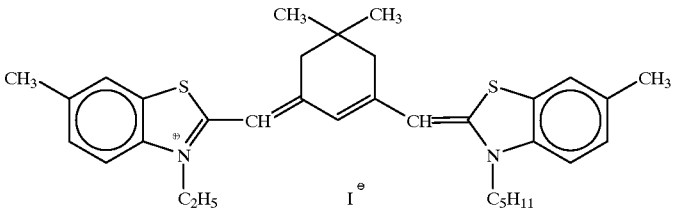

Sensitizing dye H

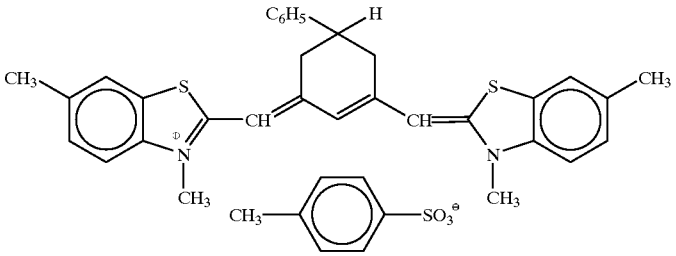

Additive X

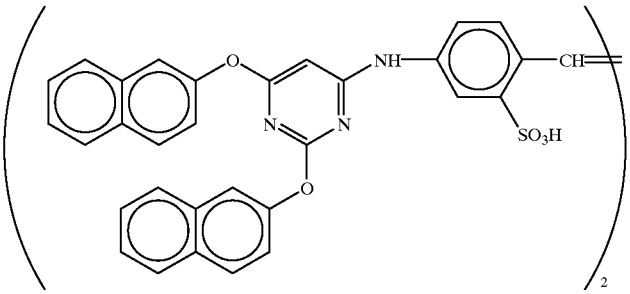

The above emulsified dispersion C and this silver chlorobromide emulsion C were mixed and dissolved, to prepare a fifth-layer coating solution. The coating amount of the emulsion is in terms of silver.

The coating solutions for the first layer to fourth layer and the sixth layer to seventh layer were prepared in the similar manner as that for the fifth layer coating solution, using each composition for the layer constitution described blow. These coating solutions were coated within 15 minutes after the preparation. As the gelatin hardener for each layer, 1-oxy-3,5-dichloro-s-triazine sodium salt was used.

Further, to each layer, were added the following AS-1, AS-2, AS-3, and AS-4, so that the total amounts would be 15.0 mg/m$^2$, 6.0 mg/m$^2$, 5.0 mg/m$^2$, and 10.0 mg/m$^2$, respectively.

(AS-1) Antiseptics

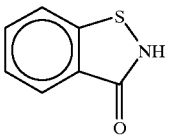

(AS-2) Antiseptics

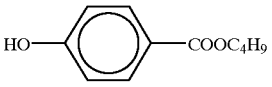

-continued (AS-3) Antiseptics

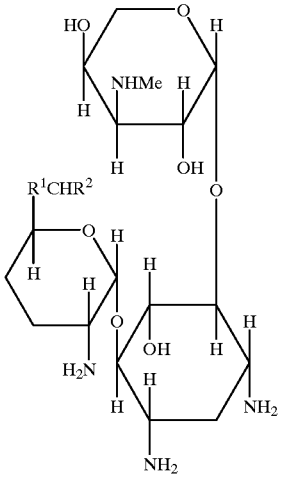

| | $R^1$ | $R^2$ |
|---|---|---|
| a | —Me | —NHMe |
| b | —Me | —$NH_2$ |
| c | —H | —$NH_2$ |
| d | —H | —NHMe |

A mixture in 1:1:1:1 (weight ratio) of a, b, c, and d

-continued (AS-4) Antiseptics

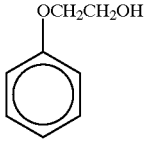

The silver chlorobromide emulsions A and B for each photosensitive emulsion layer were prepared in the same manner as the chloroboromide emulsion C, except that the following spectral sensitizing dyes were used, and the additive X was not added.

To the silver chlorobromide emulsion A for the blue-sensitive emulsion layer, the following sensitizing dyes A, B, and C were added, respectively, to the large-size emulsion, in an amount of $1.4\times10^{-4}$ mol per mol of the silver halide, and to the small-size emulsion in an amount of $1.7\times10^{-4}$ per mol of the silver halide.

Sensitizing dye A

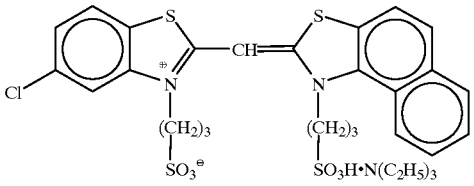

-continued

Sensitizing dye B

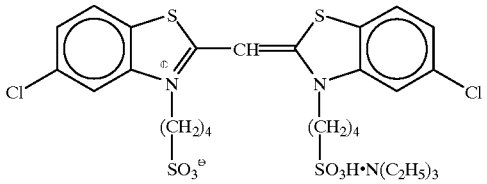

Sensitizing dye C

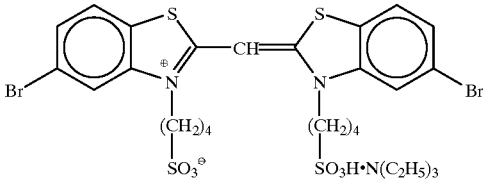

To the silver chlorobromide emulsion B for the green-sensitive emulsion layer, the sensitizing dye D was added to the large-size emulsion in an amount of $3.0\times10^{-4}$ mol per mol of the silver halide, and to the small-size emulsion in an amount of $3.6\times10^{-4}$ mol per mol of the silver halide; the sensitizing dye E was added to the large-size emulsion in an amount of $4.0\times10^{-5}$ mol per mol of the silver halide, and to the small-size emulsion in an amount of $7.0\times10^{-5}$ mol per mol of the silver halide; and the sensitizing dye F was added to the large-size emulsion in an amount of $2.0\times10^{-4}$ mol per mol of the silver halide, and to the small-size emulsion in an amount of $2.8\times10^{-4}$ mol per mol of the silver halide.

Sensitizing dye D

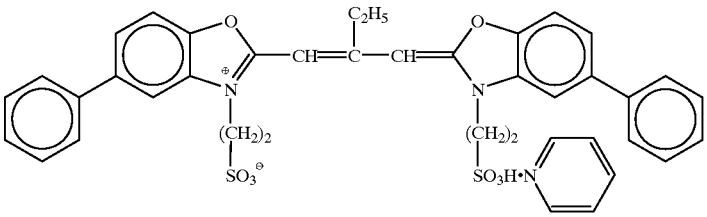

Sensitizing dye E

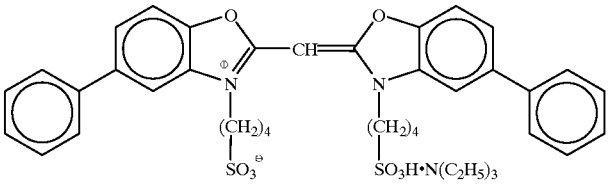

-continued

Sensitizing dye F

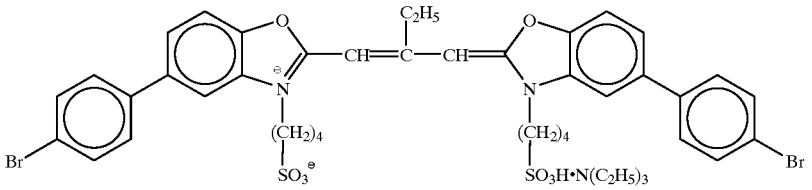

Further, to the silver chlorobromide emulsion A for the blue-sensitive emulsion layer, and the silver chlorobromide emulsion B for the green-sensitive emulsion layer, was added 1-(5-methylureidophenyl)-5-mercaptotetrazole in amounts of $3.3\times10^{-4}$ mol, and $1.0\times10^{-3}$ mol, per mol of the silver halide, respectively.

Further, to the second layer, the fourth layer, the sixth layer, and the seventh layer, it was added in amounts of 0.2 mg/m$^2$, 0.2 mg/m$^2$, 0.6 mg/m$^2$, and 0.1 mg/m$^2$, respectively.

Further, to the blue-sensitive emulsion layer and the green-sensitive emulsion layer, was added 4-hydroxy-6-methyl-1,3,3a,7-tetrazaindene in amounts of $1\times10^{-4}$ mol and $2\times10^{-4}$ mol, respectively, per mol of the silver halide.

Further, as an irradiation-neutralizing water-soluble dye, the following compounds were added to the second, the fourth, and the sixth layers, with separated.

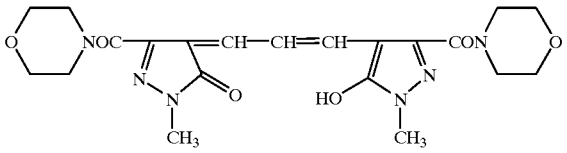

(15 mg/m$^2$)

and

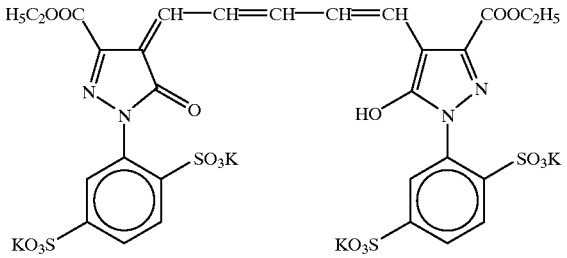

(40 mg/m$^2$)

and

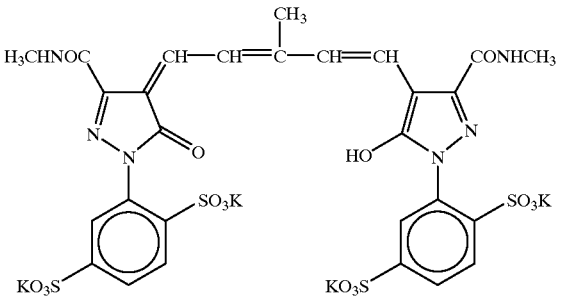

(20 mg/m$^2$)

and

-continued

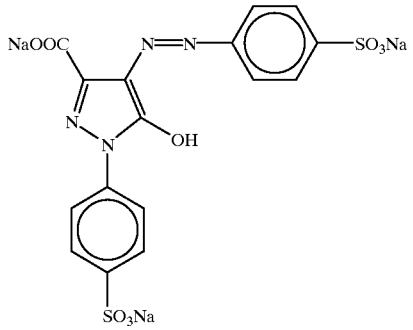

(5 mg/m$^2$)

(Layer Constitution)

The composition of each layer is shown below. The numbers show coating amounts (g/m$^2$). In the case of the silver halide emulsion, the coating amount is in terms of silver.

Base

Polyethylene Laminated Paper

[The polyethylene on the first layer side contained a white pigment ($TiO_2$: content of 15 wt %), and a blue dye (ultramarine)]

| First Layer (Blue-Sensitive Emulsion Layer) | |
|---|---|
| A silver chlorobromide emulsion A (Cubes, a mixture of a large-size emulsion A having an average grain size of 0.88 μm, and a small-size emulsion A having an average grain size of 0.70 μm (3:7 in terms of mol of silver). The deviation coefficients of the grain size distributions were 0.08 and 0.10, respectively, and each emulsion had 0.3 mol % of silver bromide locally contained in part of the grain surface whose substrate was made up of silver chloride.) | 0.26 |
| Gelatin | 1.4 |
| Yellow coupler (ExY) | 0.64 |
| Color-image stabilizer (Cpd-1) | 0.078 |
| Color-image stabilizer (Cpd-2) | 0.038 |
| Color-image stabilizer (Cpd-3) | 0.085 |
| Color-image stabilizer (Cpd-5) | 0.020 |
| Color-image stabilizer (Cpd-9) | 0.005 |
| Solvent (Solv-1) | 0.11 |
| Solvent (Solv-6) | 0.11 |

(ExY) Yellow coupler (ExY-1)

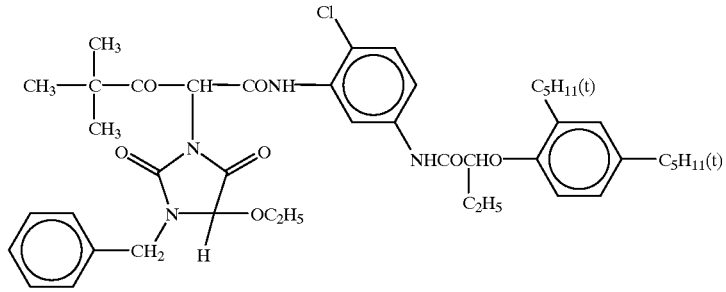

(ExY-2)

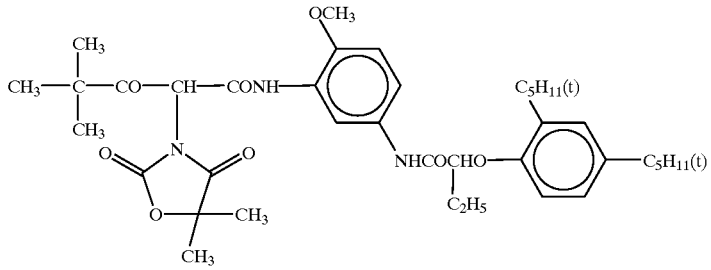

-continued (ExY-3)

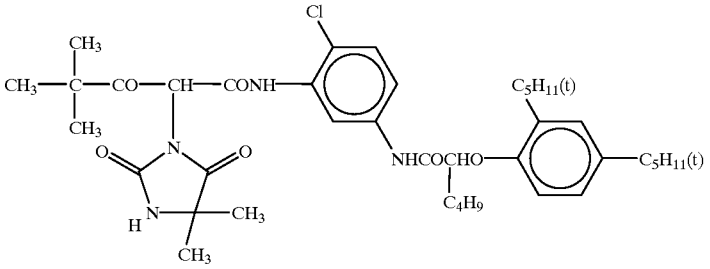

A mixture in 1:1:1 (molar ratio)

(Cpd-1) Color-image stabilizer

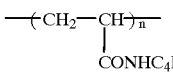

average molecular weight 60,000

(Cpd-2) Color-image stabilizer

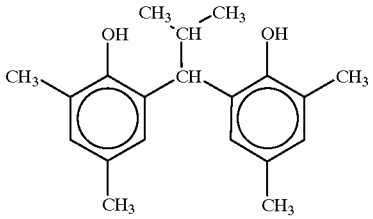

(Cpd-3) Color-image stabilizer

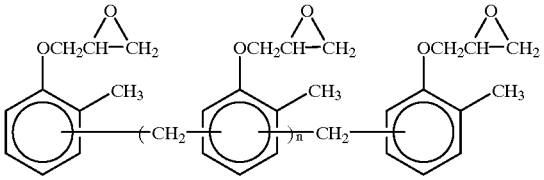

(n = 0 to 15, average 7 to 8)

(Cpd-5) Color-image stabilizer

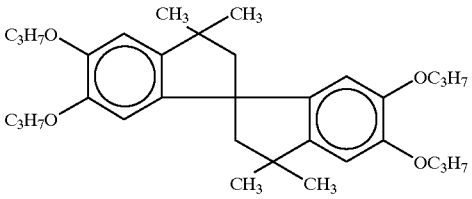

(Cpd-9) Color-image stabilizer

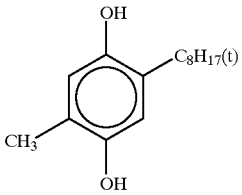

(Solv-1) Solvent

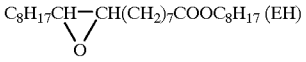

-continued (Solv-6) Solvent

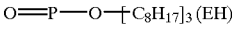

| Second Layer (Color-Mixing Inhibiting Layer) | |
|---|---|
| Gelatin | 1.0 |
| Color-mixing inhibitor (Cpd-4) | 0.11 |
| Solvent (Solv-1) | 0.06 |
| Solvent (Solv-2) | 0.22 |
| Solvent (Solv-3) | 0.08 |
| Solvent (Solv-7) | 0.01 |
| Ultraviolet absorbing agent (UV-B) | 0.07 |

(Cpd-4) Color-mixing inhibitor
A mixture in 1:1:1 (weight ratio) of

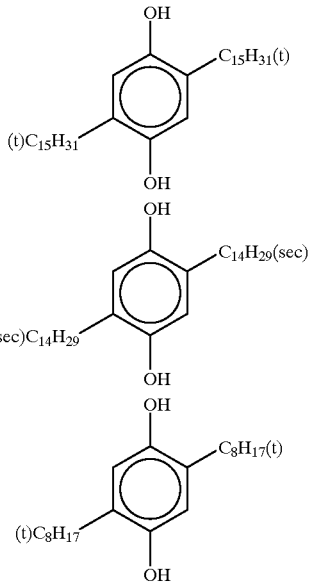

(Solv-2) Solvent

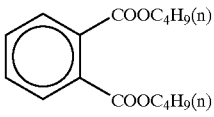

-continued (Solv-3) Solvent

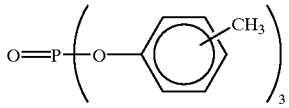

(Solv-7) Solvent

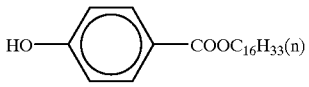

(UV-B) Ultra-violet absorbent (1)

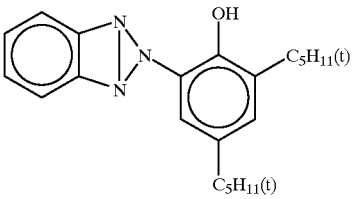

(2)

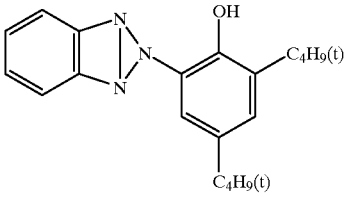

(3)

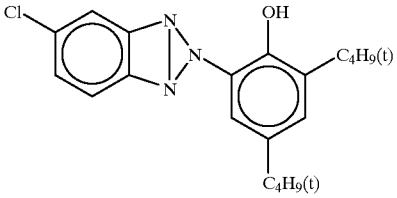

(4)

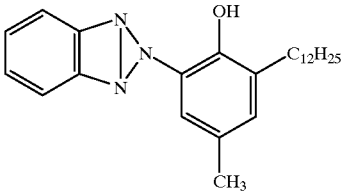

(5)

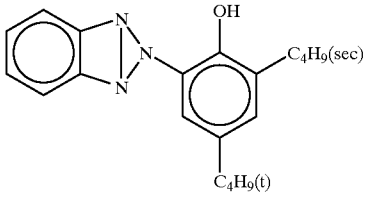

-continued (6)

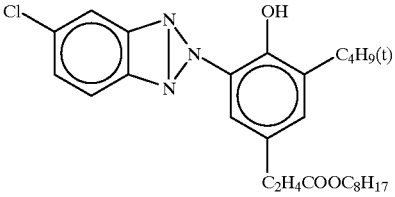

A mixture in 6:2:2:2:3:1 (weight ratio) of (1), (2), (3), (4), (5) and (6)

| Third Layer (Green-Sensitive Emulsion Layer) | |
|---|---|
| A silver chlorobromide emulsion B (Cubes, a mixture of a large-size emulsion B having an average grain size of 0.55 μm, and a small-size emulsion B having an average grain size of 0.39 μm (1:3 in terms of mol of silver). The deviation coefficients of the grain size distributions were 0.10 and 0.08, respectively, and each emulsion had 0.7 mol % of silver bromide locally contained in part of the grain surface whose substrate was made up of silver chloride.) | 0.11 |
| Gelatin | 1.3 |
| Magenta coupler (ExM) | 0.13 |
| Ultraviolet absorbing agent (UV-A) | 0.12 |
| Color-image stabilizer (Cpd-2) | 0.010 |
| Color-image stabilizer (Cpd-5) | 0.020 |
| Color-image stabilizer (Cpd-6) | 0.010 |
| Color-image stabilizer (Cpd-7) | 0.080 |
| Color-image stabilizer (Cpd-8) | 0.030 |
| Color-image stabilizer (Cpd-10) | 0.002 |
| Solvent (Solv-3) | 0.15 |
| Solvent (Solv-4) | 0.22 |
| Solvent (Solv-5) | 0.11 |

(ExM) Magenta coupler (ExM-1)

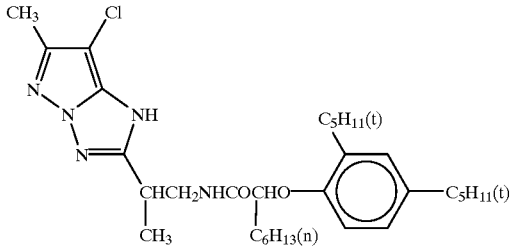

(ExM-2)

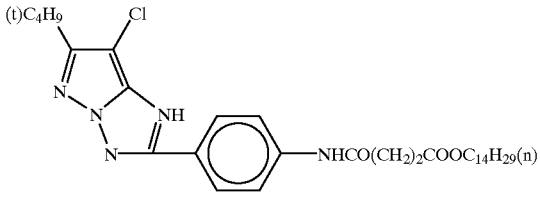

(A mixture in 1:5 (molar ratio))

(UV-A) Ultra-violet absorbent (1)

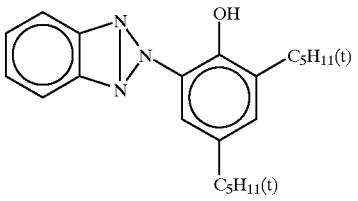

(2)

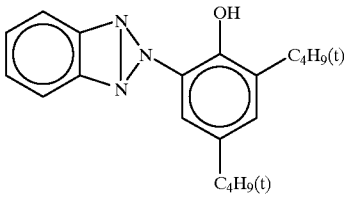

(3)

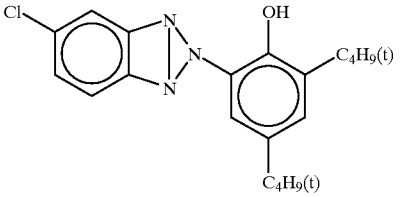

(4)

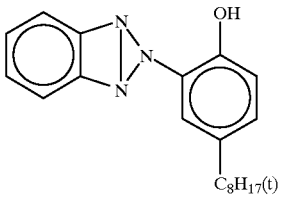

A mixture in 5:2:2:1 (weight ratio) of (1), (2), (3) and (4)

(Cpd-10)

Color-image stabilizer

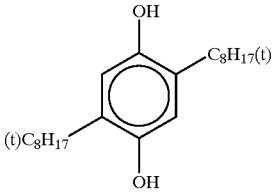

(Solv-4)

Solvent

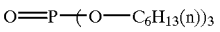

(Solv-5)

Solvent

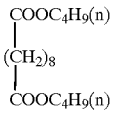

Fourth Layer (Color-Mixing Inhibiting Layer)

| | |
|---|---|
| Gelatin | 1.0 |
| Color-mixing inhibitor (Cpd-4) | 0.20 |
| Solvent (Solv-1) | 0.03 |

-continued

| | |
|---|---|
| Solvent (Solv-2) | 0.11 |
| Solvent (Solv-3) | 0.04 |
| Solvent (Solv-7) | 0.01 |
| Ultraviolet absorbing agent (UV-B) | 0.04 |

Fifth Layer (Red-Sensitive Emulsion Layer)

| | |
|---|---|
| A silver chlorobromide emulsion C (Cubes, a mixture of a large-size emulsion C having an average grain size of 0.55 μm, and a small-size emulsion C having an average grain size of 0.42 μm (1:4 in terms of mol of silver). The deviation coefficients of the grain size distributions were 0.09 and 0.11, respectively, and each emulsion had 0.8 mol % of silver bromide locally contained in part of the grain surface whose substrate was made up of silver chloride.) | 0.086 |
| Surface active agent (Cpd-12) | 0.032 |
| Gelatin | 0.79 |
| Coupler (1) represented by formula (1) | 0.15 |
| Solvent (Solv-8) | 0.15 |
| Solvent (Solv-9) | 0.05 |
| Color-image stabilizer (Cpd-7) | 0.04 |
| Color-image stabilizer (Cpd-15) | 0.11 |
| Color-image stabilizer (Cpd-13) | 0.01 |
| Color-image stabilizer (Cpd-16) | 0.11 |
| Color-image stabilizer (Cpd-17) | 0.15 |
| Color-image stabilizer (Cpd-6) | 0.01 |
| Color-image stabilizer (Cpd-8) | 0.08 |
| Color-image stabilizer (Cpd-18) | 0.10 |

Sixth Layer (Ultraviolet Absorbing Layer)

| | |
|---|---|
| Gelatin | 0.63 |
| Ultraviolet absorbing agent (UV-C) | 0.35 |
| Color-image stabilizer (Cpd-7) | 0.050 |
| Solvent (Solv-9) | 0.050 |

(UV-C) Ultra-violet absorbent (1)

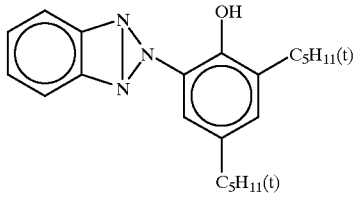

(2)

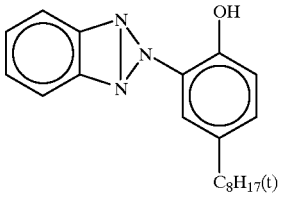

(3)

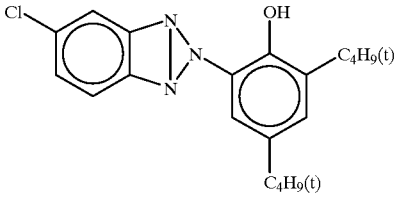

-continued (4)

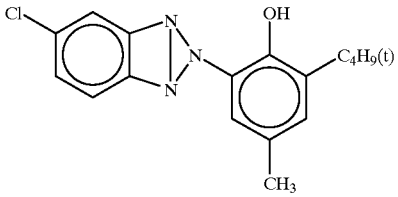

(5)

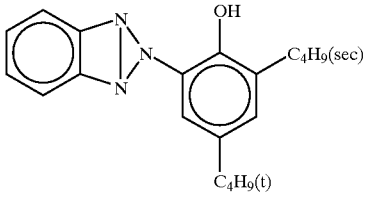

(6)

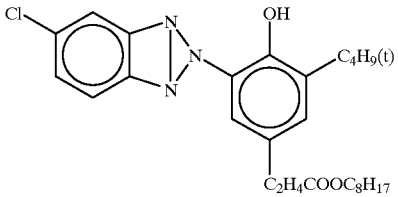

A mixture in 6:2:2:2:3:1 (weight ratio) of (1), (2), (3), (4), (5) and (6)

| Seventh Layer (Protective Layer) | |
|---|---|
| Acid-processed gelatin | 1.0 |
| Acryl-modified copolymer of polyvinyl alcohol (modification degree: 17%) | 0.043 |
| Liquid paraffin | 0.020 |
| Surface-active agent (Cpd-11) | 0.026 |

(Cpd-11) Surface-active agent (1)

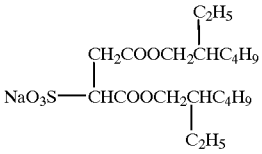

(2)

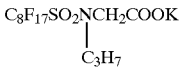

(3)

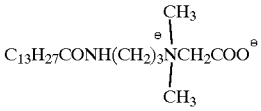

A mixture in 3:1:3 (weight ratio) of (1), (2) and (3)

Light-Sensitive Materials 502 to 526 were prepared in the same manner as the Light-Sensitive Material 501, except that in the composition in the fifth layer, the coupler represented by formula (1) was changed as shown in Table 8 shown below and the compound represented by formula (I) and/or the compound represented by formula (B) were additionally added. In these changes, the coupler of formula (1) was changed but used in equivalent moles. Further, the average grain sizes of the coupler-containing lipophilic fine grains prepared in the preparation of these samples were all in the range of 0.13 to 0.15 μm. The thus-prepared light-sensitive materials were stored at room temperature for 14 days, and then they were subjected to the following evaluations.

First, Light-Sensitive Materials 501 to 526 were exposed to light image-wise, so that about 30% of the coated amount of silver would be subjected to development, and they were continuously processed using a paper processor, until the replenishment rate of the color-developing solution in the following processing steps became twice the volume of the tank.

| Processing step | Temperature | Time | Replenishment rate | Tank volume |
|---|---|---|---|---|
| Color development | 38.5° C. | 45 sec | 73 ml | 500 ml |
| Bleach-fix | 30–35° C. | 45 sec | 60 ml | 500 ml |
| Rinse (1) | 30–35° C. | 20 sec | — | 500 ml |
| Rinse (2) | 30–35° C. | 20 sec | — | 500 ml |
| Rinse (3) | 30–35° C. | 20 sec | 370 ml | 500 ml |
| Drying | 70–80° C. | 60 sec | — | — |

The replenishment rate was the amount per $m^2$ of the light-sensitive material.

(the rinse was conducted in a 3-tank counter-current system of Rinse (3) to Rinse (1))

The composition of each processing solution is shown below.

| Color Developing Solution | Tank solution | Replenisher |
|---|---|---|
| Water | 700 ml | 700 ml |
| Sodium triisopropylene(β) sulfonate | 0.1 g | 0.1 g |
| Ethylenediaminetetraacetic acid | 3.0 g | 3.0 g |
| Disodium 1,2-dihydroxybenzene-4,6-disulfonate | 0.5 g | 0.5 g |
| Triethanolamine | 12.0 g | 12.0 g |
| Potassium chloride | 6.5 g | — |
| Potassium bromide | 0.03 g | — |
| Potassium carbonate | 27.0 g | 27.0 g |
| Fluorescent whitening agent (WHITEX 4, trade name, made by Sumitomo Chemical Ind. Co.) | 1.0 g | 3.0 g |
| Sodium sulfite | 0.1 g | 0.1 g |
| Diethylhydroxylamine | 1.0 g | 1.0 g |
| Disodium-N,N-bis(sulfonatoethyl)-hydroxylamine | 10.0 g | 13.0 g |
| N-ethyl-N-(3-methanesulfonamidoethyl)-3-methyl-4-aminoaniline sulfate | 5.0 g | 11.5 g |
| Water to make | 1000 ml | 1000 ml |
| pH (25° C.) | 10.0 | 11.0 |

| Bleach-fixing solution (Both tank solution and replenisher) | |
|---|---|
| Water | 600 ml |
| Ammonium thiosulfate (700 g/liter) | 100 ml |
| Ammonium sulfite | 40 g |
| Etylenediaminetetraacetic acid iron(III) ammonium | 55 g |
| Ethylenediaminetetraacetic acid disodium | 5 g |
| Ammonium bromide | 40 g |
| Nitric acid (67%) | 30 g |

-continued

| | |
|---|---|
| Water to make | 1000 ml |
| pH (25° C.) (pH was adjusted by acetic acid and aqueous ammonium) | 4.8 |

Rinse solution (Both tank solution and replenisher)

Ion-exchanged water (calcium and magnesium each were 3 ppm or below)

Then, the respective light-sensitive materials were subjected to gradation exposure to light through a three-color separation optical wedge for sensitometry using a sensitometer (FWH type, manufactured by Fuji Photo Film Co., Ltd.; color temperature of the light source: 3,200° K). This exposure was carried out such that the exposure amount would be 250 CMS by the exposure time of 0.1 sec.

Each of the exposed sample was processed with the above running solutions using the paper processor.

Evaluation (Fastness to Light)

Each of the light-sensitive materials processed was irradiated with light for 8 days using a xenon irradiator of a light illuminance of 200,000 lux. The cyan density residual rate (%) after the irradiation with light, at the points where the cyan density before the irradiation with light was 0.5, was found, to evaluate fastness to light, in both cases, wherein, during the irradiation, irradiation was conducted through an ultraviolet-absorbing filter [X], in which the light transmittance at 420 nm being 50% (for the case, an ultraviolet radiation portion was less), and through an ultraviolet-absorbing filter [Y], in which the light transmittance at 300 nm being 50% (for the case, an ultraviolet radiation portion was large).

The evaluation results are also shown in Table 8.

When the compound represented by-formula (I) is added to the coupler represented by formula (1), without the addition of the compound represented by formula (B), the effect for improving the fastness to light rich in UV light (filter [Y]) is indeed obtained, but its extent is small, and with respect to the effect for improving the fastness to light poor in UV light (filter [X]), the addition of a small amount thereof is effective, while when the amount is increased, the effect is deteriorated. On the other hand, when the compound represented by formula (B) is added without the addition of the compound represented by formula (I), although an effect for improving the fastness to light is obtained, irrespective of the extent of UV light, the extent of the improvement effect is small, and the effect is saturated by the addition of a small amount thereof, and even when the amount thereof is increased, the effect is not improved further. From this it can be understood that, for the coupler represented by formula (1), a combination of the compound represented by formula (I) with the compound represented by formula (B) results in an ultra-additive effect for securing a cyan dye image excellent in fastness to light in the wide range of wavelength ranging from ultraviolet light to visible light.

Example 6

A paper base both surfaces of which had been coated with a polyethylene resin, was subjected to surface corona discharge treatment; then it was provided with a gelatin undercoat layer containing sodium dodecylbenzensulfonate, and it was successively coated with the first to seventh photographic constitutional layers shown below, to prepare a sample (601) for comparison of a silver halide color photographic light-sensitive material.

The coating solutions for each photographic constitutional layer were prepared as follows.

TABLE 8

| | | Compound of formula(I) | | Compound of formula(B) | | Fastness to light (remaining ratio %) | |
|---|---|---|---|---|---|---|---|
| Light-sensitive material | Kind of coupler of formula(I) | Kind | Weight ratio of coupler of formula(I) | Kind | Weight ratio to coupler of formula(I) | UV filter [X] | UV filter [Y] |
| 501 | (1) | — | — | — | — | 72 | 54 |
| 502 | (1) | A-1 | 0.3 | — | — | 76 | 56 |
| 503 | (1) | A-1 | 0.6 | — | — | 79 | 58 |
| 504 | (1) | A-1 | 0.9 | — | — | 78 | 59 |
| 505 | (1) | A-1 | 1.2 | — | — | 74 | 61 |
| 506 | (1) | A-1 | 1.5 | — | — | 73 | 61 |
| 507 | (1) | — | — | B-1 | 0.1 | 74 | 56 |
| 508 | (1) | — | — | B-1 | 0.2 | 75 | 58 |
| 509 | (1) | — | — | B-1 | 0.3 | 78 | 60 |
| 510 | (1) | — | — | B-1 | 0.4 | 78 | 60 |
| 511 | (1) | — | — | B-1 | 0.5 | 78 | 60 |
| 512 | (1) | A-1 | 0.3 | B-1 | 0.1 | 87 | 74 |
| 513 | (1) | A-1 | 0.9 | B-1 | 0.3 | 92 | 82 |
| 514 | (1) | A-1 | 1.2 | B-1 | 0.5 | 93 | 83 |
| 515 | (25) | — | — | — | — | 73 | 55 |
| 516 | (25) | A-2 | 0.9 | — | — | 73 | 60 |
| 517 | (25) | — | — | B-2 | 0.4 | 78 | 57 |
| 518 | (25) | A-2 | 0.3 | B-2 | 0.2 | 84 | 72 |
| 519 | (25) | A-2 | 0.9 | B-2 | 0.4 | 92 | 87 |
| 520 | (25) | A-2 | 1.2 | B-2 | 0.4 | 94 | 89 |
| 521 | C-2 | — | — | — | — | 70 | 59 |
| 522 | C-2 | A-3 | 0.4 | B-5 | 0.4 | 88 | 79 |
| 523 | C-4 | — | — | — | — | 76 | 59 |
| 524 | C-4 | A-8 | 0.4 | B-7 | 0.4 | 90 | 80 |
| 525 | C-21 | — | — | — | — | 72 | 61 |
| 526 | C-21 | A-10 | 0.4 | B-11 | 0.1 | 89 | 81 |

(Preparation of Fifth-Layer Coating Solution)

190 g of a cyan coupler (ExC-2), 44 g of a cyan coupler (ExC-3), 900 g of gelatin, 73 g of a color-image-stabilizer (Cpd-1), 120 g of a color-image-stabilizer (Cpd-6), 29 g of a color-image-stabilizer (Cpd-7), 58 g of a color-image-stabilizer (Cpd-9), 15 g of a color-image-stabilizer (Cpd-10), 15 g of color-image-stabilizer (Cpd-14), 280 g of a color-image-stabilizer (Cpd-15), 132 g of a color-image-stabilizer (Cpd-16), 132 g of a color-image-stabilizer (Cpd-17) were dissolved in 219 g of a solvent (Solv-5), 73 g of a solvent (Solv-8), 146 g of a solvent (Solv-9) and 250 ml of ethyl acetate, and the resulting solution was emulsified and dispersed in 3600 g of a 25% aqueous gelatin solution containing 360 ml of 10% sodium dodecylbenzensulfonate, to prepare an emulsified dispersion C.

(ExC-2) Cyan coupler

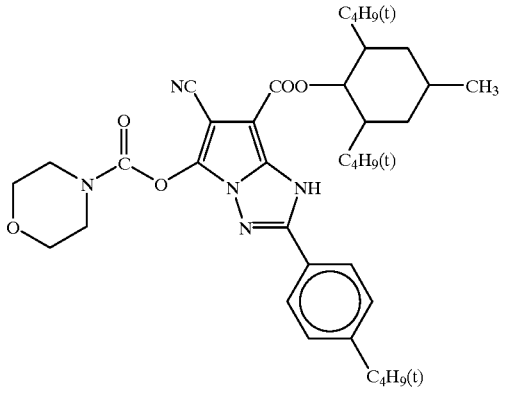

(ExC-3) Cyan coupler
A mixture in 50:25:25 of

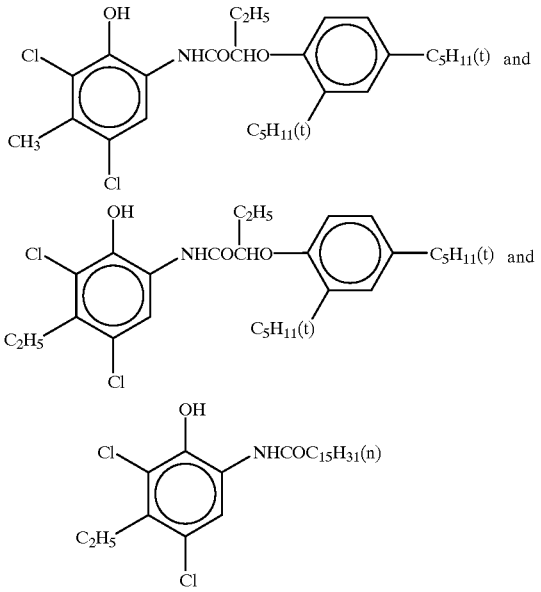

(Cpd-1) Color-image stabilizer

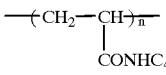

number average molecular weight 60,000

-continued (Cpd-6) Stabilizer

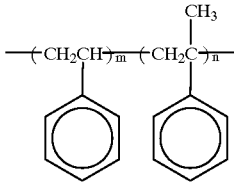

number average molecular weight 600
m/n = 10/90

(Cpd-7) Color-mixing inhibitor

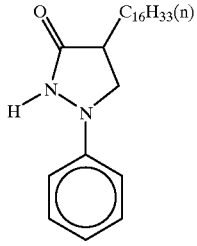

(Cpd-9) Color-image stabilizer

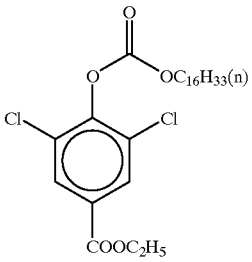

(Cpd-10) Color-image stabilizer

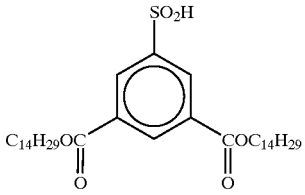

(Cpd-14)

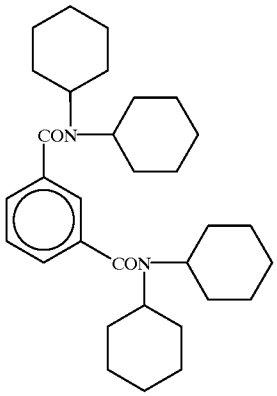

-continued (Cpd-15)

A mixture in 1:1 of

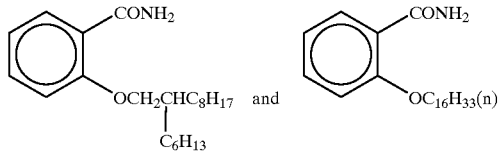

(Cpd-16)

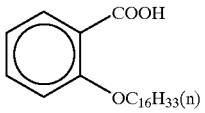

(Cpd-17)

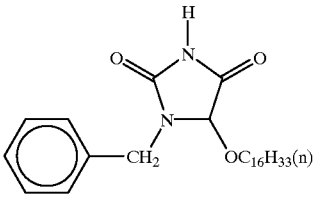

(Cpd-18)

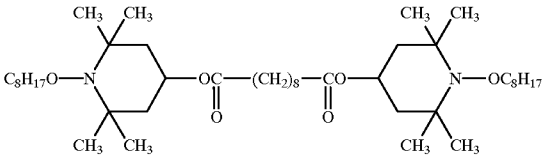

(Solv-5)

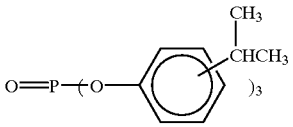

-continued (Solv-8)

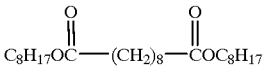

(Solv-9)

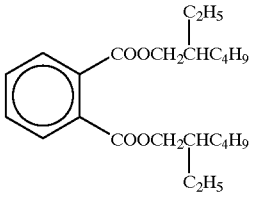

On the other hand, as a red-sensitive emulsion C, a silver chlorobromide emulsion (cubes, a mixture of a large-size emulsion C having an average grain size of 0.50 $\mu$m, and a small-size emulsion C having an average grain size of 0.41 $\mu$m (1:4 in terms of mol of silver), the deviation coefficients of the grain size distributions being 0.09 and 0.11 respectively, and each emulsion having 0.5 mol % of silver bromide locally contained in part of the grain surface whose substrate was made up of silver chloride) was prepared. To the large-size emulsion C of this red-sensitive emulsion C, had been added $6.0\times10^{-5}$ mol, per mol of silver, of each of red-sensitive sensitizing dyes G and H shown below, and to the small-size emulsion C of this red-sensitive emulsion C, had been added $9.0\times10^{-5}$ mol, per mol of silver, of each of red-sensitive sensitizing dyes G and H shown below. The chemical ripening of this emulsion was carried out optimally with a sulfur sensitizer and a gold sensitizer being added.

(Sensitizing dye G)

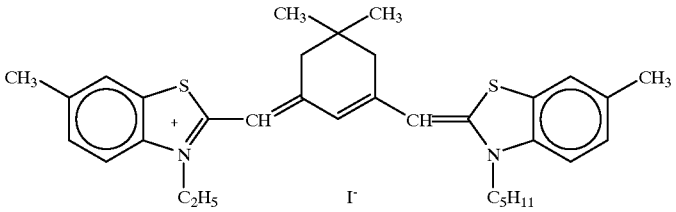

(Sensitizing dye H)

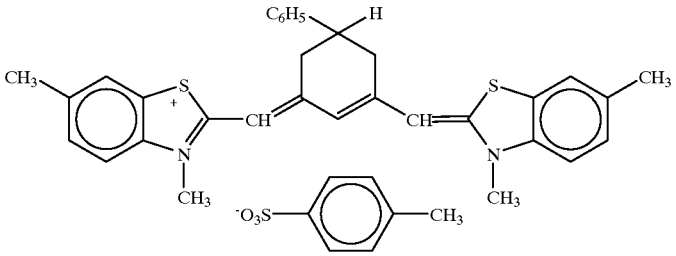

The above emulsified dispersion C and this silver chlorobromide emulsion C (red-sensitive emulsion C) were mixed and dissolved, and a fifth-layer coating solution was prepared so that it would have the composition shown below. The coating amount of the emulsion is in terms of silver.

(Preparation of Coating Solutions For the First to the Fourth, and the Sixth to the Seventh Layers)

The coating solutions for the first layer to fourth layer and the sixth layer to seventh layer were prepared in the similar manner as that for the fifth layer coating solution. As the gelatin hardener for each layer, 1-oxy-3,5-dichloro-s-triazine sodium salt was used.

Further, to each layer, were added Ab-1, Ab-2, Ab-3, and Ab-4, so that the total amounts would be 15.0 mg/m$^2$, 60.0 mg/m$^2$, 5.0 mg/m$^2$, and 10.0 mg/m$^2$, respectively.

(Ab-1) Antiseptics

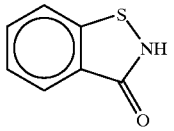

(Ab-2) Antiseptics

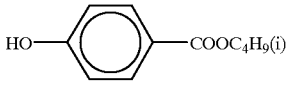

(Ab-3) Antiseptics

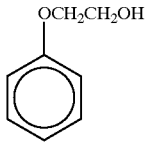

(Ab-4) Antiseptics

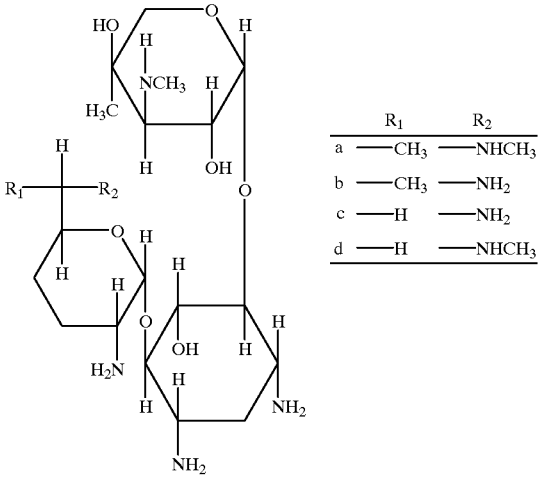

| | $R_1$ | $R_2$ |
|---|---|---|
| a | $CH_3$ | $NHCH_3$ |
| b | $CH_3$ | $NH_2$ |
| c | H | $NH_2$ |
| d | H | $NHCH_3$ |

A mixture in 1:1:1:1 of a, b, c, and d

The silver chlorobromide emulsion of each photosensitive emulsion layer was as follows.

Blue-Sensitive Emulsion A

To the silver chlorobromide emulsion (cubes, a mixture of a large-size emulsion A having an average grain size of 0.72 μm, and a small-size emulsion A having an average grain size of 0.60 μm (3:7 in terms of mol of silver); the deviation coefficients of the grain size distributions were 0.08 and 0.10, respectively, and each emulsion had 0.3 mol % of silver bromide locally contained in part of the grain surface whose substrate was made up of silver chloride), the sensitizing dyes A, B, and C shown below were added, respectively, to the large-size emulsion A, in an amount of $1.4\times10^{-4}$ mol per mol of the silver halide, and to the small-size emulsion A in an amount of $1.7\times10^{-4}$ per mol of the silver halide, to obtain a blue-sensitive emulsion A for use in this Example.

(Sensitizing dye A)

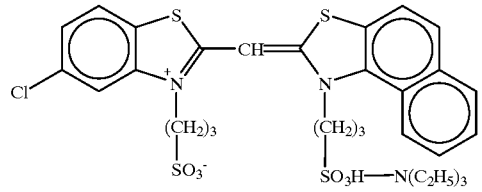

(Sensitizing dye B)

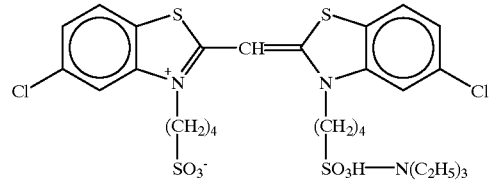

(Sensitizing dye C)

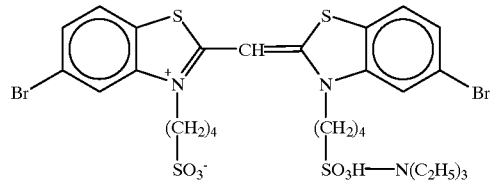

Green-Sensitive Emulsion B

To the silver chlorobromide emulsion (cubes, a mixture of a large-size emulsion B having an average grain size of 0.45 μm, and a small-size emulsion B having an average grain size of 0.35 μm (1:3 in terms of mol of silver); the deviation coefficients of the grain size distributions were 0.10 and 0.08, respectively, and each emulsion had 0.4 mol % of silver bromide locally contained in part of the grain surface whose substrate was made up of silver chloride), the sensitizing dye D shown below was added to the large-size emulsion B in an amount of $3.0\times10^{-4}$ mol per mol of the silver halide, and to the small-size emulsion B in an amount of $3.6\times10^{-4}$ mol per mol of the silver halide; the sensitizing dye E was added to the large-size emulsion B in an amount of $4.0\times10^{-5}$ mol per mol of the silver halide, and to the small-size emulsion B in an amount of $7.0\times10^{-5}$ mol per mol of the silver halide; and the sensitizing dye F was added to the large-size emulsion in an amount of $2.0\times10^{-4}$ mol per mol of the silver halide, and to the small-size emulsion in an amount of $2.8\times10^{-4}$ mol per mol of the silver halide, to obtain a green-sensitive emulsion B for use in this example.

(Sensitizing dye D)

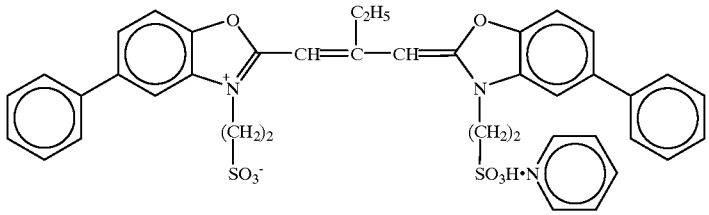

(Sensitizing dye E)

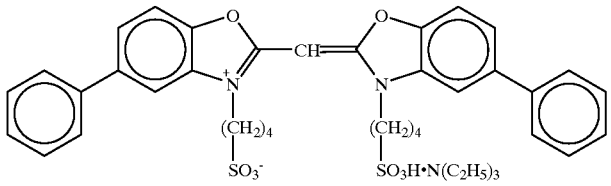

(Sensitizing dye F)

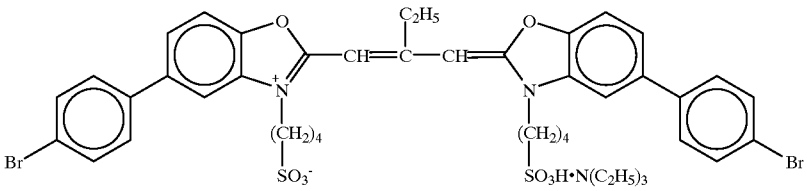

Further, the following Compound I was added to the red-sensitive emulsion layer, in an amount of $2.6\times10^{-3}$ mol per mol of the silver halide.

(Compound I)

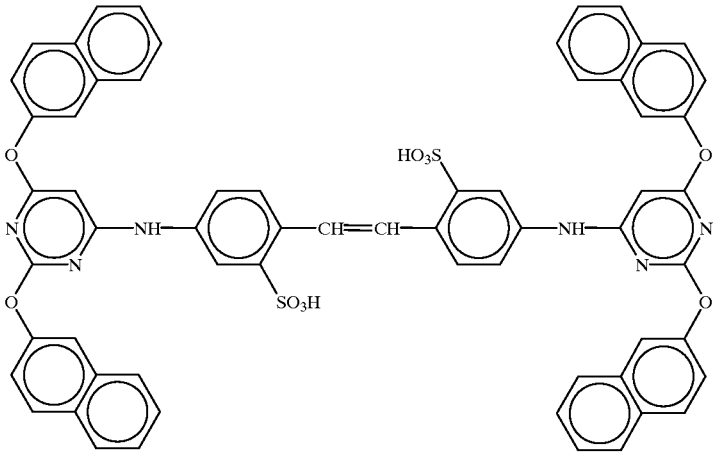

Further, to the blue-sensitive emulsion layer, the green-sensitive emulsion layer, and the red-sensitive emulsion layer, was added 1-(3-methylureidophenyl)-5-mercaptotetrazole in amounts of $3.3\times10^{-4}$ mol, $1.0\times10^{-3}$ mol, and $5.9\times10^{-4}$ mol, per mol of the silver halide, respectively. Further, to the second layer, the fourth layer, the sixth layer, and the seventh layer, it was added in amounts of 0.2 mg/M$^2$, 0.2 mg/M$^2$, 0.6 mg/m$^2$, and 0.1 mg/m$^2$, respectively.

Further, to the blue-sensitive emulsion layer and the green-sensitive emulsion layer, was added 4-hydroxy-6-methyl-1,3,3a,7-tetrazaindene in amounts of $1\times10^{-4}$ mol and $2\times10^{-4}$ mol, respectively, per mol of the silver halide.

Further, to the red-sensitive emulsion layer, was added a copolymer of methacrylic acid and butyl acrylate (1:1 in weight ratio; average molecular weight, 200,000 to 400,000) in an amount of 0.05g/m$^2$.

Further, to the second layer, the fourth layer, and the sixth layer, was added disodium catechol-3,5-disulfonate in amounts of 6 mg/M$^2$, 6 mg/m$^2$, and 18 mg/M$^2$, respectively.

Further, to neutralize irradiation, the following dyes were added to the emulsion layers (the coating amount is shown in parentheses).

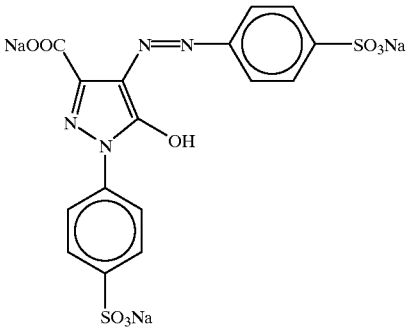

(10 mg/m$^2$)

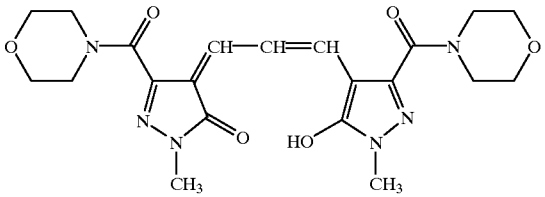

(20 mg/m$^2$)

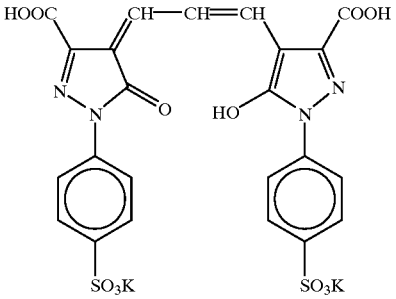

(5 mg/m$^2$)

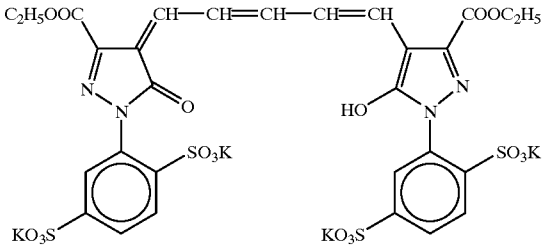

(20 mg/m$^2$)

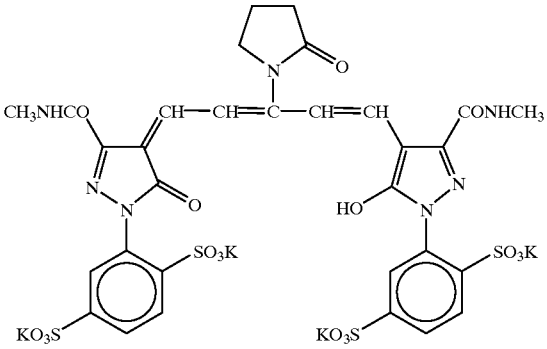

(20 mg/m$^2$)

(Layer Constitution)

The composition of each layer is shown below. The numbers show coating amounts (g/m$^2$). In the case of the silver halide emulsion, the coating amount is in terms of silver.

1. Base

A polyethylene resin-laminated paper having following configuration was used as a base.

The polyethylene resin on the first layer side contained a white pigment ($TiO_2$: content of 16 wt %, ZnO: content of 4 wt %), a fluorescent whitening agent (a mixture of 4,4'-bis(benzoxazoryl)stilbene and 4,4'-bis(5-methylbenzoxazoryl)stilbene (8:2): content of 0.05 wt %), and a blue dye (ultramarine).

| | |
|---|---|
| 2. First Layer (Blue-Sensitive Emulsion Layer) | |
| Blue-sensitive emulsion A | 0.26 |
| Gelatin | 1.35 |
| Yellow coupler (ExY) | 0.62 |
| Color-image stabilizer (Cpd-1) | 0.08 |
| Color-image stabilizer (Cpd-2) | 0.04 |
| Color-image stabilizer (Cpd-3) | 0.08 |
| Solvent (Solv-1) | 0.23 |
| 3. Second Layer (Color-Mixing Inhibiting Layer) | |
| Gelatin | 0.99 |
| Color-mixing inhibitor (Cpd-4) | 0.09 |
| Color-image stabilizer (Cpd-5) | 0.018 |
| Color-image stabilizer (Cpd-6) | 0.13 |
| Color-image stabilizer (Cpd-7) | 0.01 |
| Solvent (Solv-1) | 0.06 |
| Solvent (Solv-2) | 0.22 |
| 4. Third Layer (Green-Sensitive Emulsion Layer) | |
| Green-sensitive emulsion B | 0.14 |
| Gelatin | 1.36 |
| Magenta coupler (ExM) | 0.15 |
| Ultraviolet absorbing agent (UV-1) | 0.05 |
| Ultraviolet absorbing agent (UV-2) | 0.03 |
| Ultraviolet absorbing agent (UV-3) | 0.02 |
| Ultraviolet absorbing agent (UV-4) | 0.04 |
| Color-image stabilizer (Cpd-2) | 0.02 |
| Color-image stabilizer (Cpd-4) | 0.002 |
| Color-image stabilizer (Cpd-6) | 0.09 |
| Color-image stabilizer (Cpd-8) | 0.02 |
| Color-image stabilizer (Cpd-9) | 0.03 |
| Color-image stabilizer (Cpd-10) | 0.01 |
| Color-image stabilizer (Cpd-11) | 0.0001 |
| Solvent (Solv-3) | 0.11 |
| Solvent (Solv-4) | 0.22 |
| Solvent (Solv-5) | 0.20 |
| 5. Fourth Layer (Color-Mixing Inhibiting Layer) | |
| Gelatin | 0.71 |
| Color-mixing inhibitor (Cpd-4) | 0.06 |
| Color-image stabilizer (Cpd-5) | 0.013 |
| Color-image stabilizer (Cpd-6) | 0.10 |
| Color-image stabilizer (Cpd-7) | 0.007 |
| Solvent (Solv-1) | 0.04 |
| Solvent (Solv-2) | 0.16 |
| 6. Fifth Layer (Red-Sensitive Emulsion Layer) | |
| Red-sensitive emulsion C | 0.12 |
| Gelatin | 1.11 |
| Cyan coupler (ExC-2) | 0.13 |
| Cyan coupler (ExC-3) | 0.03 |
| Color-image stabilizer (Cpd-1) | 0.05 |
| Color-image stabilizer (Cpd-6) | 0.08 |
| Color-image stabilizer (Cpd-7) | 0.02 |
| Color-image stabilizer (Cpd-9) | 0.04 |
| Color-image stabilizer (Cpd-10) | 0.01 |
| Color-image stabilizer (Cpd-14) | 0.01 |
| Color-image stabilizer (Cpd-15) | 0.19 |
| Color-image stabilizer (Cpd-16) | 0.09 |
| Color-image stabilizer (Cpd-17) | 0.09 |
| Solvent (Solv-5) | 0.15 |

-continued

| | |
|---|---|
| Solvent (Solv-8) | 0.05 |
| Solvent (Solv-9) | 0.10 |
| 7. Sixth Layer (Ultraviolet Absorbing Layer) | |
| Gelatin | 0.66 |
| Ultraviolet absorbing agent (UV-1) | 0.19 |
| Ultraviolet absorbing agent (UV-2) | 0.06 |
| Ultraviolet absorbing agent (UV-3) | 0.06 |
| Ultraviolet absorbing agent (UV-4) | 0.05 |
| Ultraviolet absorbing agent (UV-5) | 0.09 |
| Solvent (Solv-7) | 0.25 |

-continued

| | |
|---|---|
| 8. Seventh Layer (Protective Layer) | |
| Gelatin | 1.00 |
| Acryl-modified copolymer of polyvinyl alcohol (modification degree: 17%) | 0.04 |
| Liquid paraffin | 0.02 |
| Surface-active agent (Cpd-13) | 0.01 |

The compounds used in each layer are shown below.

(ExY) Yellow coupler
A mixture in 60:40 of

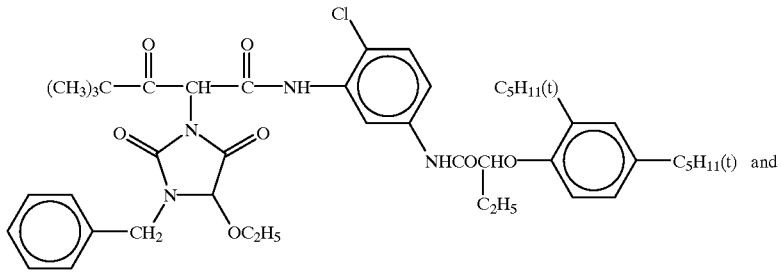

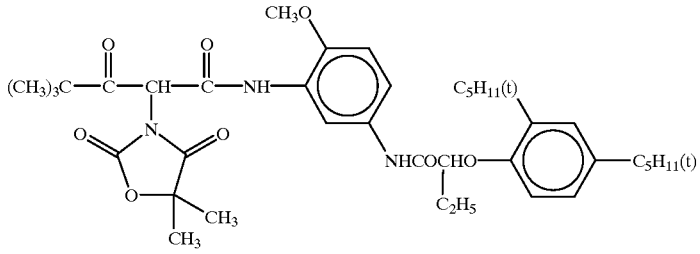

(ExM) Magenta coupler
A mixture in 60:40 of

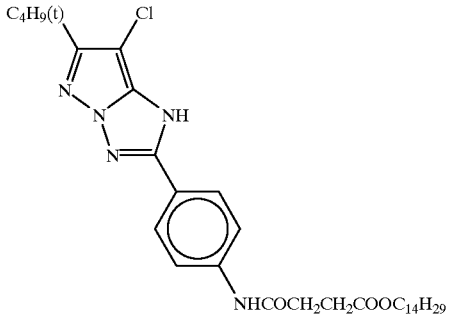

and

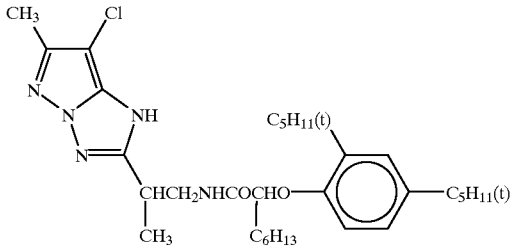

(Cpd-2) Color-image stabilizer

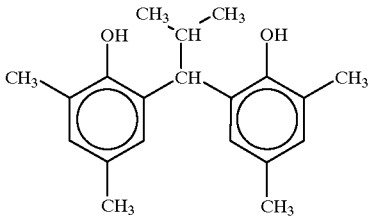

(Cpd-3) Color-image stabilizer

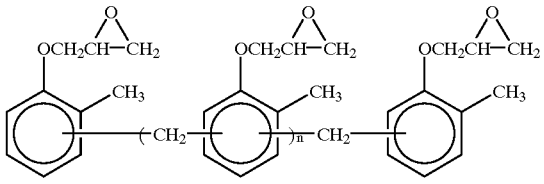

n = 7~8 (average)

-continued
(Cpd-4) Color-mixing inhibitor
A mixture in 1:1:1 of
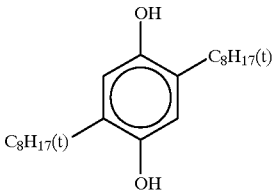
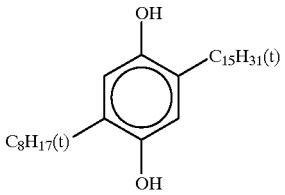
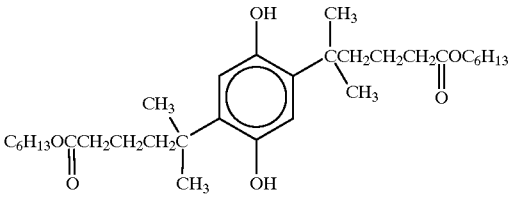
(Cpd-5) Color-mixing inhibiting auxiliary
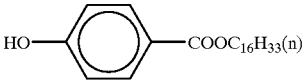
(Cpd-8) Color-image stabilizer
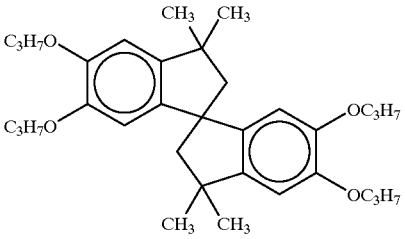
(Cpd-11)
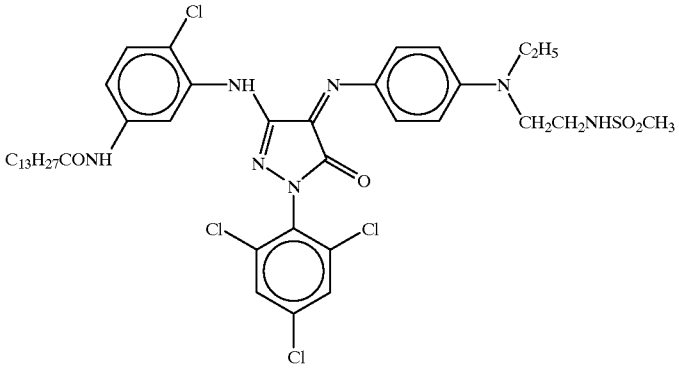
(Cpd-13) Surface-active agent
A mixture in 7:3 of
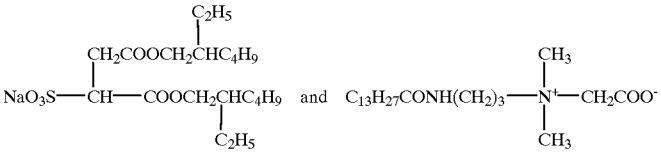
(UV-1) Ultra-violet absorbent
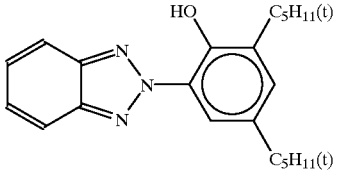
(UV-2) Ultra-violet absorbent
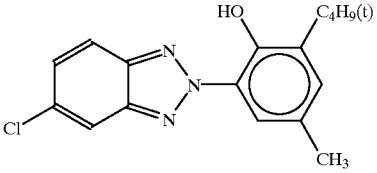
(UV-3) Ultra-violet absorbent
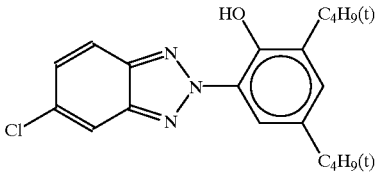
(UV-4) Ultra-violet absorbent
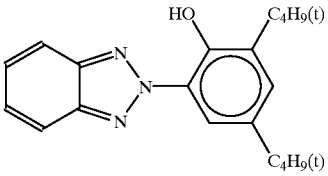

-continued (UV-5) Ultra-violet absorbent

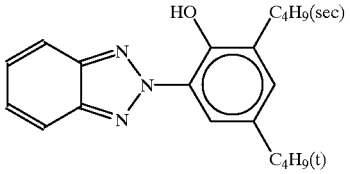

(Solv-1)

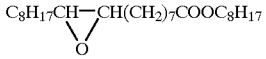

(Solv-2)

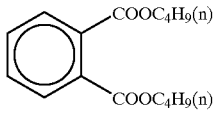

(Solv-3)

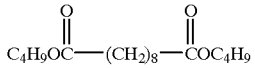

(Solv-4)

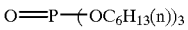

(Solv-7)

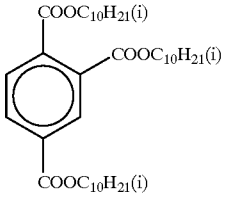

Further, Samples 602 to 621 were prepared in the same manner as the silver halide color photographic light-sensitive material 601, except that the composition in the fifth layer was changed as shown below.

Fifth Layer (Red-Sensitive Emulsion Layer)

The fifth layer in each Samples 602 to 621 was prepared in the same manner as in Sample 601, except for using, as Emulsified Dispersion C, one prepared wherein the compound of formula (II) was changed, if necessary, as shown in Table 9 and the compound of formulas (I) and/or the compound of formula (3) were added in an amount as shown in Table 9. In these change, the compound represented by formula (II) was changed but used in equivalent moles. Further, the average grain sizes of the coupler-containing lipophilic fine grains prepared in the preparation of these samples were all in the range of 0.10 to 0.20 $\mu$m.

TABLE 9

| Sample | Kind of compound of | Compound of formula(I)* | | Compound of formula(3)* | |
|---|---|---|---|---|---|
| No. | formula(II) | Kind | Added amount | Kind | Added amount |
| 601 | 1 | — | — | — | — |
| 602 | 1 | A-1 | 50 | — | — |
| 603 | 1 | A-1 | 100 | — | — |
| 604 | 1 | — | — | A-7 | 100 |
| 605 | 1 | — | — | A-7 | 200 |
| 606 | 1 | — | — | A-38 | 50 |
| 607 | 1 | — | — | A-38 | 100 |
| 608 | 1 | A-1 | 50 | A-7 | 100 |
| 609 | 1 | A-1 | 100 | A-7 | 200 |
| 610 | 1 | A-1 | 100 | A-8 | 100 |
| 611 | 1 | A-1 | 100 | A-9 | 100 |
| 612 | 1 | A-1 | 100 | A-38 | 100 |
| 613 | 1 | A-1 | 100 | A-39 | 100 |
| 614 | 1 | A-2 | 100 | A-38 | 100 |
| 615 | 1 | A-3 | 100 | A-38 | 100 |
| 616 | 1 | A-8 | 100 | A-38 | 100 |

TABLE 9-continued

| Sample | Kind of compound of | Compound of formula(I)* | | Compound of formula(3)* | |
|---|---|---|---|---|---|
| No. | formula(II) | Kind | Added amount | Kind | Added amount |
| 617 | 1 | A-10 | 100 | A-38 | 100 |
| 618 | 2 | A-1 | 100 | A-38 | 100 |
| 619 | 22 | A-1 | 100 | A-38 | 100 |
| 620 | 25 | A-1 | 100 | A-38 | 100 |
| 621 | 27 | A-1 | 100 | A-38 | 100 |

*Added amounts of the compounds of formula (I) or (3) are ratios (mol %) to that of the compound of formula(II).

The above Samples 601 to 602 were made into rolls of width 127 mm; they were exposed to light imagewise, using a Mini-lab Printer Processor PP1258AR, trade name, manufactured by Fuji Photo Film Co., Ltd., and they were continuously processed (running test) in the following processing steps, until the replenishment was equal to twice the color development tank volume (Running Test Solution A).

| Processing step | Temperature | Time | Replenishment rate* |
|---|---|---|---|
| 1. Color development | 38.5° C. | 45 sec | 45 ml |
| 2. Bleach-fix | 38.0° C. | 45 sec | 35 ml |
| 3. Rinse (1) | 38.0° C. | 20 sec | — |
| 4. Rinse (2) | 38.0° C. | 20 sec | — |

-continued

| Processing step | Temperature | Time | Replenishment rate* |
|---|---|---|---|
| 5. Rinse (3) | **38.0° C. | 20 sec | — |
| 6. Rinse (4) | **38.0° C. | 30 sec | 121 ml |

*Replenishment rates were amounts per $m^2$ of the light-sensitive material processed.

**A Rinse Cleaning System RC50D, trade name, manufactured by Fuji Photo Film Co., Ltd., was installed in a rinse (3), and the rinse solution was taken out from the rinse (3) and was pumped to a reverse osmosis membrane module (RC50D) by a pump. The permeated water obtained in that tank was fed to a rinse (4), and the concentrated water was returned to the rinse (3). The pump pressure was adjusted so that the amount of the permeated water to the reverse osmosis membrane module would be kept at 50 to 300 ml/min, and circulation was conducted for 10 hours per day, with the temperature controlled (The rinse was of a tank counter-current system from the tank (1) to the tank (4).)

The compositions of the processing solutions were as follows. In passing, the tank solution refers to the processing solution in each tank before the start of the above running test, and the particular composition was kept almost unchanged even during the running test. On the other hand, the replenishment refers to the processing solution that, in the running test, replenishes the processing solution in the tank, in accordance with "the replenishment rate" in the above processing step, and the composition of the replenishment was set to allow the composition of the tank solution to be kept constant.

[Composition of Color Developer]

| | Tank Solution | Replenisher |
|---|---|---|
| Water | 800 ml | 800 ml |
| Dimethylpolysiloxane-series surface active agent (Silicone KF351A, trade name: manufactured by Shinetsu Kagaku Kogyo Co.) | 0.1 g | 0.1 g |
| Triethanolamine | 11.6 g | 11.6 g |
| Ethylenediaminetetraacetic acid | 4.0 g | 4.0 g |
| Sodium 4,5-dihydroxybenzene-1,3-disulfonate | 0.5 g | 0.5 g |
| Potassium chloride | 10.0 g | — |
| Potassium bromide | 0.040 g | 0.010 g |
| Triazinylaminostilbene-series fluorescent whitening agent (Hakkol FWA-SF, trade name: manufactured by Showa Kagaku Co.) | 2.5 g | 5.0 g |
| Sodium sulfite | 0.1 g | 0.1 g |
| Disodium-N,N-bis(sulfonatoethyl) hydroxylamine | 8.5 g | 11.1 g |
| N-Ethyl-N-(β-methanesulfonamidoethyl)-3-methyl-4-aminoaniline 3/2 sulfuric acid monohydrate | 5.0 g | 15.7 g |
| Potassium carbonate | 26.3 g | 26.3 g |
| pH (at 25° C.) | 10.15 | 12.50 |

Further, after water was added to the above compositions, to make the total amount to be 1,000 ml, respectively, pH was adjusted to be the above values by using potassium hydroxide and sulfuric acid.

[Composition of breach-fixing solution]

| | Tank Solution | Replenisher |
|---|---|---|
| Water | 800 ml | 800 ml |
| Ethylenediaminetetraacetate iron (III) ammonium | 47.0 g | 94.0 g |
| Ethylenediaminetetraacetic acid | 1.4 g | 2.8 g |
| m-Carboxymethylbenzenesulfinic acid | 8.3 g | 16.5 g |
| Nitric acid (67%) | 16.5 g | 33.0 g |
| Imidazole | 14.6 g | 29.2 g |
| Ammonium thiosulfate (750 g/litter) | 107.0 ml | 214.0 ml |
| Ammonium sulfite | 16.0 g | 32.0 g |
| Potassium metabisulfite | 23.1 g | 46.2 g |
| pH (at 25° C.) | 6.0 | 6.0 |

Further, after water was added to the above compositions, to make the total amount to be 1,000 ml, respectively, pH was adjusted to be the above values by using acetic acid and ammonia.

[Composition of rinse solution]

| | Tank solution | Replenisher |
|---|---|---|
| Sodium chlorinated-isocyanurate | 0.02 g | 0.02 g |
| Deionized water (having a conductivity of 5 μs/cm or below) | 1000 ml | 1000 ml |
| pH | 6.5 | 6.5 |

Then, the respective samples were subjected to gradation exposure to light through a three-color separation optical wedge for sensitometry, using a sensitometer (FWH type, manufactured by Fuji Photo Film Co., Ltd.; color temperature of the light source: 3,200° K). This exposure was carried out such that the exposure amount would be 250 CMS by the exposure time of 0.1 sec.

These samples were subjected to the following evaluations:

Evaluation 1 (fastness to light)

Each of the exposed sample was processed with the above running solutions using the paper processor. Each of the thus-obtained samples was irradiated with light for 14 days using a xenon irradiator of 100,000 lux. During the irradiation, a heat-absorbing filter and an ultraviolet-absorbing filter, in the latter filter the light transmittance at 370 nm being 50%, were used. The cyan density residual rate (%) after the irradiation with light, at the points where the cyan density before the irradiation with light was 0.5, was found, to evaluate fastness to light.

Evaluation 2 (color-forming property: Dmax)

Regarding each of the samples processed in the processing steps in Evaluation 1, the maximum color density (Dmax) of cyan in the cyan color-formed section (red-exposed section) of each of the processed samples were measured by an X-Rite 350 densitometer (manufactured by The X-Rite Company).

The thus-obtained evaluation results are shown in Table 10.

TABLE 10

| Sample No. | Fastness to light (%) | Color forming property |
|---|---|---|
| 601 | 52 | 100 |
| 602 | 68 | 88 |
| 603 | 70 | 85 |
| 604 | 73 | 87 |
| 605 | 75 | 82 |
| 606 | 59 | 96 |
| 607 | 61 | 97 |
| 608 | 87 | 90 |
| 609 | 92 | 92 |
| 610 | 85 | 90 |
| 611 | 84 | 91 |
| 612 | 88 | 101 |
| 613 | 85 | 98 |
| 614 | 86 | 100 |
| 615 | 85 | 99 |
| 616 | 84 | 100 |
| 617 | 85 | 100 |
| 618 | 90 | 99 |
| 619 | 88 | 98 |
| 620 | 89 | 99 |
| 621 | 89 | 96 |

As is shown in the results in Table 10, in Sample 601, wherein only the compound represented by formula (II) was used, the fastness to light was low, while in Samples 602 to 603, wherein the compound represented by formula (I) was additionally used, and Samples 604 to 607, wherein the compound represented by formula (3) was additionally used, the fastness to light was improved. However, when the amount of the addition of these compounds was increased, it seemed that the particular improvement effect was saturated and the fastness to light was changed little. Further, it was observed that the addition of the compound represented by formula (I) or the compound represented by formula (3) in each of the samples lowered the color-forming property a little.

In contrast, in Samples 608 to 621, the light-sensitive materials, wherein both the compound represented by formula (I) and the compound represented by formula (3) were added, the fastness to light was improved drastically, and the lowering of the color-forming property could be suppressed drastically.

Example 7

Samples 701 to 710 were prepared in the same manner as the silver halide color photographic light-sensitive material 601 prepared in Example 6, except that the composition in the fifth layer was changed as shown below.

Fifth Layer (red-sensitive emulsion layer)

The fifth layer in each Samples 701 to 710 was prepared in the same manner as in Sample 601, except for using, as Emulsified Dispersion C, one prepared wherein the compound of formula (II) was changed as shown in Table 11, and the compound of formula (I) and the compound of formula (3), and if necessary the compound of formula (4), were added as shown in Table 11. In the above changes, the compound represented by formula (II) was changed but used in an equivalent molar amount. Further, the average particle size of the coupler-containing lipophilic fine particles prepared for the production of these samples was in the range of 0.10 to 0.20 $\mu$m in all cases.

TABLE 11

| Sample No. | Kind of compound of formula(II) | Kind of compound of formula(I)*1 | Kind of compound of formula(3)*2 | Kind of compound of formula (4)*3 |
|---|---|---|---|---|
| 701 | 1 | A-1 | A-7 | — |
| 702 | 1 | A-1 | A-38 | — |
| 703 | 1 | A-1 | A-7 | ph 52 |
| 704 | 1 | A-1 | A-38 | ph 52 |
| 705 | 1 | A-2 | A-39 | ph 54 |
| 706 | 1 | A-2 | A-38 | ph 60 |
| 707 | 2 | A-9 | A-7 | ph 52 |
| 708 | 22 | A-9 | A-7 | ph 52 |
| 709 | 25 | A-9 | A-7 | ph 52 |
| 710 | 27 | A-9 | A-7 | ph 52 |

*1The added amount of the compound of formula(I) was 100 mol % to that of the compound of formula(II).
*2The added amount of the compound of formula(3) was 100 mol % to that of the compound of formula(II).
*3The added amount of the compound of formula(4) was 20 mol % to that of the compound of formula(II).

With respect to Samples 701 to 710 thus-obtained above, the fastness to light and the cyan stain at the time of processing were evaluated. The evaluation of the fastness to light was carried out in the same manner as in Evaluation 1 in Example 6, and the evaluation of the cyan stain at the time of processing was carried out as follows:

Evaluation 3 (cyan stain at the time of processing)

A bleach-fix solution for cyan stain at the time of processing was prepared by changing the bleach-fix solution (described in Example 6), such that 40 g of ammonium sulfite contained therein was changed to 4.0 g, and the pH was changed from 4.8 to 8.0. The difference between the cyan density of the Dmin part of each sample processed with the above prepared bleach-fix solution, and the cyan density of the Dmin part of each sample processed with the bleach-fix solution described in Example 6, was designated cyan stain at the time of processing.

The results of the evaluation obtained above are shown in Table 12.

TABLE 12

| Sample No. | Fastness to light (%) | Stain at processing |
|---|---|---|
| 701 | 92 | 0.07 |
| 702 | 88 | 0.06 |
| 703 | 95 | 0.01 |
| 704 | 91 | 0.01 |
| 705 | 90 | 0.00 |
| 706 | 89 | 0.00 |
| 707 | 94 | 0.01 |
| 708 | 92 | 0.00 |
| 709 | 93 | 0.01 |
| 710 | 92 | 0.01 |

It can be understood that in Samples 701 and 702, wherein the compound represented by formula (I) and the compound represented by formula (3) were added, the fastness to light was improved, but stain at the time of processing occurred a little. On the other hand, in Samples 703 to 710, wherein the compound represented by formula (4) was additionally added, stain at the time of processing could be almost completely suppressed.

Having described our invention as related to the present embodiments, it is our intention that the invention not be limited by any of the details of the description, unless otherwise specified, but rather be construed broadly within its spirit and scope as set out in the accompanying claims.

What we claim is:

1. A silver halide color photographic light-sensitive material, which comprises in at least one hydrophilic colloid layer provided on a support, a compound represented by the following formula (I):

(I)

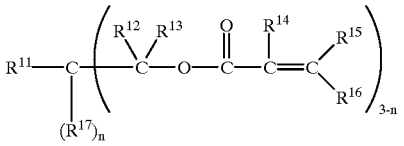

wherein, in formula (I), $R^{11}$ represents a hydrogen atom, an alkyl group having 1 to 30 carbon atoms, an alkenyl group having 2 to 30 carbon atoms, or an aryl group; $R^{12}$, $R^{13}$, $R^{14}$, $R^{15}$, $R^{16}$, and $R^{17}$, which are the same or different, each independently represent a hydrogen atom or an alkyl group having 1 to 30 carbon atoms, and n is 0 or 1.

2. The silver halide color photographic light-sensitive material as claimed in claim 1, wherein, in formula (I), $R^{11}$ represents an alkyl group having 1 to 30 carbon atoms.

3. The silver halide color photographic light-sensitive material as claimed in claim 1, wherein, in formula (I), $R^{11}$ represents an unsubstituted alkyl group having 1 to 3 carbon atoms.

4. The silver halide color photographic light-sensitive material as claimed in claim 1, wherein, in formula (I), $R^{12}$, $R^{13}$, $R^{14}$, $R^{15}$, $R^{16}$, and $R^{17}$ each represent a hydrogen atom or an unsubstituted alkyl group having 1 to 3 carbon atoms.

5. The silver halide color photographic light-sensitive material as claimed in claim 1, wherein, in formula (I), $R^{12}$ and $R^{13}$ each represent a hydrogen atom.

6. The silver halide color photographic light-sensitive material as claimed in claim 1, wherein, in formula (I), $R^{14}$ represents a hydrogen atom or a methyl group.

7. The silver halide color photographic light-sensitive material as claimed in claim 1, wherein the compound of formula (I) forms a polymer by bonding two or more molecules of the compound at $R^{11}$.

8. The silver halide color photographic light-sensitive material as claimed in claim 1, which comprises a cyan coupler, wherein the amount to be added of the compound of formula (I) is 1 to 300 mol % to the cyan coupler.

9. The silver halide color photographic light-sensitive material as claimed in claim 1, which comprises a cyan coupler represented by the following formula (II) and the compound represented by the following formula (I):

(II)

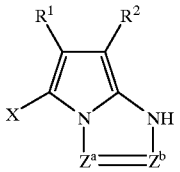

-continued (I)

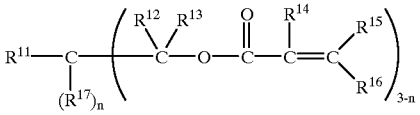

wherein, in formula (II), $Z^a$ and $Z^b$ each represent —C($R^3$)═ or —N═, provided that one of $Z^a$ and $Z^b$ is —N═ and the other is —C($R^3$)═; $R^1$ and $R^2$ each represent an electron-attracting group whose Hammet substituent constant $\sigma_p$ value is 0.20 or more, with the sum of the $\sigma_p$ values of $R^1$ and $R^2$ being 0.65 or more; $R^3$ represents a hydrogen atom or a substituent; X represents a hydrogen atom, or a group capable of being split-off in the coupling reaction with the oxidized product of an aromatic primary amine color-developing agent; the group $R^1$, $R^2$, $R^3$, or X may be a divalent group, to form a dimer or higher polymer, or to bond to a polymer chain to form a homopolymer or a copolymer; and in formula (I), $R^{11}$ represents a hydrogen atom, an alkyl group having 1 to 30 carbon atoms, an alkenyl group having 2 to 30 carbon atoms, or an aryl group; $R^{12}$, $R^{13}$, $R^{14}$, $R^{15}$, $R^{16}$, and $R^{17}$, which are the same or different, each independently represent a hydrogen atom or an alkyl group having 1 to 30 carbon atoms, and n is 0 or 1.

10. The silver halide color photographic light-sensitive material as claimed in claim 9, wherein, in formula (II), $R^1$ and $R^2$ each represent an acyl group, an acyloxy group, a carbamoyl group, an alkoxycarbonyl group, an aryloxycarbonyl group, a cyano group, a nitro group, a dialkylphosphono group, a diarylphosphono group, a diarylphosphinyl group, an alkylsulfinyl, an arylsulfinyl group, an alkylsulfonyl group, an arylsulfonyl group, a sulfonyloxy group, an acylthio group, a sulfamoyl group, a thiocyanate group, a thiocarbonyl group, a halogenated alkyl group, a halogenated alkoxy group, a halogenated aryloxy group, a halogenated alkylamino group, a halogenated alkylthio group, an aryl group substituted by another electron-attracting group whose σp value is 0.20 or more, a heterocyclic group, a halogen atom, an azo group, or a selenocyanate group.

11. The silver halide color photographic light-sensitive material as claimed in claim 9, wherein, in formula (II), $R^3$ represents a halogen atom, an alkyl group, an aryl group, a heterocyclic group, a cyano group, a hydroxyl group, a nitro group, a carboxyl group, a sulfo group, an amino group, an alkoxy group, an aryloxy group, an acylamino group, an alkylamino group, an anilino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclic oxy group, an azo group, an acyloxy group, a carbamoyloxy group, a silyloxy group, an aryloxycarbonylamino group, an imido group, a heterocyclic thio group, a sulfinyl group, a phosphonyl group, an aryloxycarbonyl group, or an acyl group.

12. The silver halide color photographic light-sensitive material as claimed in claim 9, wherein the cyan coupler represented by formula (II) is a compound represented by the following formula (III):

(III)

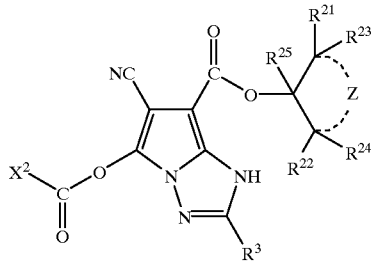

wherein, in formula (III), $R^{21}$, $R^{22}$, $R^{23}$, $R^{24}$, and $R^{25}$, which are the same or different, each represent a hydrogen atom or a substituent; Z represents a group of non-metal atoms required to form a 5- to 8-membered ring, $R^3$ has the same meaning as that in formula (II), and $X^2$ represents a hydrogen atom or a substituent.

13. The silver halide color photographic light-sensitive material as claimed in claim 9, wherein the amount to be added of the cyan coupler of formula (II) is 0.01 to 0.6 g/m$^2$.

14. The silver halide color photographic light-sensitive material as claimed in claim 9, which further comprises at least one compound represented by the following formula (4):

formula (4)

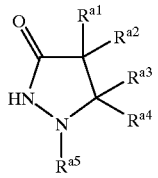

wherein, in formula (4), $R^{a1}$ and $R^{a2}$ each independently represent a hydrogen atom, an alkyl group, or an aryl group; $R^{a3}$ and $R^{a4}$ each represent a hydrogen atom, an alkyl group, or an aryl group, and $R^{a5}$ represents an aryl group, with the proviso that the total number of the carbon atoms of $R^{a1}$, $R^{a2}$, $R^{a3}$, $R^{a4}$, and $R^{a5}$ is more than 13.

15. The silver halide color photographic light-sensitive material as claimed in claim 9, wherein the cyan-coupler-containing layer further contains a cyan coupler represented by the following formula (C) and a polymer latex represented by the following formula (L):

formula (C)

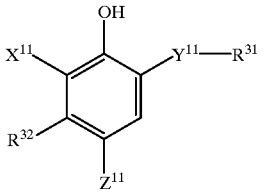

wherein, in formula (C), $Y^{11}$ represents —NHCO— or —CONH—; $R^{31}$ represents an aliphatic group, an aryl group, a heterocyclic group, or a substituted or unsubstituted amino group; $X^{11}$ represents a hydrogen atom, a halogen atom, an alkoxy group, or an acylamino group; $R^{32}$ represents an alkyl group or an acylamino group; or $X^{11}$ and $R^{32}$ together represent a group of nonmetallic atoms to form a 5- to 7-membered ring, and $Z^{11}$ represents a hydrogen atom or a group capable of being split-off in the coupling reaction with the oxidized product of a developing agent;

formula (L)

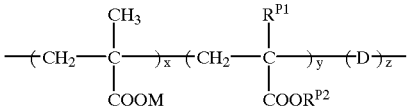

wherein, in formula (L), $R^{P1}$ represents a hydrogen atom or a methyl group, $R^{P2}$ represents an alkyl group having 1 to 8 carbon atoms or a cycloalkyl group, D represents a repeating unit derived from an ethylenically unsaturated monomer; x, y, and z each represent the weight percent of the particular component with x=25 to 60, y=75 to 40, and z=0 to 30, and x+Y+z=100; and the degree of neutralization of —COOM in which M represents a hydrogen atom or a cation is 0 to 50%.

16. The silver halide color photographic light-sensitive material as claimed in claim 15, wherein the amount to be added of the cyan coupler of formula (C) is 1 to 50 mol %, to that of the cyan coupler of formula (II).

17. The silver halide color photographic light-sensitive material as claimed in claim 15, wherein, in formula (L), D represents a repeating unit derived from an acrylate-series, methacrylate-series, or vinyl ester-series monomer.

18. The silver halide color photographic light-sensitive material as claimed in claim 15, wherein the amount to be added of the polymer latex of formula (L) is 1 to 100 wt %, to the cyan coupler.

19. The silver halide color photographic light-sensitive material as claimed in claim 1, which comprises at least one silver halide emulsion layer on a base, wherein the emulsion layer contains at least one cyan dye-forming coupler represented by the following formula (1) and at least one compound represented by formula (B):

formula (1)

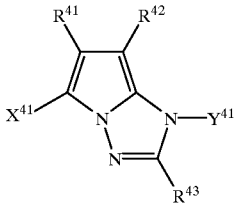

wherein, in formula (1), $R^{41}$ and $R^{42}$ each represent an electron-attracting group whose Hammet substituent constant $\sigma_p$ value is 0.20 or more, with the sum of the $\sigma_p$ values of $R^{41}$ and $R^{42}$ being 0.65 or more; $R^{43}$ represents a substituent; $X^{41}$ represents a hydrogen atom, or a group capable of being split-off in the coupling reaction with the oxidized product of an aromatic primary amine color-developing agent; and $Y^{41}$ represents a hydrogen atom or a substituent; and formula (B)

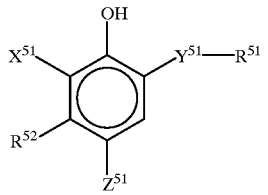

wherein, in formula (B), $R^{51}$ represents an aliphatic group, an aromatic group, a heterocyclic group, or an amino group; $R^{52}$ represents an alkyl group or an acylamino group; $X^{51}$ represents a hydrogen atom, a halogen atom, an aliphatic group, an alkoxy group, or an acylamino group; $Y^{51}$ represents —NHCO— or —CONH—; $Z^{51}$ represents a hydrogen atom, or a group capable of being split-off upon coupling reaction with the oxidized product of a developing agent, and $X^{51}$ and $R^{52}$ may bond together to form a 5- to 7-membered ring.

20. The silver halide color photographic light-sensitive material as claimed in claim 19, wherein, in formula (1), $R^{41}$ and $R^{42}$ each represent an acyl group, an acyloxy group, a carbamoyl group, an aliphatic oxycarbonyl group, an aryloxycarbonyl group, a cyano group, a nitro group, a dialkylphosphono group, a diarylphosphono group, a diarylphosphinyl group, an alkylsulfinyl, an arylsulfinyl group, an alkylsulfonyl group, an arylsulfonyl group, a sulfonyloxy group, an acylthio group, a sulfamoyl group, a thiocyanate group, a thiocarbonyl group, an alkyl group substituted by at least 2 halogen atoms, an alkoxy group substituted by at least 2 halogen atoms, an aryloxy group substituted by at least 2 halogen atoms, an alkylamino group substituted by at least 2 halogen atoms, an alkylthio group substituted by at least 2 halogen atoms, an aryl group substituted by another electron-attracting group whose σp value is 0.20 or more, a heterocyclic group, a chlorine atom, a bromine atom, an azo group, or a selenocyanate group.

21. The silver halide color photographic light-sensitive material as claimed in claim 19, wherein, in formula (1), $R^{43}$ represents a halogen atom, an aliphatic group, an aryl group, a heterocyclic group, a cyano group, a hydroxyl group, a nitro group, a carboxyl group, an amino group, an alkoxy group, an aryloxy group, an arylcarbonyloxy group, an acylamino group, an alkylamino group, an anilino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclic oxy group, an azo group, an acyloxy group, a carbamoyloxy group, a silyloxy group, an aryloxycarbonylamino group, an imido group, a heterocyclic thio group, a sulfinyl group, an alkyloxycarbonyl, aryloxycarbonyl, or heterocyclic oxycarbonyl group, an alkyloxycarbonylamino, aryloxycarbonylamino, or heterocyclic oxycarbonylamino group, a sulfonamido group, a carbamoyl group, a sulfamoyl group, a phosphonyl group, a sulfamido group, an imido group, an azolyl group, a hydroxyl group, a cyano group, a carboxyl group, a nitro group, a sulfo group, or an unsubstituted amino group.

22. The silver halide color photographic light-sensitive material as claimed in claim 19, wherein, in formula (1), $Y^{41}$ represents a hydrogen atom, or a group capable of being split-off upon the coupling reaction of the cyan dye-forming coupler represented by formula (1) with the oxidized product of a developing agent.

23. The silver halide color photographic light-sensitive material as claimed in claim 19, wherein, in formula (1), $R^{41}$ is a cyano group and $R^{42}$ is an alkoxycarbonyl group.

24. The silver halide color photographic light-sensitive material as claimed in claim 19, wherein, in formula (B), $R^{52}$ is an alkyl group having 1 to 15 carbon atoms, $X^{51}$ is a halogen atom, and $Z^{51}$ is a hydrogen atom or a halogen atom.

25. The silver halide color photographic light-sensitive material as claimed in claim 19, wherein the amount to be added of the cyan dye-forming coupler of formula (1) is 0.35 to 0.80 mmol/$m^2$ when it is a four-equivalent coupler, or the amount is 0.18 to 0.4 mmol/$m^2$ when it is a two-equivalent coupler.

26. The silver halide color photographic light-sensitive material as claimed in claim 19, wherein the amount to be added of the compound of formula (B) is 1 to 160% by weight, to that of the cyan dye-forming coupler of formula (1).

27. The silver halide color photographic light-sensitive material as claimed in claim 1, which comprises on a base at least one yellow color-forming light-sensitive silver halide emulsion layer, at least one magenta color-forming light-sensitive silver halide emulsion layer, at least one cyan color-forming light-sensitive silver halide emulsion layer, and at least one non-light-sensitive non-color forming hydrophilic colloid layer, wherein at least one of the cyan color-forming light-sensitive silver halide emulsion layers contains i) at least one cyan dye-forming coupler selected from compounds represented by the following formula (II), and ii) at least one compound represented by the following formula (3):

formula (II)

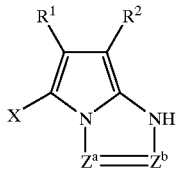

wherein, in formula (II), $Z^a$ and $Z^b$ each represent —C($R^3$)= or —N=, provided that one of $Z^a$ and $Z^b$ is —N= and the other is —C($R^3$)=; $R^1$ and $R^2$ each represent an electron-attracting group whose Hammet substituent constant $\sigma_p$ value is 0.20 or more, with the sum of the $\sigma_p$ values of $R^1$ and $R^2$ being 0.65 or more; $R^3$ represents a hydrogen atom or a substituent; X represents a hydrogen atom, or a group capable of being split-off in the coupling reaction with the oxidized product of an aromatic primary amine color-developing agent; the group $R^1$, $R^2$, $R^3$, or X may be a divalent group, to form a dimer or higher polymer, or to bond to a polymer chain to form a homopolymer or a copolymer; and formula (3)

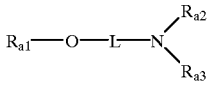

wherein, in formula (3), L represents a single bond or an arylene group; $R_{a1}$, $R_{a2}$, and $R_{a3}$, which are the same or different, each represent an alkyl group, an alkenyl group, an aryl group, or a heterocyclic group; when L represents a single bond, $R_{a1}$ may further represent a radical (•); $R_{a3}$ may further represent a hydrogen atom; $R_{a1}$ and L, $R_{a2}$ and L, $R_{a3}$ and L, $R_{a1}$ and $R_{a2}$, $R_{a1}$ and $R_{a3}$, and $R_{a2}$ and $R_{a3}$ each may bond together to form a 5- to 7-membered ring.

28. The silver halide color photographic light-sensitive material as claimed in claim 27, wherein the compound of formula (3) is a compound represented by the following formula (3a):

[formula (3a)]

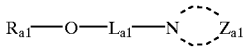

wherein, in formula (3a), $R_{a1}$ has the same meaning as in formula (3); $Z_{a1}$ represents a divalent group in which both the two atoms bonded to the N are carbon atoms, and $Z_{a1}$ represents a group of non-metal atoms required to form a 5- to 7-membered ring, together with the N; and $L_{a1}$ represents a single bond or a phenylene group.

29. The silver halide color photographic light-sensitive material as claimed in claim 27, wherein the amount to be added of the compound of formula (3) is 50 to 500 mol %, to the cyan dye-forming coupler of formula (II).

30. The silver halide color photographic light-sensitive material as claimed in claim 27, which further comprises, in one or both of at least one layer of the cyan color-forming light-sensitive silver halide emulsion layer and the non-color-forming hydrophilic colloid layer, at least one compound represented by the following formula (4):

formula (4)

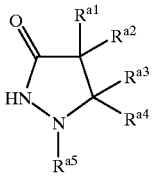

wherein, in formula (4), $R^{a1}$ and $R^{a2}$ each independently represent a hydrogen atom, an alkyl group, or an aryl group; $R^{a3}$ and $R^{a4}$ each represent a hydrogen atom, an alkyl group, or an aryl group, and $R^{a5}$ represents an aryl group, with the proviso that the total number of the carbon atoms of $R^{a1}$, $R^{a2}$, $R^{a3}$, $R^{a4}$, and $R^{a5}$ is more than 13.

31. The silver halide color photographic light-sensitive material as claimed in claim 30, wherein the compound of formula (4) is a compound represented by the following formula (IV) or (V):

(IV)

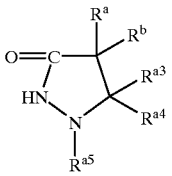

-continued (V)

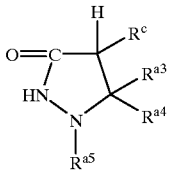

wherein, in formulae (IV) and (V), $R^a$ and $R^b$ each independently represent a substituted or unsubstituted aryl group or a substituted or unsubstituted alkyl group having 1 to 30 carbon atoms in all, inclusive of the carbon atoms in the substituent; $R^{a3}$ and $R^{a4}$ each represent a hydrogen atom, a substituted or unsubstituted alkyl group, or a substituted or unsubstituted aryl group; $R^{a5}$ represents a substituted or unsubstituted aryl group, and $R^c$ represents an alkyl group or an aryl group.

32. A method for forming an image, comprising carrying out scanning exposure of a silver halide color photographic light-sensitive material having at least one silver halide emulsion layer on a base by a light beam modulated based on an image information, and subjecting the silver halide color photographic light-sensitive material to development, to form a color image, wherein the silver halide color photographic light-sensitive material comprises a compound represented by the following formula (I):

(I)

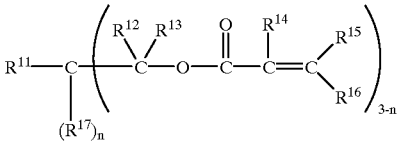

wherein, in formula (I), $R^{11}$ represents a hydrogen atom, an alkyl group having 1 to 30 carbon atoms, an alkenyl group having 2 to 30 carbon atoms, or an aryl group; $R^{12}$, $R^{13}$, $R^{14}$, $R^{15}$, $R^{16}$, and $R^{17}$, which are the same or different, each independently represent a hydrogen atom or an alkyl group having 1 to 30 carbon atoms, and n is 0 or 1.

33. The method for forming an image as claimed in claim 32, wherein the emulsion layer of the silver halide color photographic light-sensitive material contains at least one cyan dye-forming coupler represented by the following formula (1), and at least one compound represented by formula (B):

formula (1)

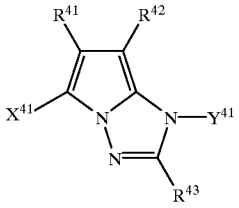

wherein, in formula (1), $R^{41}$ and $R^{42}$ each represent an electron-attracting group whose Hammet substituent constant $\sigma_p$ value is 0.20 or more, with the sum of the $\sigma_p$ values of $R^{41}$ and $R^{42}$ being 0.65 or more; $R^{43}$ represents a substituent; $X^{41}$ represents a hydrogen atom, or a group capable of being split-off in the coupling reaction with the oxidized product of an aromatic primary amine color-developing agent; and $Y^{41}$ represents a hydrogen atom or a substituent; and formula (B)

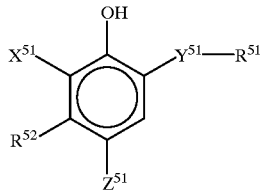

wherein, in formula (B), $R^{51}$ represents an aliphatic group, an aromatic group, a heterocyclic group, or an amino group; $R^{52}$ represents an alkyl group or an acylamino group; $X^{51}$ represents a hydrogen atom, a halogen atom, an aliphatic group, an alkoxy group, or an acylamino group; $Y^{51}$ represents —NHCO— or —CONH—; $Z^{51}$ represents a hydrogen atom, or a group capable of being split-off upon coupling reaction with the oxidized product of a developing agent, and $X^{51}$ and $R^{52}$ may bond together to form a 5- to 7-membered ring.

34. A method for stabilizing an image, comprising using a compound represented by the following formula (I) in a silver halide color photographic light-sensitive material:

formula (I)

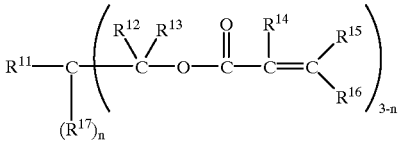

(I)

wherein, in formula (I), $R^{11}$ represents a hydrogen atom, an alkyl group having 1 to 30 carbon atoms, an alkenyl group having 2 to 30 carbon atoms, or an aryl group; $R^{12}$, $R^{13}$, $R^{14}$, $R^{15}$, $R^{16}$, and $R^{17}$, which are the same or different, each independently represent a hydrogen atom or an alkyl group having 1 to 30 carbon atoms, and n is 0 or 1.

* * * * *